US009495901B2

(12) United States Patent
Jinta

(10) Patent No.: US 9,495,901 B2
(45) Date of Patent: Nov. 15, 2016

(54) DISPLAY UNIT, DRIVE CIRCUIT, DRIVING METHOD, AND ELECTRONIC APPARATUS

(71) Applicant: Sony Corporation, Tokyo (JP)

(72) Inventor: Seiichiro Jinta, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 375 days.

(21) Appl. No.: 13/940,841

(22) Filed: Jul. 12, 2013

(65) Prior Publication Data

US 2014/0035797 A1 Feb. 6, 2014

(30) Foreign Application Priority Data

Jul. 31, 2012 (JP) ..... 2012-170487
Sep. 14, 2012 (JP) ..... 2012-202840
Nov. 12, 2012 (JP) ..... 2012-248286

(51) Int. Cl.
*G09G 3/30* (2006.01)
*G09G 3/32* (2016.01)

(52) U.S. Cl.
CPC ..... *G09G 3/30* (2013.01); *G09G 3/3233* (2013.01); *G09G 2300/0819* (2013.01); *G09G 2300/0852* (2013.01); *G09G 2300/0861* (2013.01)

(58) Field of Classification Search
CPC ..... G09G 3/3233; G09G 3/3283
USPC ..... 345/77, 204, 211, 80; 327/437
See application file for complete search history.

(56) References Cited

U.S. PATENT DOCUMENTS

2006/0119552 A1* 6/2006 Yumoto ..... G09G 3/3283 345/76
2007/0103419 A1* 5/2007 Uchino et al. ..... 345/92
2009/0027423 A1* 1/2009 Kwon ..... 345/690
2012/0287103 A1* 11/2012 Wu et al. ..... 345/211

FOREIGN PATENT DOCUMENTS

CN 1705001 A 12/2005
CN 101401146 A 4/2009
CN 101645233 A 2/2010
(Continued)

OTHER PUBLICATIONS

Office Action Received for Japanese Patent Application No. 2012-248286 Mailed on Jan. 5, 2016, pp. 4 of Office Action.
(Continued)

*Primary Examiner* — Calvin C Ma
(74) *Attorney, Agent, or Firm* — Chip Law Group

(57) ABSTRACT

A display unit includes: a pixel circuit including a display element, a first transistor having a gate and a source, and a capacitor inserted between the gate and the source, the first transistor supplying a current to the display element; and a drive section driving the pixel circuit, through sequentially performing first and second driving operations, the first driving operation allowing the drive section to apply a pixel voltage to a first terminal and allowing a second terminal to be at a first voltage, the pixel voltage determining luminance of the display element, the first and second terminals being one and the other of the gate and the source of the first transistor, respectively, and the second driving operation allowing the second terminal to be at a second voltage, through applying the pixel voltage to the first terminal and allowing a current to flow through the first transistor.

29 Claims, 97 Drawing Sheets

(56) References Cited

FOREIGN PATENT DOCUMENTS

| | | | |
|---|---|---|---|
| CN | 203552655 | U | 4/2014 |
| JP | 2006-119180 | A | 5/2006 |
| JP | 2007-171828 | A | 7/2007 |
| JP | 2008-009198 | A | 1/2008 |

OTHER PUBLICATIONS office Action received for Chinese Patent Application No. 2013103135542, mailed on Mar. 2, 2016, 44 pages of office action including 28 pages of English translation.

* cited by examiner

DISPLAY UNIT, DRIVE CIRCUIT, DRIVING METHOD, AND ELECTRONIC APPARATUS

BACKGROUND

The present disclosure relates to a display unit that includes a display element of a current-drive type, to a drive circuit and a driving method that are used in such a display unit, and to an electronic apparatus that includes such a display unit.

Recently, in a field of a display unit that performs image display, a display unit that uses a current-drive-type optical device in which light-emission luminance is varied in accordance with a value of a current flowing therethrough, for example, an organic EL (Electro Luminescence) display unit that uses an organic EL device, has been developed and commercialized. The organic EL device is a self-emitting device unlike a liquid crystal device etc. and it is not necessary to use a light source (backlight) therewith. Therefore, the organic EL display unit has properties such as high image visibility, low electric power consumption, and high device response speed, compared to a liquid crystal display unit in which the light source is necessary.

In such a display unit, a drive transistor in each pixel serves as a current source and supplies current to the display element, and thereby the display element emits light. At that time, image quality may be lowered due to variations in devices such as the drive transistors and the organic EL devices. In order to suppress such lowering in image quality, various techniques have been developed. For example, Japanese Unexamined Patent Application Publication No. 2007-171828 discloses a display unit that performs correcting operation for suppressing influence, on image quality, of the variations in devices such as drive transistors and organic EL devices.

SUMMARY

As described above, it has been demanded to suppress the influence of variations in devices on image quality and to improve image quality in the display unit. Also, it is expected to improve the image quality by simple correcting operation.

It is desirable to provide a display unit, a drive circuit, a driving method, and an electronic apparatus that are capable of improving image quality.

According to an embodiment of the present disclosure, there is provided a display unit including: a pixel circuit including a display element, a first transistor having a gate and a source, and a capacitor inserted between the gate and the source of the first transistor, the first transistor supplying a current to the display element; and a drive section driving the pixel circuit, through performing a first driving operation and performing a second driving operation after the first driving operation, the first driving operation allowing the drive section to apply a pixel voltage to a first terminal and allowing a second terminal to be at a first voltage, the pixel voltage determining luminance of the display element, the first terminal being one of the gate and the source of the first transistor, and the second terminal being the other of the gate and the source of the first transistor, and the second driving operation allowing the second terminal to be at a second voltage, through applying the pixel voltage to the first terminal and allowing a current to flow through the first transistor.

According to an embodiment of the present disclosure, there is provided a drive circuit including a drive section, the drive section performing a first driving operation and performing a second driving operation after the first driving operation, the first driving operation allowing the drive section to apply a pixel voltage to a first terminal and allowing a second terminal to be at a first voltage, the pixel voltage determining luminance of a display element, the first terminal being one of a gate and a source of a first transistor, the second terminal being the other of the gate and the source of the first transistor, the first transistor having the gate and the source between which a capacitor is inserted, and the first transistor supplying a current to the display element, and the second driving operation allowing the second terminal to be at a second voltage, through applying the pixel voltage to the first terminal and allowing a current to flow through the first transistor.

According to an embodiment of the present disclosure, there is provided a driving method including: performing a first driving operation and performing a second driving operation after the first driving operation, the first driving operation allowing a pixel voltage to be applied to a first terminal and allowing a second terminal to be at a first voltage, the pixel voltage determining luminance of a display element, the first terminal being one of a gate and a source of a first transistor, the second terminal being the other of the gate and the source of the first transistor, the first transistor having the gate and the source between which a capacitor is inserted, and the first transistor supplying a current to the display element, and the second driving operation allowing the second terminal to be at a second voltage, through applying the pixel voltage to the first terminal and allowing a current to flow through the first transistor.

According to an embodiment of the present disclosure, there is provided an electronic apparatus with a display unit and a control section controlling operation of the display unit, the display unit including: a pixel circuit including a display element, a first transistor having a gate and a source, and a capacitor inserted between the gate and the source of the first transistor, the first transistor supplying a current to the display element; and a drive section driving the pixel circuit, through performing a first driving operation and performing a second driving operation after the first driving operation, the first driving operation allowing the drive section to apply a pixel voltage to a first terminal and allowing a second terminal to be at a first voltage, the pixel voltage determining luminance of the display element, the first terminal being one of the gate and the source of the first transistor, and the second terminal being the other of the gate and the source of the first transistor, and the second driving operation allowing the second terminal to be at a second voltage, through applying the pixel voltage to the first terminal and allowing a current to flow through the first transistor. Examples of the electronic apparatus of the present disclosure may include televisions, digital cameras, personal computers, video camcorders, and personal digital assistants such as mobile phones.

In the display unit, the drive circuit, the driving method, and the electronic apparatus according to the above embodiments of the present disclosure, the first driving operation and the second driving operation are performed and a current is supplied from the first transistor to the display element. At that time, during the first driving operation, the pixel voltage is applied to one of the gate and the source of the first transistor and the voltage at the other of the gate and the source of the first transistor is allowed to be the first voltage. During the second driving operation, the pixel voltage is applied to one of the gate and the source of the first transistor while a current is supplied to the first transistor, and thereby, the voltage at the other of the gate and the source of the first transistor is varied to the second voltage.

According to the display unit, the drive circuit, the driving method, and the electronic apparatus of the above embodiments of the present disclosure, the pixel voltage is applied to one of the gate and the source of the first transistor and driving operation is performed to allow the voltage of the other of the gate and the source of the first transistor to be the first voltage. Thereafter, the pixel voltage is applied to the one of the gate and the source of the first transistor and a current is supplied to the first transistor, and thereby, the voltage at the other of the gate and the source of the first transistor is varied to the second voltage. Therefore, image quality is improved.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the disclosure, and are incorporated in and constitute a part of this specification. The drawings illustrate embodiments and, together with the specification, serve to explain the principles of the technology.

DETAILED DESCRIPTION

Some embodiments of the present disclosure will be described below in detail with reference to the drawings. The description will be given in the following order.

1. First Embodiment (an example of Ids correction)
2. Second Embodiment (an example of Ids correction)
3. Third Embodiment (an example of Ids correction)
4. Fourth Embodiment (an example of Vth correction+μ correction)
5. Fifth Embodiment (an example of Vth correction)
6. Sixth Embodiment (an example without correction)
7. Seventh Embodiment (an example without correction)
8. Eighth Embodiment (an example of Ids correction)
9. Ninth Embodiment (an example of Ids correction)
10. Tenth Embodiment (an example of Vth correction)
11. Eleventh Embodiment (an example of Vth correction)
12. Twelfth Embodiment (an example of Ids correction)
13. Thirteenth Embodiment (an example of Ids correction)
14. Comparison between Schemes
15. Application Examples

1. First Embodiment

Configuration Example

Figure 1:
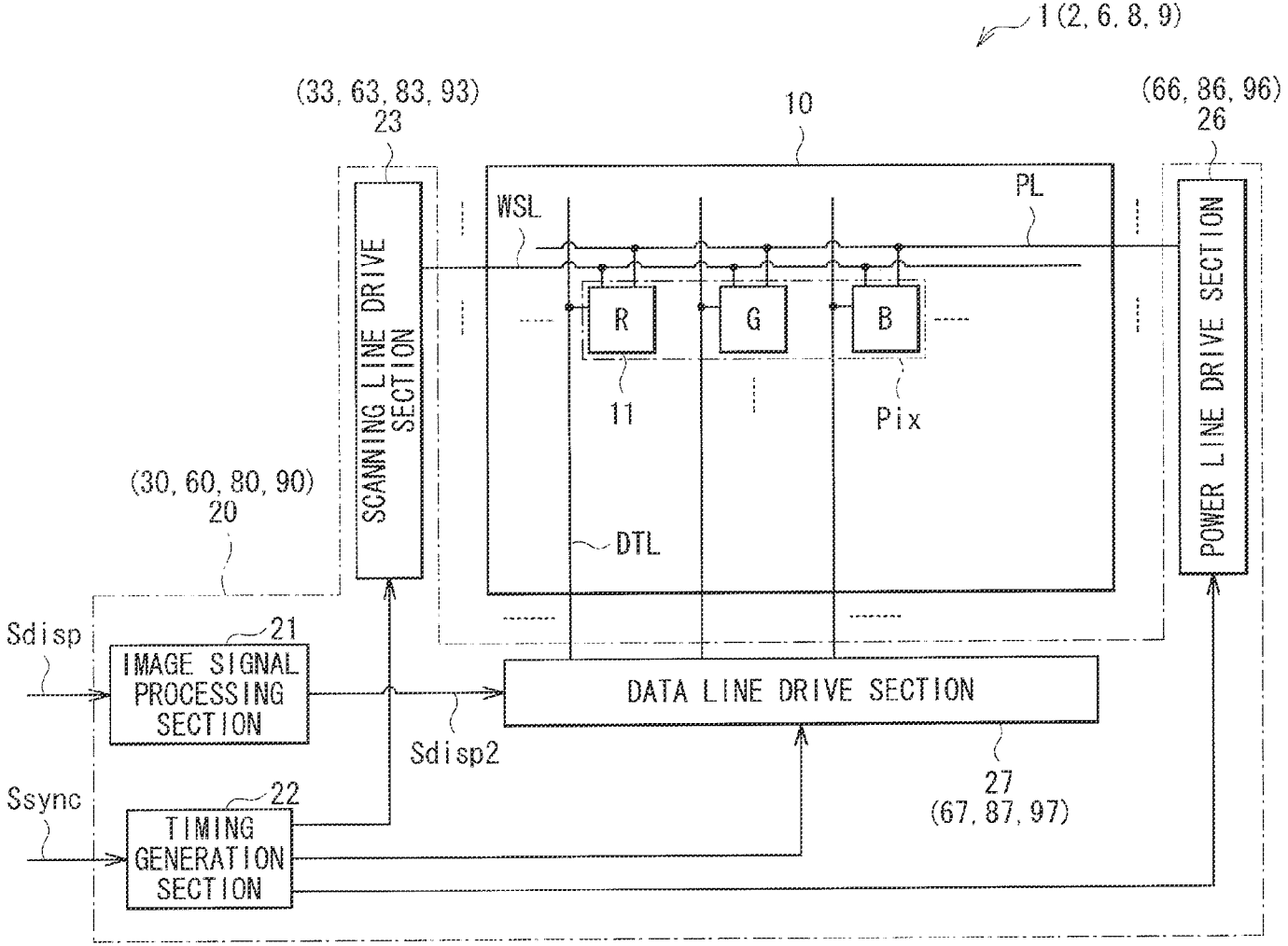
FIG. 1 is a block diagram illustrating a configuration example of a display unit according to a first embodiment of the present disclosure.

FIG. 1 illustrates a configuration example of a display unit according to a first embodiment. A display unit 1 is a display unit of an active-matrix type that uses an organic EL device. It is to be noted that, since a drive circuit and a driving method according to embodiments of the present disclosure are embodied by the present embodiment, the drive circuit and the driving method according to embodiments of the present disclosure will be described together herein. The display unit 1 includes a display section 10 and a drive section 20.

The display section 10 includes a plurality of pixels Pix that are arranged in a matrix. Each pixel Pix includes sub-pixels 11 of red, green, and blue. Further, the display section 10 includes a plurality of scanning lines WSL and a plurality of power lines PL that extend in a row direction, and includes a plurality of data lines DTL that extend in a column direction. One end of each of the scanning lines WSL, the power lines PL, and the data lines DTL is connected to the drive section 20. Each of the above-described sub-pixels 11 is arranged at an intersection of the scanning line WSL and the data line DTL.

Figure 2:
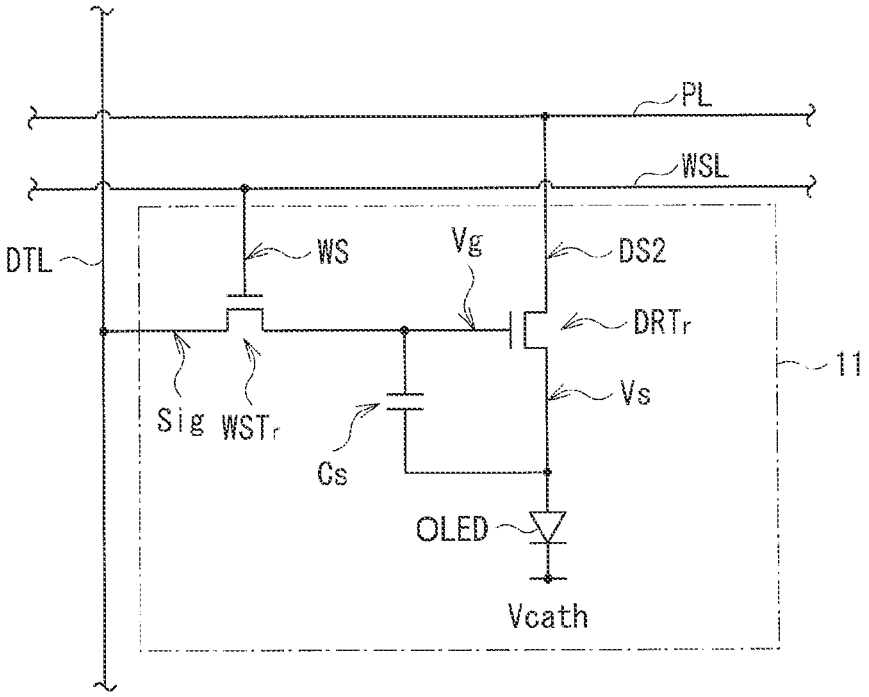
FIG. 2 is a circuit diagram illustrating a configuration example of a sub-pixel shown in FIG. 1.

FIG. 2 illustrates an example of a circuit configuration of the sub-pixel 11. The sub-pixel 11 includes a write transistor WSTr, a drive transistor DRTr, an organic EL device OLED, and a capacitor Cs. In other words, in this example, the sub-pixel 11 has a so-called "2Tr1C" configuration that includes two transistors (the write transistor WSTr and the drive transistor DRTr) and one capacitor Cs.

The write transistor WSTr and the drive transistor DRTr may be configured, for example, of a TFT (Thin Film Transistor) of an N-channel MOS (Metal Oxide Semiconductor) type. The write transistor WSTr has a gate connected to the scanning line WSL, a source connected to the data line DTL, and a drain connected to a gate of the drive transistor DRTr and to a first end of the capacitor Cs. The drive transistor DRTr has the gate connected to the drain of the write transistor WSTr and to the first end of the capacitor Cs, a drain connected to the power line PL, and a source connected to the second end of the capacitor and to an anode of the organic EL device OLED. It is to be noted that a type of the TFT is not specifically limited, and the TFT may have, for example, an inverted-staggered structure (a so-called bottom gate type) or a staggered structure (a so-called top gate type).

The first end of the capacitor Cs is connected to the gate of the drive transistor DRTr and the like, and the second end of the capacitor Cs is connected to the source of the drive transistor DRTr and the like. The organic EL device OLED is a light emitting device that emits light of a color (red, green, or blue) corresponding to each sub-pixel 11. The anode of the organic EL device OLED is connected to the source of the drive transistor DRTr and to the second end of the capacitor Cs. To the cathode of the organic EL device OLED, a cathode voltage Vcath is supplied by the drive section 20.

The drive section 20 drives the display section 10 based on an image signal Sdisp and a synchronization signal Ssync that are supplied from the outside. The drive section 20 includes an image signal processing section 21, a timing generation section 22, a scanning line drive section 23, a power line drive section 26, and a data line drive section 27, as shown in FIG. 1.

The image signal processing section 21 performs a predetermined signal processing on the image signal Sdisp that is supplied from the outside, thereby generating an image signal Sdisp2. Examples of the predetermined signal processing may include gamma correction, over drive correction, etc.

The timing generation section 22 is a circuit that supplies a control signal to each of the scanning line drive section 23, the power line drive section 26, and the data line drive section 27 based on the synchronization signal Ssync that is supplied from the outside, and thereby controlling these sections to operate in synchronization with each other.

The scanning line drive section 23 sequentially applies scanning signals WS to the plurality of scanning lines WSL in accordance with the control signal supplied from the timing generation section 22, thereby sequentially selecting the sub-pixels 11 for the respective rows.

The power line drive section 26 sequentially applies power signals DS2 to the plurality of power lines PL in accordance with the control signal supplied from the timing generation section 22, thereby controlling light emitting operation and light extinction operation of the sub-pixels 11 for the respective rows. The power signal DS2 is varied between a voltage Vccp and a voltage Vini. As will be described later, the voltage Vini is a voltage for initializing the sub-pixel 11, and the voltage Vccp is a voltage for applying a current Ids to the drive transistor DRTr and thereby allowing the organic EL device OLED to emit light.

The data line drive section 27 generates a signal Sig that includes a pixel voltage Vsig that instructs light-emission luminance of each sub-pixel 11 based on the image signal Sdisp2 supplied from the image signal processing section 21 and the control signal supplied from the timing generation section 22, and applies the generated signal Sig to each data line DTL.

With this configuration, as will be described later, the drive section 20 writes the pixel voltage Vsig in the sub-pixels 11 and performs correction (Ids correction) for suppressing the influence, on image quality, of device variations in the drive transistors DRTr in one horizontal period. Subsequently, the organic EL device OLED in the sub-pixel 11 emits light with luminance in accordance with the written pixel voltage Vsig.

The sub-pixel 11 corresponds to a specific but not limitative example of "pixel circuit" in one embodiment of the present disclosure. The organic EL device OLED corresponds to a specific but not limitative example of "display element" in one embodiment of the present disclosure. The drive transistor DRTr corresponds to a specific but not limitative example of "first transistor" in one embodiment of the present disclosure. The write transistor WSTr corresponds to a specific but not limitative example of "second transistor" in one embodiment of the present disclosure. Drive in a write period P1 corresponds to a specific but not limitative example of "first driving operation" in one embodiment of the present disclosure. Drive in an Ids correction period P2 corresponds to specific but not limitative example of "second driving operation" in one embodiment of the present disclosure. The voltage Vini corresponds to a specific but not limitative example of "first voltage" in one embodiment of the present disclosure. The voltage Vcc corresponds to a specific but not limitative example of "third voltage" in one embodiment of the present disclosure.

[Operation and Functions]

Description will be given of operation and functions of the display unit 1 of the present embodiment.

[General Operation Outline]

First, outline of general operation of the display unit 1 will be described referring to FIG. 1. The image signal processing section 21 performs the predetermined signal processing on the image signal Sdisp supplied from the outside, thereby generating the image signal Sdisp2. The timing generation section 22 supplies the control signal to each of the scanning line drive section 23, the power line drive section 26, and the data line drive section 27 based on the synchronization signal Ssync supplied from the outside, thereby controlling these sections to operate in synchronization with each other. The scanning line drive section 23 sequentially applies the scanning signals WS to the plurality of scanning lines WSL in accordance with the control signal supplied from the timing generation section 22, thereby sequentially selecting the sub-pixels 11 for the respective rows. The power line drive section 26 sequentially applies the power signals DS2 to the plurality of power lines PL in accordance with the control signal supplied from the timing generation section 22, thereby controlling the light emitting operation and the light extinction operation of the sub-pixels 11 for the respective rows. The data line drive section 27 generates the signal Sig that includes the pixel voltage Vsig corresponding to luminance of each sub-pixel 11 in accordance with the image signal Sdisp2 supplied from the image signal processing section 21 and the control signal supplied from the timing generation section 22, and applies the generated signal Sig to each data line DTL. The display section 10 performs display based on the scanning signal WS, the power signal DS2, and the signal Sig that are supplied from the drive section 20.

[Detailed Operation]

Next, detailed operation of the display unit 1 will be described.

Figure 3:
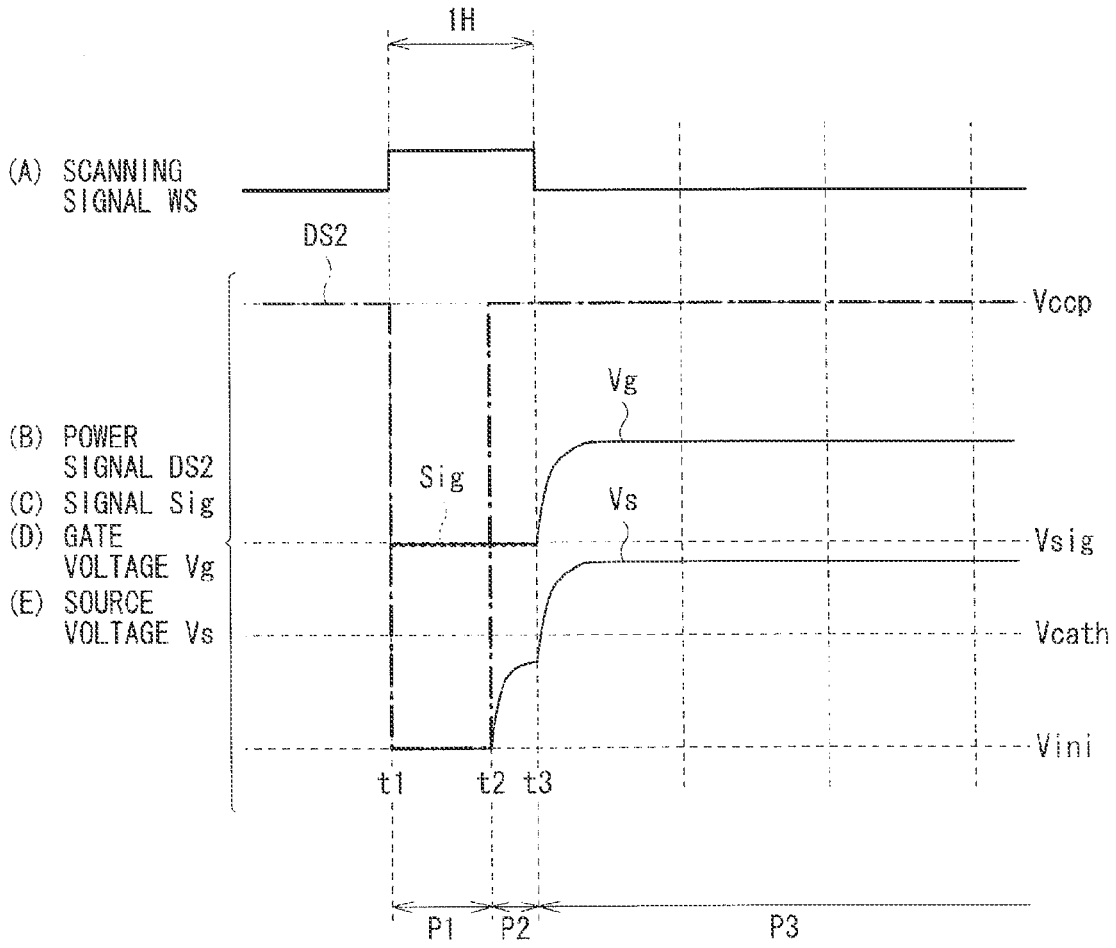
FIG. 3 is a timing waveform chart illustrating an operation example of the display unit shown in FIG. 1.

FIG. 3 is a timing chart of display operation in the display unit 1. This timing chart illustrates an operation example of display drive with respect to certain one of the sub-pixels 11 which is focused on. In FIG. 3, Part (A) shows a waveform of the scanning signal WS, Part (B) shows a waveform of the power signal DS2, Part (C) shows a waveform of the signal Sig, Part (D) shows a waveform of a gate voltage Vg of the drive transistor DRTr, and Part (E) shows a waveform of a source voltage Vs of the drive transistor DRTr. In Parts (B) to (E) in FIG. 3, the respective waveforms are shown with the use of the same voltage axis.

The drive section 20 writes the pixel voltage Vsig in the sub-pixel 11 and initializes the sub-pixel 11 (write period P1), and performs the Ids correction for suppressing the influence, on image quality, of the device variations in the drive transistors DRTr (Ids correction period P2) in one horizontal period (1H). Thereafter, the organic EL device OLED in the sub-pixel 11 emits light with luminance in accordance to the written pixel voltage Vsig (light emission period P3). Details thereof will be described below.

First, the drive section 20 writes the pixel voltage Vsig in the sub-pixel 11 and initializes the sub-pixel 11 in a period (write period P1) from timing t1 to timing t2. Specifically, first, at the timing t1, the data line drive section 27 sets the signal Sig to the pixel voltage Vsig (Part (C) in FIG. 3), and the scanning line drive section 23 allows a voltage of the scanning signal WS to be varied from a low level to a high level (Part (A) in FIG. 3). Accordingly, the write transistor WSTr is turned on, and the gate voltage Vg of the drive transistor DRTr is set to the pixel voltage Vsig (Part (D) in FIG. 3). It is to be noted that the higher voltage Vsig allows the organic EL device OLED to emit light with higher luminance, and the lower voltage Vsig allows the organic EL device OLED to emit light with lower luminance. Further, at the same time, the power line drive section 26 allows the power signal DS2 to be varied from the voltage Vccp to the voltage Vini (Part (B) in FIG. 3). Accordingly, the drive transistor DRTr is turned on, and the source voltage Vs of the drive transistor DRTr is set to the voltage Vini (Part (E) in FIG. 3). Accordingly, a gate-source voltage Vgs (=Vsig−Vini) between the gate and the source of the drive transistor DRTr is set to a voltage higher than a threshold voltage Vth of the drive transistor DRTr, and the sub-pixel 11 is initialized.

Next, the drive section 20 performs the Ids correction on the sub-pixel 11 in a period (Ids correction period P2) from the timing t2 to timing t3. Specifically, at the timing t2, the power line drive section 26 allows the power signal DS2 to be varied from the voltage Vini to the voltage Vccp (Part (B) in FIG. 3). Accordingly, the drive transistor DRTr is allowed to operate in a saturation region, and thereby, the current Ids flows from the drain to the source and the source voltage Vs is increased (Part (E) in FIG. 3). At this time, the source voltage Vs is lower than the voltage Vcath at the cathode of the organic EL device OLED. Therefore, the organic EL device OLED retains a reverse bias state and a current does not flow into the organic EL device OLED. It is to be noted that the state of the organic EL device OLED at this time is not limited to the reverse bias state. Alternatively, for example, a current may be prevented from flowing into the organic EL device OLED by setting an operating point of the organic EL device OLED to be equal to or lower than a threshold voltage Vel. Because the source voltage Vs is thus increased, the gate-source voltage Vgs is decreased, and therefore, the current Ids is decreased. With this negative feedback operation, the source voltage Vs is increased in a slower pace over time. A length of the time period (from the timing t2 to the timing t3) for performing the Ids correction is determined in order to suppress variations in the current Ids at the timing t3 as will be described later.

Subsequently, the drive section 20 allows the sub-pixel 11 to emit light in a period (light emission period P3) that begins from the timing t3. Specifically, at the timing t3, the scanning line drive section 23 allows the voltage of the scanning signal WS to be varied from the high level to the low level (Part (A) in FIG. 3). Accordingly, the write transistor WSTr is turned off, and the gate of the drive transistor DRTr is placed in a floating state. Therefore, after this, the voltage between the terminals of the capacitor Cs, that is, the gate-source voltage Vgs of the drive transistor DRTr is maintained. Further, as the current Ids flows into the drive transistor DRTr, the source voltage Vs of the drive transistor DRTr is increased (Part (E) in FIG. 3), and the gate voltage Vg of the drive transistor DRTr is increased accordingly (Part (D) in FIG. 3). When the source voltage Vs of the drive transistor DRTr becomes higher than a sum (Vel+Vcath) of the threshold voltage Vel and the voltage Vcath of the organic EL device OLED, a current flows between the anode and the cathode of the organic EL device OLED, which allows the organic EL device OLED to emit light. In other words, the source voltage Vs is increased in accordance with the device variations in the organic EL devices OLED, and the organic EL device OLED emits light.

Subsequently, in the display unit 1, the transition is made from the light emission period P3 to the write period P1 after a predetermined period (one frame period) has passed. The drive section 20 drives the sub-pixel 11 so that the above-described series of operation is repeated.

[Concerning Ids Correction]

As described above, in the Ids correction period P2, the current Ids is flown from the drain to the source of the drive transistor DRTr, and thereby, the source voltage Vs is increased and the gate-source voltage Vgs is gradually decreased. This operation will be described below in detail.

The current Ids that flows from the drain to the source of the drive transistor DRTr is expressed as the following expression.

$$Ids(t) = \frac{\beta}{2}(Vgs(t) - Vth)^2 \tag{1}$$

$$\beta \equiv \frac{W}{L} \cdot Cox \cdot \mu$$

In the above-described Expression (1), t represents time when the timing t2 (FIG. 3) at which the Ids correction begins is used as a reference. Vth represents the threshold voltage of the drive transistor DRTr. W represents a gate width of the drive transistor DRTr. L represents a gate length thereof. Cox represents oxide film capacitance. μ represents mobility.

The current Ids is supplied to the second end of the capacitor Cs, and thereby, the voltage (=Vgs) between the both ends of the capacitor Cs is varied. This behavior is expressed by the following expression.

$$Ids(t) = -Cs\frac{dVgs(t)}{dt} \tag{2}$$

With the use of Expressions (1) and (2), the following expression concerning the variation in the gate-source voltage Vgs over time is obtained.

$$Vgs(t) - Vth = \frac{1}{\frac{1}{Vgs(0) - Vth} + \frac{\beta}{2Cs} \cdot t} \tag{3}$$

In the above-described Expression (3), Vgs(0) is the gate-source voltage Vgs (=Vsig−Vini) at the timing t2.

As described above, in the Ids correction period P2, the gate-source voltage Vgs is decreased gradually over time as shown in Expression (3). Accordingly, the current Ids that flows from the drain to the source of the drive transistor DRTr is also decreased gradually.

Figure 4:
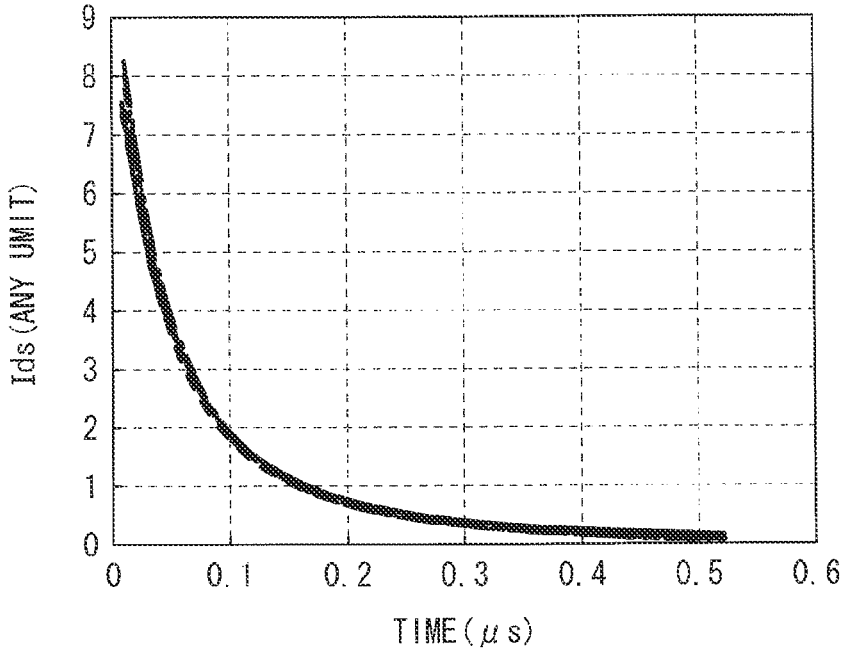
FIG. 4 is an explanatory diagram for explaining operation of the display unit shown in FIG. 1.

FIG. 4 illustrates the variation in the current Ids over time upon application of a certain pixel voltage Vsig. FIG. 4 illustrates a simulation result in which a case of manufacturing transistors in a plurality of different process conditions is assumed. As shown in FIG. 4, the current Ids is decreased gradually over time. At that time, the variation in the current Ids over time differs between the transistors depending on the process conditions. Specifically, for example, the current Ids may be decreased faster when a value of the current Ids is large (when the mobility μ is large and the threshold value Vth is small), and the current Ids may be decreased slower when the value of the current Ids is small (when the mobility μ is small and the threshold value Vth is large).

Figure 5:
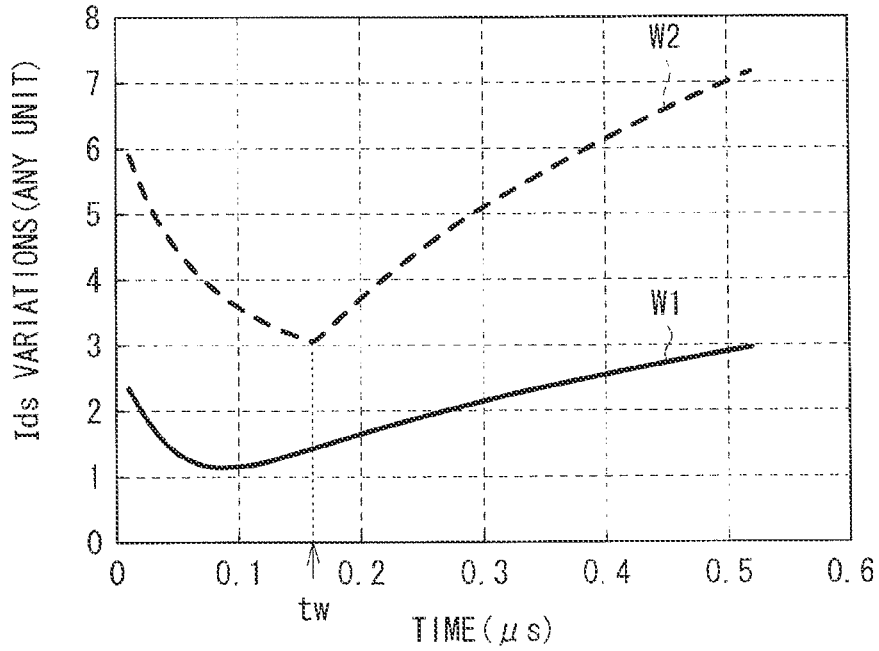
FIG. 5 is another explanatory diagram for explaining the operation of the display unit shown in FIG. 1.

FIG. 5 illustrates time dependency of the variations in the current Ids shown in FIG. 4. The characteristics W1 indicate a value (σ/ave.) that is obtained by dividing standard deviation by an average value. The characteristics W2 indicate a value (Range/ave.) that is obtained by dividing a variation value by the average value. As shown in FIG. 5, the variations in the current Ids have a local minimum value at a certain time t (for example, at time tw in the characteristics W2). Accordingly, the width of variations in the current Ids is minimized when the Ids correction is performed for a time period of tw.

In the display unit 1, as described above, the time length (in FIG. 3, from the timing t2 to the timing t3) of the Ids correction period P2 is set to be the time length (for example, the time period of tw) that allows the variations in the current Ids to be small. Accordingly, the variations in the current Ids at the timing t3 are suppressed. Therefore, degradation in image quality is suppressed.

Moreover, in the display unit 1, the Ids correction is completed before the current Ids is converged to "0 (zero)". Therefore, the period (Ids correction period P2) used for the correction operation is allowed to be shorter compared to in a correction method (for example, Vth correction described in a fourth embodiment) which will be described later. Accordingly, design freedom of the display unit 1 is increased. Specifically, for example, a high-definition display unit may be achieved with the use of the display unit 1. In particular, in the high-definition display unit, it is necessary to perform correction operation in a shorter time period since one horizontal period (1H) becomes shorter in accordance with increase in the number of lines. In the display unit 1, the correction operation is allowed to be performed in a short time period. Therefore, the high-definition display unit is achievable.

[Effects]

As described above, in the present embodiment, the Ids correction is performed. Therefore, degradation in image quality resulting from the device variations in the drive transistors is suppressed.

Moreover, in the present embodiment, the correction is completed before the current Ids is converged to "0 (zero)" in the Ids correction period. Therefore, the period used for the correction operation is allowed to be short. Accordingly, design freedom is increased. For example, a high-definition display unit may be achievable.

Moreover, in the present embodiment, the source voltage is increased in accordance with the device variations in the organic EL devices. Therefore, degradation in image quality resulting from the device variations in the organic EL device is suppressed.

[Modification 1-1]

In the above-described embodiment, the sub-pixel 11 includes two transistors and one capacitor Cs. However, this is not limitative. Alternatively, for example, the sub-pixel may include three transistors and one capacitor Cs. The present modification will be described below in detail.

Figure 6:
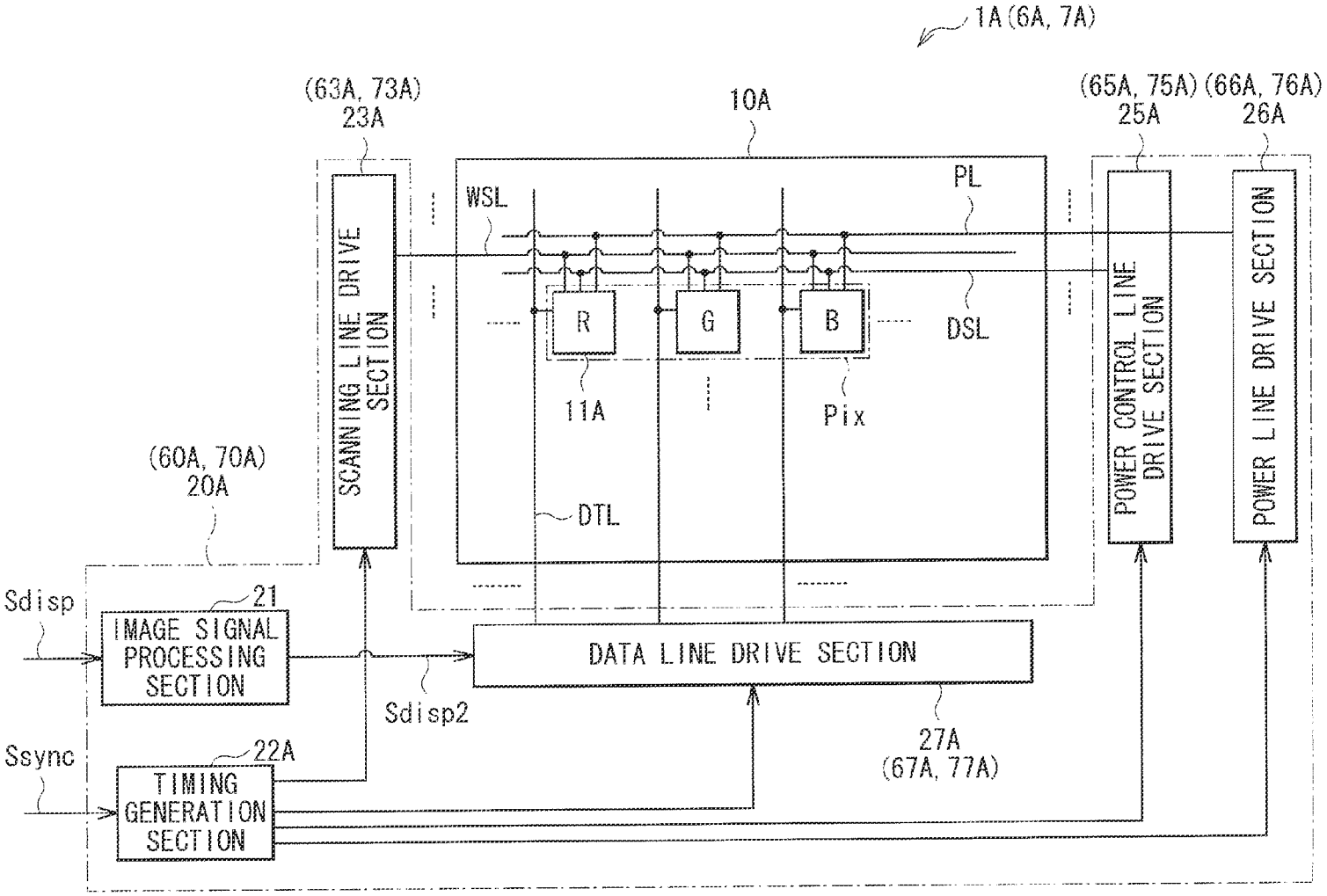
FIG. 6 is a block diagram illustrating a configuration example of a display unit according to a modification of the first embodiment.

FIG. 6 illustrates a configuration example of a display unit 1A according to the present modification. The display unit 1A includes a display section 10A and a drive section 20A. The display section 10A includes a plurality of sub-pixels 11A and a plurality of power control lines DSL that extend in the row direction. One end of each of the power control lines DSL is connected to the drive section 20A.

Figure 7:
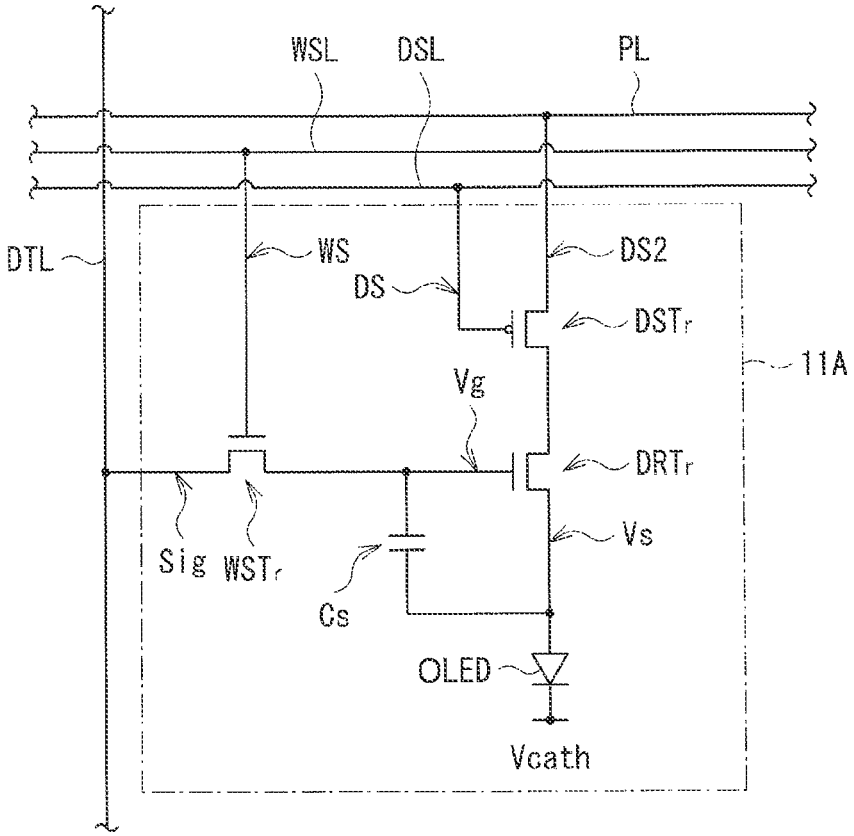
FIG. 7 is a circuit diagram illustrating a configuration example of a sub-pixel shown in FIG. 6.

FIG. 7 illustrates an example of a circuit configuration of the sub-pixel 11A. The sub-pixel 11A includes a power transistor DSTr. In other words, in this example, the sub-pixel 11A has a so-called "3Tr1C" configuration that includes three transistors (the write transistor WSTr, the drive transistor DRTr, and the power transistor DSTr) and one capacitor Cs. The power transistor DSTr is configured of a TFT of a P-channel MOS type. A gate of the power transistor DSTr is connected to the power control line DSL, a source thereof is connected to the power line PL, and a drain thereof is connected to the drain of the drive transistor DRTr.

The power transistor DSTr corresponds to a specific but not limitative example of "third transistor" in one embodiment of the present disclosure.

The drive section 20A includes a timing generation section 22A, a scanning line drive section 23A, a power control line drive section 25A, a power line drive section 26A, and a data line drive section 27A. The timing generation section 22A is a circuit that supplies a control signal to each of the scanning line drive section 23A, the power control line drive section 25A, the power line drive section 26A, and the data line drive section 27A based on the synchronization signal Ssync that is supplied from the outside, and thereby controlling these sections to operate in synchronization with each other. The power control line drive section 25A sequentially applies power control signals DS to the plurality of power control lines DSL in accordance with the control signal supplied from the timing generation section 22A, thereby controlling light emitting operation and light extinction operation of the sub-pixels 11A for the respective rows. The scanning line drive section 23A, the power line drive section 26A, and the data line drive section 27A have functions similar to those of the scanning line drive section 23, the power line drive section 26, and the data line drive section 27 according to the above-described embodiment, respectively.

Figure 8:
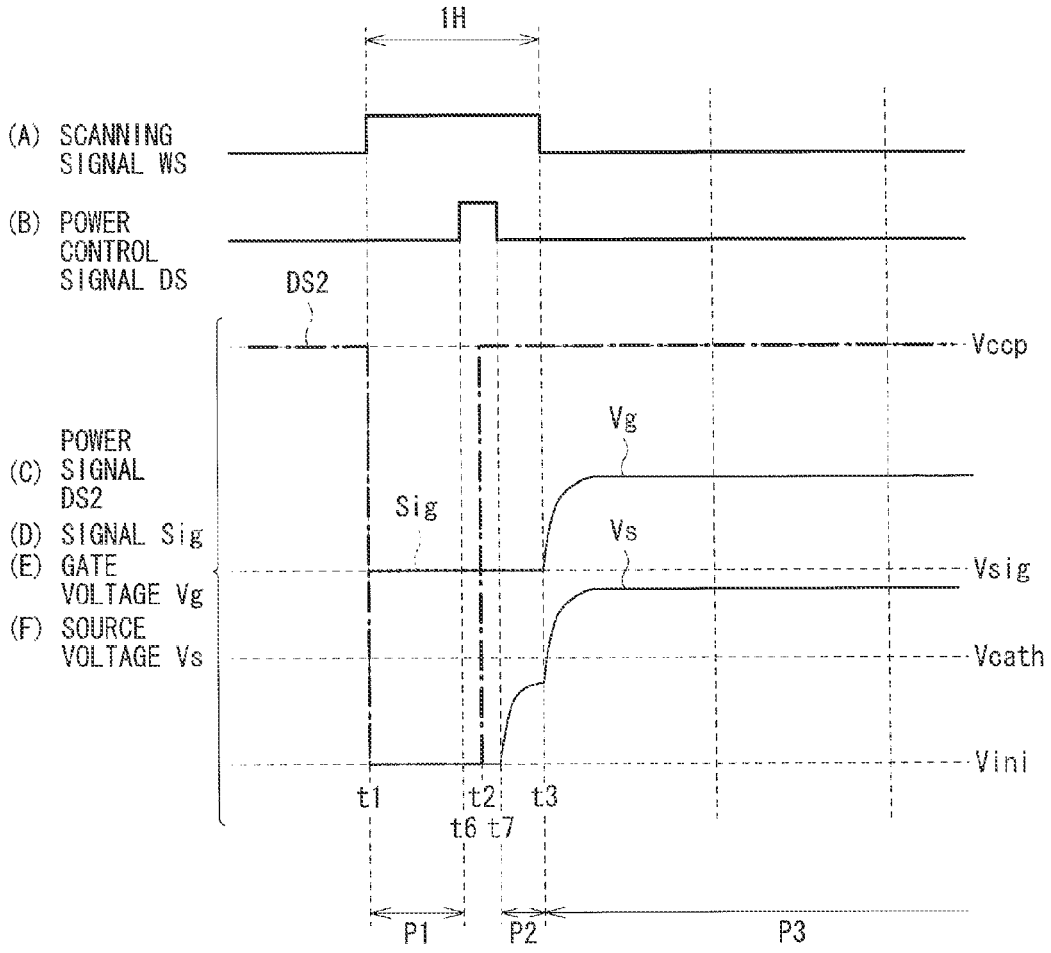
FIG. 8 is a timing waveform chart illustrating an operation example of the display unit shown in FIG. 6.

FIG. 8 is a timing chart of display operation in the display unit 1A. In FIG. 8, Part (A) shows the waveform of the scanning signal WS, Part (B) shows a waveform of the power control signal DS, Part (C) shows a waveform of the power signal DS2, Part (D) shows the waveform of the signal Sig, Part (E) shows the waveform of the gate voltage Vg of the drive transistor DRTr, and Part (F) shows the waveform of the source voltage Vs of the drive transistor DRTr.

First, the drive section 20A writes the pixel voltage Vsig in the sub-pixel 11A and initializes the sub-pixel 11A in a period (write period P1) from the timing t1 to timing t6, as in the above-described embodiment.

Next, at the timing t6, the power control line drive section 25A allows the power control signal DS to be varied from a low level to a high level (Part (B) in FIG. 8). Accordingly, the power transistor DSTr is turned off, and supply of the voltage Vini to the source of the drive transistor DRTr is completed. Further, at the timing t2, the power line drive section 26A allows the power signal DS2 to be varied from the voltage Vini to the voltage Vccp (Part (C) in FIG. 8) as in the above-described embodiment. Thereafter, at timing t7, the power control line drive section 25A allows the power control signal DS to be varied from the high level to the low level (Part (B) in FIG. 8). Accordingly, the power transistor DSTr is turned on, and the voltage Vccp is supplied to the drain of the drive transistor DRTr.

Subsequently, the drive section 20A performs the Ids correction on the sub-pixel 11A in a period (Ids correction period P2) from the timing t7 to the timing t3, as in the above-described first embodiment.

Effects similar to those in the above-described embodiment are obtainable also in such a configuration.

[Modification 1-2]

In the above-described first embodiment, the sub-pixel 11 is initialized by supplying the voltage Vini by the power line drive section 26. However, this is not limitative. Alternatively, for example, a transistor used only to supply the voltage Vini may be provided. The present modification will be described below in detail.

Figure 9:
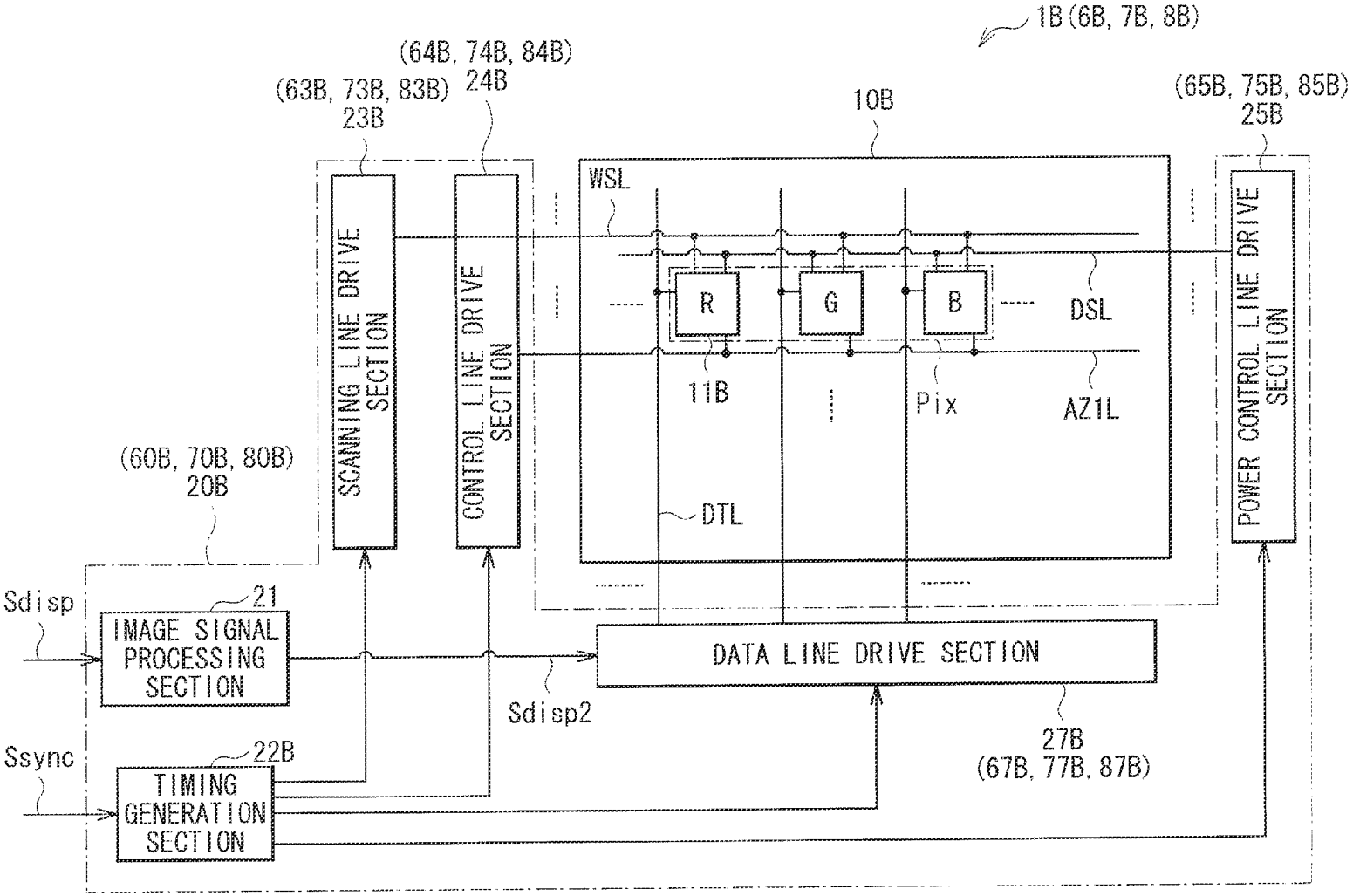
FIG. 9 is a block diagram illustrating a configuration example of a display unit according to another modification of the first embodiment.

FIG. 9 illustrates a configuration example of a display unit 1B according to the present modification. The display unit 1B includes a display section 10B and a drive section 20B. The display section 10B includes a plurality of sub-pixels 11B and a plurality of control lines AZ1L that extend in the row direction. One end of each of the control lines AZ1L is connected to the drive section 20B.

Figure 10:
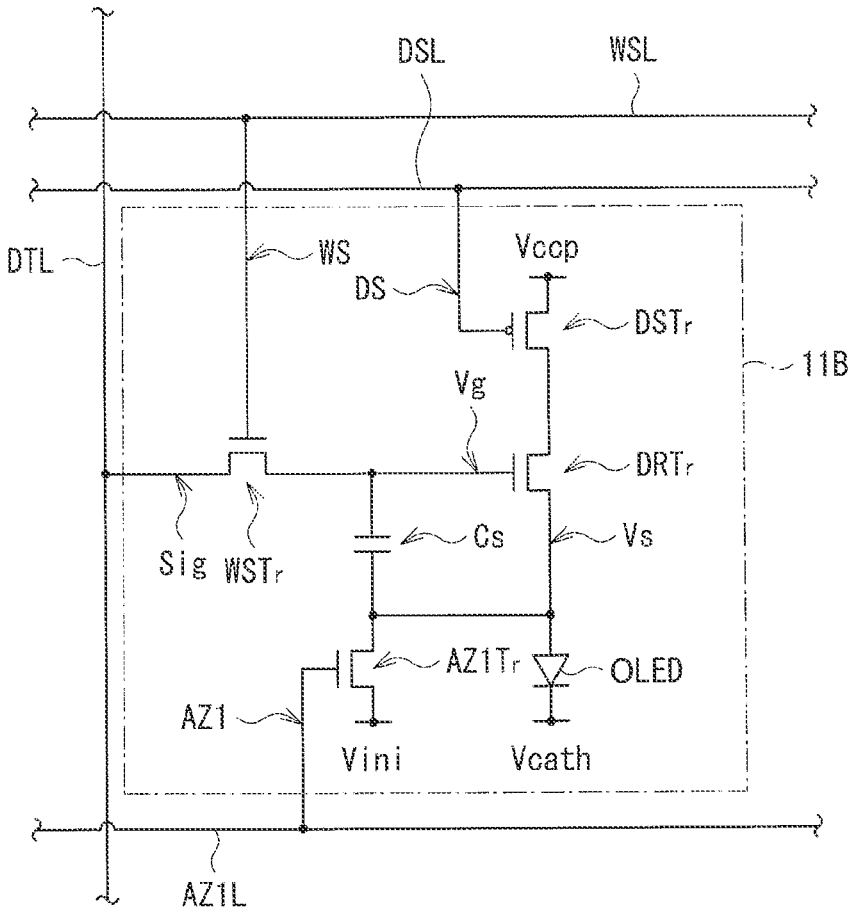
FIG. 10 is a circuit diagram illustrating a configuration example of a sub-pixel shown in FIG. 9.

FIG. 10 illustrates an example of a circuit configuration of the sub-pixel 11B. The sub-pixel 11B includes a control transistor AZ1Tr. In other words, in this example, the sub-pixel 11B has a so-called "4Tr1C" configuration that includes four transistors (the write transistor WSTr, the drive transistor DRTr, the power transistor DSTr, and the control transistor AZ1Tr) and one capacitor Cs. The control transistor AZ1Tr is configured of a TFT of an N-channel MOS type. A gate of the control transistor AZ1Tr is connected to the control line AZ1L, a drain thereof is connected to the source of the drive transistor DRTr and to the second end of the capacitor Cs, and a source thereof is supplied with the voltage Vini by the drive section 20B. Further, the voltage Vccp is supplied to the source of the power transistor DSTr by the drive section 20B.

Here, the control transistor AZ1Tr corresponds to a specific but not limitative example of "fourth transistor" in one embodiment of the present disclosure.

The drive section 20B includes a timing generation section 22B, a scanning line drive section 23B, a control line drive section 24B, a power control line drive section 25B, and a data line drive section 27B. The timing generation section 22B is a circuit that supplies a control signal to each of the scanning line drive section 23B, the control line drive section 24B, the power control line drive section 25B, and the data line drive section 27B based on the synchronization signal Ssync that is supplied from the outside, and thereby controlling these sections to operate in synchronization with each other. The control line drive section 24B sequentially applies control signals AZ1 to the plurality of control lines AZ1L in accordance with the control signal supplied from the timing generation section 22B, thereby controlling initialization operation of the sub-pixels 11B for the respective rows. The scanning line drive section 23B, the power control line drive section 25B, and the data line drive section 27B have functions similar to those of the scanning line drive section 23, the power control line drive section 25A, and the data line drive section 27, respectively.

Figure 11:
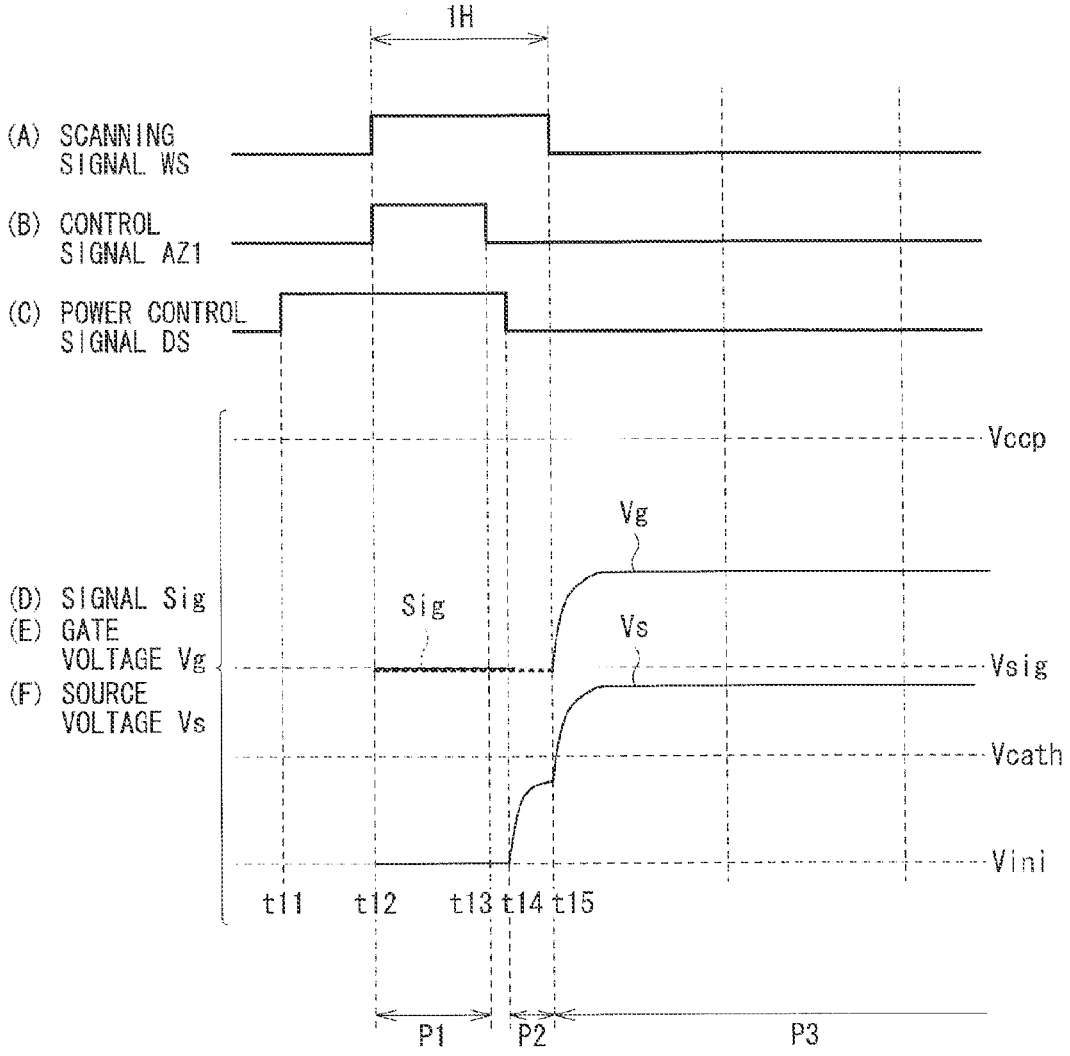
FIG. 11 is a timing waveform chart illustrating an operation example of the display unit shown in FIG. 9.

FIG. 11 is a timing chart of display operation in the display unit 1B. In FIG. 11, Part (A) shows the waveform of the scanning signal WS, Part (B) shows a waveform of the control signal AZ1, Part (C) shows the waveform of the power control signal DS, Part (D) shows the waveform of the signal Sig, Part (E) shows the waveform of the gate voltage Vg of the drive transistor DRTr, and Part (F) shows the waveform of the source voltage Vs of the drive transistor DRTr.

First, at timing t11 prior to the write period P1, the power control line drive section 25B allows a voltage of the power control signal DS to be varied from a low level to a high level (Part (C) in FIG. 11). Accordingly, the power transistor DSTr is turned off.

Next, the drive section 20B writes the pixel voltage Vsig in the sub-pixel 11B in a period (write period P1) from timing t12 to timing t13, as in the above-described first embodiment. Further, at the timing t12, the control line drive section 24B allows a voltage of the control signal AZ1 to be varied from a low level to a high level (Part (B) in FIG. 11). Accordingly, the control transistor AZ1Tr is turned on, and the source voltage Vs of the drive transistor DRTr is set to the voltage Vini (Part (F) in FIG. 11). Thus, the sub-pixel 11B is initialized.

Subsequently, at the timing t13, the control line drive section 24B allows the voltage of the control signal AZ1 to be varied from the high level to the low level (Part (B) in FIG. 11). Accordingly, the control transistor AZ1Tr is turned off, and the supply of the voltage Vini to the source of the drive transistor DRTr is completed.

Subsequently, the drive section 20B performs the Ids correction on the sub-pixel 11B in a period (Ids correction period P2) from timing t14 to timing t15. Specifically, at the timing t14, the power control line drive section 25B allows the voltage of the power control signal DS to be varied from a high level to a low level (Part (C) in FIG. 11). Accordingly, the power transistor DSTr is turned on, and the Ids correction is performed as in the above-described first embodiment.

Effects similar to those in the above-described embodiment are obtainable also in such a configuration.

[Modification 1-3]

In the above-described first embodiment, the sub-pixel 11 includes two transistors. However, this is not limitative. Alternatively, for example, the sub-pixel may further include other transistors.

Figure 12:
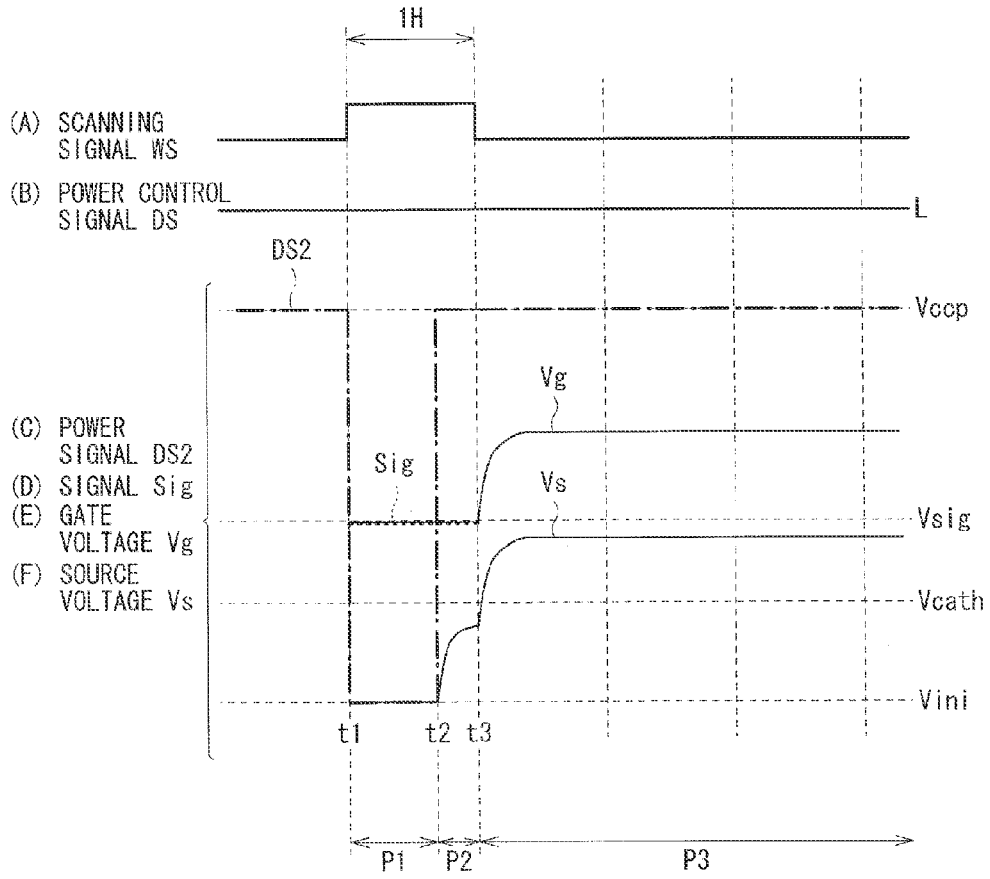
FIG. 12 is a timing waveform chart illustrating an operation example of a display unit according to another modification of the first embodiment.

For example, a method (FIG. 3) of driving the display section 10 (FIGS. 1 and 2) that includes the sub-pixel 11 having the "2Tr1C" configuration may be applied as it is to the display section 10A (FIGS. 6 and 7) that includes the sub-pixel 11A having the "3Tr1C" configuration. In this case, the same method as the driving method shown in FIG. 3 is achievable by allowing the power control signal DS to be mostly at the low level (L) (Part (B) in FIG. 12) and allowing the power transistor DSTr to be mostly ON, as shown in FIG. 12.

Moreover, for example, the method (FIG. 3) of driving the display section 10 (FIGS. 1 and 2) that includes the sub-pixel 11 having the "2Tr1C" configuration may be applied as it is to a display section that includes a sub-pixel having the "4Tr1C" configuration. Details thereof will be described below.

Figure 13:
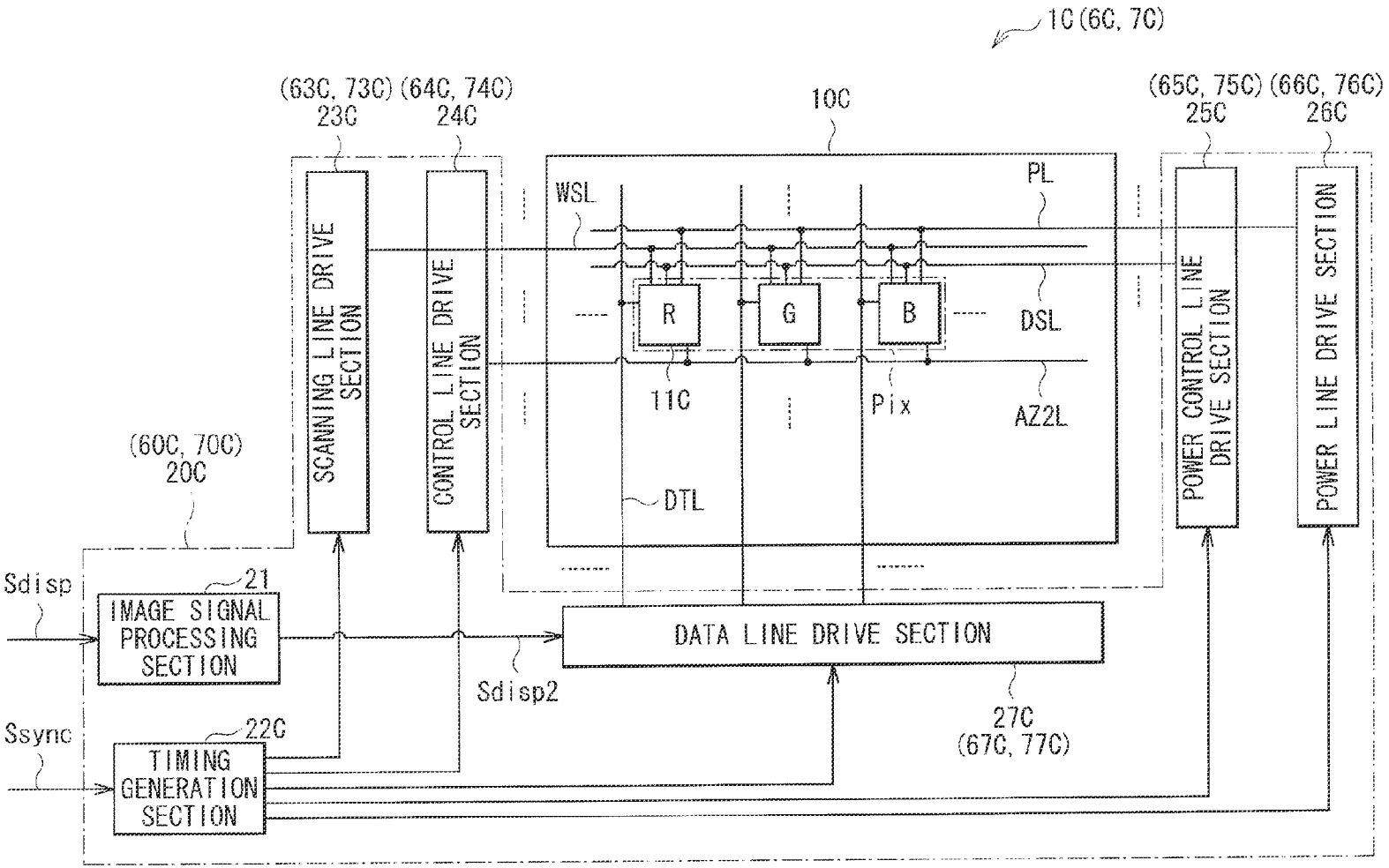
FIG. 13 is a block diagram illustrating a configuration example of a display unit according to another modification of the first embodiment.

FIG. 13 illustrates a configuration example of a display unit 1C according to the present modification. The display unit 1C includes a display section 10C and a drive section 20C. The display section 10C includes a plurality of sub-pixels 11C and a plurality of control lines AZ2L that extend in the row direction. One end of each of the control lines AZ2L is connected to the drive section 20C.

Figure 14:
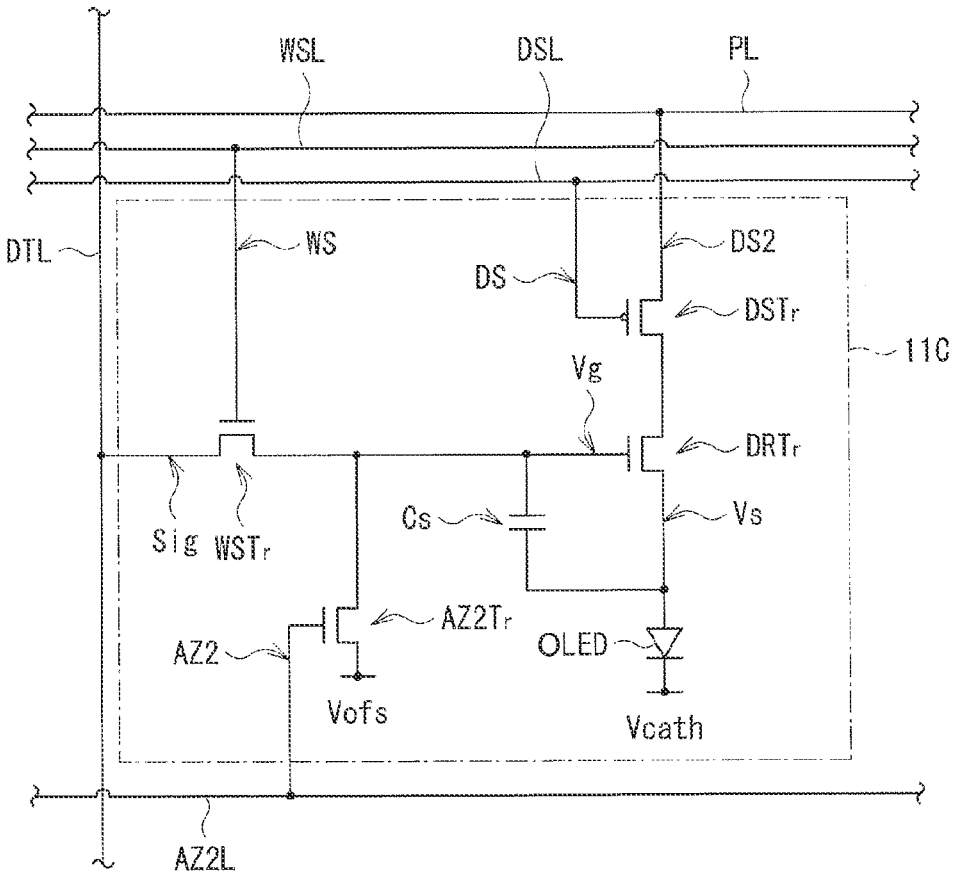
FIG. 14 is a circuit diagram illustrating a configuration example of a sub-pixel shown in FIG. 13.

FIG. 14 illustrates an example of a circuit configuration of the sub-pixel 11C. The sub-pixel 11C includes a control transistor AZ2Tr. In other words, in this example, the sub-pixel 11C has the so-called "4Tr1C" configuration that includes four transistors (the write transistor WSTr, the drive transistor DRTr, the power transistor DSTr, and the control transistor AZ2Tr) and one capacitor Cs. The control transistor AZ2Tr is configured of a TFT of an N-channel MOS type. A gate of the control transistor AZ2Tr is connected to the control line AZ2L, a drain thereof is connected to the gate of the drive transistor DRTr and to the first end of the capacitor Cs, and a source thereof is supplied with a voltage Vofs by the drive section 20C. Further, the source of the power transistor DSTr is connected to the power line PL.

The drive section 20C includes a timing generation section 22C, a scanning line drive section 23C, a control line drive section 24C, a power control line drive section 25C, a power line drive section 26C, and a data line drive section 27C. The timing generation section 22C is a circuit that supplies a control signal to each of the scanning line drive section 23C, the control line drive section 24C, the power control line drive section 25C, the power line drive section 26C, and the data line drive section 27C based on the synchronization signal Ssync that is supplied from the outside, and thereby controlling these sections to operate in synchronization with each other. The control line drive section 24C sequentially applies control signals AZ2 to the plurality of control lines AZ2L in accordance with the control signal supplied from the timing generation section 22C. The scanning line drive section 23C, the power control line drive section 25C, the power line drive section 26C, and the data line drive section 27C have functions similar to those of the scanning line drive section 23, the power control line drive section 25A, the power line drive section 26, and the data line drive section 27, respectively.

Figure 15:
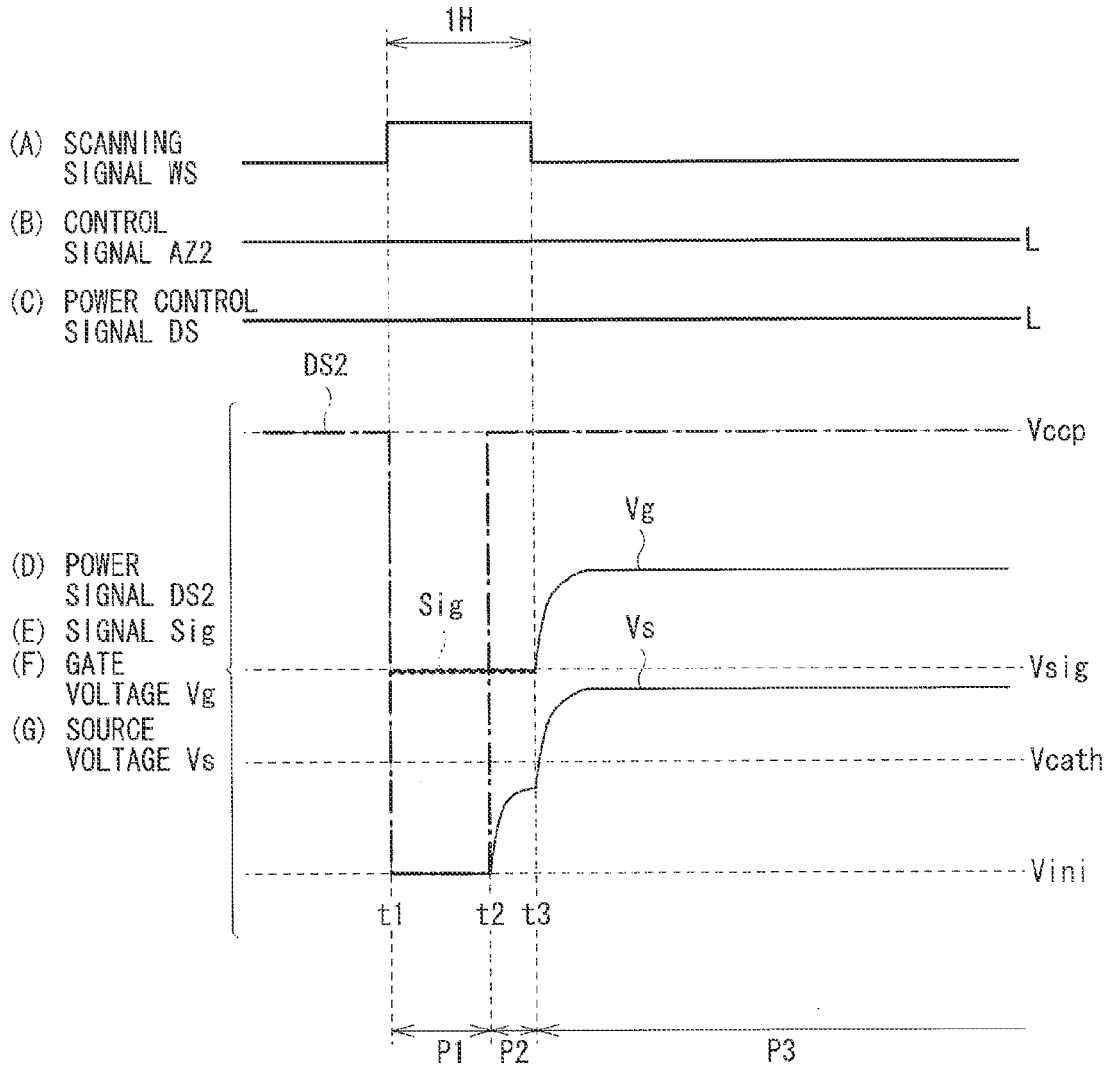
FIG. 15 is a timing waveform chart illustrating an operation example of a display unit shown in FIG. 13.

Also in such a configuration, the same method as the driving method shown in FIG. 3 is achievable by allowing the control signal AZ2 to be mostly at the low level (L) (Part (B) in FIG. 15), allowing the power control signal DS to be mostly at the low level (L) (Part (C) in FIG. 15) and allowing the control transistor AZ2Tr to be mostly OFF, and allowing the power transistor DSTr to be mostly ON, as shown in FIG. 15.

Figure 16:
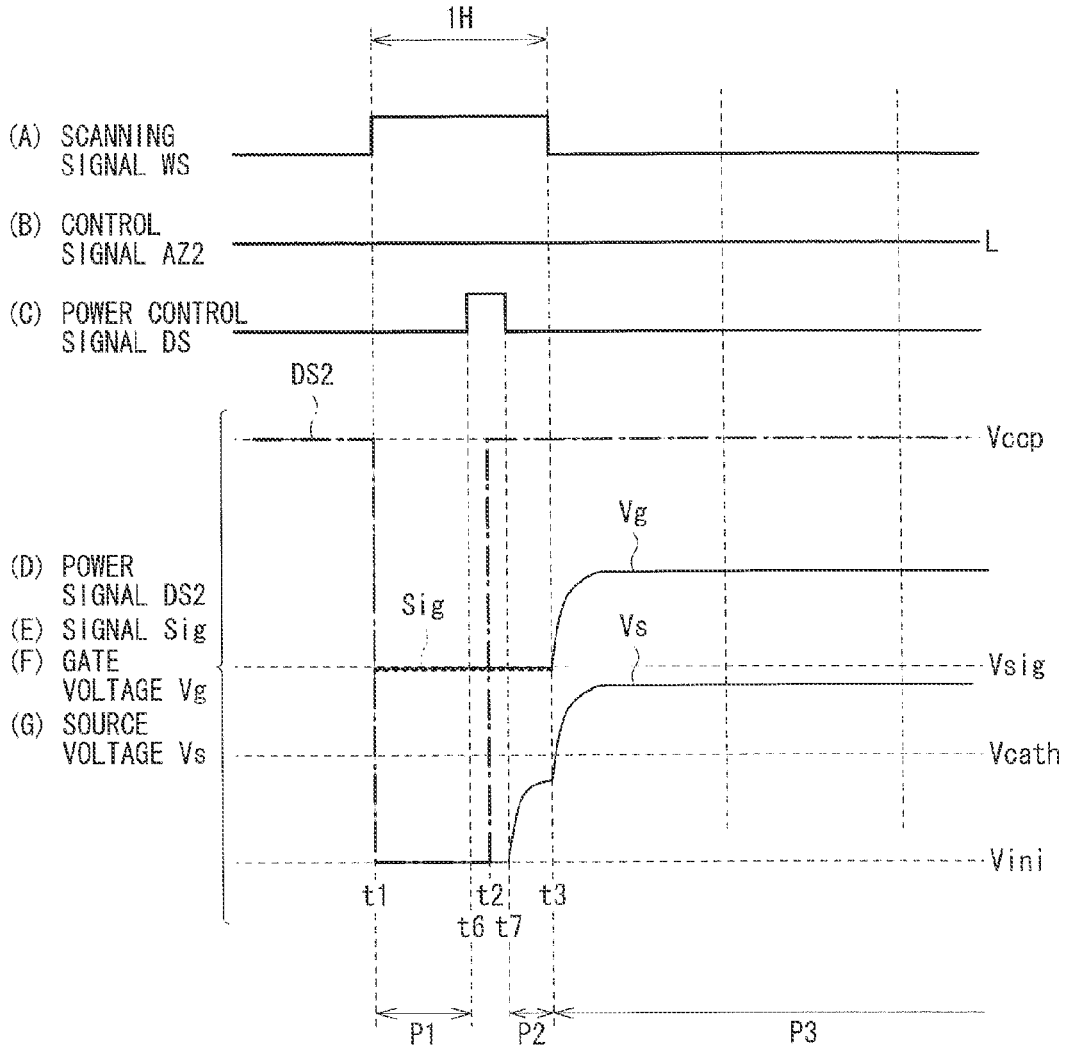
FIG. 16 is a timing waveform chart illustrating an operation example of a display unit according to another modification of the first embodiment.

Moreover, for example, the method (FIG. 8) of driving the display section 10A (FIGS. 6 and 7) that includes the sub-pixel 11A having the "3Tr1C" configuration may be applied as it is to the display section 10C (FIGS. 13 and 14) that includes the sub-pixel 11C having the "4Tr1C" configuration. In this case, the same method as the driving method shown in FIG. 8 is achievable, by allowing the control signal AZ2 to be mostly at the low level (L) (Part (B) in FIG. 16) and allowing the control transistor AZ2Tr to be mostly OFF, as shown in FIG. 16.

Moreover, for example, the method (FIG. 11) of driving the display section 10B (FIGS. 9 and 10) that includes the sub-pixel 11B having the "4Tr1C" configuration may be applied as it is to the display section that includes a sub-pixel having a "5Tr1C" configuration. Details thereof will be described below.

Figure 17:
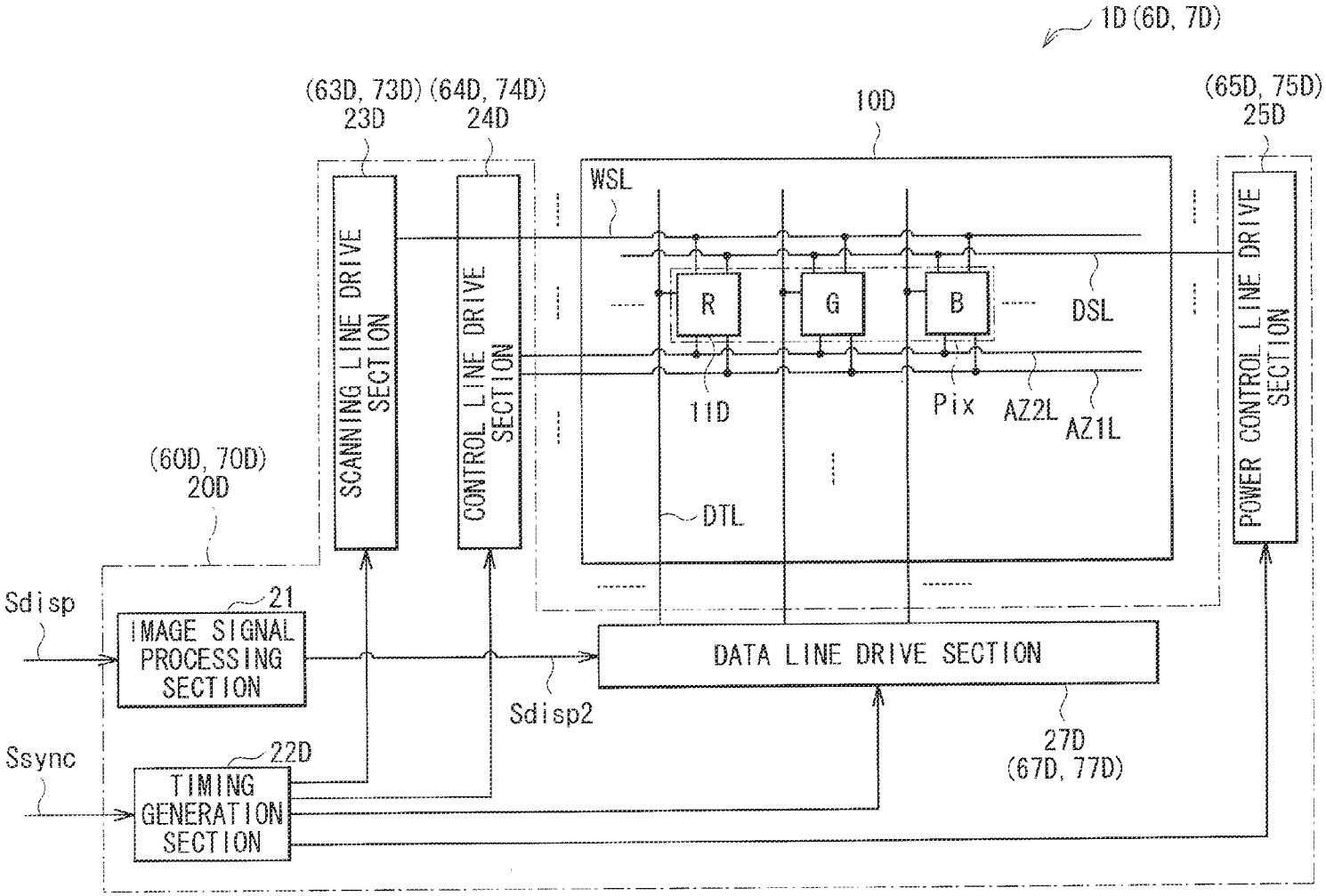
FIG. 17 is a block diagram illustrating a configuration example of a display unit according to another modification of the first embodiment.

FIG. 17 illustrates a configuration example of a display unit 1D according to the present modification. The display unit 1D includes a display section 10D and a drive section 20D. The display section 10D includes a plurality of sub-pixels 11D and the plurality of control lines AZ1L and AZ2L that extend in the row direction. One end of each of the control lines AZ1L and AZ2L is connected to the drive section 20D.

Figure 18:
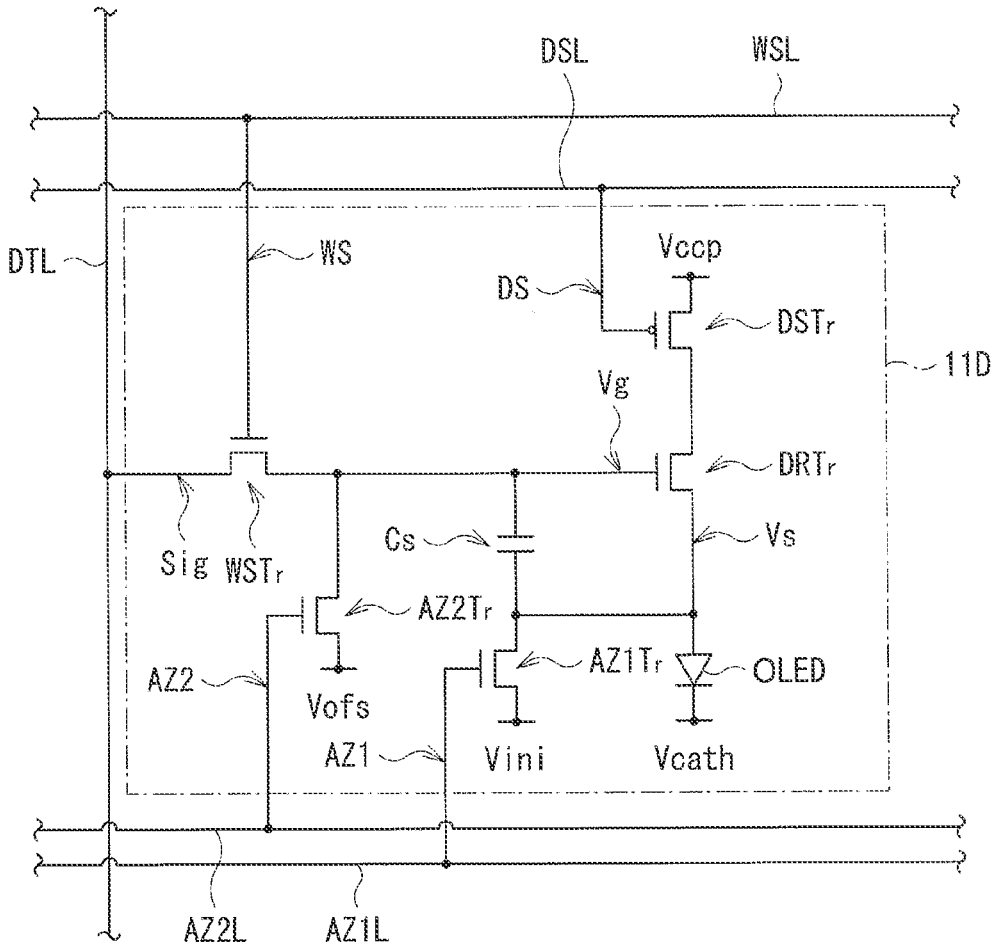
FIG. 18 is a circuit diagram illustrating a configuration example of a sub-pixel shown in FIG. 17.

FIG. 18 illustrates an example of a circuit configuration of the sub-pixel 11D. The sub-pixel 11D includes the control transistors AZ1Tr and AZ2Tr. In other words, in this example, the sub-pixel 11D has the so-called "5Tr1C" configuration that includes five transistors (the write transistor WSTr, the drive transistor DRTr, the power transistor DSTr, and the control transistors AZ1Tr and AZ2Tr) and one capacitor Cs.

The drive section 20D includes a timing generation section 22D, a scanning line drive section 23D, a control line drive section 24D, a power control line drive section 25D, and a data line drive section 27D. The timing generation section 22D is a circuit that supplies a control signal to each of the scanning line drive section 23D, the control line drive section 24D, the power control line drive section 25D, and the data line drive section 27D based on the synchronization signal Ssync that is supplied from the outside, and thereby controlling these sections to operate in synchronization with each other. The control line drive section 24D sequentially applies the control signals AZ1 to the plurality of control lines AZ1L, and sequentially applies the control signals AZ2 to the plurality of control lines AZ2L, in accordance with the control signal supplied from the timing generation section 22D. The scanning line drive section 23D, the power control line drive section 25D, and the data line drive section 27D have functions similar to those of the scanning line drive section 23, the power control line drive section 25A, and the data line drive section 27, respectively.

Figure 19:
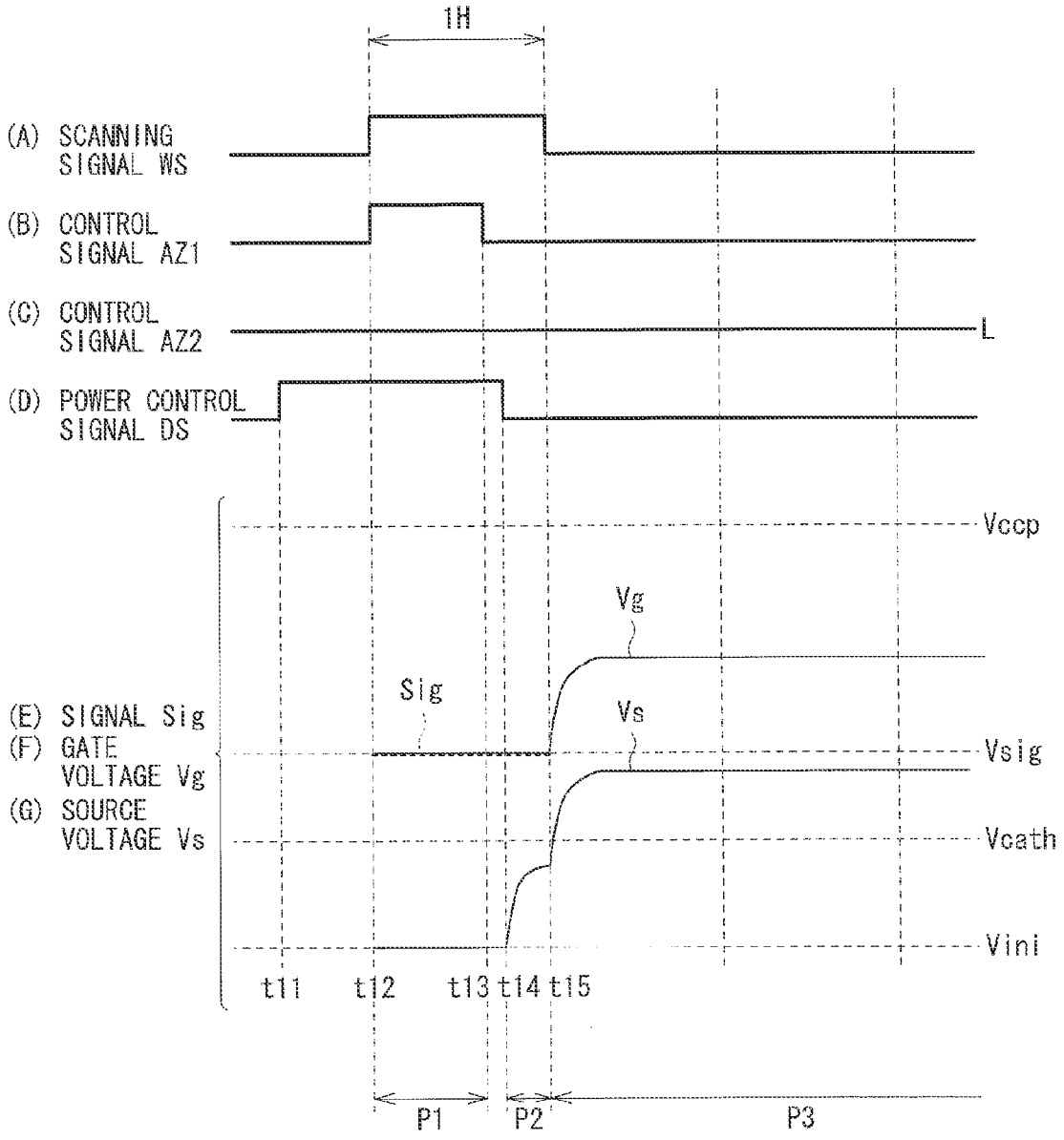
FIG. 19 is a timing waveform chart illustrating an operation example of a display unit shown in FIG. 17.

Also in such a configuration, the same method as the driving method shown in FIG. 11 is achievable by allowing the control signal AZ2 to be mostly at the low level (L) (Part (C) in FIG. 19), and allowing the control transistor AZ2Tr to be mostly OFF, as shown in FIG. 19.

[Modification 1-4]

In the above-described embodiment, the sub-pixels 11 that are adjacent to each other in the row direction are connected to different data lines DTL. However, this is not limitative. Alternatively, for example, the adjacent sub-pixels 11 may share one data line DTL. Description will be given below in detail of a display unit 1E and a display unit 1F according to the present modification.

Figure 20:
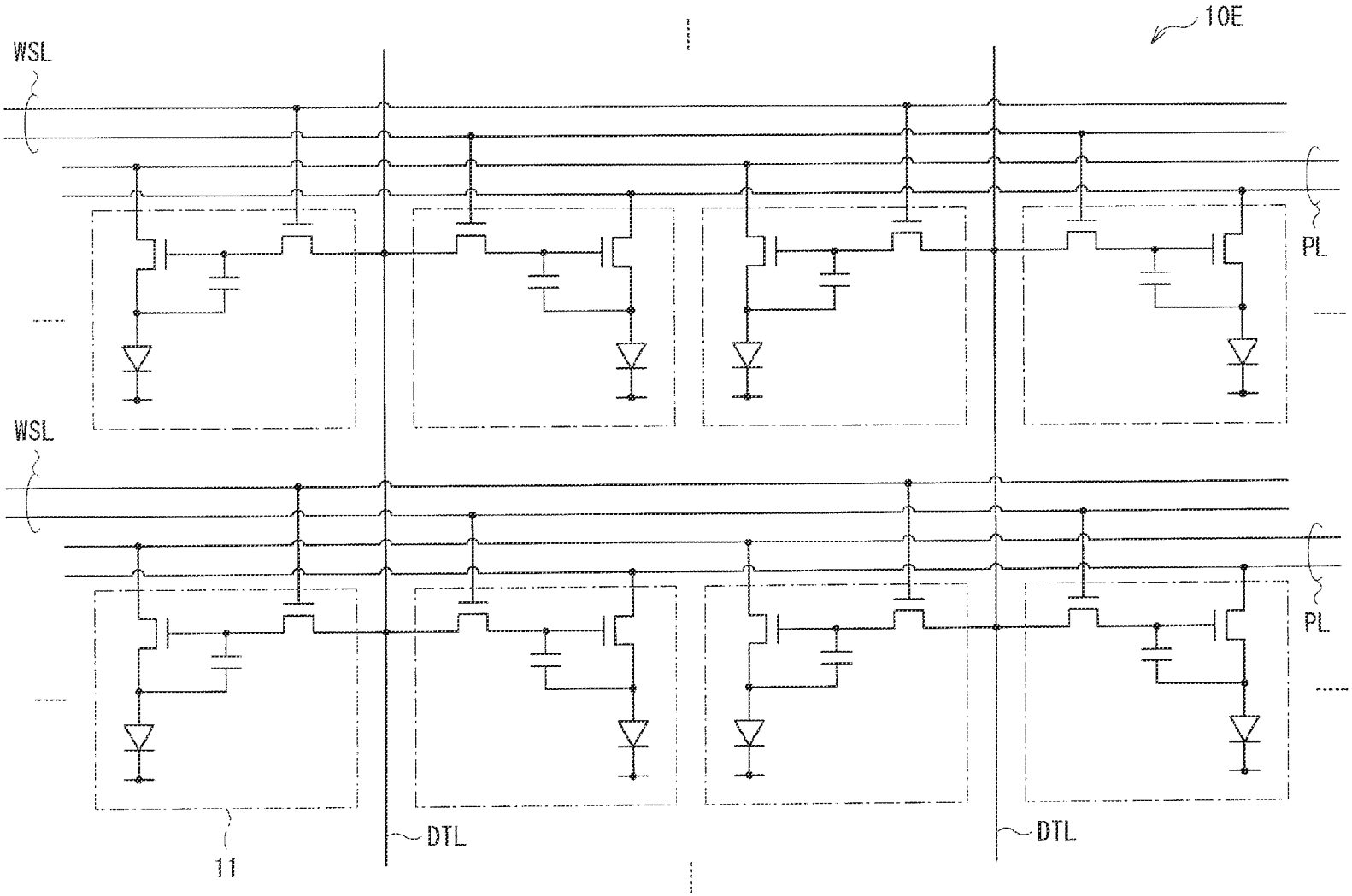
FIG. 20 is a circuit diagram illustrating a configuration example of a display section according to another modification of the first embodiment.

FIG. 20 illustrates a configuration example of a display section 10E in the display unit 1E. In the display section 10E, the sub-pixels 11 that are adjacent to each other in the row direction are connected to one data line DTL. Moreover, the display section 10E includes two scanning lines WSL and two power lines PL for each row.

Figure 21:
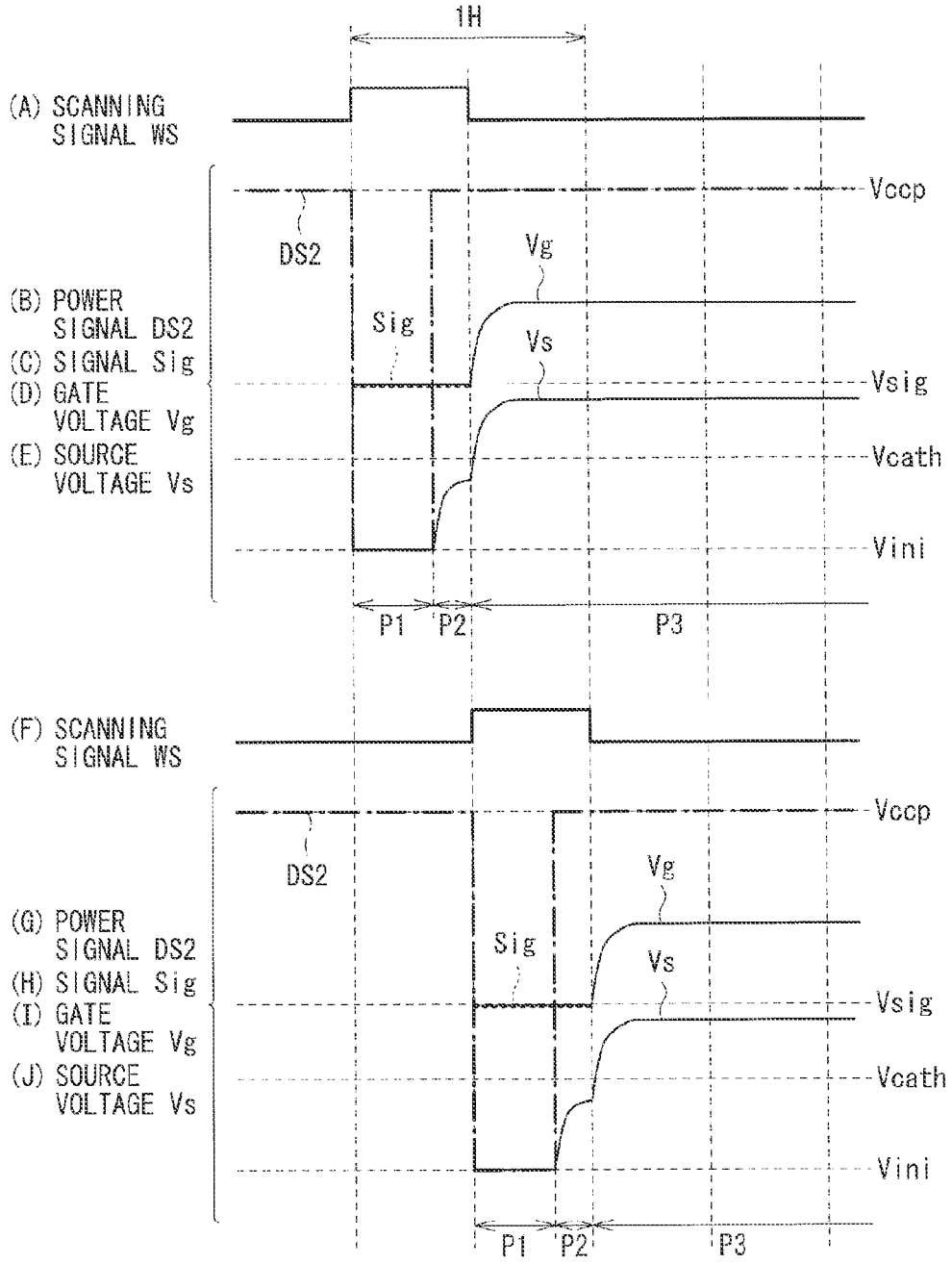
FIG. 21 is a timing waveform chart illustrating an operation example of a display unit shown in FIG. 20.

FIG. 21 is a timing chart of display operation in the display unit 1E. This timing chart illustrates an operation example of display drive with respect to the two sub-pixels 11 that are adjacent to each other in the row direction. In FIG. 21, Parts (A) to (E) illustrate operation example of one of the two sub-pixels 11, and Parts (F) to (J) illustrate operation example of the other. Parts (A) and (F) each show the waveform of the scanning signal WS, Parts (B) and (G) each show the waveform of the power signal DS2, Parts (C) and (H) each show the waveform of the signal Sig, Parts (D) and (I) each show the waveform of the gate voltage Vg of the drive transistor DRTr, and Parts (E) and (J) each show the waveform of the source voltage Vs of the drive transistor DRTr.

In the display unit 1E, the pixel voltage Vsig is written in the two sub-pixels 11 that are adjacent to each other in the row direction and the Ids correction is performed in one horizontal period (1H). Specifically, the writing operation (write period P1) and the Ids correction operation (Ids correction period P2) are performed on one of the two sub-pixels 11 in a first half of the one horizontal period (1H), and the writing operation (write period P1) and the Ids correction operation (Ids correction period P2) are performed on the other of the two sub-pixels 11 in a second half of the horizontal period (1H).

Figure 22A:
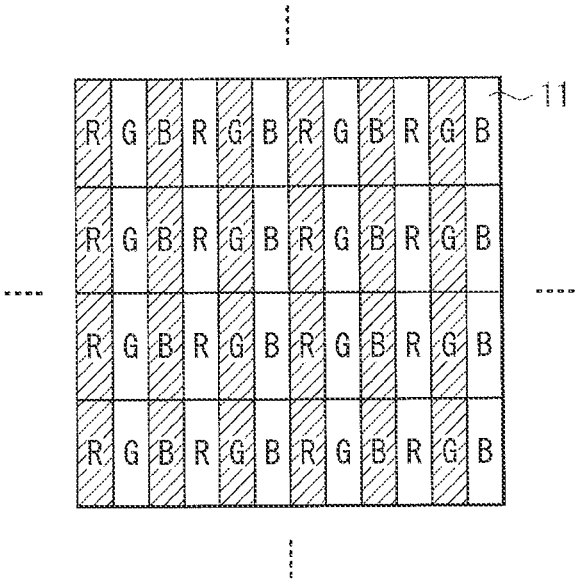
FIG. 22A is an explanatory diagram for explaining operation of the display unit shown in FIG. 20.
Figure 22B:
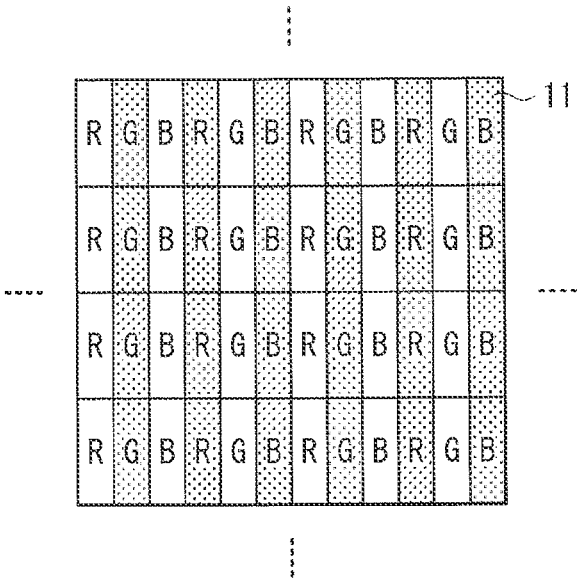
FIG. 22B is another explanatory diagram for explaining the operation of the display unit shown in FIG. 20.

FIG. 22A illustrates operation of the respective sub-pixels 11 in the first half of one horizontal period (1H). FIG. 22B illustrates operation of the respective sub-pixels 11 in the second half of the one horizontal period (1H). In FIGS. 22A and 22B, the hatched sub-pixels 11 represent the sub-pixels 11 on which the writing operation and the Ids correction are performed. In this example, the sub-pixels 11 in every other row are driven in each of the first and second halves of the one horizontal period (1H).

As described above, in the display unit 1E, the Ids correction period is short. Therefore, the writing operation and the Ids correction operation are allowed to be performed on the plurality of sub-pixels 11 in a time-divisional manner in one horizontal period (1H).

Figure 23:
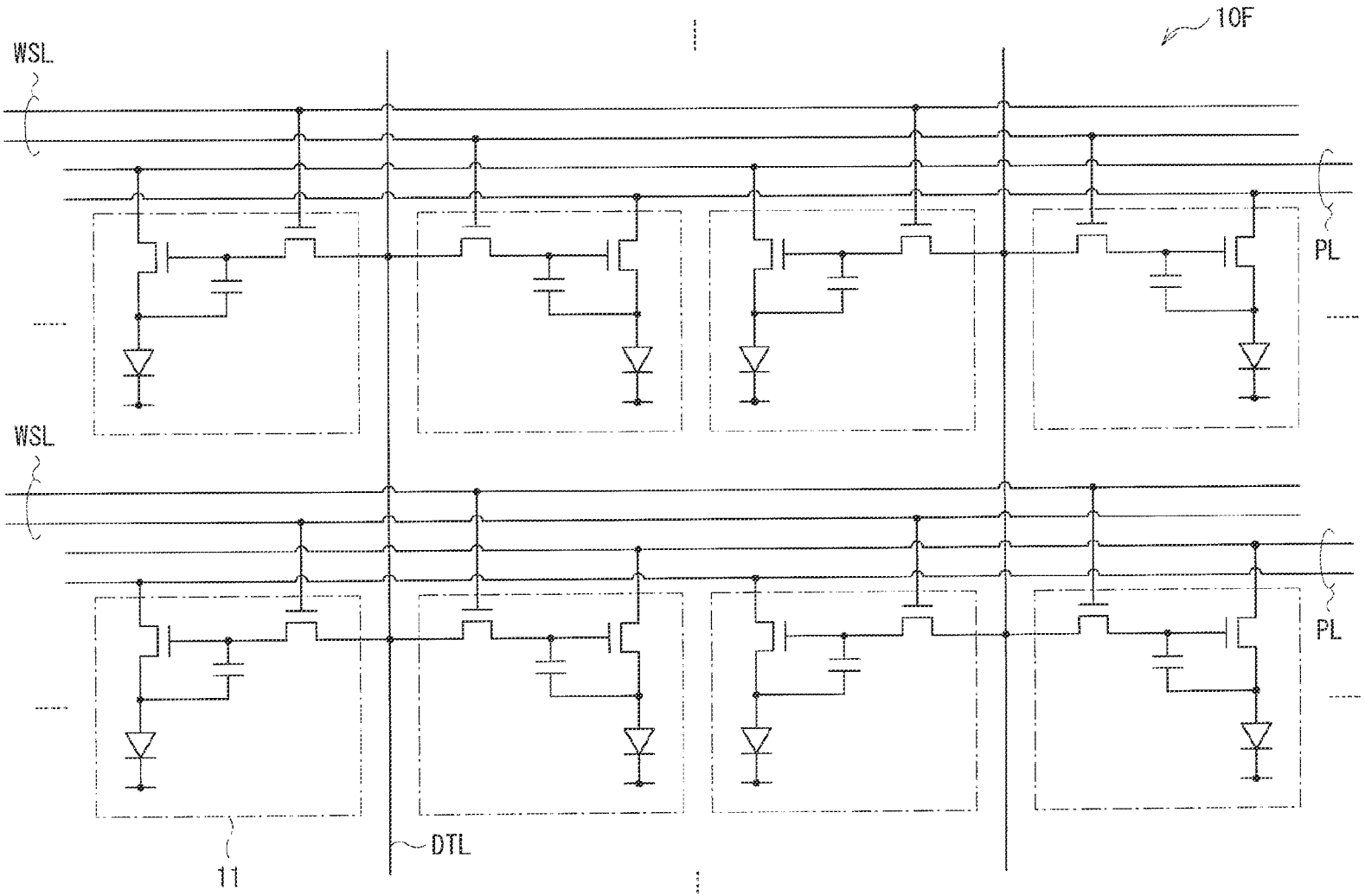
FIG. 23 is a circuit diagram illustrating a configuration example of a display section according to another modification of the first embodiment.
Figure 24A:
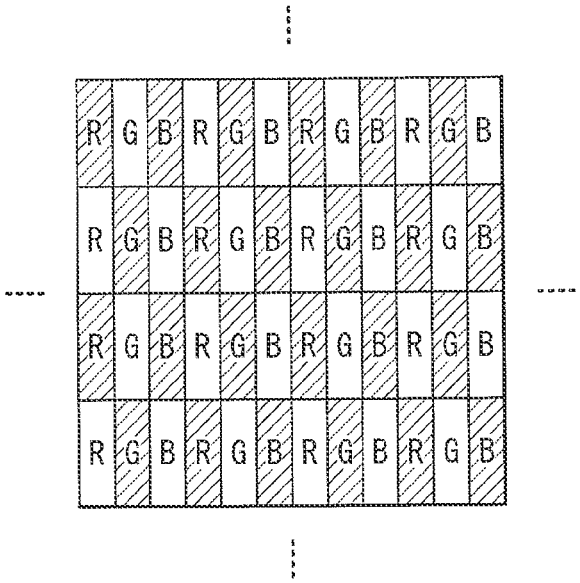
FIG. 24A is an explanatory diagram for explaining operation of a display unit shown in FIG. 23.
Figure 24B:
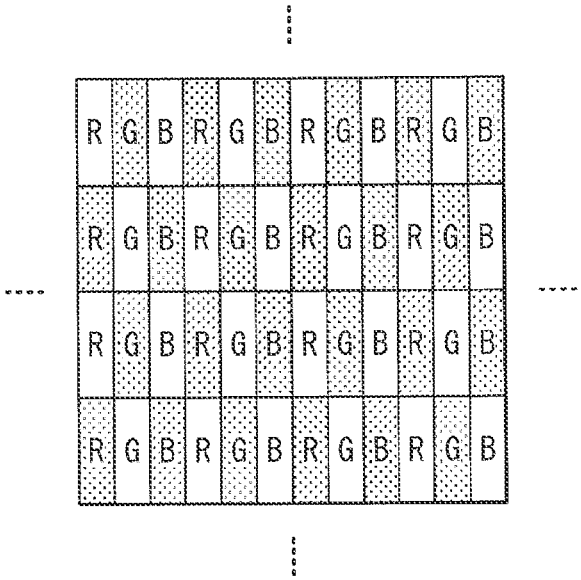
FIG. 24B is another explanatory diagram for explaining the operation of the display unit shown in FIG. 23.

In the above-described example, the scanning lines WSL and the power lines PL are connected to the sub-pixels 11 in the same manner in the respective rows. However, this is not limitative. Alternatively, for example, the scanning lines WSL and the power lines PL may be connected to the sub-pixels 11 in manners different between the respective rows as shown in FIG. 23. In this case, as shown in FIGS.

24A and 24B, the sub-pixels 11 are driven in a checkerboard-like pattern in the respective first and second halves of one horizontal period (1H).

Figure 25:
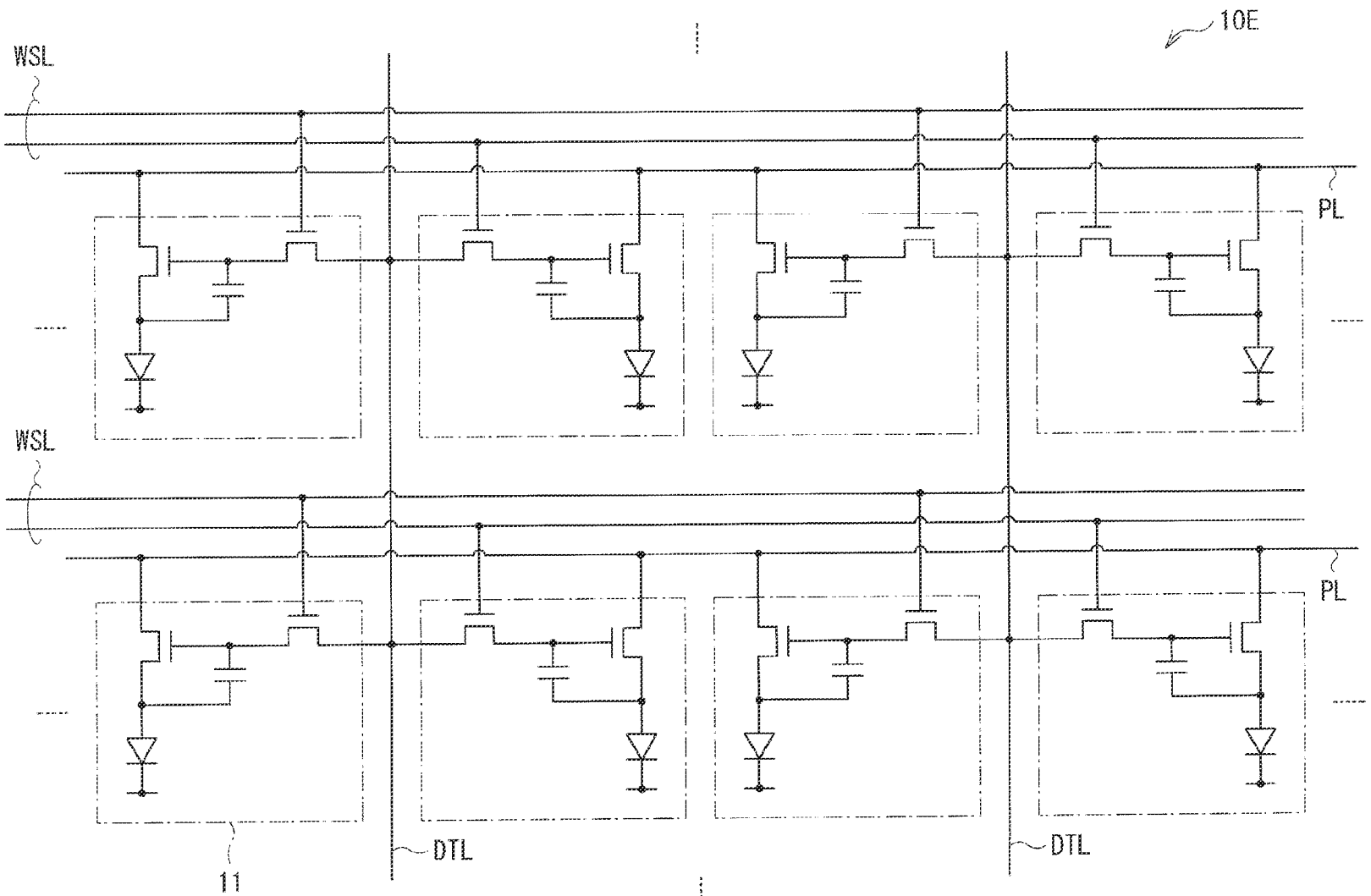
FIG. 25 is a circuit diagram illustrating a configuration example of a display section according to another modification of the first embodiment.
Figure 26:
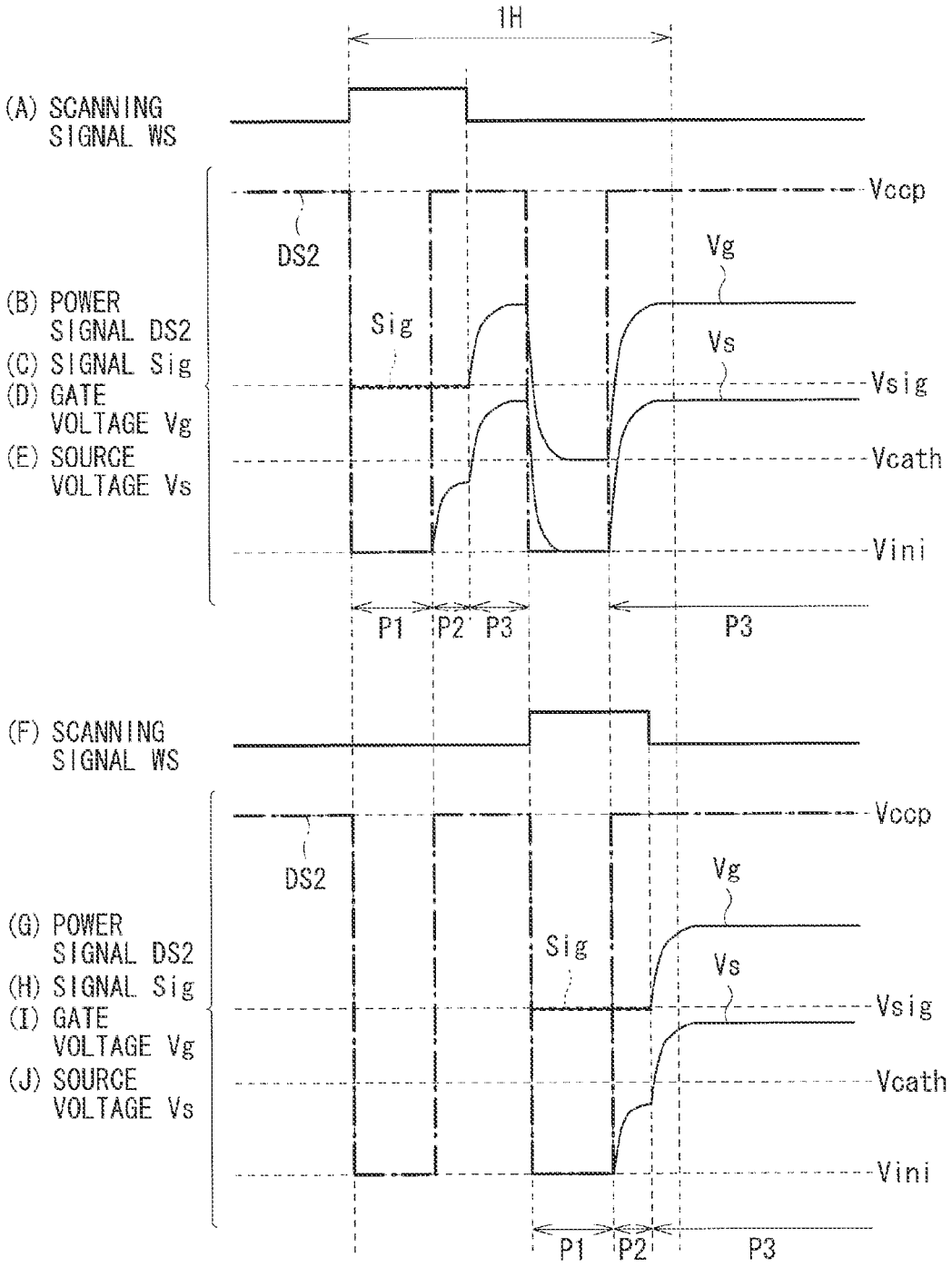
FIG. 26 is a timing waveform chart illustrating an operation example of a display unit shown in FIG. 25.

Moreover, in the above-described example, two power lines PL are included in each row. However, this is not limitative. Alternatively, for example, as shown in FIG. 25, one power line PL may be included in each row. In this case, as shown in FIG. 26, the two sub-pixels 11 that are adjacent to each other in the row direction may operate based on the common power signal DS2 (Parts (B) and (G) in FIG. 26). The voltage of the power signal DS2 becomes the voltage Vini in each of the write period P1 of each of the two sub-pixels 11 in one horizontal period (1H).

2. Second Embodiment

Next, a display unit 2 according to a second embodiment will be described. In the present embodiment, a voltage of a falling part of the waveform of the scanning signal WS is gradually decreased. It is to be noted that the same numerals are used to designate substantially the same components of the display unit 1 according to the above-described first embodiment, and the description thereof will be appropriately omitted.

As shown in FIG. 1, the display unit 2 includes a drive section 30. The drive section 30 includes a scanning line drive section 33. The scanning line drive section 33 sequentially applies the scanning signals WS to the plurality of scanning lines WSL in accordance with the control signal supplied from the timing generation section 22, thereby sequentially selecting the sub-pixels 11 for the respective rows, as with the scanning line drive section 23 according to the above-described first embodiment. At that time, the scanning line drive section 33 applies, to the scanning line WSL, the scanning signal WS that has a waveform in which the voltage of the falling part is decreased gradually.

Figure 27:
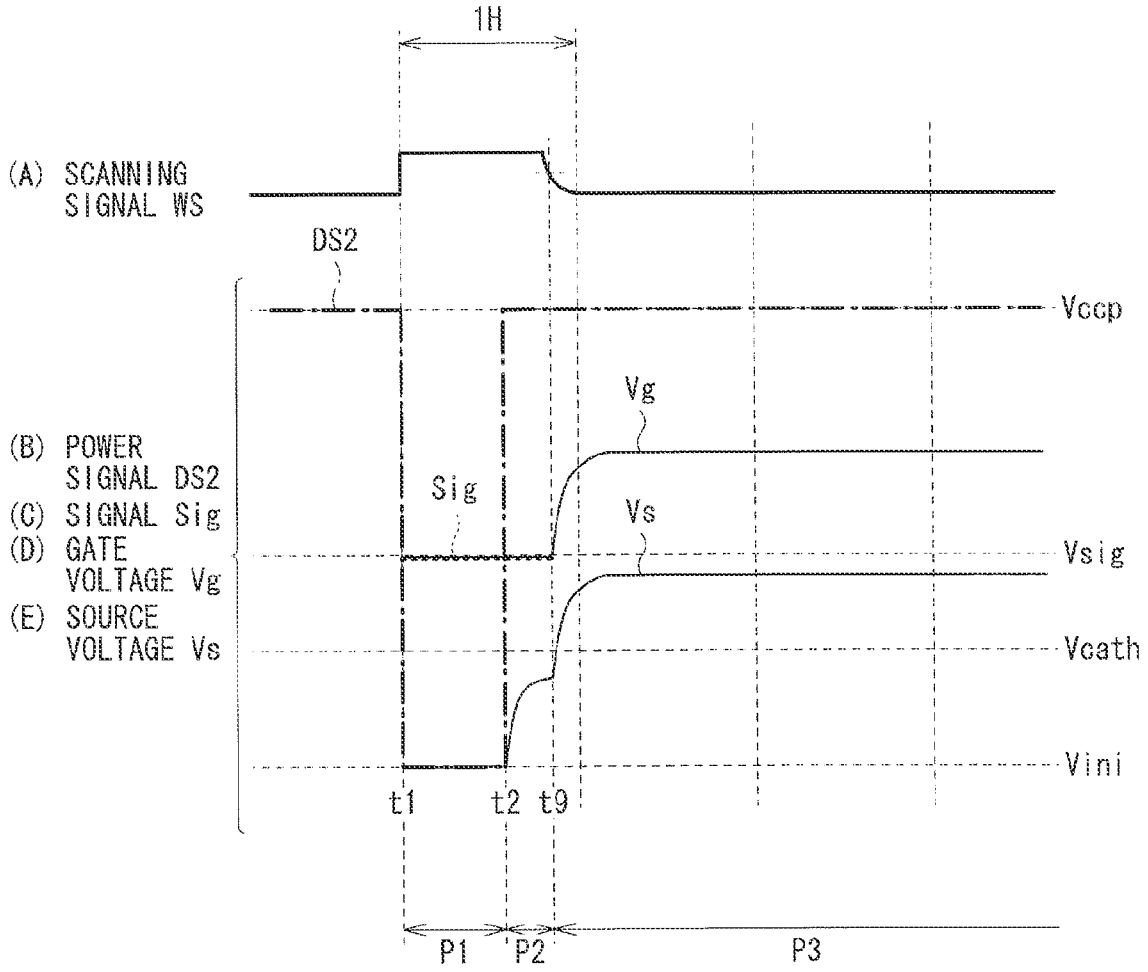
FIG. 27 is a timing waveform chart illustrating an operation example of a display unit according to a second embodiment.

FIG. 27 is a timing chart of display operation in the display unit 2. In FIG. 27, Part (A) shows the waveform of the scanning signal WS, Part (B) shows the waveform of the power signal DS2, Part (C) shows the waveform of the signal Sig, Part (D) shows the waveform of the gate voltage Vg of the drive transistor DRTr, and Part (E) shows the waveform of the source voltage Vs of the drive transistor DRTr.

First, the drive section 30 writes the pixel voltage Vsig in the sub-pixel 11 and initializes the sub-pixel 11 in the period (write period P1) from the timing t1 to the timing t2, as in the above-described first embodiment.

Next, the drive section 30 performs the Ids correction on the sub-pixel 11 in a period (Ids correction period P2) from the timing t2 to timing t9, as with the drive section 20 according to the above-described first embodiment. At that time, the scanning line drive section 33 generates the scanning signal WS that has the waveform in which the voltage of the falling part is decreased gradually (Part (A) in FIG. 27). Thus, the display unit 2 so operates as to allow the time length (from the timing t2 to the timing t9) of the Ids correction period P2 to be different depending on the level of the pixel voltage Vsig.

Figure 28:
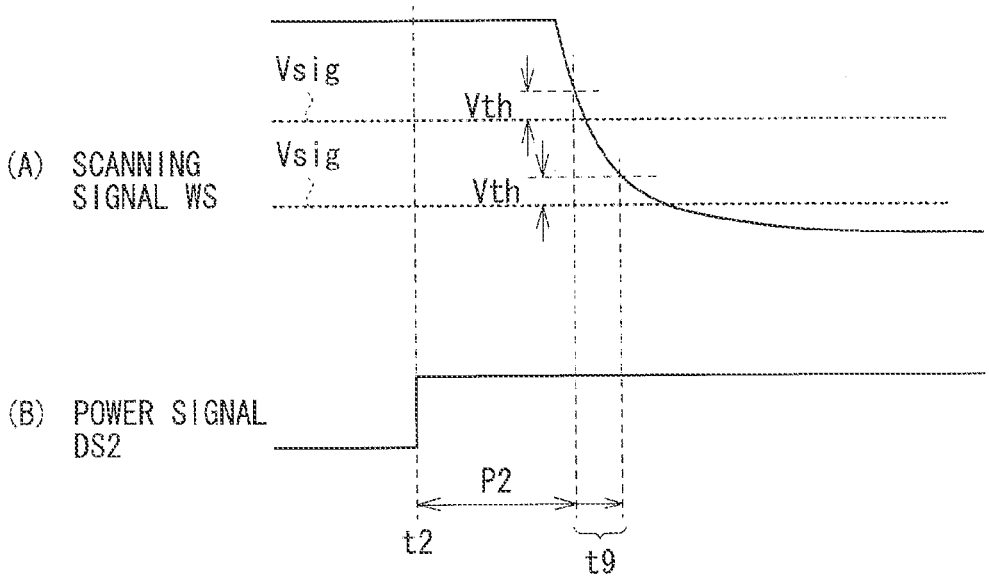
FIG. 28 is an explanatory diagram for explaining the operation of the display unit shown in FIG. 27.

FIG. 28 is a timing chart of the Ids correction operation. Part (A) shows the waveform of the scanning signal WS, and Part (B) shows the waveform of the power signal DS2. The write transistor WSTr is turned on when the voltage of the scanning signal WS is higher than (the pixel voltage Vsig+the threshold voltage Vth), and is turned off when the voltage of the scanning signal WS is lower than (the pixel voltage Vsig+the threshold voltage Vth). As shown in Part (A) in FIG. 28, the voltage of the scanning signal WS is decreased gradually upon falling. Therefore, the timing t9 at which the write transistor WSTr is switched from the ON state to the OFF state depends on the level of the pixel voltage Vsig. In other words, the time length of the Ids correction period P2 depends on the level of the pixel voltage Vsig. Specifically, the time period of the Ids correction period P2 becomes shorter as the level of the pixel voltage Vsig is increased, and becomes longer as the level of the pixel voltage Vsig is decreased.

After the Ids correction is completed, the drive section 30 allows the sub-pixel 11 to emit light in a period (light emission period P3) that begins from the timing t9, as in the above-described first embodiment.

As described above, in the display unit 2 is so configured that the voltage of the falling part of the waveform of the scanning signal WS is decreased gradually. Accordingly, image quality is improved as will be described below.

As shown in FIGS. 4 and 5, the variations in the current Ids has the local minimum value at a certain time t (for example, at time tw in the characteristics W2). The time period during which the variations in the current Ids take the local minimum value is varied in accordance with the pixel voltage Vsig.

Figure 29:
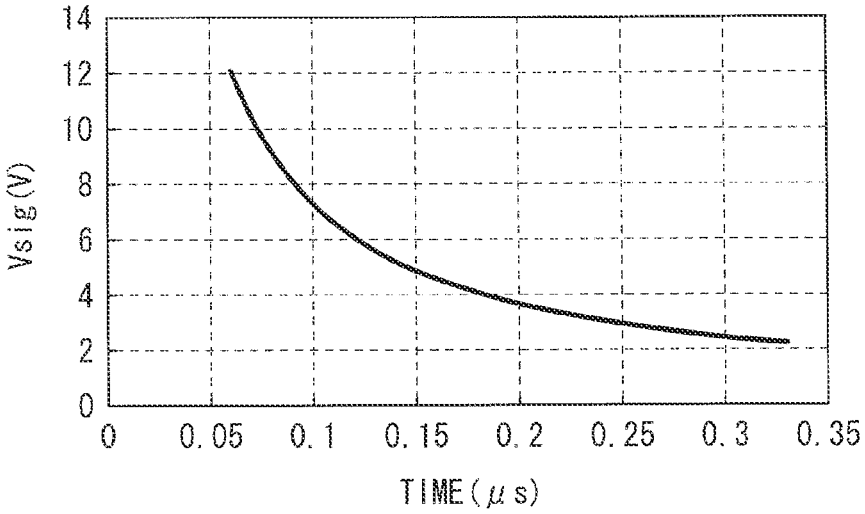
FIG. 29 is another explanatory diagram for explaining the operation of the display unit shown in FIG. 27.

FIG. 29 illustrates a relationship between the pixel voltage Vsig and the time period during which the variations in the current Ids takes the local minimum value. As shown in FIG. 29, the time period during which the variations in the current Ids take the local minimum value is shorter as the pixel voltage Vsig is higher and is longer as the pixel voltage Vsig is lower. Accordingly, when the time period of the Ids correction period P2 is reduced as the pixel voltage Vsig is higher and is increased as the pixel voltage Vsig is lower, the variations in the current Ids at the timing t9 is suppressed independently of the pixel voltage Vsig.

In the display unit 2, the voltage of the falling part of the scanning signal WS is decreased gradually in order to vary the time length of the Ids correction period P2 in accordance with the pixel voltage Vsig as described above. Specifically, the waveform of the falling part of the scanning signal WS is generated so that the characteristics shown in FIG. 29 are achieved. Accordingly, the variations in the current Ids are suppressed independently of the level of the pixel voltage Vsig, and thereby, degradation in image quality is suppressed.

It is to be noted that a method of generating such a waveform of the scanning signal WS is disclosed, for example, in Japanese Unexamined Patent Application Publication No. 2008-9198.

As described above, in the present embodiment, the voltage of the falling part of the scanning signal is decreased gradually. Therefore, degradation in image quality is suppressed. Other effects are similar to those in the above-described first embodiment.

[Modification 2-1]

In the above-described second embodiment, the scanning line drive section 33 that allows the voltage of the falling part of the scanning signal WS to be decreased gradually is applied to the display unit 1 according to the first embodiment. However, this is not limitative. Alternatively, for example, the scanning line drive section 33 may be applied to any of the display units according to Modifications 1-1 to 1-4 of the first embodiment.

3. Third Embodiment

Next, a display unit 3 according to a third embodiment will be described. The present embodiment is different from the display unit 1 according to the above-described first embodiment and the like in the specific method of the Ids correction. Specifically, in the display unit 1, the pixel voltage Vsig is applied to the gate of the drive transistor DRTr, and the source voltage is varied by the Ids correction. On the other hand, in the display unit 3 according to the present embodiment, the pixel voltage Vsig is applied to the source of the drive transistor, and the gate voltage is varied by the Ids correction. It is to be noted that the same numerals are used to designate substantially the same components of the display unit 1 according to the above-described first embodiment, and the description thereof will be appropriately omitted.

Figure 30:
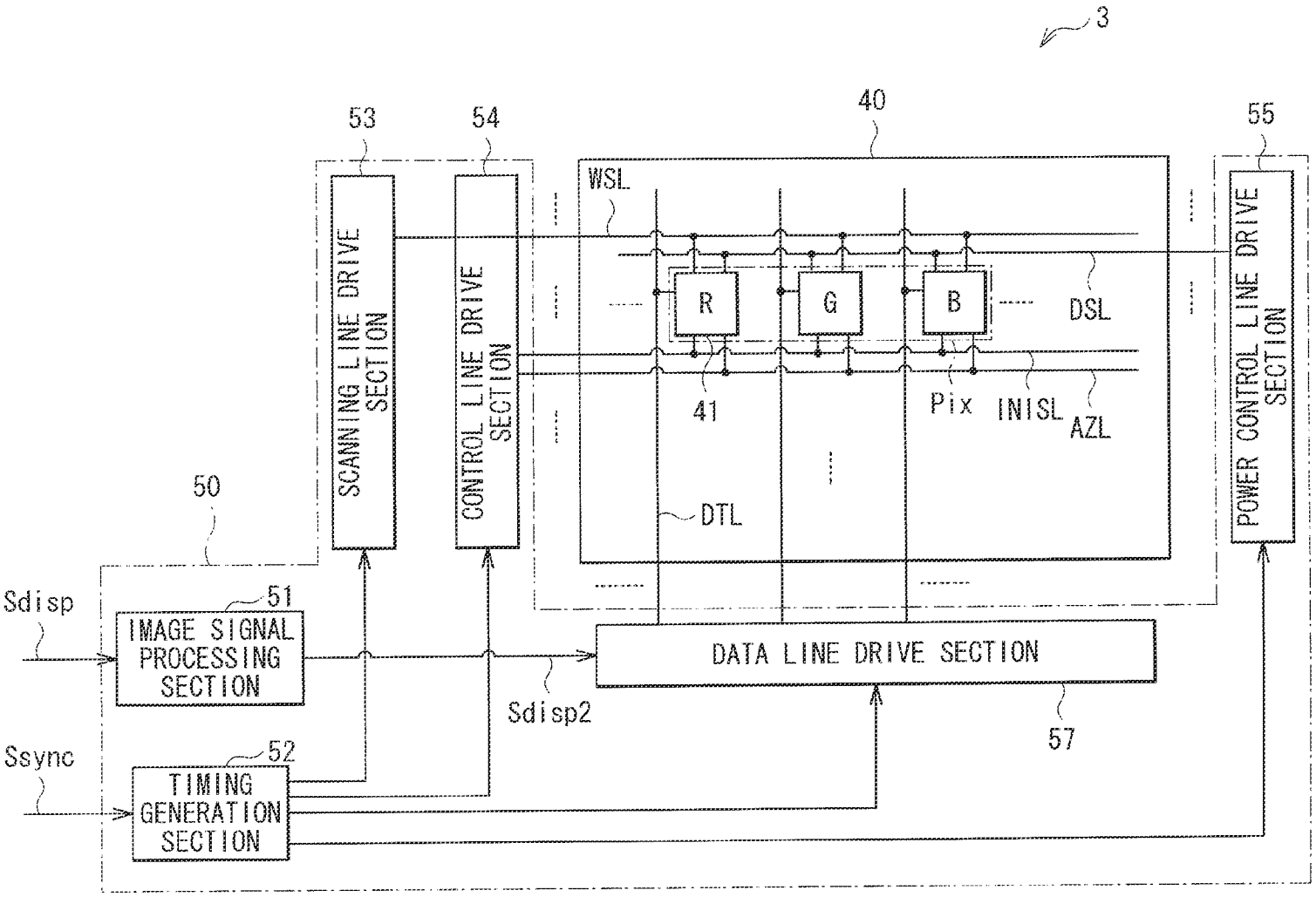
FIG. 30 is a block diagram illustrating a configuration example of a display unit according to a third embodiment.

FIG. 30 illustrates a configuration example of the display unit 3 according to the present embodiment. The display unit 3 includes a display section 40 and a drive section 50.

The display section 40 includes a plurality of sub-pixels 41, the scanning lines WSL, the power control lines DSL, control lines INISL and AZL, and the data lines DTL. The scanning lines WSL, the power control lines DSL, and the control lines INISL and AZL extend in the row direction. The data lines DTL extend in the column direction. One end of each of the scanning lines WSL, the power control lines DSL, the control lines INISL and AZL, and the data lines DTL is connected to the drive section 50.

Figure 31:
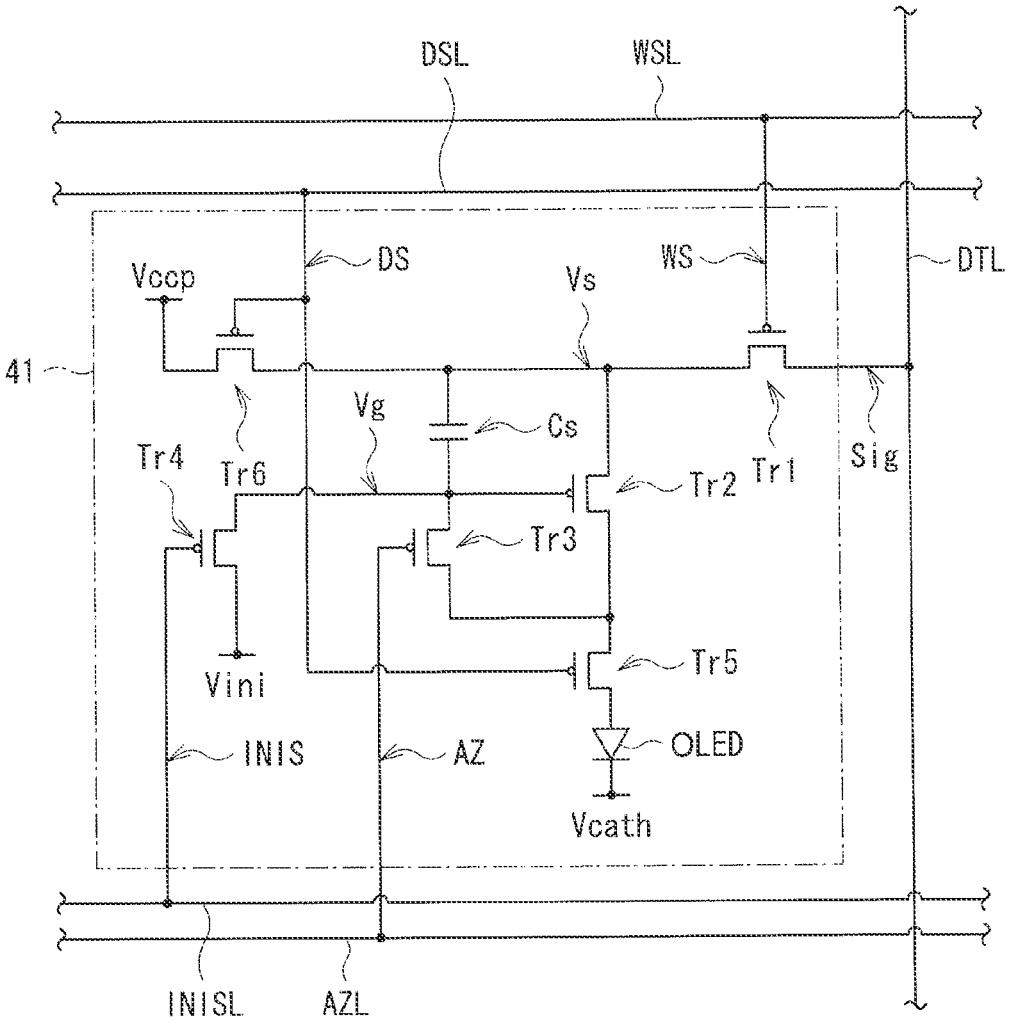
FIG. 31 is a circuit diagram illustrating a configuration example of a sub-pixel shown in FIG. 30.

FIG. 31 illustrates an example of a circuit configuration of the sub-pixel 41. The sub-pixel 41 includes a write transistor Tr1, a drive transistor Tr2, control transistors Tr3 and Tr4, power transistors Tr5 and Tr6, the organic EL device OLED, and the capacitor Cs. In other words, in this example, the sub-pixel 41 has a so-called "6Tr1C" configuration that includes six transistors (the write transistor Tr1, the drive transistor Tr2, the control transistors Tr3 and Tr4, the power transistors Tr5 and Tr6) and one capacitor Cs.

The write transistor Tr1, the drive transistor Tr2, the control transistors Tr3 and Tr4, and the power transistors Tr5 and Tr6 may each be configured, for example, of a TFT of a P-channel MOS type. A gate of the write transistor Tr1 is connected to the scanning line WSL, a source thereof is connected to the data line DTL, and a drain thereof is connected to a source of the drive transistor Tr2, the first end of the capacitor Cs, and the like. A gate of the drive transistor Tr2 is connected to the second end of the capacitor Cs and the like, the source thereof is connected to the drain of the write transistor Tr1, the first end of the capacitor Cs, and the like, and the drain thereof is connected to a drain of the control transistor Tr3 and a source of the power transistor Tr5. A gate of the control transistor Tr3 is connected to the control line AZL, a source thereof is connected to the second end of the capacitor Cs, the gate of the drive transistor Tr2 and the like, and the drain thereof is connected to the drain of the drive transistor Tr2 and the source of the power transistor Tr5. A gate of the control transistor Tr4 is connected to the control line INISL, a source thereof is connected to the second end of the capacitor Cs, the gate of the drive transistor Tr2, and the like, and a drain thereof is supplied with the voltage Vini by the drive section 50. A gate of the power transistor Tr5 is connected to the power control line DSL, the source thereof is connected to the drain of the drive transistor Tr2 and the drain of the control transistor Tr3, and a drain thereof is connected to the anode of the organic EL device OLED. A gate of the power transistor Tr6 is connected to the power control line DSL, a source thereof is supplied with the voltage Vccp by the drive section 50, and a drain thereof is connected to the first end of the capacitor Cs, the source of the drive transistor Tr2, and the like.

The first end of the capacitor Cs is connected to the source of the drive transistor Tr2 and the like, and the second end thereof is connected to the gate of the drive transistor Tr2 and the like. The anode of the organic EL device OLED is connected to the drain of the power transistor Tr5, and the cathode thereof is supplied with the cathode voltage Vcath by the drive section 50.

The drive transistor Tr2 corresponds to a specific but not limitative example of "first transistor" in one example of the present disclosure. The write transistor Tr1 corresponds to a specific but not limitative example of "sixth transistor" in one example of the present disclosure. The control transistor Tr3 corresponds to a specific but not limitative example of "seventh transistor" in one example of the present disclosure. The control transistor Tr4 corresponds to a specific but not limitative example of "eighth transistor" in one example of the present disclosure. The power transistor Tr5 corresponds to a specific but not limitative example of "ninth transistor" in one example of the present disclosure. The power transistor Tr6 corresponds to a specific but not limitative example of "tenth transistor" in one example of the present disclosure.

The drive section 50 drives the display section 40 based on the image signal Sdisp and the synchronization signal Ssync that are supplied from the outside, as with the drive section 20 according to the above-described first embodiment. The drive section 50 includes an image signal processing section 51, a timing generation section 52, a scanning line drive section 53, a control line drive section 54, a power control line drive section 55, and a data line drive section 57. The control line drive section 54 sequentially applies control signals INIS to the plurality of control lines INISL in accordance with a control signal supplied from the timing generation section 52, thereby controlling initialization operation of the sub-pixels 41 for the respective rows. Also, the control line drive section 54 sequentially applies control signals AZ to the plurality of control lines AZL in accordance with the control signal supplied from the timing generation section 52, thereby controlling the Ids correction operation of the sub-pixels 41 for the respective rows.

Figure 32:
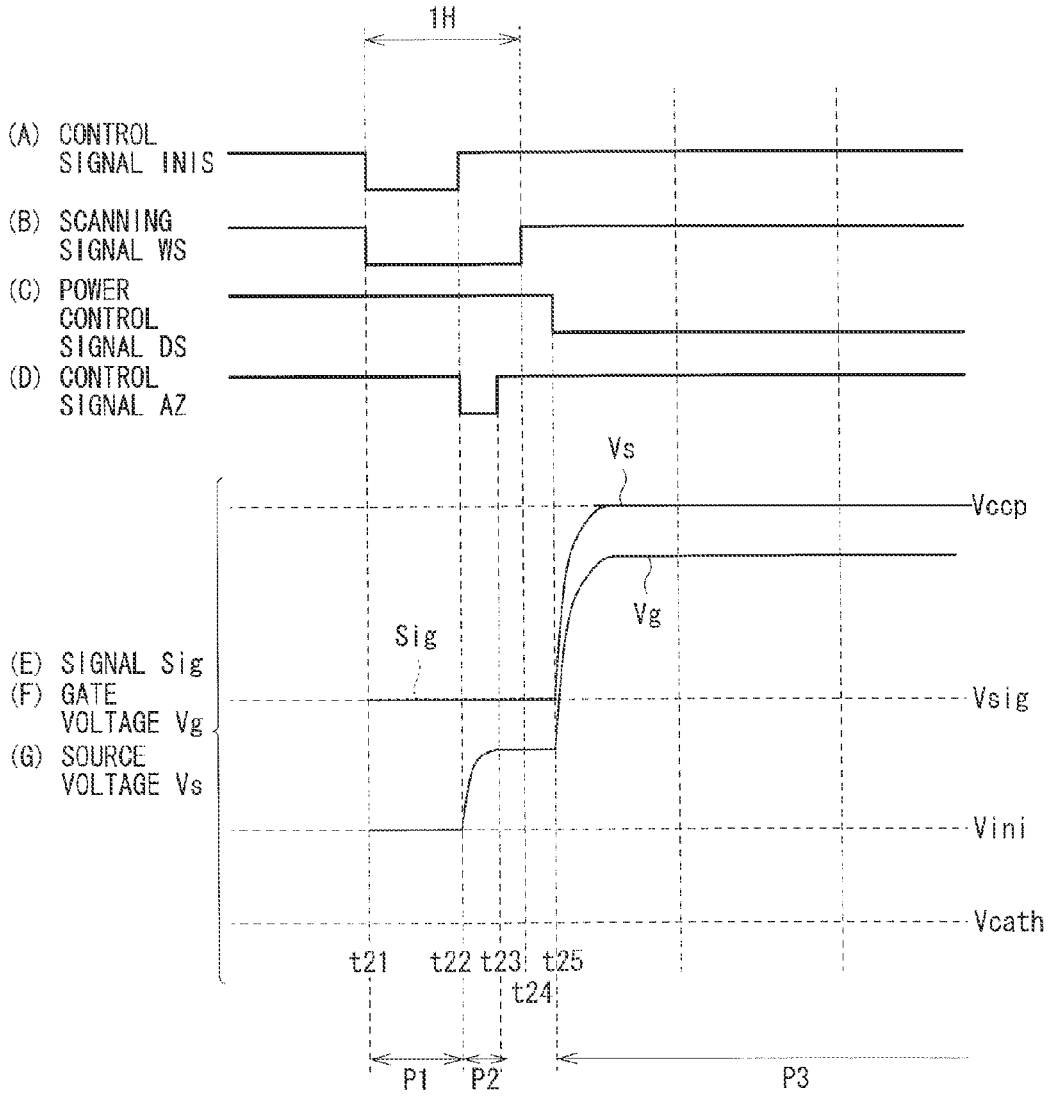
FIG. 32 is a timing waveform chart illustrating an operation example of the display unit shown in FIG. 30.

FIG. 32 is a timing chart of display operation in the display unit 3. In FIG. 32, Part (A) shows a waveform of the control signal INIS, Part (B) shows the waveform of the scanning signal WS, Part (C) shows the waveform of the power control signal DS, Part (D) shows a waveform of the control signal AZ, Part (E) shows the waveform of the signal Sig, Part (F) shows a waveform of a gate voltage Vg of the drive transistor Tr2, and Part (G) shows a waveform of a source voltage Vs of the drive transistor Tr2.

First, the drive section 50 writes the pixel voltage Vsig in the sub-pixel 41 and initializes the sub-pixel 41 in a period (write period P1) from timing t21 to timing t22. Specifically, first, at the timing t11, the data line drive section 57 sets the signal Sig to the pixel voltage Vsig (Part (E) in FIG. 32), and the scanning line drive section 53 allows the voltage of the scanning signal WS to be varied from a high level to a low level (Part (B) in FIG. 32). Accordingly, the write transistor Tr1 is turned on, and the source voltage Vs of the drive transistor Tr2 is set to the pixel voltage Vsig (Part (G) in FIG. 32). At the same time, the control line drive section 54 allows a voltage of the control signal INIS to be varied from a high level to a low level (Part (A) in FIG. 32). Accordingly, the control transistor Tr4 is turned on, and the gate voltage Vg of the drive transistor Tr2 is set to the voltage Vini (Part (F) in FIG. 32). Thus, the sub-pixel 41 is initialized.

Next, the drive section 50 performs the Ids correction on the sub-pixel 41 in a period (Ids correction period P2) from the timing t22 to timing t23. Specifically, first, at the timing t22, the control line drive section 54 allows the voltage of the control signal INIS to be varied from the low level to the high level (Part (A) in FIG. 32). Accordingly, the control transistor Tr4 is turned off. Further, at the same time, the control line drive section 54 allows the voltage of the control signal AZ to be varied from a high level to a low level (Part (D) in FIG. 32). Accordingly, the control transistor Tr3 is turned on. In other words, the drain and the gate of the drive transistor Tr2 are connected to each other through the control transistor Tr3 (a so-called "diode connection"). Accordingly, a current is flown from the source to the drain of the drive transistor Tr2, and thereby, the gate voltage Vg is increased (Part (F) in FIG. 32). Because the gate voltage Vg is thus increased, a current flown from the source to the drain of the drive transistor Tr2 is decreased. With this negative feedback operation, the gate voltage Vg is increased in a slower pace over time. A length of the time period (from the timing t22 to the timing t23) for performing this Ids correction is determined in order to suppress variations in the current that flows through the drive transistor Tr2 at the timing t23 as described in the above first embodiment.

Subsequently, at the timing t23, the control line drive section 54 allows the voltage of the control signal AZ to be varied from the low level to the high level (Part (D) in FIG. 32). Accordingly, the control transistor Tr3 is turned off, and the gate of the drive transistor Tr2 is placed in a floating state. Thereafter, the voltage between the terminals of the capacitor Cs, that is, a gate-source voltage Vgs between the gate and the source of the drive transistor Tr2 is maintained.

Subsequently, at timing t24, the scanning line drive section 53 allows the voltage of the scanning signal WS to be varied from the low level to the high level (Part (B) in FIG. 32). Accordingly, the write transistor Tr1 is turned off.

Subsequently, the drive section 50 allows the sub-pixel 41 to emit light in a period (light emission period P3) that begins from timing t25. Specifically, at the timing t25, the power control line drive section 55 allows the voltage of the power control signal DS to be varied from a high level to a low level (Part (C) in FIG. 32). Accordingly, the power transistors Tr5 and Tr6 are turned on, and thereby, the source voltage Vs of the drive transistor Tr2 is increased toward the voltage Vccp (Part (G) in FIG. 32) and the gate voltage Vg of the drive transistor Tr2 is also increased (Part (F) in FIG. 32). Accordingly, the drive transistor Tr2 is allowed to operate in a saturation region, and a current is flown through a path including the power transistor Tr6, the drive transistor Tr2, the power transistor Tr5, and the organic EL device OLED in order. Accordingly, the organic EL device OLED emits light.

Subsequently, in the display unit 3, the transition is made from the light emission period P3 to the write period P1 after a predetermined period (one frame period) has passed. The drive section 50 drives the sub-pixel 41 so that the above-described series of operation is repeated.

As described above, effects similar to those in the above-described embodiments and the like are obtainable also when the pixel voltage is applied to the source of the drive transistor and the gate voltage is varied by the Ids correction.

Moreover, in the present embodiment, the display section 40 is configured only of a PMOS transistor without using an NMOS transistor. Therefore, the display section 40 may be manufactured, for example, even in a process in which the NMOS transistor is not allowed to be manufactured, such as in an organic TFT (O-TFT) process.

[Modification 3-1]

For example, Modification 1-4 according to the first embodiment may be applied to the display unit 3 according to the above-described third embodiment.

4. Fourth Embodiment

Next, a display unit 6 according to a fourth embodiment will be described. The present embodiment is different from the display unit 1 according to the above-described first embodiment and the like in a correction method. It is to be noted that the same numerals are used to designate substantially the same components of the display unit 1 according to the above-described first embodiment, and the description thereof will be appropriately omitted.

As shown in FIGS. 1 and 2, the display unit 6 includes the display section 10 and a drive section 60. The display section 10 includes the sub-pixels 11 having the "2Tr1C" configuration. The drive section 60 includes a scanning line drive section 63, a power line drive section 66, and a data line drive section 67.

Figure 33:
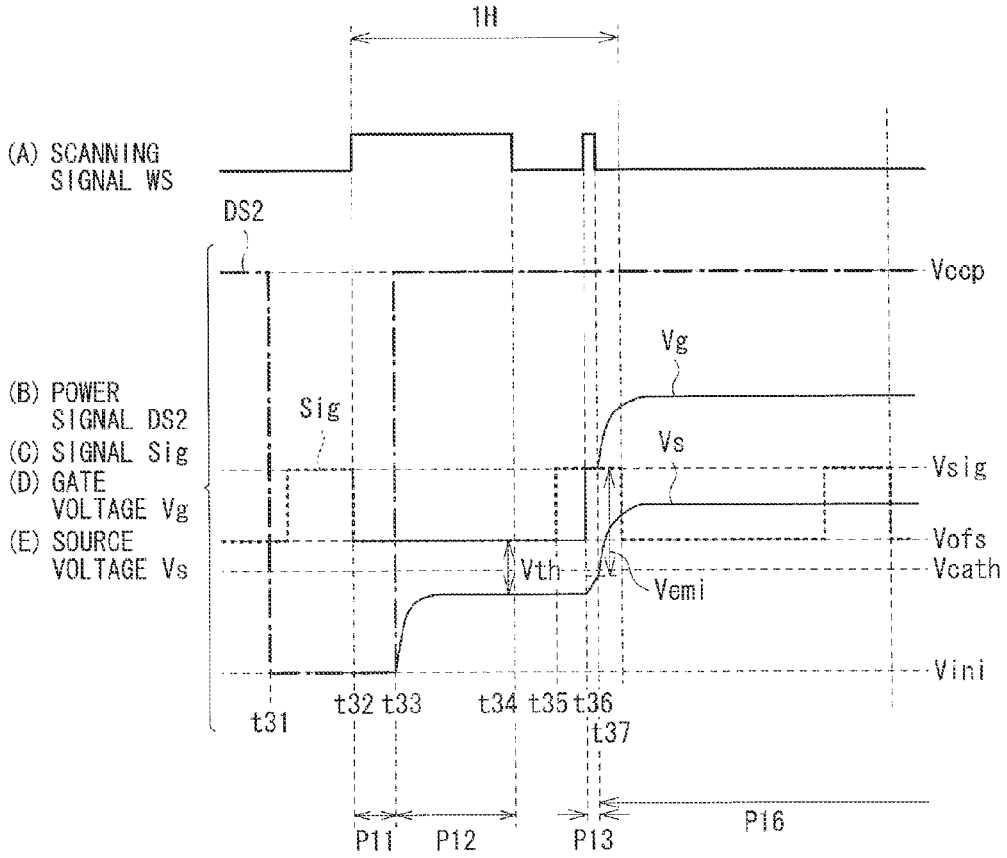
FIG. 33 is a timing waveform chart illustrating an operation example of a display unit according to a fourth embodiment.

FIG. 33 is a timing chart of display operation in the display unit 6. In FIG. 33, Part (A) shows the waveform of the scanning signal WS, Part (B) shows the waveform of the power signal DS2, Part (C) shows the waveform of the signal Sig, Part (D) shows the waveform of the gate voltage Vg of the drive transistor DRTr, and Part (E) shows the waveform of the source voltage Vs of the drive transistor DRTr.

The drive section 60 initializes the sub-pixel 11 (initialization period P11), performs Vth correction for suppressing the influence, on image quality, of the device variations in the drive transistors DRTr (Vth correction period P12), writes the pixel voltage Vsig in the sub-pixel 11, and performs μ (mobility) correction that is different from the above-described Vth correction (write-μ-correction period P13), in one horizontal period (1H). Thereafter, the organic EL device OLED in the sub-pixel 11 emits light with luminance in accordance with the written pixel voltage Vsig (light emission period P16). Details thereof will be described below.

First, at timing t31 prior to the initialization period P11, the power line drive section 66 allows the power signal DS2 to be varied from the voltage Vccp to the voltage Vini (Part (B) in FIG. 33). Accordingly, the drive transistor DRTr is turned on, and the source voltage Vs of the drive transistor DRTr is set to the voltage Vini (Part (E) in FIG. 33).

Subsequently, the drive section 60 initializes the sub-pixel 11 in a period (initialization period P11) from timing t32 to timing t33. Specifically, at the timing t32, the data line drive section 67 sets the signal Sig to the voltage Vofs (Part (C) in FIG. 33), and the scanning line drive section 63 allows the voltage of the scanning signal WS to be varied from a low level to a high level (Part (A) in FIG. 33). Accordingly, the write transistor WSTr is turned on, and the gate voltage Vg of the drive transistor DRTr is set to the voltage Vofs (Part (D) in FIG. 33). Thus, the gate-source voltage Vgs (=Vofs−Vini) between the gate and the source of the drive transistor DRTr is set to a voltage higher than the threshold voltage Vth of the drive transistor DRTr, and the sub-pixel 11 is initialized.

Next, the drive section 60 performs the Vth correction in a period (Vth correction period P12) from the timing t33 to timing t34. Specifically, at the timing t33, the power line drive section 66 allows the power signal DS2 to be varied from the voltage Vini to the voltage Vccp (Part (B) in FIG. 33). Accordingly, the drive transistor DRTr is allowed to operate in the saturation region, and thereby, the current Ids flows from the drain to the source and the source voltage Vs is increased (Part (E) in FIG. 33). At that time, the source voltage Vs is lower than the voltage Vcath at the cathode of the organic EL device OLED. Therefore, the organic EL device OLED retains the reverse bias state and a current does not flow into the organic EL device OLED. Because the source voltage Vs is thus increased, the gate-source voltage Vgs is decreased, and therefore, the current Ids is decreased. With this negative feedback operation, the current Ids is converged toward "0 (zero)". In other words, the gate-source voltage Vgs of the drive transistor DRTr is so converged as to be equal to the threshold voltage Vth of the drive transistor DRTr (Vgs=Vth).

Basic operation in the Vth correction period P12 is similar to the operation in the Ids correction period P2 according to the above-described first embodiment, and the gate-source voltage Vgs is decreased gradually over time as shown in Expression (3). At that time, in the Vth correction period P12, unlike in the Ids correction period P2 according to the above-described first embodiment, the negative feedback operation is performed until the gate-source voltage Vgs is almost converged. In other words, time length of the Vth correction period P12 is set to be longer than the time length of the Ids correction period P2.

Subsequently, at the timing t34, the scanning line drive section 63 allows the voltage of the scanning signal WS to be varied from the high level to the low level (Part (A) in FIG. 33). Accordingly, the write transistor WSTr is turned off. At the timing t35, the data line drive section 67 sets the signal Sig to the pixel voltage Vsig (Part (C) in FIG. 33).

Subsequently, the drive section 60 writes the pixel voltage Vsig in the sub-pixel 11 and performs the μ correction in a period (write-μ-correction period P13) from timing t36 to timing t37. Specifically, at the timing t36, the scanning line drive section 63 allows the voltage of the scanning signal WS to be varied from the low level to the high level (Part (A) in FIG. 33). Accordingly, the write transistor WSTr is turned on, and the gate voltage Vg of the drive transistor DRTr is increased from the voltage Vofs to the pixel voltage Vsig (Part (D) in FIG. 33). At this time, the gate-source voltage Vgs of the drive transistor DRTr becomes higher than the threshold voltage Vth (Vgs>Vth), and the current Ids is flown from the drain to the source. Therefore, the source voltage Vs of the drive transistor DRTr is increased (Part (E) in FIG. 33). With such negative feedback operation, influence of the device variations in the drive transistors DRTr is suppressed (μ correction), and the gate-source voltage Vgs of the drive transistor DRTr is set to a voltage Vemi in accordance with the pixel voltage Vsig.

It is to be noted that such a μ correction method is disclosed, for example, in Japanese Unexamined Patent Publication Application No. 2006-215213.

Subsequently, the drive section 60 allows the sub-pixel 11 to emit light in a period (light emission period P16) that begins from timing t37. Specifically, at the timing t37, the scanning line drive section 63 allows the voltage of the scanning signal WS to be varied from the high level to the low level (Part (A) in FIG. 33). Accordingly, the gate voltage Vg and the source voltage Vs of the drive transistor DRTr are increased (Parts (D) and (E) in FIG. 33) and the organic EL device OLED emits light, as in the light emission period P3 according to the above-described first embodiment.

As described above, in the present embodiment, both the Vth correction and the μ correction are performed. Therefore, degradation in image quality resulting from the device variations in the drive transistors is suppressed.

Moreover, in the present embodiment, the source voltage is increased in accordance with the device variations in the organic EL devices in the light emission period. Therefore, degradation in image quality resulting from the device variations in the organic EL devices is suppressed.

[Modification 4-1]

In the above-described fourth embodiment, both the Vth correction and the μ correction are performed on the display section 10 (FIGS. 1 and 2) that includes the sub-pixels 11 having the "2Tr1C" configuration. However, this is not limitative. Alternatively, both the Vth correction and the μ correction may be performed on the display section 10A (FIGS. 6 and 7) that includes the sub-pixels 11A having the "3Tr1C" configuration. A display unit 6A according to the present modification will be described below in detail.

As shown in FIGS. 6 and 7, the display unit 6A includes the display section 10A and a drive section 60A. The display section 10A includes the sub-pixels 11A having the "3Tr1C" configuration. The drive section 60A includes a scanning line drive section 63A, a power control line drive section 65A, a power line drive section 66A, and a data line drive section 67A.

Figure 34:
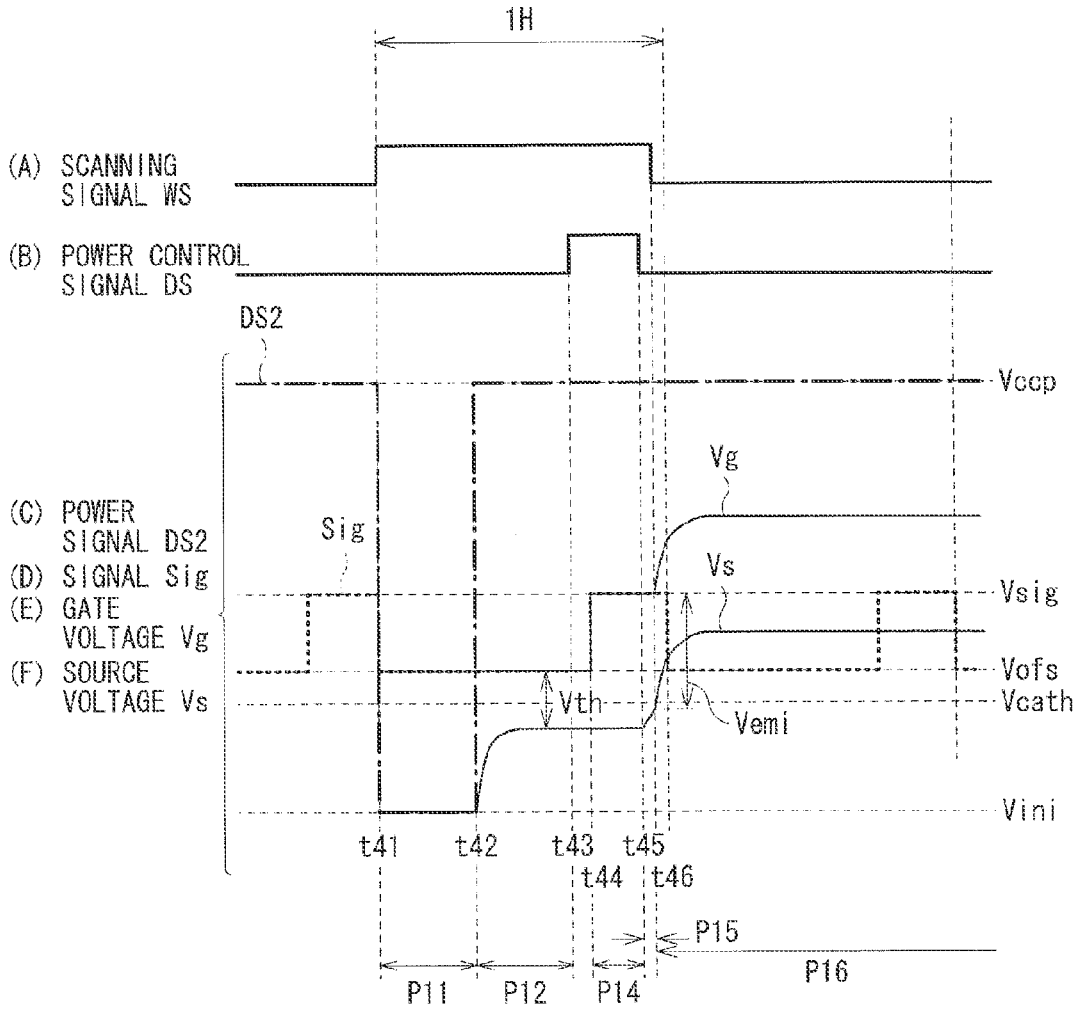
FIG. 34 is a timing waveform chart illustrating an operation example of a display unit according to a modification of the fourth embodiment.

FIG. 34 is a timing chart of display operation in the display unit 6A. In FIG. 34, Part (A) shows the waveform of the scanning signal WS, Part (B) shows the waveform of the power control signal DS, Part (C) shows the waveform of the power signal DS2, Part (D) shows the waveform of the signal Sig, Part (E) shows the waveform of the gate voltage Vg of the drive transistor DRTr, and Part (F) shows the waveform of the source voltage Vs of the drive transistor DRTr.

First, the drive section 60A initializes the sub-pixel 11A in a period (initialization period P11) from timing t41 to timing t42. Specifically, first, at the timing t41, the data line drive section 67A sets the signal Sig to the voltage Vofs (Part (D) in FIG. 34), and the scanning line drive section 63A allows the voltage of the scanning signal WS to be varied from a low level to a high level (Part (A) in FIG. 34). At the same time, the power line drive section 66A allows the power signal DS2 to be varied from the voltage Vccp to the voltage Vini (Part (C) in FIG. 34). Accordingly, the gate voltage Vg of the drive transistor DRTr is set to the voltage Vofs (Part (E) in FIG. 34), and the source voltage Vs of the drive transistor DRTr is set to the voltage Vini (Part (F) in FIG. 34). Thus, the sub-pixel 11A is initialized.

Subsequently, the drive section 60A performs the Vth correction in a period (Vth correction period P12) from the timing t42 to timing t43, as in the above-described fourth embodiment.

Subsequently, at the timing t43, the power control line drive section 65A allows the voltage of the power control signal DS to be varied from a low level to a high level (Part (B) in FIG. 34). Accordingly, the power transistor DSTr is turned off.

Subsequently, the drive section 60A writes the pixel voltage Vsig in the sub-pixel 11A in a period (write period P14) from timing t44 to timing t45. Specifically, at the timing t44, the data line drive section 67A sets the signal Sig to the pixel voltage Vsig (Part (D) in FIG. 34). Accordingly, the gate voltage Vg of the drive transistor DRTr is increased from the voltage Vofs to the pixel voltage Vsig (Part (E) in FIG. 34). Accordingly, the gate-source voltage Vgs of the drive transistor DRTr becomes higher than the threshold voltage Vth (Vgs>Vth).

Subsequently, the drive section 60A performs the μ correction in a period (μ correction period P15) from the timing t45 to timing t46. Specifically, at the timing t45, the power control line drive section 65A allows the voltage of the power control signal DS to be varied from the high level to the low level (Part (B) in FIG. 34). Accordingly, the power transistor DSTr is turned on, and the current Ids is flown from the drain to the source. Therefore, the source voltage Vs of the drive transistor DRTr is increased (Part (F) in FIG. 34). Through the operation described above, the μ correction is performed.

Effects similar to those in the above-described fourth embodiment are obtainable also in such a configuration.

[Modification 4-2]

Moreover, for example, both the Vth correction and the μ correction may be performed on the display section 10B (FIGS. 9 and 10) that includes the sub-pixels 11B having the "4Tr1C" configuration. A display unit 6B according to the present modification will be described below in detail.

As shown in FIGS. 9 and 10, the display unit 6B includes the display section 10B and a drive section 60B. The display section 10B includes the sub-pixels 11B having the "4Tr1C" configuration. The drive section 60B includes a scanning line drive section 63B, a control line drive section 64B, a power control line drive section 65B, and a data line drive section 67B.

Figure 35:
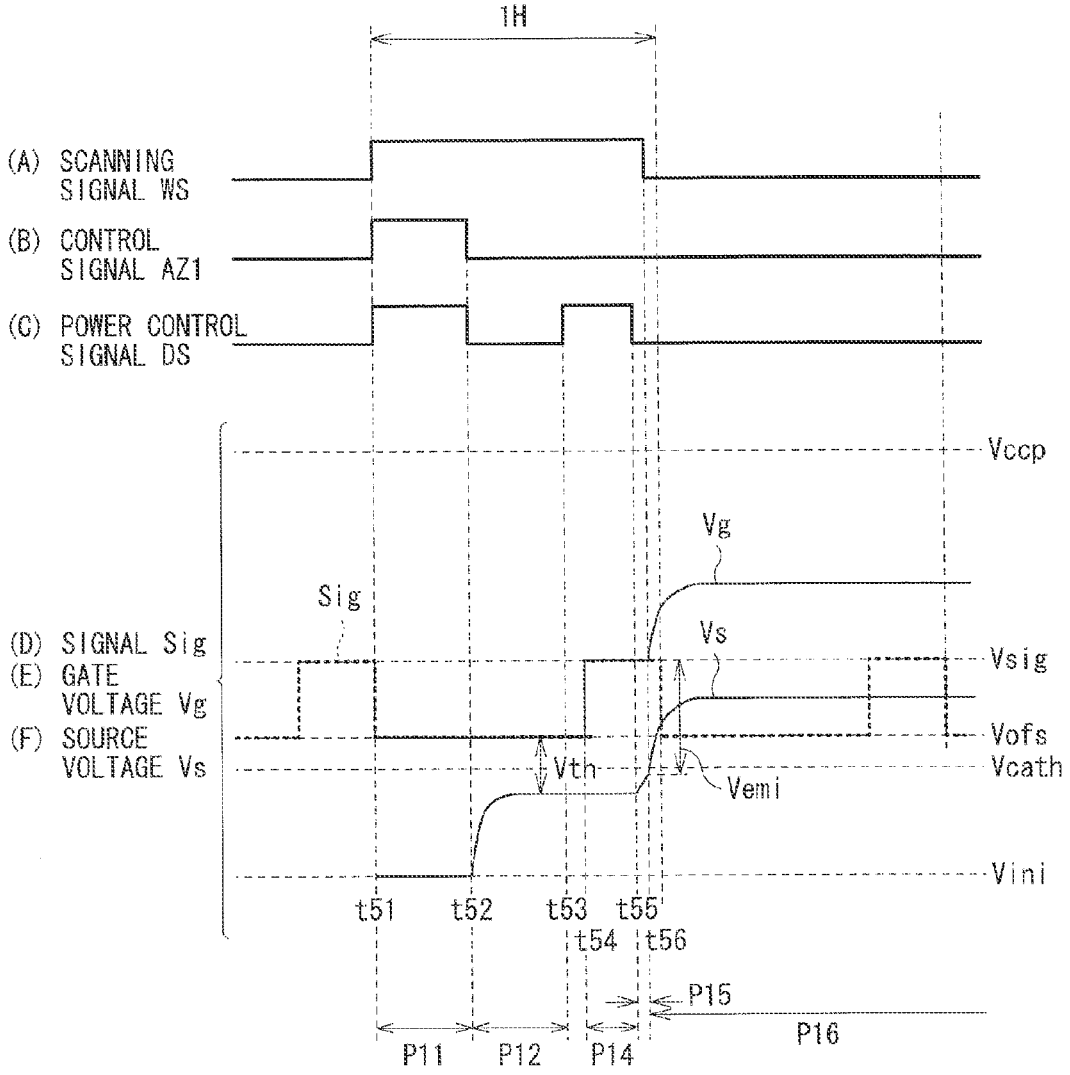
FIG. 35 is a timing waveform chart illustrating an operation example of a display unit according to another modification of the fourth embodiment.

FIG. 35 is a timing chart of display operation in the display unit 6B. In FIG. 35, Part (A) shows the waveform of the scanning signal WS, Part (B) shows the waveform of the control signal AZ1, Part (C) shows the waveform of the power control signal DS, Part (D) shows the waveform of the signal Sig, Part (E) shows the waveform of the gate voltage Vg of the drive transistor DRTr, and Part (F) shows the waveform of the source voltage Vs of the drive transistor DRTr.

First, the drive section 60B initializes the sub-pixel 11B in a period (initialization period P11) from timing t51 to timing t52. Specifically, first, at the timing t51, the data line drive section 67B sets the signal Sig to the voltage Vofs (Part (D) in FIG. 35), and the scanning line drive section 63B allows the voltage of the scanning signal WS to be varied from a low level to a high level (Part (A) in FIG. 35). At the same time, the control line drive section 64B allows the voltage of the control signal AZ1 to be varied from a low level to a high level (Part (B) in FIG. 35), and the power control line drive section 65B allows the voltage of the power control signal DS to be varied from a low level to a high level (Part (C) in FIG. 35). Accordingly, the gate voltage Vg of the drive transistor DRTr is set to the voltage Vofs (Part (E) in FIG. 35), and the source voltage Vs of the drive transistor DRTr is set to the voltage Vini (Part (F) in FIG. 35). Thus, the sub-pixel 11B is initialized.

Subsequently, the drive section 60B performs the Vth correction in a period (Vth correction period P12) from the timing t52 to timing t53. Specifically, the control line drive section 64B allows the voltage of the control signal AZ1 to be varied from the high level to the low level (Part (B) in FIG. 35), and the power control line drive section 65B allows the voltage of the power control signal DS to be varied from the high level to the low level (Part (C) in FIG. 35). Accordingly, the control transistor AZ1 is turned off, and the power transistor DSTr is turned on. Thus, the Vth correction is performed as in the above-described fourth embodiment.

Subsequently, at timing t54, the power control line drive section 65B allows the voltage of the power control signal DS to be varied from the low level to the high level (Part (C) in FIG. 35). Accordingly, the power transistor DSTr is turned off.

Subsequently, the drive section 60B writes the pixel voltage Vsig in the sub-pixel 11B in a period (write period P14) from the timing t54 to timing t55, and performs the μ correction in a period (μ correction period P15) from the timing t54 to the timing t55, as in the above-described Modification 4-1.

Effects similar to those in the above-described fourth embodiment are obtainable also in such a configuration.

[Modification 4-3]

Moreover, for example, both the Vth correction and the μ correction may be performed on the display section 10C (FIGS. 13 and 14) that includes the sub-pixels 11C having the "4Tr1C" configuration. A display unit 6C according to the present modification will be described below in detail.

As shown in FIGS. 13 and 14, the display unit 6C includes the display section 10C and a drive section 60C. The display section 10C includes the sub-pixels 11C having the "4Tr1C" configuration. The drive section 60C includes a scanning line drive section 63C, a control line drive section 64C, a power control line drive section 65C, a power line drive section 66C, and a data line drive section 67C.

Figure 36:
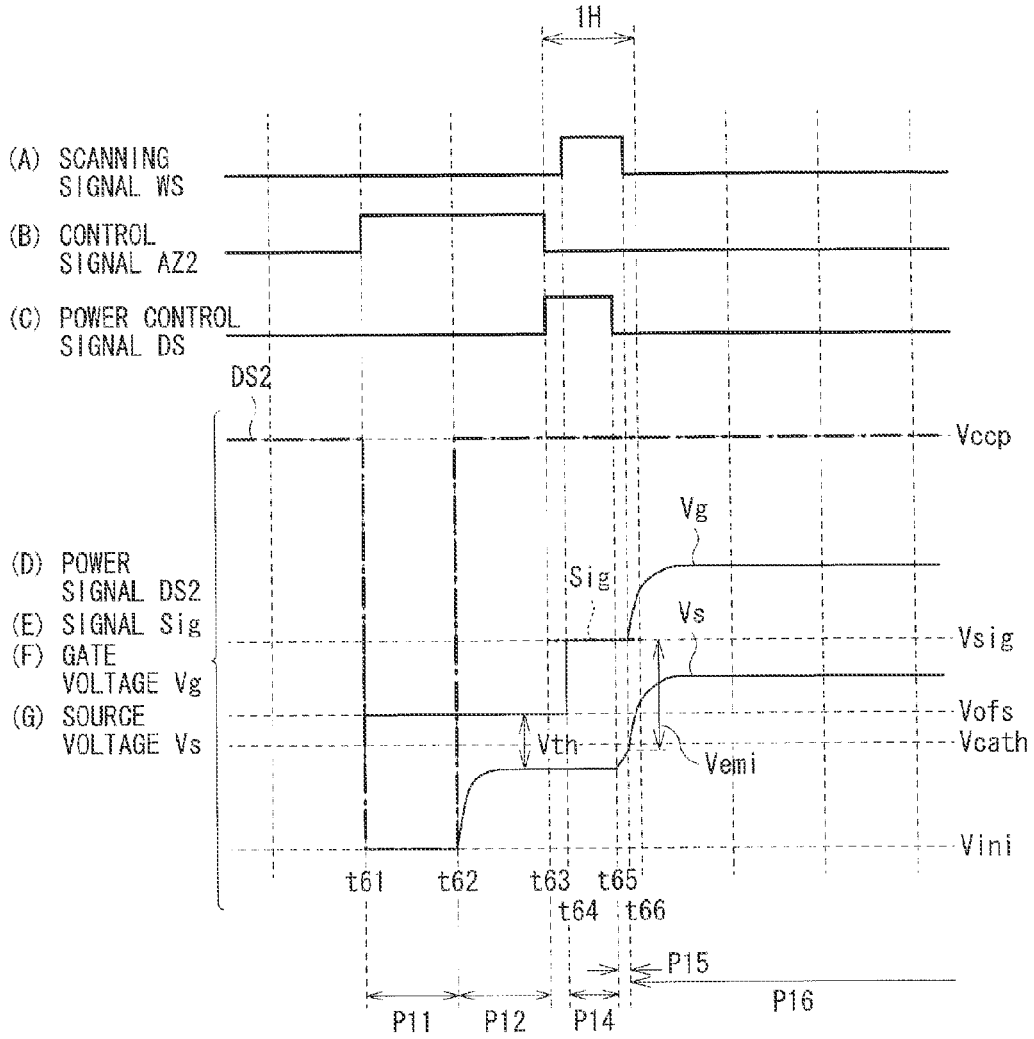
FIG. 36 is a timing waveform chart illustrating an operation example of a display unit according to another modification of the fourth embodiment.

FIG. 36 is a timing chart of display operation in the display unit 6C. In FIG. 36, Part (A) shows the waveform of the scanning signal WS, Part (B) shows the waveform of the control signal AZ2, Part (C) shows the waveform of the power control signal DS, Part (D) shows the waveform of the power signal DS2, Part (E) shows the waveform of the signal Sig, Part (F) shows the waveform of the gate voltage Vg of the drive transistor DRTr, and Part (G) shows the waveform of the source voltage Vs of the drive transistor DRTr.

First, the drive section 60C initializes the sub-pixel 11C in a period (initialization period P11) from timing t61 to timing t62. Specifically, first, at the timing t61, the control line drive section 64C allows the voltage of the control signal AZ2 to be varied from a low level to a high level (Part (B) in FIG. 36). Accordingly, the control transistor AZ2Tr is turned on, and the gate voltage Vg of the drive transistor DRTr is set to the voltage Vofs (Part (F) in FIG. 36). At the same time, the power line drive section 66C allows the power signal DS2 to be varied from the voltage Vccp to the voltage Vini (Part (D) in FIG. 36). Accordingly, the drive transistor DRTr is turned on, and the source voltage Vs of the drive transistor DRTr is set to the voltage Vini (Part (G) in FIG. 36). Thus, the sub-pixel 11C is initialized.

Subsequently, the drive section 60C performs the Vth correction in a period (Vth correction period P12) from the timing t62 and timing t63, as in the above-described fourth embodiment.

Subsequently, at the timing t63, the control drive section 64C allows the voltage of the control signal AZ2 to be varied from the high level to the low level (Part (B) in FIG. 36), and the power control line drive section 65C allows the voltage of the power control signal DS to be varied from a low level to a high level (Part (C) in FIG. 36). Accordingly, the control transistor AZ2Tr is turned off, and the power transistor DSTr is turned off.

Subsequently, the drive section 60C writes the pixel voltage Vsig in the sub-pixel 11C in a period (write period P14) from timing t64 to timing t65. Specifically, at the timing t64, the data line drive section 67C sets the signal Sig to the pixel voltage Vsig (Part (E) in FIG. 36), and the scanning line drive section 63C allows the voltage of the scanning signal WS to be varied from a low level to a high level (Part (A) in FIG. 36). Accordingly, the write transistor WSTr is turned on, and the gate voltage Vg of the drive transistor DRTr is increased from the voltage Vofs to the pixel voltage Vsig (Part (F) in FIG. 36). Accordingly, the gate-source voltage Vgs of the drive transistor DRTr becomes higher than the threshold voltage Vth (Vgs>Vth).

Subsequently, the drive section 60C performs the μ correction in a period (μ correction period P15) from the timing t65 to timing t66 as in the above-described Modification 4-1.

Effects similar to those in the above-described fourth embodiment are obtainable also with such a configuration.

[Modification 4-4]

Moreover, for example, both the Vth correction and the μ correction may be performed on the display section 10D (FIGS. 17 and 18) that includes the sub-pixels 11D having the "5Tr1C" configuration. A display unit 6D according to the present modification will be described below in detail.

As shown in FIGS. 17 and 18, the display unit 6D includes the display section 10D and a drive section 60D. The display section 10D includes the sub-pixels 11D having the "5Tr1C" configuration. The drive section 60D includes a scanning line drive section 63D, a control line drive section 64D, a power control line drive section 65D, and a data line drive section 67D.

Figure 37:
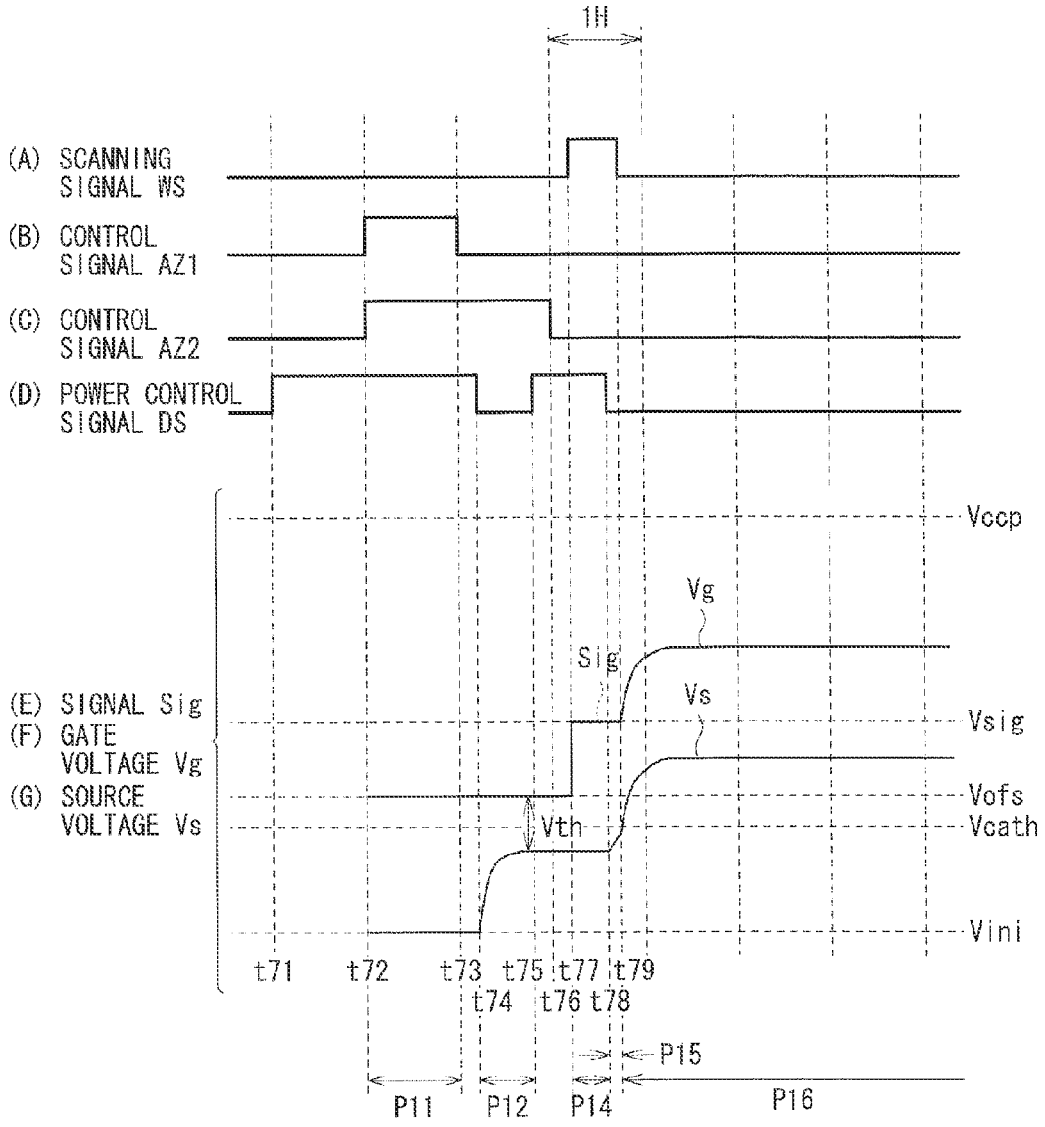
FIG. 37 is a timing waveform chart illustrating an operation example of a display unit according to another modification of the fourth embodiment.

FIG. 37 is a timing chart of display operation in the display unit 6D. In FIG. 37, Part (A) shows the waveform of the scanning signal WS, Part (B) shows the waveform of the control signal AZ1, Part (C) shows the waveform of the control signal AZ2, Part (D) shows the waveform of the power control signal DS, Part (E) shows the waveform of the signal Sig, Part (F) shows the waveform of the gate voltage Vg of the drive transistor DRTr, and Part (G) shows the waveform of the source voltage Vs of the drive transistor DRTr.

First, at timing t71 prior to the initialization period P11, the power control line drive section 65D allows the voltage of the power control signal DS to be varied from a low level to a high level (Part (D) in FIG. 37). Accordingly, the power transistor DSTr is turned off.

Subsequently, the drive section 60D initializes the sub-pixel 11D in a period (initialization period P11) from timing t72 to timing t73. Specifically, first, at the timing t72, the control line drive section 64D allows the voltage of the control signal AZ1 to be varied from a low level to a high level (Part (B) in FIG. 37), and allows the voltage of the control signal AZ2 to be varied from a low level to a high level (Part (C) in FIG. 37). Accordingly, the control transistor AZ1Tr is turned on, and the source voltage Vs of the drive transistor DRTr is set to the voltage Vini (Part (G) in FIG. 37). Also, the control transistor AZ2Tr is turned on, and the gate voltage Vg of the drive transistor DRTr is set to the voltage Vofs (Part (F) in FIG. 37). Thus, the sub-pixel 11D is initialized.

Subsequently, at the timing t73, the control line drive section 64D allows the voltage of the control signal AZ1 to be varied from the high level to the low level (Part (B) in FIG. 37). Accordingly, the control transistor AZ1Tr is turned off.

Subsequently, the drive section 60D performs the Vth correction in a period (Vth correction period P12) from timing t74 to timing t75. Specifically, at the timing t74, the power control line drive section 65D allows the voltage of the power control signal DS to be varied from the high level to the low level (Part (D) in FIG. 37). Thus, the Vth correction is performed as in the above-described fourth embodiment.

Subsequently, at the timing t75, the power control line drive section 65D allows the voltage of the power control signal DS to be varied from the low level to the high level (Part (D) in FIG. 37). Further, at the timing t76, the control line drive section 64D allows the voltage of the control signal AZ2 to be varied from the high level to the low level (Part (C) in FIG. 37).

Subsequently, the drive section 60D writes the pixel voltage Vsig in the sub-pixel 11D in a period (write period P14) from timing t77 to timing t78. Specifically, at the timing t77, the data line drive section 67D sets the signal Sig to the pixel voltage Vsig (Part (E) in FIG. 37), and the scanning line drive section 63D allows the voltage of the scanning signal WS to be varied from a low level to a high level (Part (A) in FIG. 37). Accordingly, the write transistor WSTr is turned on, and the gate voltage Vg of the drive transistor DRTr is increased from the voltage Vofs to the pixel voltage Vsig (Part (F) in FIG. 37). Accordingly, the gate-source voltage Vgs of the drive transistor DRTr becomes higher than the threshold voltage Vth (Vgs>Vth).

Subsequently, the drive section 60D performs the μ correction in a period from the timing t78 to timing t79 (μ correction period P15) as in the above-described Modification 4-1.

Effects similar to those in the above-described fourth embodiment are obtainable also with such a configuration.

5. Fifth Embodiment

Next, a display unit 7A according to a fifth embodiment will be described. The present embodiment is a display unit that eliminates the μ correction and performs only the Vth correction in the display unit 6 according to the above-described fourth embodiment. It is to be noted that the same numerals are used to designate substantially the same components of the display unit 6 according to the above-described fourth embodiment etc., and the description thereof will be appropriately omitted.

As shown in FIGS. 6 and 7, the display unit 7A includes the display section 10A and a drive section 70A. The display section 10A includes sub-pixels 11A having the "3Tr1C" configuration. The drive section 70A includes a scanning line drive section 73A, a power control line drive section 75A, a power line drive section 76A, and a data line drive section 77A.

Figure 38:
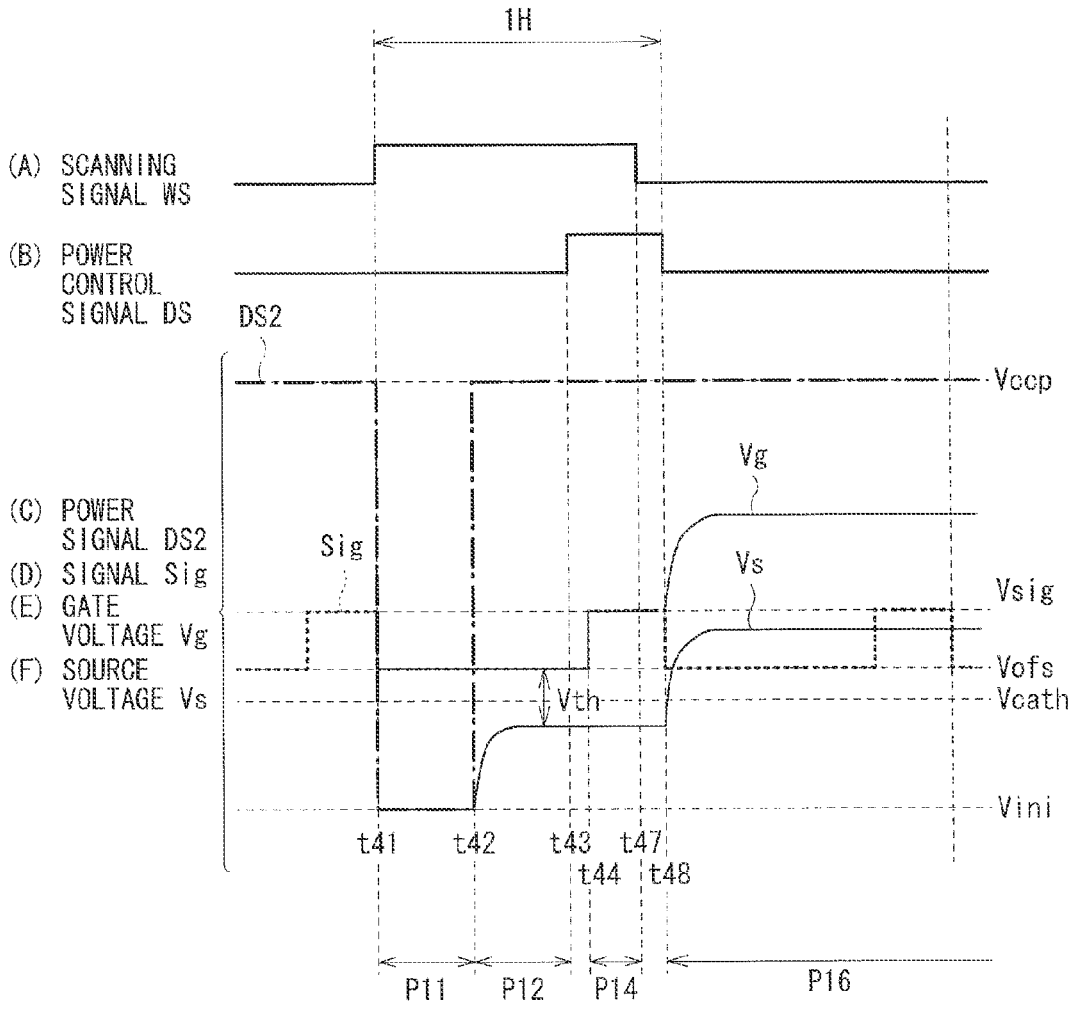
FIG. 38 is a timing waveform chart illustrating an operation example of a display unit according to a fifth embodiment.

FIG. 38 is a timing chart of display operation in the display unit 7A. In FIG. 38, Part (A) shows the waveform of the scanning signal WS, Part (B) shows the waveform of the power signal DS2, Part (C) shows the waveform of the signal Sig, Part (D) shows the waveform of the gate voltage Vg of the drive transistor DRTr, and Part (E) shows the waveform of the source voltage Vs of the drive transistor DRTr.

The drive section 70A initializes the sub-pixel 11A (initialization period P11), performs the Vth correction for suppressing the influence, on image quality, of the device variations in the drive transistors DRTr (Vth correction period P12), and writes the pixel voltage Vsig in the sub-pixel 11A (write period P14), in one horizontal period (1H). Thereafter, the organic EL device OLED in the sub-pixel 11A emits light with luminance in accordance with the written pixel voltage Vsig (light emission period P16). Details thereof will be described below.

First, the drive section 70A initializes the sub-pixel 11A in the period (initialization period P11) from the timing t41 to the timing t42, performs the Vth correction in the period (Vth correction period P12) from the timing t42 to the timing t43, and writes the pixel voltage Vsig in the sub-pixel 11A in the period (write period P14) from the timing t44 to the timing t47, as with the drive section 60A (FIG. 34) according to the above-described fourth embodiment.

Subsequently, at the timing t47, the scanning line drive section 73A allows the scanning signal WS to be varied from a high level to a low level (Part (A) in FIG. 38). Accordingly, the write transistor WSTr is turned off.

Subsequently, the drive section 70A allows the sub-pixel 11A to emit light in a period (light emission period P16) that begins from the timing t48. Specifically, at the timing t48, the power control line drive section 75A allows the power control signal DS to be varied from a high level to a low level (Part (B) in FIG. 38). Accordingly, the gate voltage Vg and the source voltage Vs of the drive transistor DRTr are increased (Parts (E) and (F) in FIG. 38), and the organic EL device OLED emits light, as in the light emission period P16 according to the above-described fourth embodiment.

As described above, in the present embodiment, only the Vth correction is performed. Therefore, simpler operation is achieved while degradation in image quality resulting from the device variations in the drive transistors is suppressed.

Moreover, in the present embodiment, the source voltage is increased in accordance with the device variations in the organic EL devices in the light emission period. Therefore, degradation in image quality resulting from the device variations in the organic EL devices is suppressed.

[Modification 5-1]

In the above-described fifth embodiment, the Vth correction is performed on the display section 10A (FIGS. 6 and 7) that includes the sub-pixels 11A having the "3Tr1C" configuration. However, this is not limitative. Alternatively, the Vth correction may be performed on the display section 10B (FIGS. 9 and 10) that includes the sub-pixels 11B having the "4Tr1C" configuration. A display unit 7B according to the present modification will be described below in detail.

As shown in FIGS. 9 and 10, the display unit 7B includes the display section 10B and a drive section 70B. The display section 10B includes the sub-pixels 11B having the "4Tr1C" configuration. The drive section 70B includes a scanning line drive section 73B, a control line drive section 74B, a power control line drive section 75B, and a data line drive section 77B.

Figure 39:
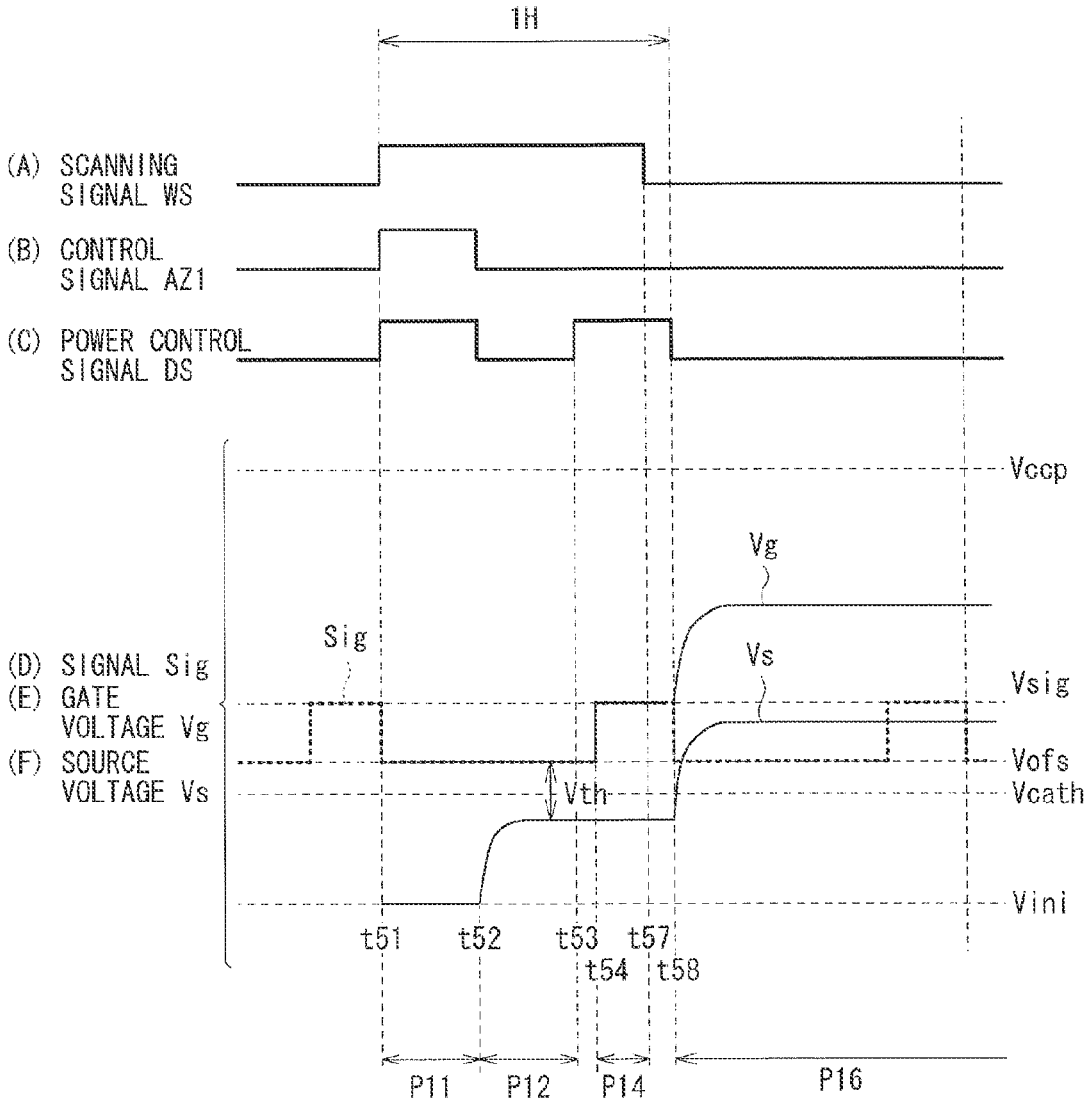
FIG. 39 is a timing waveform chart illustrating an operation example of a display unit according to a modification of the fifth embodiment.

FIG. 39 is a timing chart of display operation in the display unit 7B. In FIG. 39, Part (A) shows the waveform of the scanning signal WS, Part (B) shows the waveform of the control signal AZ1, Part (C) shows the waveform of the power control signal DS, Part (D) shows the waveform of the signal Sig, Part (E) shows the waveform of the gate voltage Vg of the drive transistor DRTr, and Part (F) shows the waveform of the source voltage Vs of the drive transistor DRTr.

First, the drive section 70B initializes the sub-pixel 11B in the period (initialization period P11) from the timing t51 to the timing t52, performs the Vth correction in the period (Vth correction period P12) from the timing t52 to the timing t53, and writes the pixel voltage Vsig in the sub-pixel 11B in the period (write period P14) from the timing t54 to the timing t57, as with the drive section 60B (FIG. 35) according to the above-described fourth embodiment.

Subsequently, at the timing t57, the scanning line drive section 73B allows the scanning signal WS to be varied from a high level to a low level (Part (A) in FIG. 39). Accordingly, the write transistor WSTr is turned off.

Subsequently, the drive section 70B allows the sub-pixel 11B to emit light in a period (light emission period P16) that begins from timing t58. Specifically, at the timing t58, the power control line drive section 75B allows the power control signal DS to be varied from a high level to a low level (Part (C) in FIG. 39). Accordingly, the gate voltage Vg and the source voltage Vs of the drive transistor DRTr are increased (Parts (E) and (F) in FIG. 39), and the organic EL device OLED emits light, as in the light emission period P16 according to the above-described fourth embodiment.

Effects similar to those in the above-described fifth embodiment are obtainable also in such a configuration.

[Modification 5-2]

Alternatively, for example, the Vth correction may be performed on the display section 10C (FIGS. 13 and 14) that includes the sub-pixels 11C having the "4Tr1C" configuration. A display unit 7C according to the present modification will be described below in detail.

As shown in FIGS. 13 and 14, the display unit 7C includes the display section 10C and a drive section 70C. The display section 10C includes the sub-pixels 11C having the "4Tr1C" configuration. The drive section 70C includes a scanning line drive section 73C, a control line drive section 74C, a power control line drive section 75C, a power line drive section 76C, and a data line drive section 77C.

Figure 40:
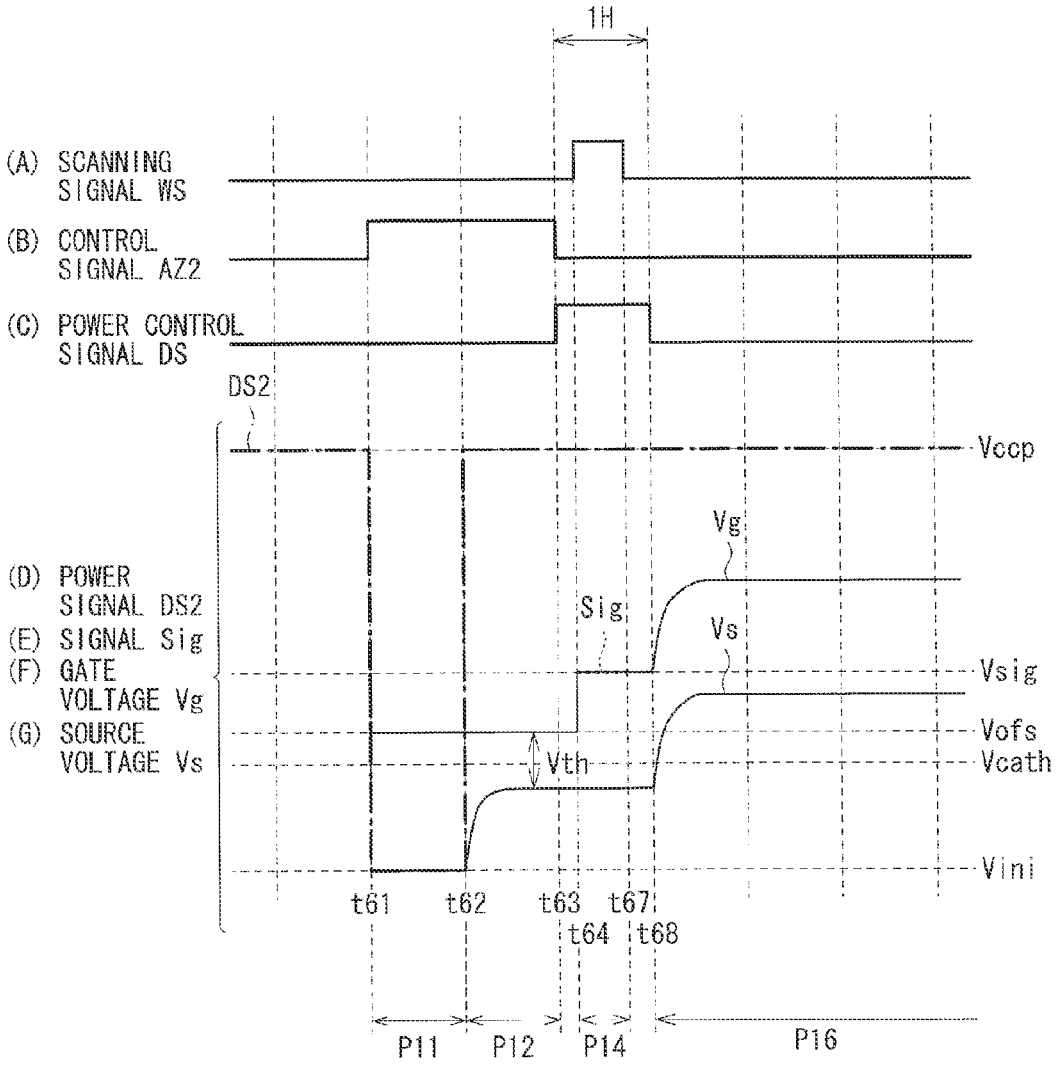
FIG. 40 is a timing waveform chart illustrating an operation example of a display unit according to another modification of the fifth embodiment.

FIG. 40 is a timing chart of display operation in the display unit 7C. In FIG. 40, Part (A) shows the waveform of the scanning signal WS, Part (B) shows the waveform of the control signal AZ2, Part (C) shows the waveform of the power control signal DS, Part (D) shows the waveform of the power signal DS2, Part (E) shows the waveform of the signal Sig, Part (F) shows the waveform of the gate voltage Vg of the drive transistor DRTr, and Part (G) shows the waveform of the source voltage Vs of the drive transistor DRTr.

First, the drive section 70C initializes the sub-pixel 11C in the period (initialization period P11) from the timing t61 to the timing t62, performs the Vth correction in the period (Vth correction period P12) from the timing t62 to the timing t63, and writes the pixel voltage Vsig in the sub-pixel 11C in the period (write period P14) from the timing t64 to the timing t67, as with the drive section 60C (FIG. 36) according to the above-described fourth embodiment.

Subsequently, at the timing t67, the scanning line drive section 73C allows the scanning signal WS to be varied from a high level to a low level (Part (A) in FIG. 40). Accordingly, the write transistor WSTr is turned off.

Subsequently, the drive section 70C allows the sub-pixel 11C to emit light in a period (light emission period P16) that begins from timing t68. Specifically, at the timing t68, the power control line drive section 75C allows the power control signal DS to be varied from a high level to a low level (Part (C) in FIG. 40). Accordingly, the gate voltage Vg and the source voltage Vs of the drive transistor DRTr are increased (Parts (F) and (G) in FIG. 40), and the organic EL device OLED emits light, as in the light emission period P16 according to the above-described fourth embodiment.

Effects similar to those in the above-described fifth embodiment are obtainable also in such a configuration.

[Modification 5-3]

Alternatively, for example, the Vth correction may be performed on the display section 10D (FIGS. 17 and 18) that includes the sub-pixels 11D having the "5Tr1C" configuration. A display unit 7D according to the present modification will be described below in detail.

As shown in FIGS. 17 and 18, the display unit 7D includes the display section 10D and a drive section 70D. The display section 10D includes the sub-pixels 11D having the "5Tr1C" configuration. The drive section 70D includes a scanning line drive section 73D, a control line drive section 74D, a power control line drive section 75D, and a data line drive section 77D.

Figure 41:
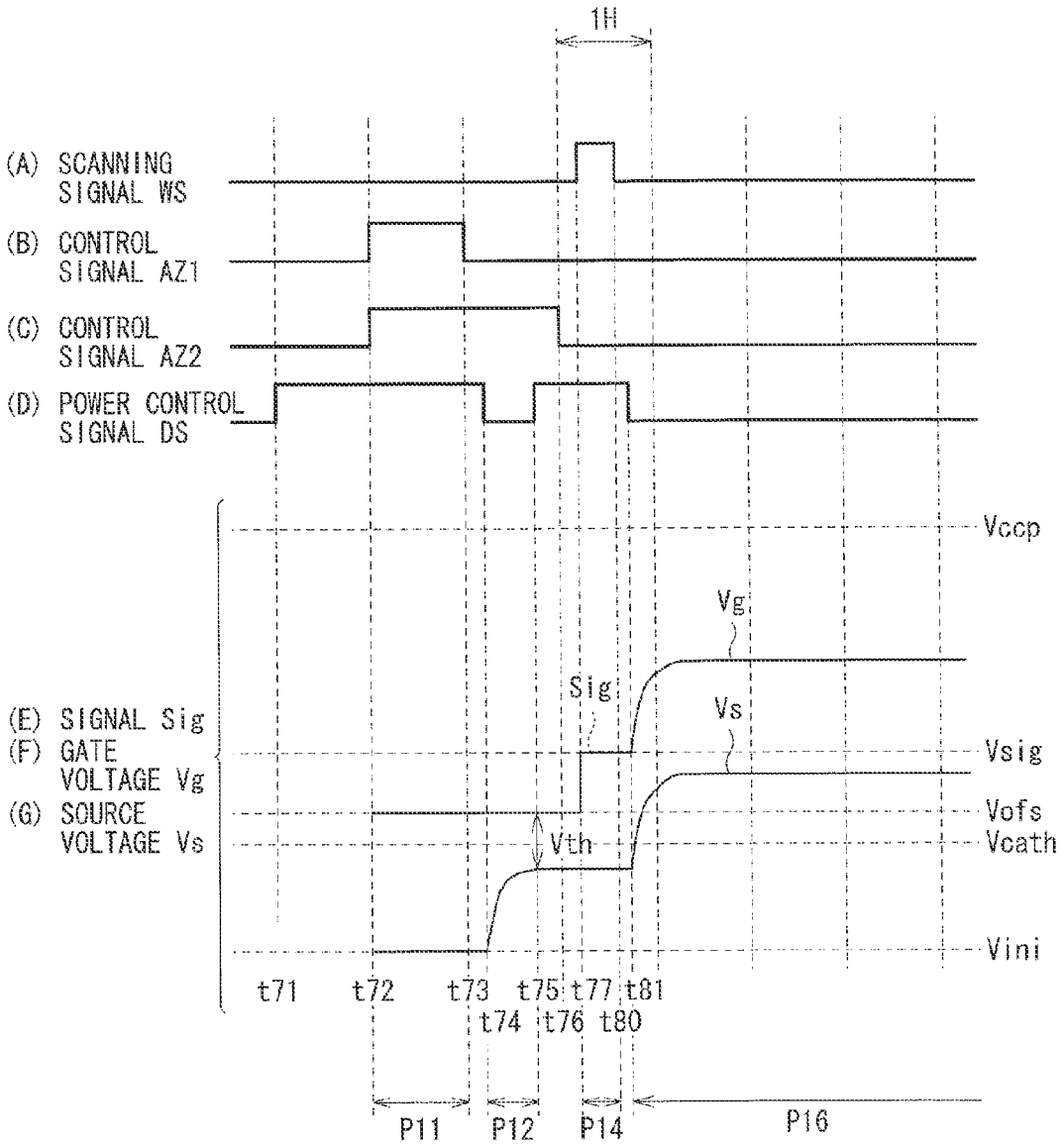
FIG. 41 is a timing waveform chart illustrating an operation example of a display unit according to another modification of the fifth embodiment.

FIG. 41 is a timing chart of display operation in the display unit 7D. In FIG. 41, Part (A) shows the waveform of the scanning signal WS, Part (B) shows the waveform of the control signal AZ1, Part (C) shows the waveform of the control signal AZ2, Part (D) shows the waveform of the power control signal DS, Part (E) shows the waveform of the signal Sig, Part (F) shows the waveform of the gate voltage Vg of the drive transistor DRTr, and Part (G) shows the waveform of the source voltage Vs of the drive transistor DRTr.

First, the drive section 70D initializes the sub-pixel 11D in the period (initialization period P11) from the timing t72 to the timing t73, performs the Vth correction in the period (Vth correction period P12) from the timing t74 to the timing t75, and writes the pixel voltage Vsig in the sub-pixel 11D in the period (write period P14) from the timing t77 to the timing t80, as with the drive section 60D (FIG. 37) according to the above-described fourth embodiment.

Subsequently, at the timing t80, the scanning line drive section 73D allows the scanning signal WS to be varied from a high level to a low level (Part (A) in FIG. 41). Accordingly, the write transistor WSTr is turned off.

Subsequently, the drive section 70D allows the sub-pixel 11D to emit light in a period (light emission period P16) that begins from timing t81. Specifically, at the timing t81, the power control line drive section 75D allows the power control signal DS to be varied from a high level to a low level (Part (D) in FIG. 41). Accordingly, the gate voltage Vg and the source voltage Vs of the drive transistor DRTr are increased (Parts (F) and (G) in FIG. 41), and the organic EL device OLED emits light, as in the light emission period P16 according to the above-described fourth embodiment.

Effects similar to those in the above-described fifth embodiment are obtainable also in such a configuration.

6. Sixth Embodiment

Next, a display unit 8 according to a sixth embodiment will be described. The present embodiment is a display unit that does not perform correction for suppressing the influence, on image quality, of the device variations in the drive transistors DRTr. It is to be noted that the same numerals are used to designate substantially the same components of the display unit 1 according to the above-described first embodiment and the like, and the description thereof will be appropriately omitted.

As shown in FIGS. 1 and 2, the display unit 8 includes the display section 10 and a drive section 80. The display section 10 includes the sub-pixels 11 having the "2Tr1C" configuration. The drive section 80 includes a scanning line drive section 83, a power line drive section 86, and a data line drive section 87.

Figure 42:
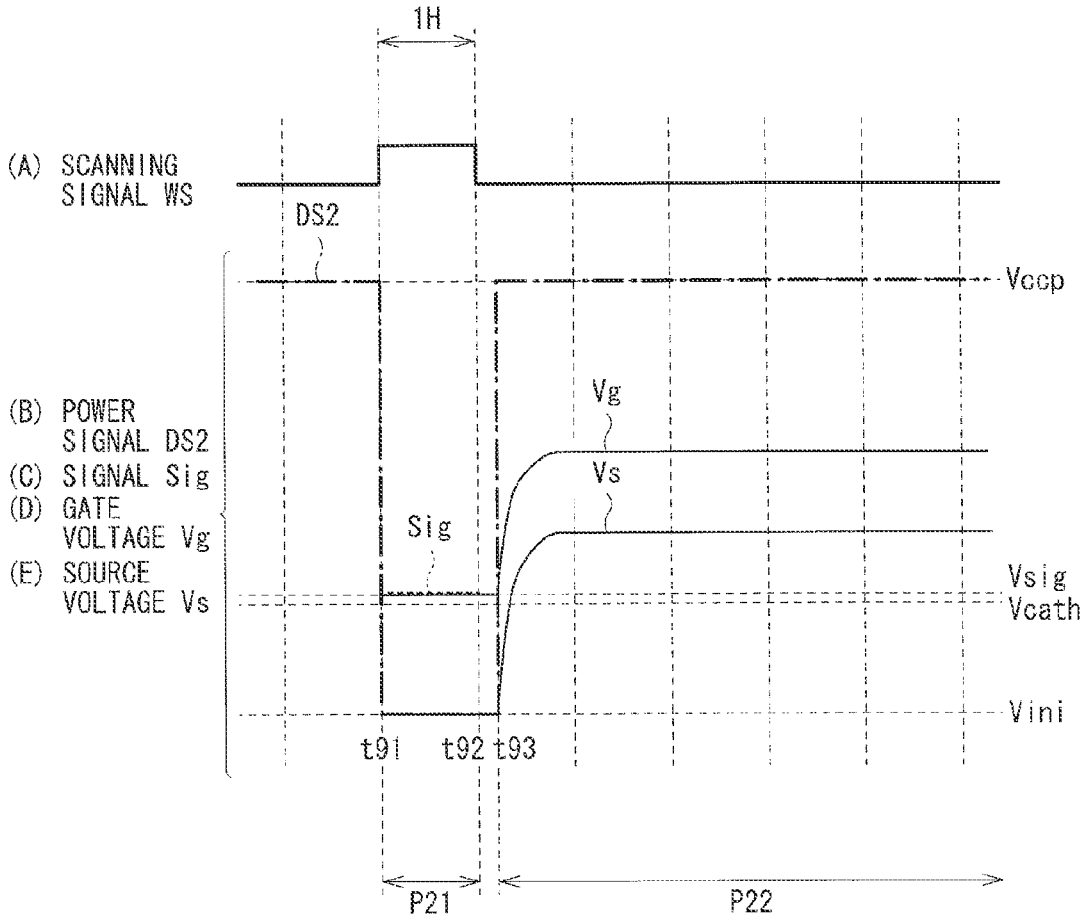
FIG. 42 is a timing waveform chart illustrating an operation example of a display unit according to a sixth embodiment.

FIG. 42 is a timing chart of display operation in the display unit 8. In FIG. 42, Part (A) shows the waveform of the scanning signal WS, Part (B) shows the waveform of the power signal DS2, Part (C) shows the waveform of the signal Sig, Part (D) shows the waveform of the gate voltage Vg of the drive transistor DRTr, and Part (E) shows the waveform of the source voltage Vs of the drive transistor DRTr.

The drive section 80 writes the pixel voltage Vsig in the sub-pixel 11 (write period P21) in one horizontal period (1H). Thereafter, the organic EL device OLED in the sub-pixel 11 emits light with luminance corresponding to the written pixel voltage Vsig (light emission period P22). Details thereof will be described below.

First, the drive section 80 writes the pixel voltage Vsig in the sub-pixel 11 in a period (write period P21) from timing t91 to timing t92. Specifically, first, at the timing t91, the data line drive section 97 sets the signal Sig to the pixel voltage Vsig (Part (C) in FIG. 42), and the scanning line drive section 83 allows the voltage of the scanning signal WS to be varied from a low level to a high level (Part (A) in FIG. 42). Accordingly, the write transistor WSTr is turned on, and the gate voltage Vg of the drive transistor DRTr is set to the pixel voltage Vsig (Part (D) in FIG. 42). At the same time, the power line drive section 86 allows the power signal DS2 to be varied from the voltage Vccp to the voltage Vini (Part (B) in FIG. 42). Accordingly, the drive transistor DRTr is turned on, and the source voltage Vs of the drive transistor DRTr is set to the voltage Vini (Part (E) in FIG. 42).

Subsequently, at the timing t92, the scanning line drive section 83 allows the voltage of the scanning signal WS to be varied from the high level to the low level (Part (A) in FIG. 42). Accordingly, the write transistor WSTr is turned off, and the gate of the drive transistor DRTr is placed in a floating state. Thereafter, the voltage between the terminals of the capacitor Cs, that is, the gate-source voltage Vgs of the drive transistor DRTr is maintained.

Subsequently, the drive section 80 allows the sub-pixel 11 to emit light in a period (light emission period P22) that begins from timing t93. Specifically, at the timing t93, the power line drive section 86 allows the power signal DS2 to be varied from the voltage Vini to the voltage Vccp (Part (B) in FIG. 42). Accordingly, the current Ids is flown into the drive transistor DRTr, and the source voltage Vs of the drive transistor DRTr is increased (Part (E) in FIG. 42). In accordance therewith, the gate voltage Vg of the drive transistor DRTr is increased (Part (D) in FIG. 42). When the source voltage Vs of the drive transistor DRTr becomes higher than a sum (Vel+Vcath) of the threshold voltage Vel and the voltage Vcath of the organic EL device OLED, a current flows between the anode and the cathode of the organic EL device OLED, which allows the organic EL device OLED to emit light. In other words, the source voltage Vs is increased in accordance with the device variations in the organic EL devices OLED, and the organic EL device OLED emits light.

As described above, in the present embodiment, the correction for suppressing the influence, on image quality, of the device variations in the drive transistors is not performed. Therefore, simpler operation is achieved.

Moreover, in the present embodiment, the source voltage is increased in accordance with the device variations in the organic EL devices in the light emission period. Therefore, degradation in image quality resulting from the device variations in the organic EL devices is suppressed.

[Modification 6-1]

In the above-described sixth embodiment, the correction for suppressing the influence, on image quality, of the device variations in the drive transistors DRTr is not performed on the display section 10 (FIGS. 1 and 2) that includes the sub-pixel 11 having the "2Tr1C" configuration. However, this is not limitative. Alternatively, similar correction may not be performed on the display section 10B (FIGS. 9 and 10) that includes the sub-pixel 11B having the "4Tr1C" configuration. A display unit 8B according to the present modification will be described below in detail.

As shown in FIGS. 9 and 10, the display unit 8B includes the display section 10B and a drive section 80B. The display section 10B includes the sub-pixels 11B having the "4Tr1C" configuration. The drive section 80B includes a scanning line drive section 83B, a control line drive section 84B, a power control line drive section 85B, and a data line drive section 87B.

Figure 43:
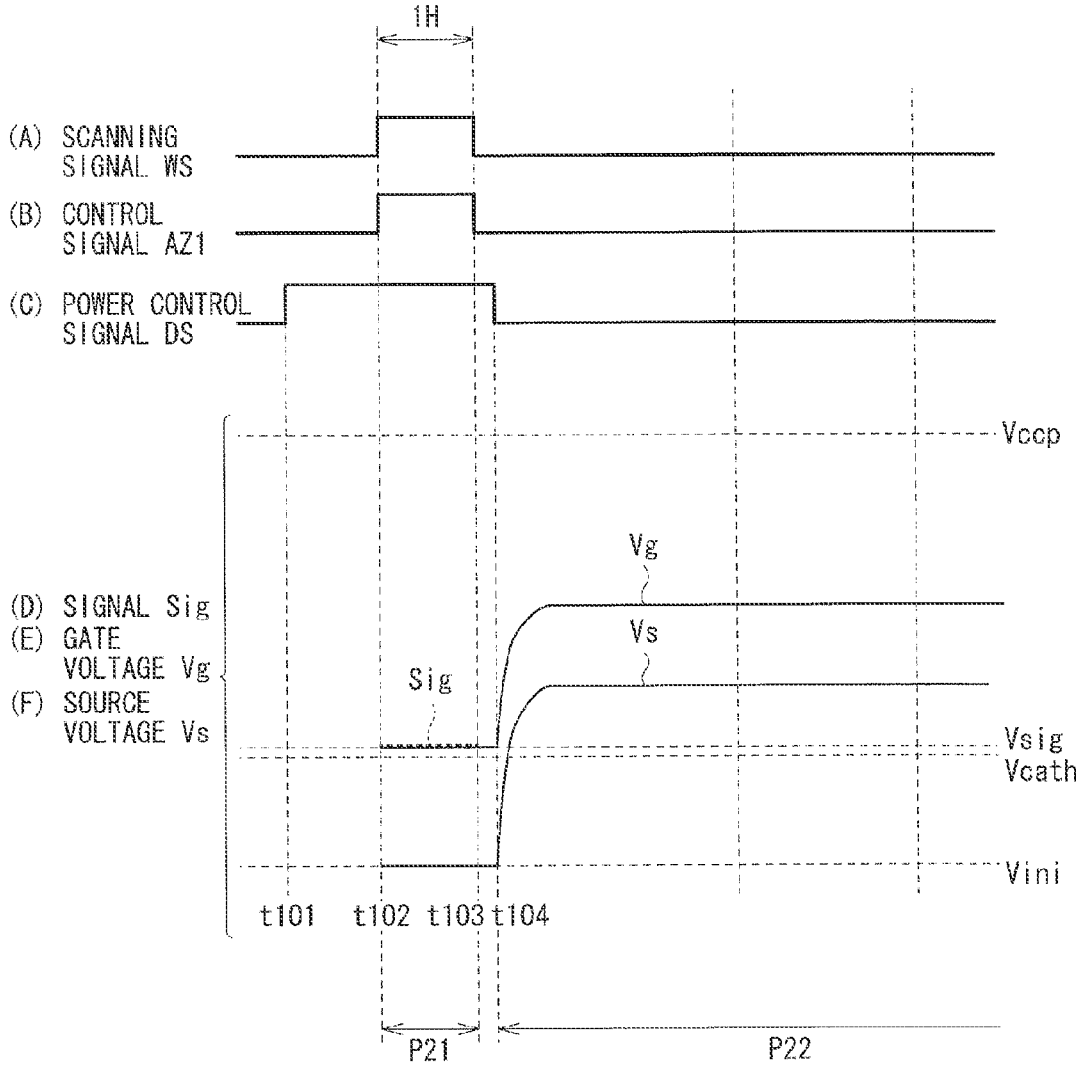
FIG. 43 is a timing waveform chart illustrating an operation example of a display unit according to a modification of the sixth embodiment.

FIG. 43 is a timing chart of display operation in the display unit 8B. In FIG. 43, Part (A) shows the waveform of the scanning signal WS, Part (B) shows the waveform of the control signal AZ1, Part (C) shows the waveform of the power control signal DS, Part (D) shows the waveform of the signal Sig, Part (E) shows the waveform of the gate voltage Vg of the drive transistor DRTr, and Part (F) shows the waveform of the source voltage Vs of the drive transistor DRTr.

First, at timing t101 prior to the write period P21, the power control line drive section 85D allows the voltage of the power control signal DS to be varied from a low level to a high level (Part (C) in FIG. 43). Accordingly, the power transistor DSTr is turned off.

Next, the drive section 80B writes the pixel voltage Vsig in the sub-pixel 11B in a period (write period P21) from timing t102 to timing t103, as in the above-described sixth embodiment. Further, at the timing t102, the control line drive section 84B allows the voltage of the control signal AZ1 to be varied from a low level to a high level (Part (B) in FIG. 43). Accordingly, the control transistor AZ1Tr is turned on, and the source voltage Vs of the drive transistor DRTr is set to the voltage Vini (Part (F) in FIG. 43).

Subsequently, at the timing t103, the scanning line drive section 83B allows the voltage of the scanning signal WS to be varied from a high level to a low level (Part (A) in FIG. 43), and the control line drive section 84B allows the voltage of the control signal AZ1 to be varied from the high level to the low level (Part (B) in FIG. 43). Accordingly, the write transistor WSTr is turned off, and the control transistor AZ1Tr is turned off.

Subsequently, the drive section 80B allows the sub-pixel 11B to emit light in a period (light emission period P22) that begins from timing t104. Specifically, at the timing t104, the power control line drive section 85B allows the power control signal DS to be varied from the high level to the low level (Part (C) in FIG. 43). Accordingly, the organic EL device OLED emits light as in the above-described sixth embodiment.

Effects similar to those in the above-described sixth embodiment are obtainable also in such a configuration.

[Modification 6-2]

In the above-described sixth embodiment, the sub-pixel 11 includes two transistors. However, this is not limitative. Alternatively, for example, the sub-pixel may further include other transistors.

Figure 44:
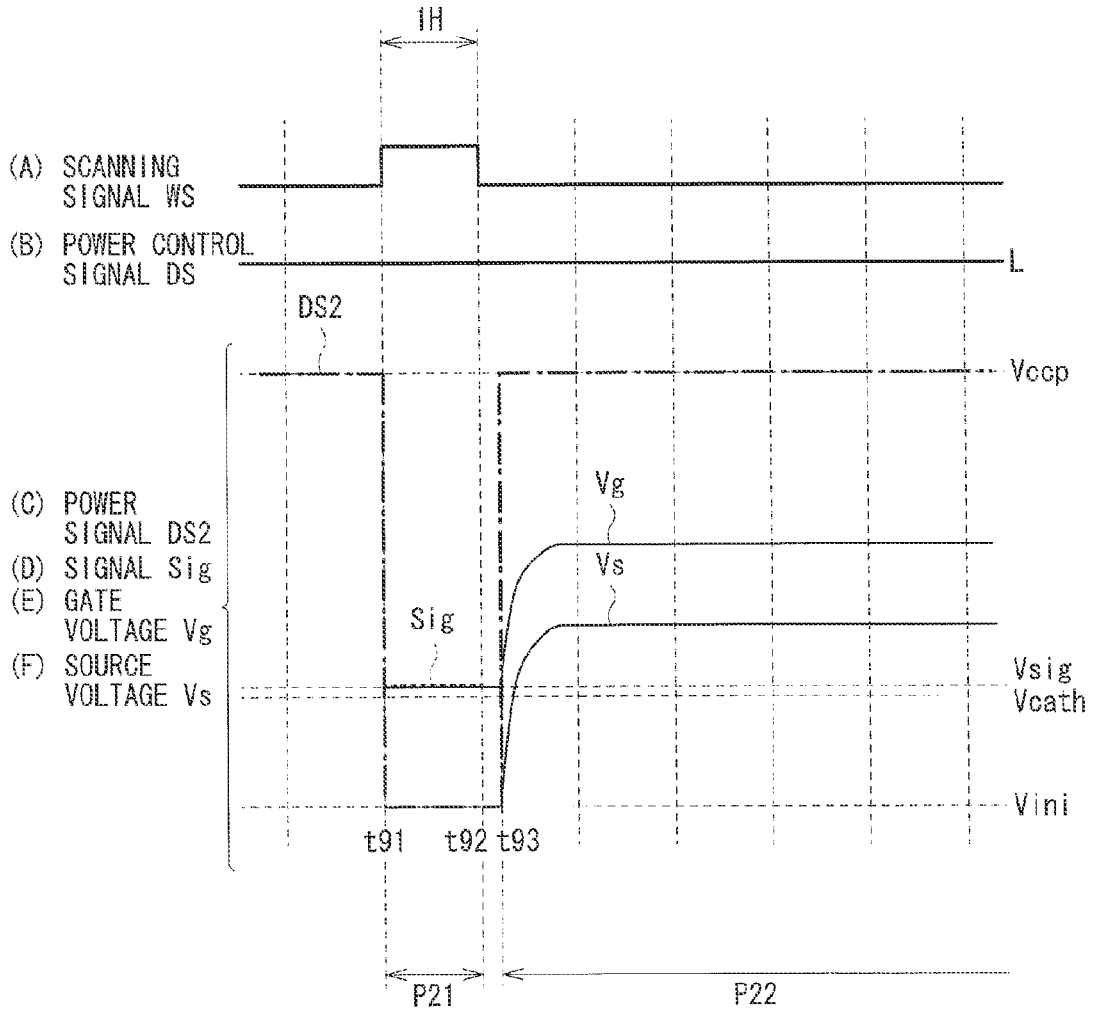
FIG. 44 is a timing waveform chart illustrating an operation example of a display unit according to another modification of the sixth embodiment.

For example, a method (FIG. 42) of driving the display section 10 (FIGS. 1 and 2) that includes the sub-pixel 11 having the "2Tr1C" configuration may be applied as it is to the display section 10A (FIGS. 6 and 7) that includes the sub-pixel 11A having the "3Tr1C" configuration. In this case, the same method as the driving method shown in FIG. 42 is achievable by allowing the power control signal DS to be mostly at the low level (L) (Part (B) in FIG. 44) and allowing the power transistor DSTr to be mostly ON, as shown in FIG. 44.

Figure 45:
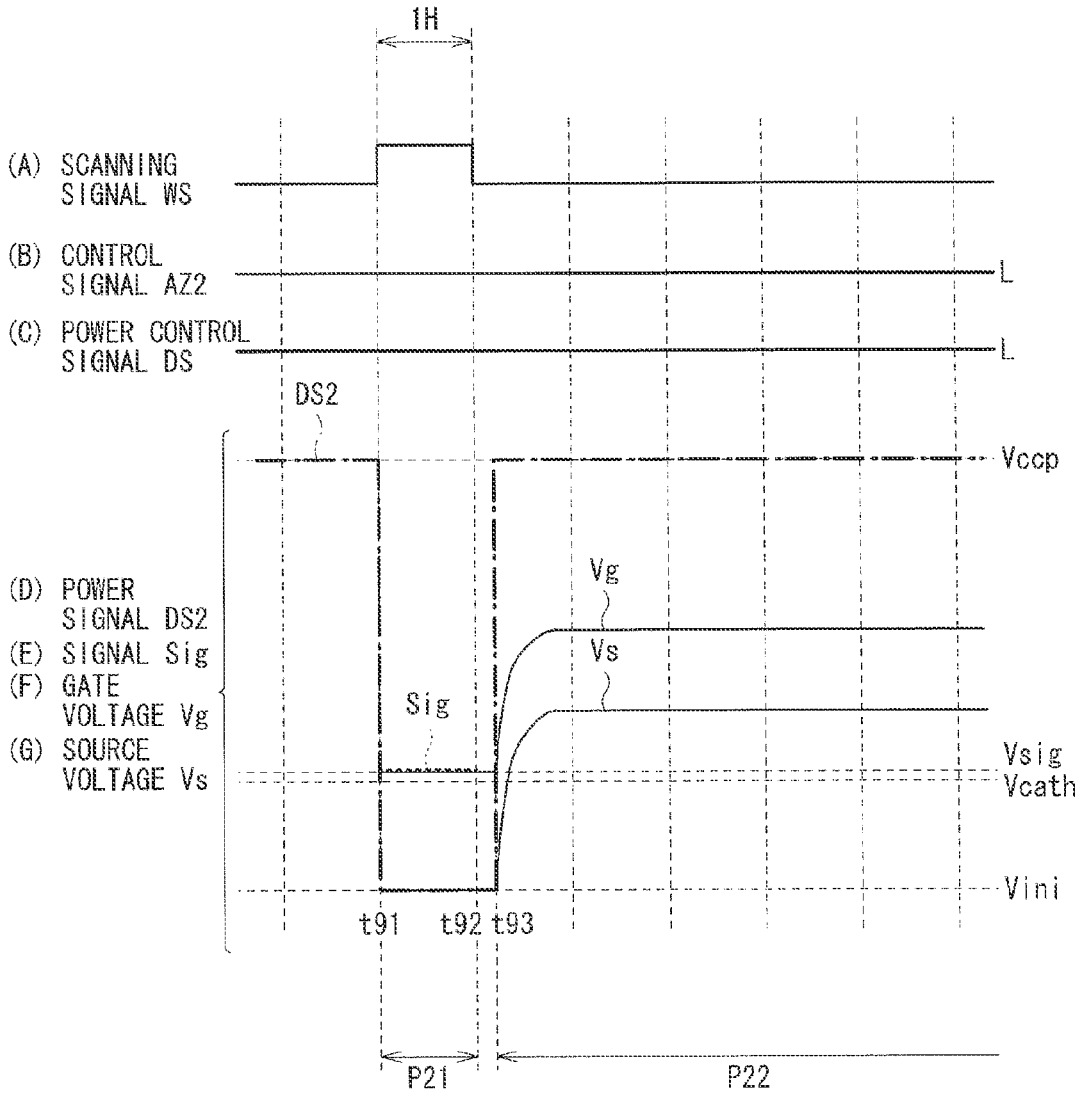
FIG. 45 is a timing waveform chart illustrating an operation example of a display unit according to another modification of the sixth embodiment.

Moreover, for example, the method (FIG. 42) of driving the display section 10 (FIGS. 1 and 2) that includes the sub-pixel 11 having the "2Tr1C" configuration may be applied as it is to the display section 10C (FIGS. 13 and 14) that includes the sub-pixel 11C having the "4Tr1C" configuration. In this case, the same method as the driving method shown in FIG. 42 is achievable, by allowing the control signal AZ2 to be mostly at the low level (L) (Part (B) in FIG. 45) to allow the control transistor AZ2Tr to be mostly OFF, and allowing the power control signal DS to be mostly at the low level (L) (Part (C) in FIG. 45) to allow the power transistor DSTr to be mostly ON, as shown in FIG. 45.

Figure 46:
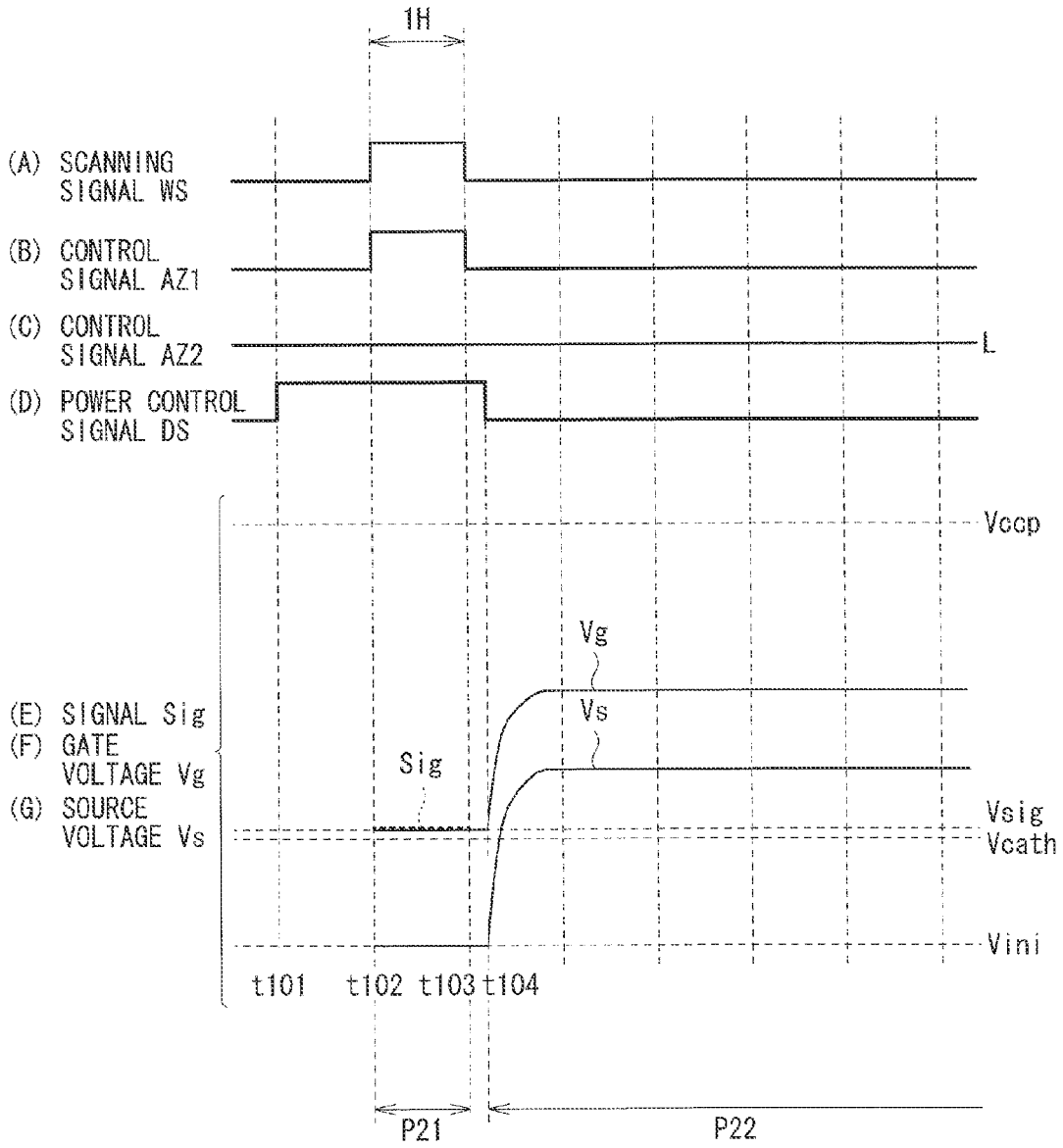
FIG. 46 is a timing waveform chart illustrating an operation example of a display unit according to another modification of the sixth embodiment.

Moreover, for example, the method (FIG. 43) of driving the display section 10B (FIGS. 9 and 10) that includes the sub-pixel 11B having the "4Tr1C" configuration may be applied as it is to the display section 10D (FIGS. 17 and 18) that includes the sub-pixel 11D having the "5Tr1C" configuration. In this case, the same method as the driving method shown in FIG. 43 is achievable, by allowing the control signal AZ2 to be mostly at the low level (L) (Part (C) in FIG. 46) to allow the control transistor AZ2Tr to be mostly OFF, as shown in FIG. 46.

7. Seventh Embodiment

Next, a display unit 9 according to a seventh embodiment will be described. The present embodiment is a display unit that is configured to begin light emission of the sub-pixel 11 upon the operation of writing in the sub-pixel 11. It is to be noted that the same numerals are used to designate substantially the same components of the display unit 1 according to the above-described first embodiment and the like, and the description thereof will be appropriately omitted.

As shown in FIGS. 1 and 2, the display unit 9 includes the display section 10 and a drive section 90. The display section 10 includes the sub-pixels 11 having the "2Tr1C" configuration. The drive section 90 includes a scanning line drive section 93, a power line drive section 96, and a data line drive section 97.

Figure 47:
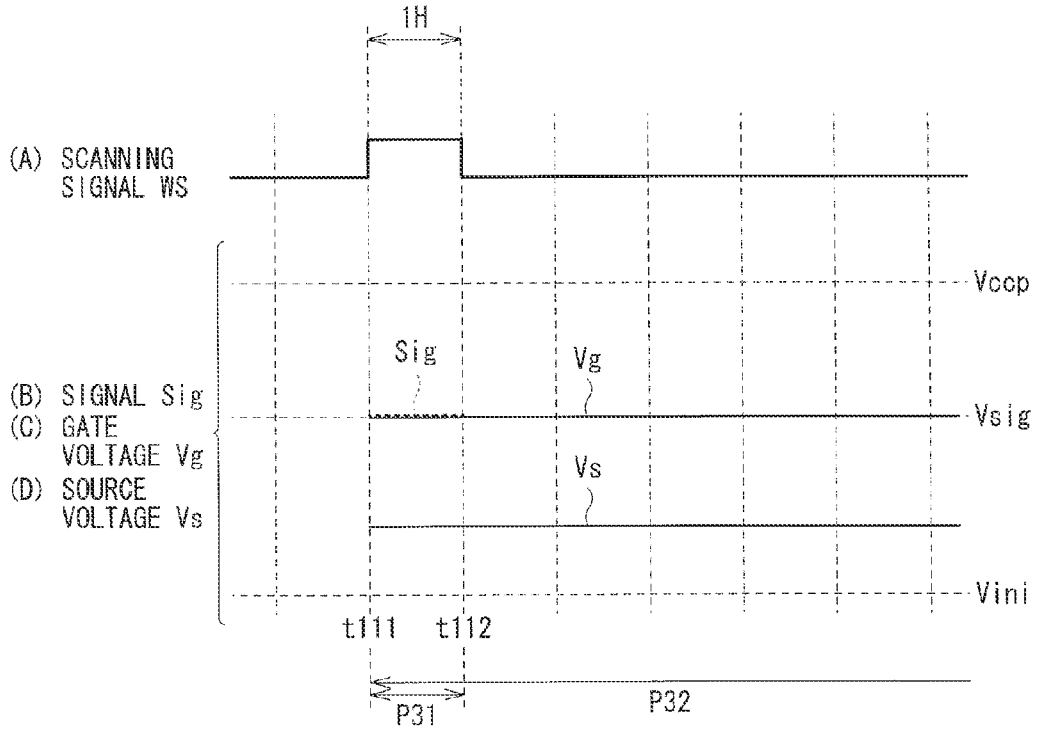
FIG. 47 is a timing waveform chart illustrating an operation example of a display unit according to a seventh embodiment.

FIG. 47 is a timing chart of display operation in the display unit 9. In FIG. 47, Part (A) shows the waveform of the scanning signal WS, Part (B) shows the waveform of the signal Sig, Part (C) shows the waveform of the gate voltage Vg of the drive transistor DRTr, and Part (D) shows the waveform of the source voltage Vs of the drive transistor DRTr.

The drive section 90 writes the pixel voltage Vsig in the sub-pixel 11 in a period (write period P31) from timing t111 to timing t112. Specifically, first, at the timing t111, the data line drive section 97 sets the signal Sig to the pixel voltage Vsig (Part (B) in FIG. 47), and the scanning line drive section 93 allows the voltage of the scanning signal WS to be varied from a low level to a high level (Part (A) in FIG. 47). Accordingly, the write transistor WSTr is turned on, and the gate voltage Vg of the drive transistor DRTr is set to the pixel voltage Vsig (Part (C) in FIG. 47). The current Ids in the drive transistor DRTr is flown into the organic EL device OLED, and the source voltage Vs is determined (Part (D) in FIG. 47). Thus, the organic EL devices OLED emits light in a period (light emission period P32) that begins from the timing t111.

As described above, in the present embodiment, the sub-pixel begins to emit light upon the operation of writing in the sub-pixel. Therefore, simpler operation is achievable.

[Modification 7-1]

In the above-described seventh embodiment, the sub-pixel 11 includes two transistors. However, this is not limitative. Alternatively, for example, the sub-pixel may further include other transistors.

Figure 48:
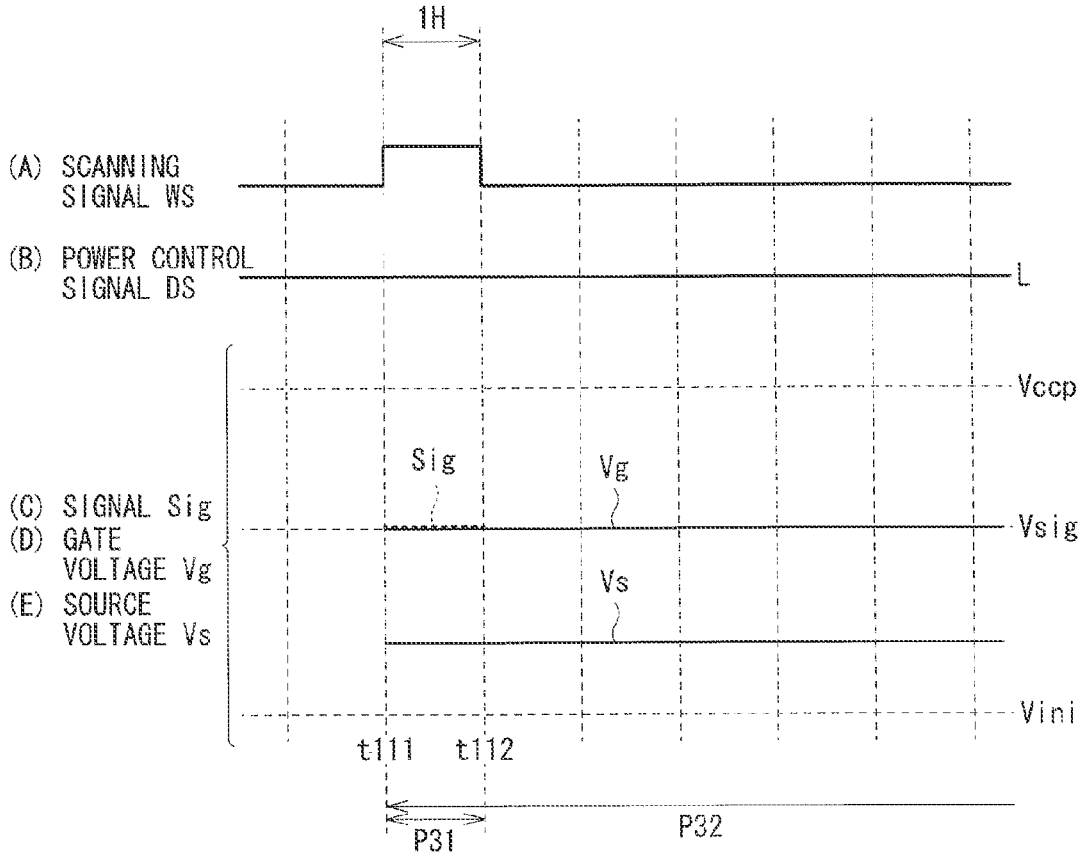
FIG. 48 is a timing waveform chart illustrating an operation example of a display unit according to a modification of the seventh embodiment.

For example, a method (FIG. 47) of driving the display section 10 (FIGS. 1 and 2) that includes the sub-pixel 11 having the "2Tr1C" configuration may be applied as it is to the display section 10A (FIGS. 6 and 7) that includes the sub-pixel 11A having the "3Tr1C" configuration. In this case, the same method as the driving method shown in FIG. 47 is achievable by allowing the power control signal DS to be mostly at the low level (L) (Part (B) in FIG. 48) and allowing the power transistor DSTr to be mostly ON, as shown in FIG. 48.

Figure 49:
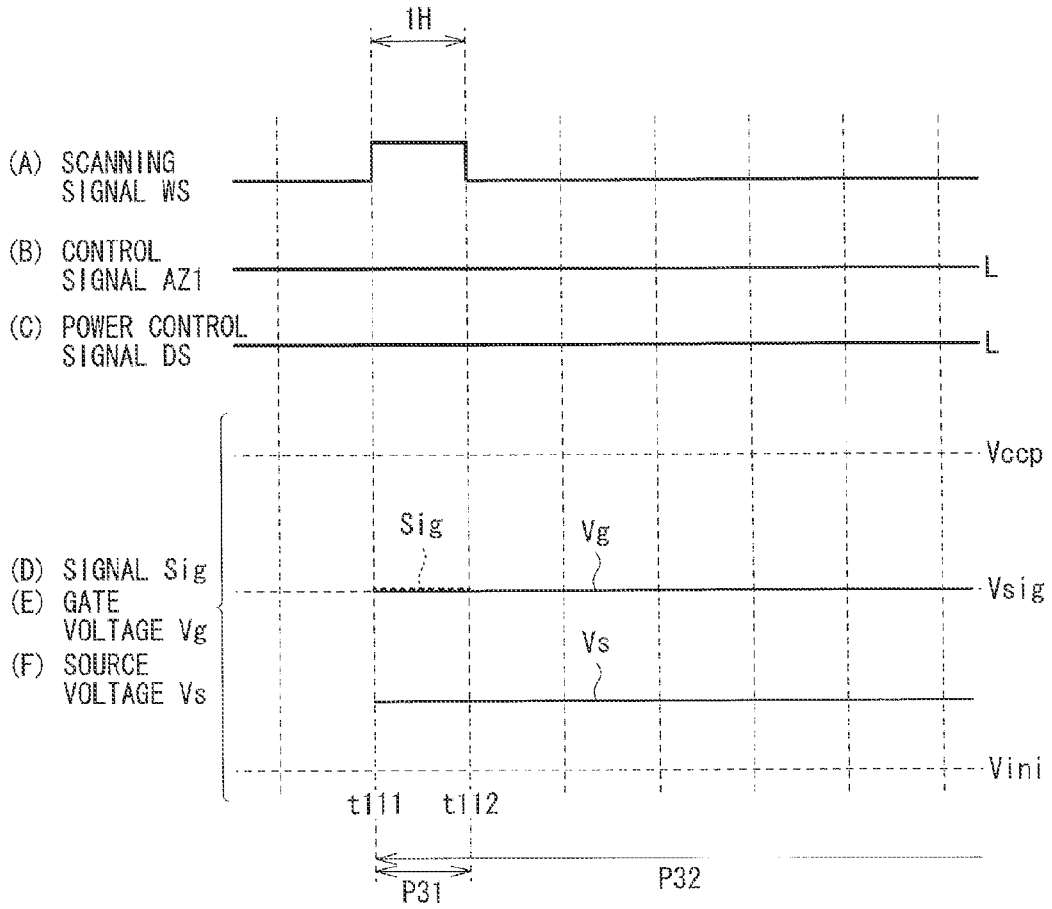
FIG. 49 is a timing waveform chart illustrating an operation example of a display unit according to another modification of the seventh embodiment.

Moreover, for example, the above-described driving method (FIG. 47) may be applied as it is to the display section 10B (FIGS. 9 and 10) that includes the sub-pixel 11B having the "4Tr1C" configuration. In this case, the same method as the driving method shown in FIG. 47 is achievable by allowing the control signal AZ1 to be mostly at the low level (L) (Part (B) in FIG. 49) to allow the control transistor AZ1Tr to be mostly OFF, and allowing the power control signal DS to be mostly at the low level (L) (Part (C) in FIG. 49) to allow the power transistor DSTr to be mostly ON as shown in FIG. 49.

Figure 50:
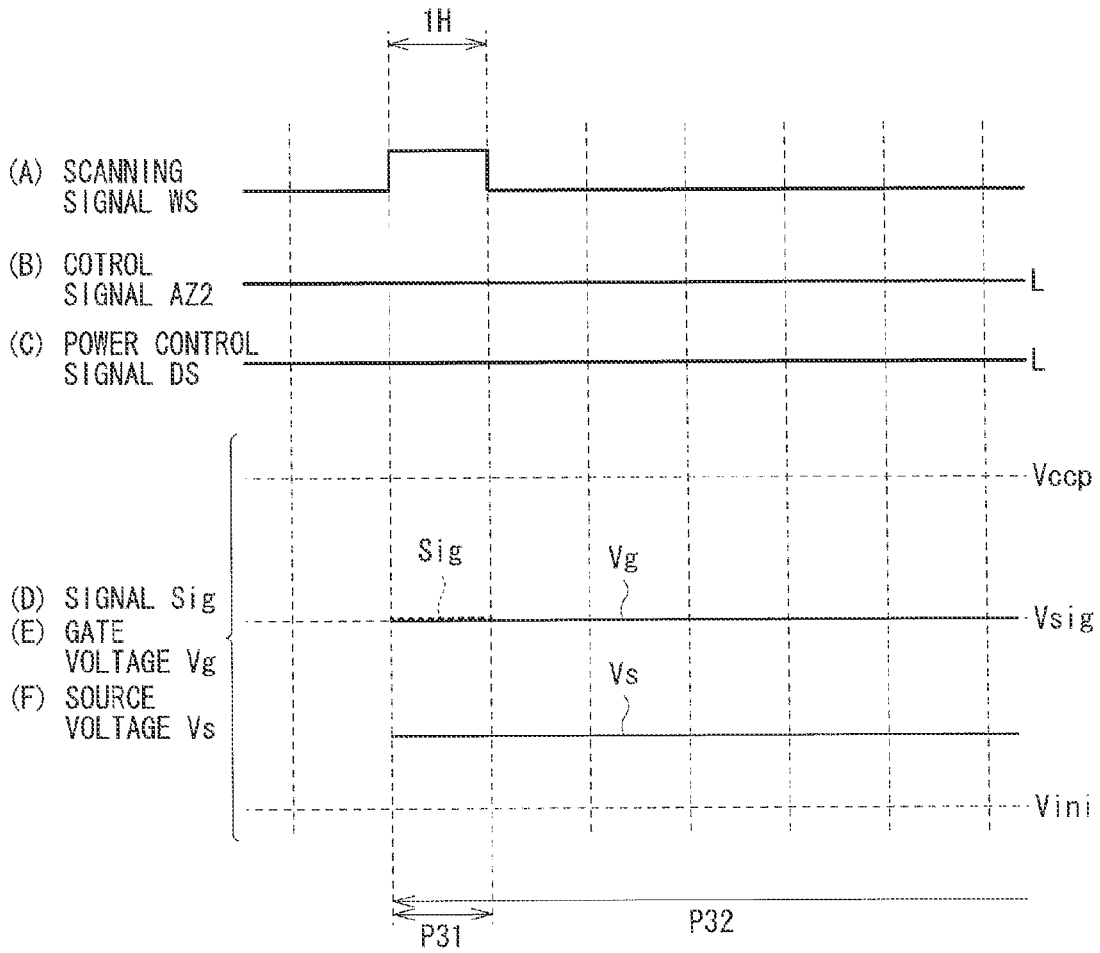
FIG. 50 is a timing waveform chart illustrating an operation example of a display unit according to another modification of the seventh embodiment.

Moreover, for example, the above-described driving method (FIG. 47) may be applied as it is to the display section 10C (FIGS. 13 and 14) that includes the sub-pixel 11C having the "4Tr1C" configuration. In this case, the same method as the driving method shown in FIG. 47 is achievable by allowing the control signal AZ2 to be mostly at the low level (L) (Part (B) in FIG. 50) to allow the control transistor AZ2Tr to be mostly OFF, and allowing the power control signal DS to be mostly at the low level (L) (Part (C) in FIG. 50) to allow the power transistor DSTr to be mostly ON as shown in FIG. 50.

Figure 51:
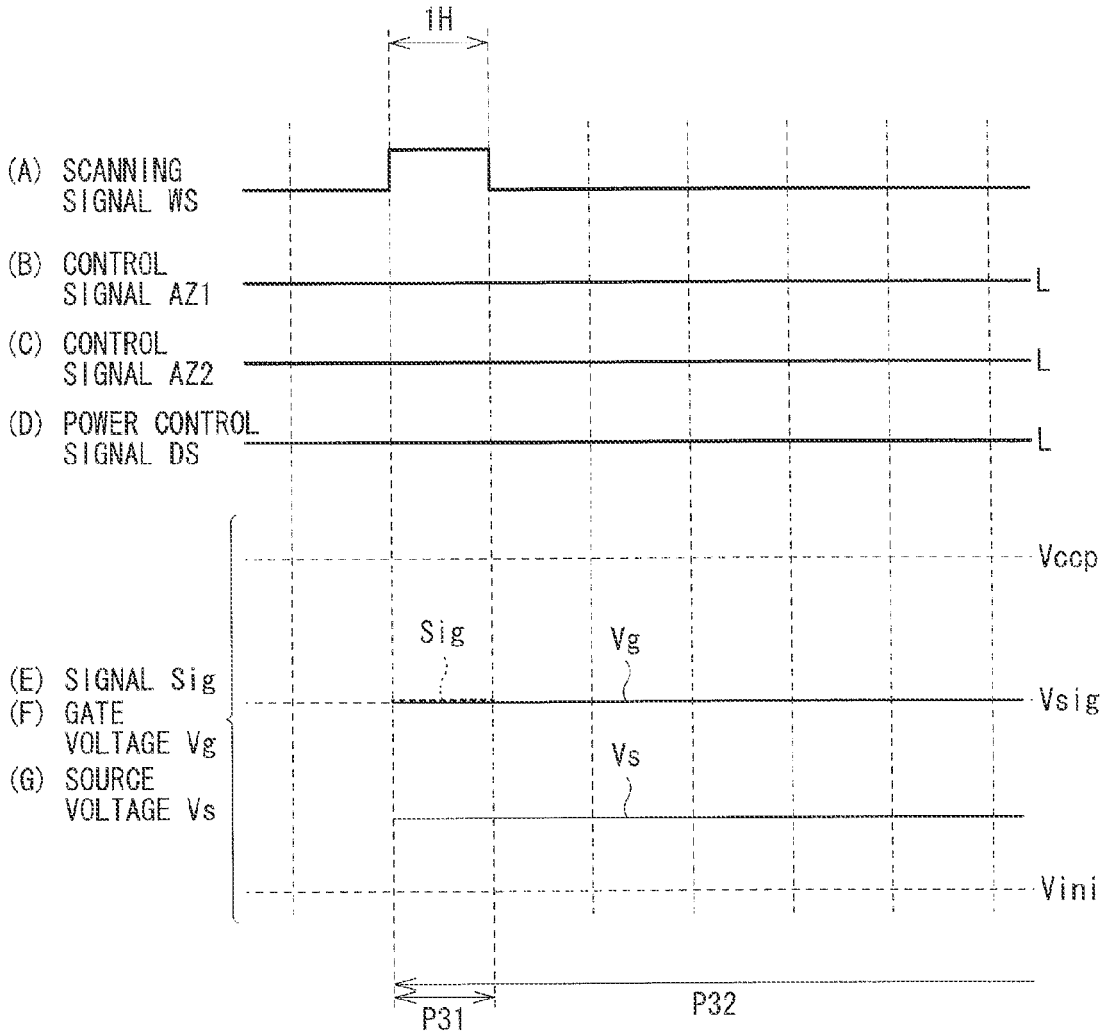
FIG. 51 is a timing waveform chart illustrating an operation example of a display unit according to another modification of the seventh embodiment.

Moreover, for example, the above-described driving method (FIG. 47) may be applied as it is to the display section 10D (FIGS. 17 and 18) that includes the sub-pixels 11D having the "5Tr1C" configuration. In this case, the same method as the driving method shown in FIG. 47 is achievable by allowing the control signal AZ1 to be mostly at the low level (L) (Part (B) in FIG. 51) to allow the control transistor AZ1Tr to be mostly OFF, allowing the control signal AZ2 to be mostly at the low level (L) (Part (C) in FIG. 51) to allow the control transistor AZ2Tr to be mostly OFF, and allowing the power control signal DS to be mostly at the low level (L) (Part (D) in FIG. 51) to allow the power transistor DSTr to be mostly ON, as shown in FIG. 51.

8. Eighth Embodiment

Next, a display unit 100 according to an eighth embodiment will be described. In the present embodiment, the display section in the display unit, in which the pixel voltage Vsig is applied to the gate of the drive transistor DRTr and the source voltage is varied by the Ids correction, is configured using only a PMOS transistor. It is to be noted that the same numerals are used to designate substantially the same components of the display unit 1 according to the above-described first embodiment, and the description thereof will be appropriately omitted.

Figure 52:
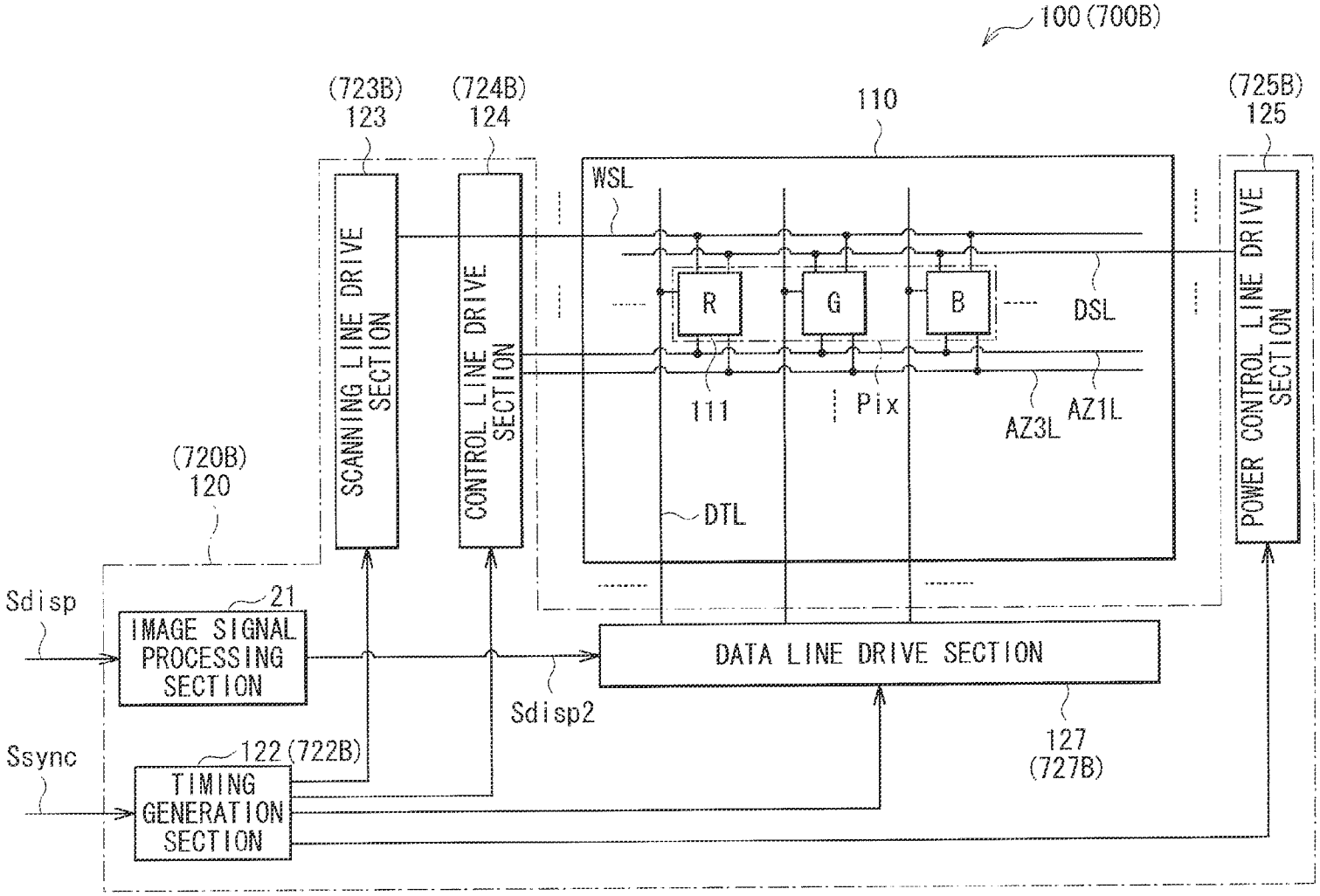
FIG. 52 is a block diagram illustrating a configuration example of a display unit according to an eighth embodiment.

FIG. 52 illustrates a configuration example of a display unit 100 according to the present embodiment. The display unit 100 includes a display section 110 and a drive section 120.

The display section 110 includes a plurality of sub-pixels 111, the plurality of scanning lines WSL, the plurality of power control lines DSL, the plurality of control lines AZ1L, and a plurality of control lines AZ3L. The scanning lines WSL, the power control lines DSL, and the control lines AZ1L and AZ3L extend in the row direction. One end of each of the scanning lines WSL, the power control lines DSL, and the control lines AZ1L and AZ3L is connected to the drive section 120.

Figure 53:
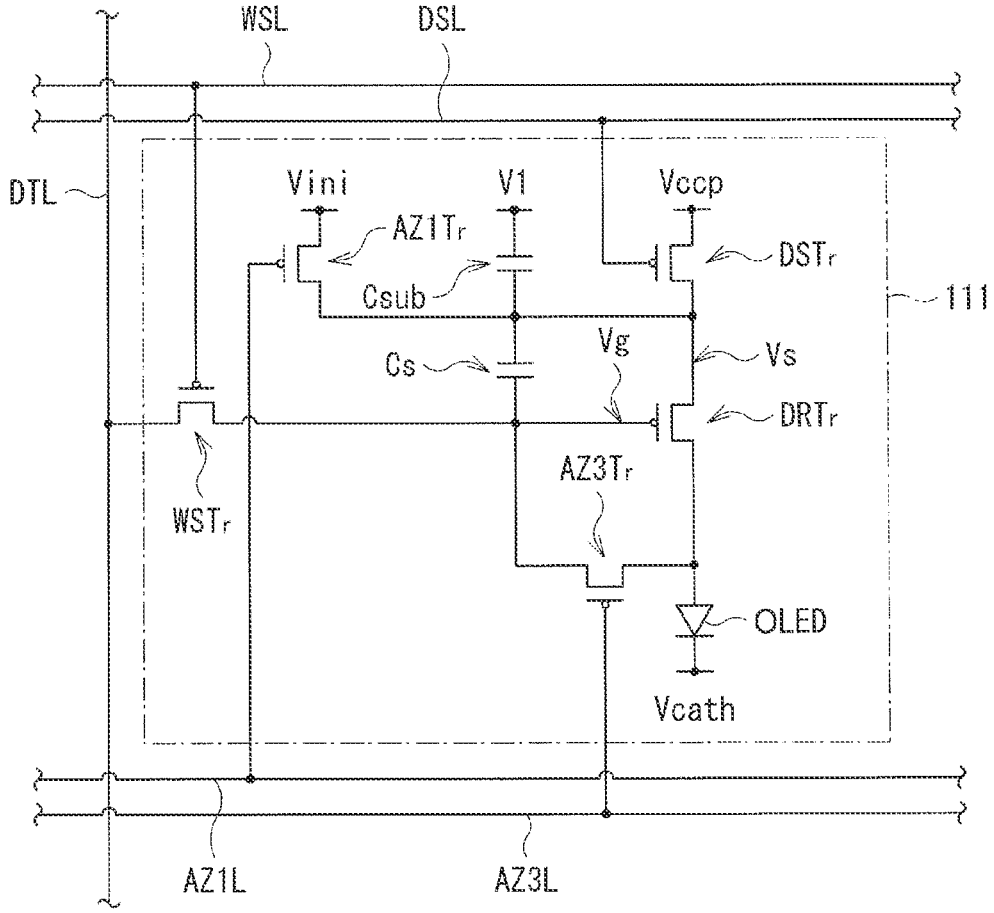
FIG. 53 is a circuit diagram illustrating a configuration example of a sub-pixel shown in FIG. 52.

FIG. 53 illustrates an example of a circuit configuration of the sub-pixel 111. The sub-pixel 111 includes the write transistor WSTr, the drive transistor DRTr, the control transistor AZ1Tr, a control transistor AZ3Tr, the power transistor DSTr, and a capacitor Csub.

The write transistor WSTr, the drive transistor DRTr, the control transistors AZ1Tr and AZ3Tr, and the power transistor DSTr may each be configured, for example, of a TFT of a P-channel MOS type. The gate of the write transistor WSTr is connected to the scanning line WSL, the source thereof is connected to the data line DTL, and the drain thereof is connected to the gate of the drive transistor DRTr, the first end of the capacitor Cs, and the like. The gate of the drive transistor DRTr is connected to the drain of the write transistor WSTr, the first end of the capacitor Cs, and the like, the source thereof is connected to the drain of the power transistor DSTr, the second end of the capacitor Cs, and the like, and the drain thereof is connected to the anode of the organic EL device OLED and the like. The gate of the control transistor AZ1Tr is connected to the control line AZ1L, the source thereof is supplied with the voltage Vini by the drive section 120, and the drain thereof is connected to the source of the drive transistor DRTr, the second end of the capacitor Cs, and the like. A gate of the control transistor AZ3Tr is connected to the control line AZ3L, one of a source and a drain thereof is connected to the gate of the drive transistor DRTr, the first end of the capacitor Cs, and the like, and the other of the source and the drain thereof is connected to the drain of the drive transistor DRTr and the like. The gate of the power transistor DSTr is connected to the power control line DSL, the source thereof is supplied with the voltage Vccp by the drive section 120, and the drain thereof is connected to the source of the drive transistor DRTr, the second end of the capacitor Cs, and the like.

One end of the capacitor Csub is connected to the source of the drive transistor DRTr, the second end of the capacitor Cs, and the like, and the other end of the capacitor Csub is supplied with a voltage V1 by the drive section 120. The voltage V1 may be any direct-current voltage, and may be, for example, any of the voltages Vccp, Vini, Vofs, and Vcath.

The write transistor WSTr corresponds to a specific but not limitative example of "eleventh transistor" in one embodiment of the present disclosure. The control transistor AZ3Tr corresponds to a specific but not limitative example of "twelfth transistor" in one embodiment of the present disclosure.

The drive section 120 includes a timing generation section 122, a scanning line drive section 123, a control line drive section 124, a power control line drive section 125, and a data line drive section 127. The timing generation section 122 is a circuit that supplies a control signal to each of the scanning line drive section 123, the control line drive section 124, the power control line drive section 125, and the data line drive section 127 based on the synchronization signal Ssync that is supplied from the outside, and thereby controlling these sections to operate in synchronization with each other. The control line drive section 124 sequentially applies the control signals AZ1 to the plurality of control lines AZ1L and sequentially applies the control signals AZ3 to the plurality of control lines AZ3L, in accordance with the control signal supplied from the timing generation section 122. The scanning line drive section 123, the power control line drive section 125, and the data line drive section 127 have functions similar to those of the scanning line drive section 23, the power control line drive section 25A, and the data line drive section 27, respectively.

Figure 54:
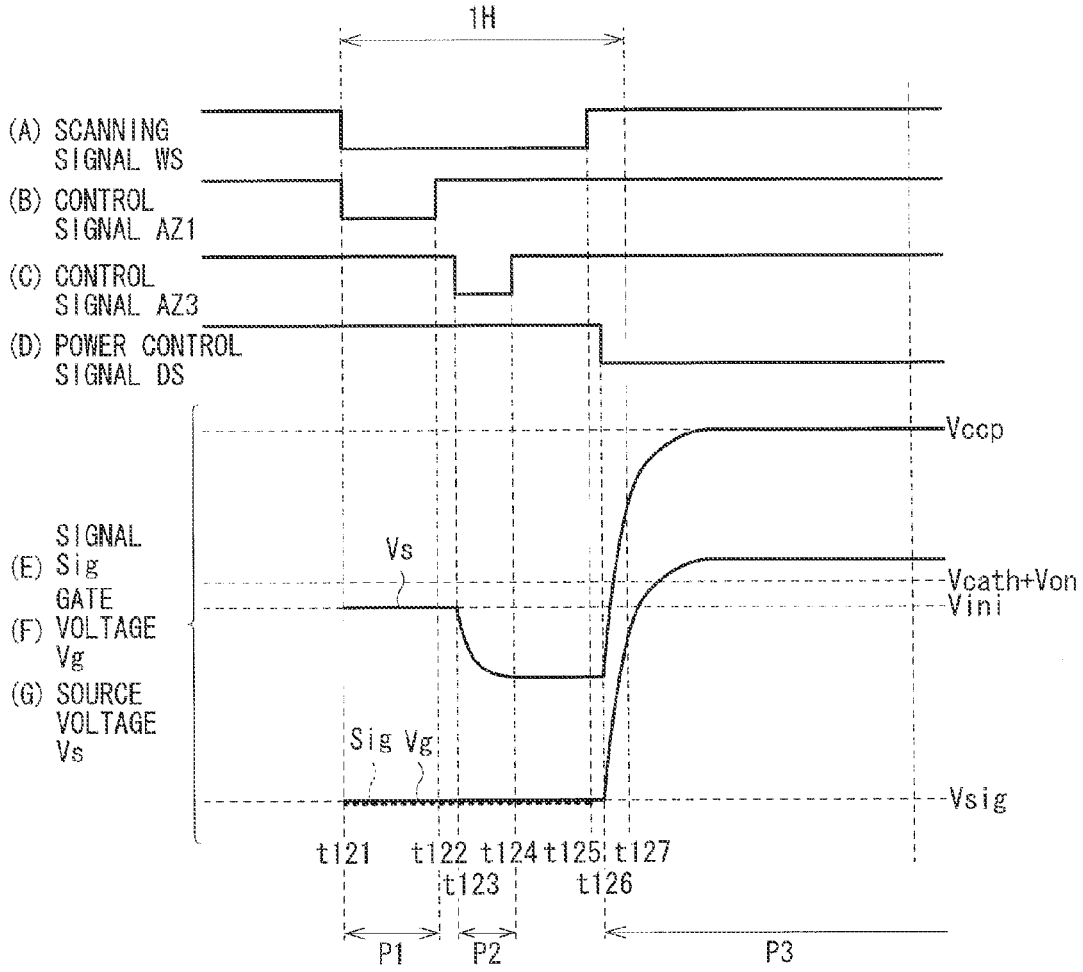
FIG. 54 is a timing waveform chart illustrating an operation example of a display unit shown in FIG. 52.

FIG. 54 is a timing chart of display operation in the display unit 100. In FIG. 54, Part (A) shows the waveform of the scanning signal WS, Part (B) shows the waveform of the control signal AZ1, Part (C) shows a waveform of the control signal AZ3, Part (D) shows the waveform of the power control signal DS, Part (E) shows the waveform of the signal Sig, Part (F) shows the waveform of the gate voltage Vg of the drive transistor DRTr, and Part (G) shows the waveform of the source voltage Vs of the drive transistor DRTr.

First, the drive section 120 writes the pixel voltage Vsig in the sub-pixel 111 and initializes the sub-pixel 111 in a period (write period P1) from timing t121 to timing t122. Specifically, first, at the timing t121, the data line drive section 127 sets the signal Sig to the pixel voltage Vsig (Part (E) in FIG. 54), and the scanning line drive section 123 allows the voltage of the scanning signal WS to be varied from a high level to a low level (Part (A) in FIG. 54). Accordingly, the write transistor WSTr is turned on, and the gate voltage Vg of the drive transistor DRTr is set to the pixel voltage Vsig (Part (F) in FIG. 54). At the same time, the control line drive section 124 allows the voltage of the control signal AZ1 to be varied from a high level to a low level (Part (B) in FIG. 54). Accordingly, the control transistor AZ1Tr is turned on, and the source voltage Vs of the drive transistor DRTr is set to the voltage Vini (Part (G) in FIG. 54). Thus, the sub-pixel 111 is initialized.

Subsequently, at the timing t122, the control line drive section 124 allows the voltage of the control signal AZ1 to be varied from the low level to the high level (Part (B) in FIG. 54). Accordingly, the control transistor AZ1Tr is turned off, and the supply of the voltage Vini to the source of the drive transistor DRTr is stopped.

Subsequently, the drive section 120 performs the Ids correction on the sub-pixel 111 in a period (Ids correction period P2) from timing t123 to timing t124. Specifically, at the timing t123, the control line drive section 124 allows a voltage of the control signal AZ3 to be varied from a high level to a low level (Part (C) in FIG. 54). Accordingly, the control transistor AZ3Tr is turned on, and the drain and the gate of the drive transistor DRTr are connected to each other through the control transistor AZ3Tr (a so-called "diode connection"). Accordingly, a current is flown from the source to the gate of the drive transistor DRTr through the drain thereof, and the source voltage Vs is decreased (Part (G) in FIG. 54). Because the source voltage Vs is thus decreased, the current flown from the source to the drain of the drive transistor DRTr is decreased. With this negative feedback operation, the source voltage Vs is decreased in a slower pace over time. A length of the time period (from the timing t123 to the timing t124) for performing the Ids correction is determined in order to suppress variations in the current that flows through the drive transistor DRTr at the timing t124 as described in the above first embodiment.

Subsequently, at the timing t124, the control line drive section 124 allows the voltage of the control signal AZ3 to be varied from the low level to the high level (Part (C) in FIG. 54). Accordingly, the control transistor AZ3Tr is turned off. Therefore, after this, the voltage between the terminals of the capacitor Cs, that is, the gate-source voltage Vgs of the drive transistor DRTr is maintained.

Subsequently, at timing t125, the scanning line drive section 123 allows the voltage of the scanning signal WS to be varied from the low level to the high level (Part (A) in FIG. 54). Accordingly, the write transistor WSTr is turned off.

Subsequently, the drive section 120 allows the sub-pixel 111 to emit light in a period (light emission period P3) that begins from timing t126. Specifically, at the timing t126, the power control line drive section 125 allows the voltage of the power control signal DS to be varied from a high level to a low level (Part (D) in FIG. 54). Accordingly, the power transistor DSTr is turned on, and the source voltage Vs of the drive transistor DRTr is increased toward the voltage Vccp (Part (G) in FIG. 54). In accordance therewith, the gate voltage Vg of the drive transistor DRTr is also increased (Part (F) in FIG. 54). Accordingly, the drive transistor DRTr is allowed to operate in a saturation region, and a current is flown through a path including the power transistor DSTr, the drive transistor DRTr, and the organic EL device OLED in order. Accordingly, the organic EL device OLED emits light.

Subsequently, in the display unit 100, the transition is made from the light emission period P3 to the write period P1 after a predetermined period (one frame period) has passed. The drive section 120 drives the sub-pixel 111 so that the above-described series of operation is repeated.

As described above, in the present embodiment, the display section is configured only of a PMOS transistor without using an NMOS transistor. Therefore, the display section may be manufactured, for example, even in a process in which the NMOS transistor is not allowed to be manufactured, such as in an organic TFT (O-TFT) process.

[Modification 8-1]

In the above-described eighth embodiment, the sub-pixel 111 includes five transistors. However, this is not limitative. Alternatively, for example, the sub-pixel may further include other transistors. An example thereof will be described below.

Figure 55:
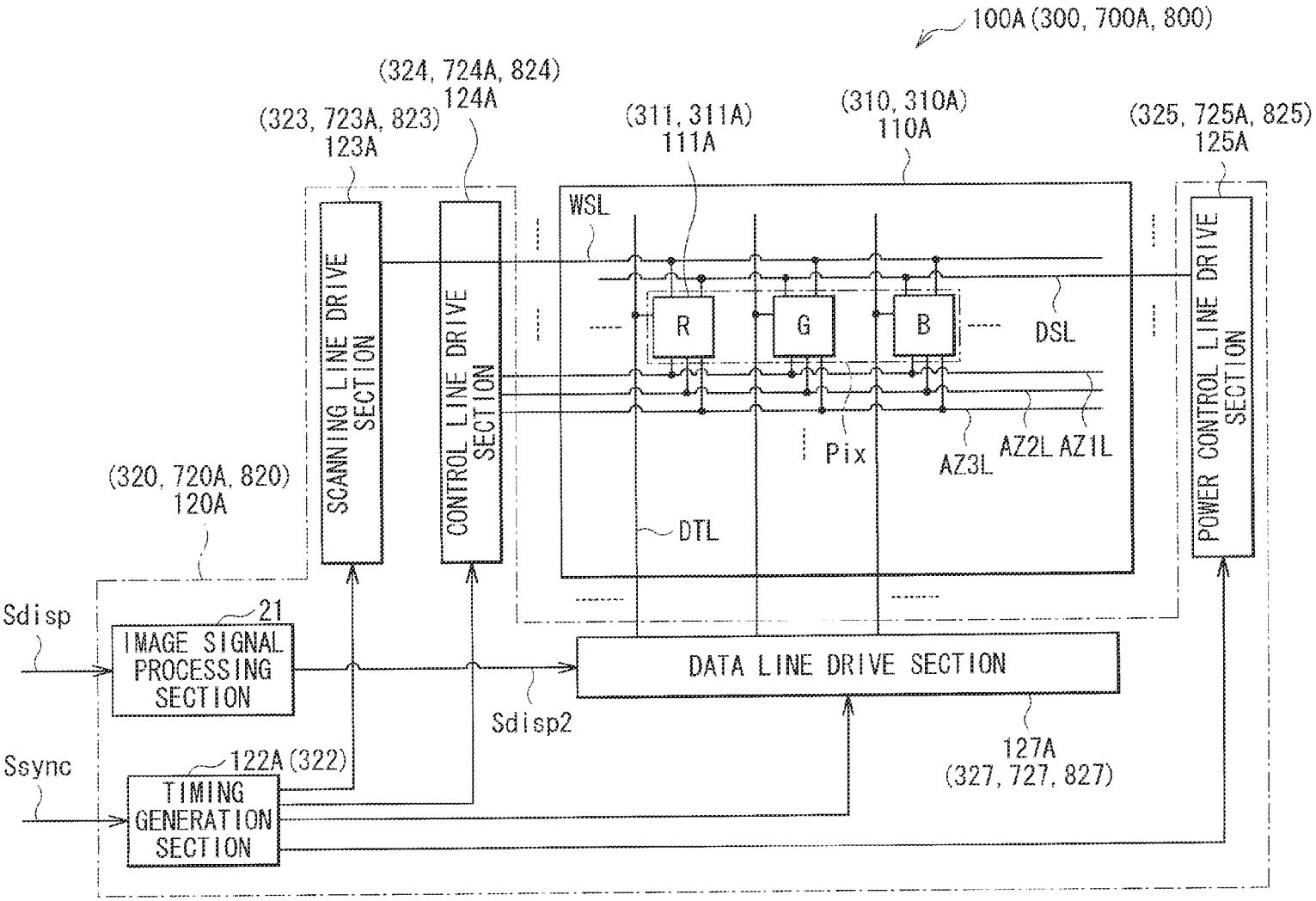
FIG. 55 is a block diagram illustrating a configuration example of a display unit according to a modification of the eighth embodiment.

FIG. 55 illustrates a configuration example of a display unit 100A according to the present modification. The display unit 100A includes a display section 110A and a drive section 120A. The display section 110A includes a plurality of sub-pixels 111A and the plurality of control lines AZ2L that extend in the row direction. One end of each of the control lines AZ2L is connected to the drive section 120A.

Figure 56:
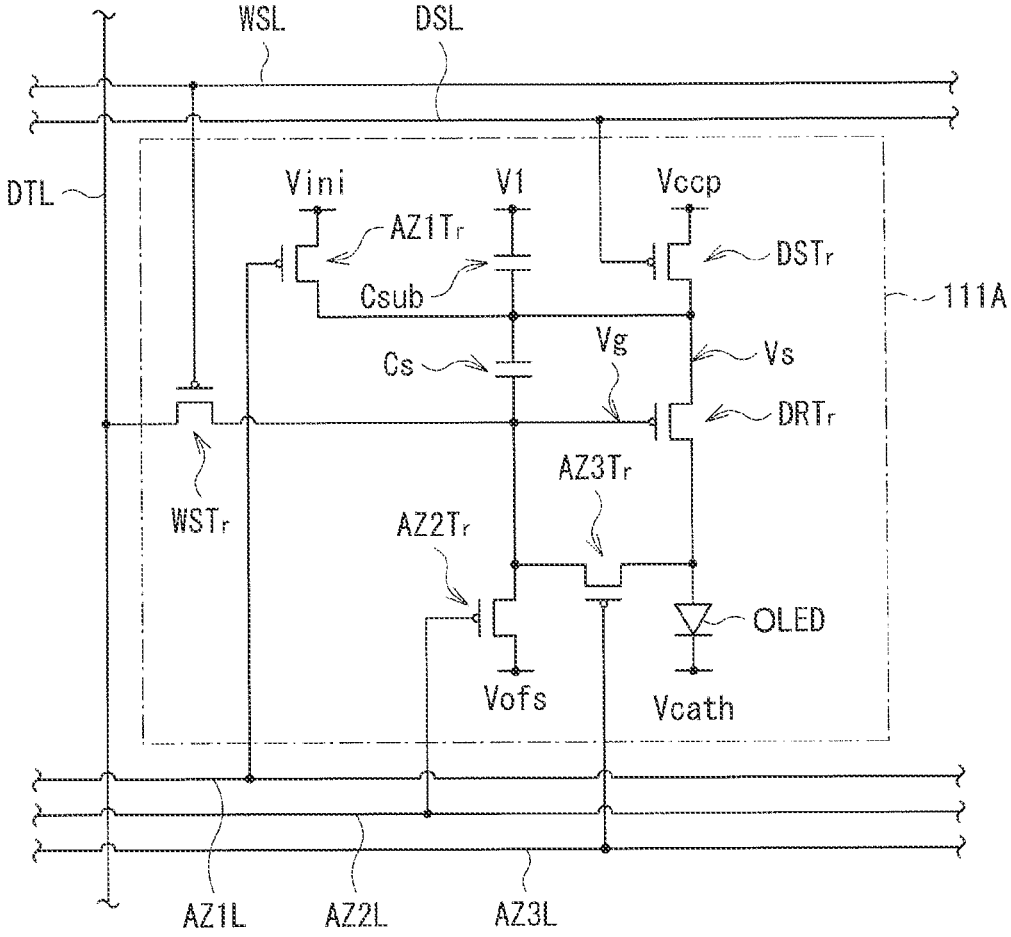
FIG. 56 is a circuit diagram illustrating a configuration example of a sub-pixel shown in FIG. 55.

FIG. 56 illustrates an example of a circuit configuration of the sub-pixel 111A. The sub-pixel 111A includes the control transistor AZ2Tr. The control transistor AZ2Tr is configured of a TFT of a P-channel MOS type. The gate of the control transistor AZ2Tr is connected to the control line AZ2L, the source thereof is supplied with the voltage Vofs by the drive section 120A, and the drain thereof is connected to the gate of the drive transistor DRTr, the first end of the capacitor Cs, and the like.

Figure 57:
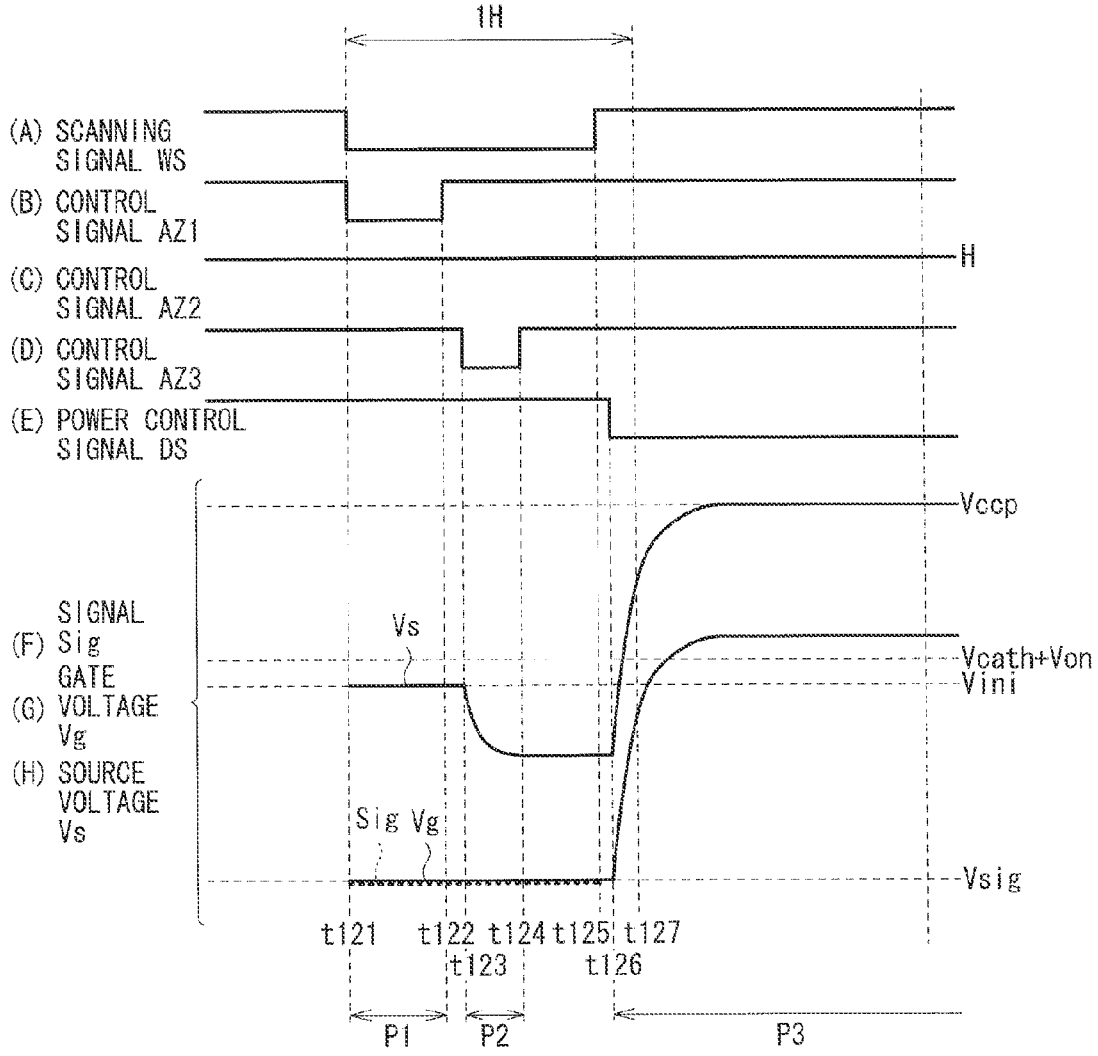
FIG. 57 is a timing waveform chart illustrating an operation example of a display unit shown in FIG. 55.

Also in such a configuration, the same method as the driving method shown in FIG. 54 is achievable by allowing the control signal AZ2 to be mostly at the high level (H) (Part (C) in FIG. 57) to allow the control transistor AZ2Tr to be mostly OFF, as shown in FIG. 57.

[Modification 8-2]

In the above-described eighth embodiment, the voltage Vini is supplied to the source of the drive transistor DRTr by allowing the control transistor AZ1Tr to be ON in the write period P1. However, this is not limitative. Alternatively, for example, the voltage Vini may be supplied to the source of the drive transistor DRTr by allowing the power transistor DSTr to be ON. The present modification will be described below in detail.

Figure 58:
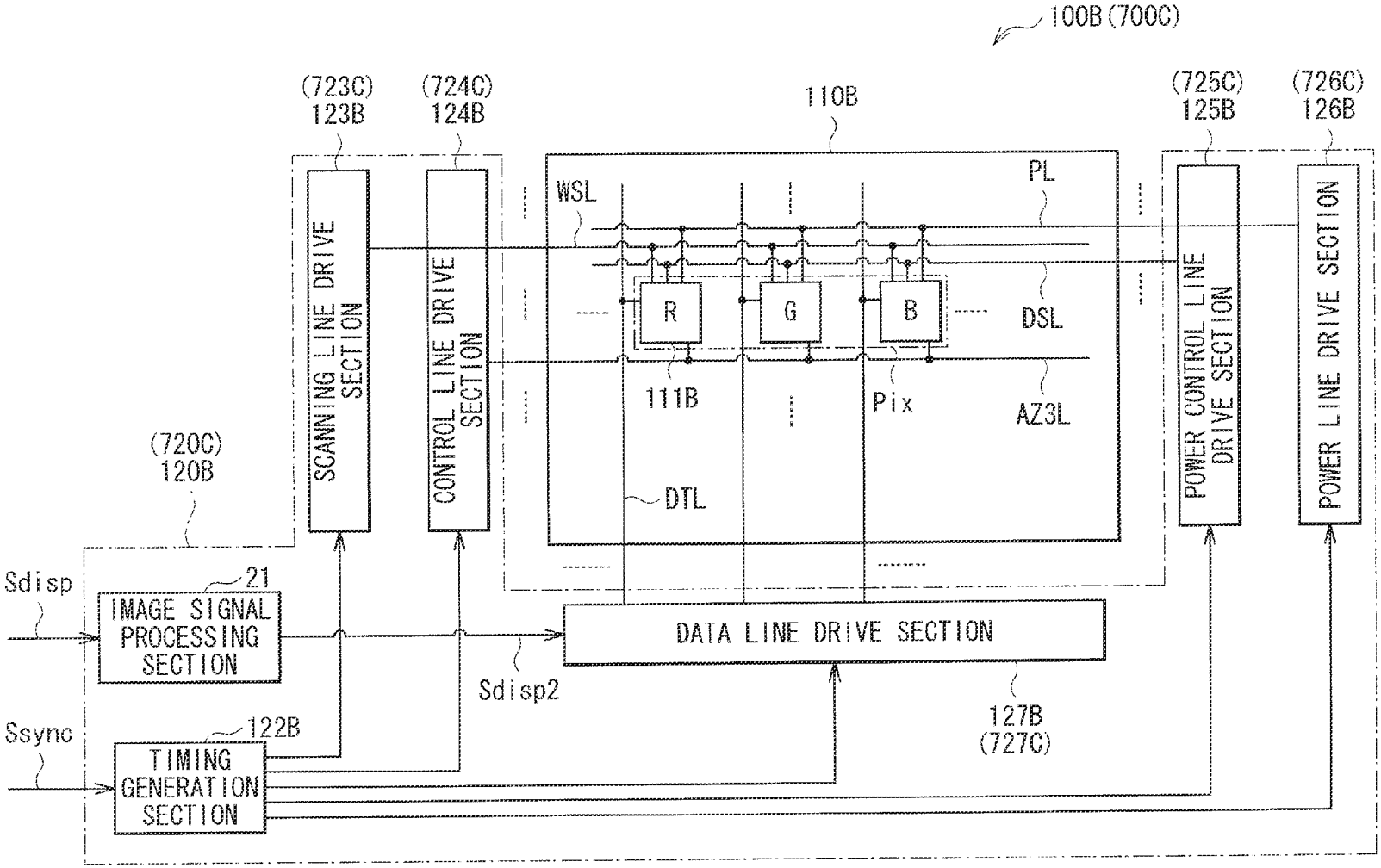
FIG. 58 is a block diagram illustrating a configuration example of a display unit according to another modification of the eighth embodiment.

FIG. 58 illustrates a configuration example of a display unit 100B according to the present modification. The display unit 100B includes a display section 110B and a drive section 120B. The display section 110B includes a plurality of sub-pixels 111B. The display section 110B also includes the plurality of power lines PL and the plurality of control lines AZ3L that extend in the row direction. One end of each of the power lines PL that extend in the row direction and the control lines AZ3L is connected to the drive section 120B.

Figure 59:
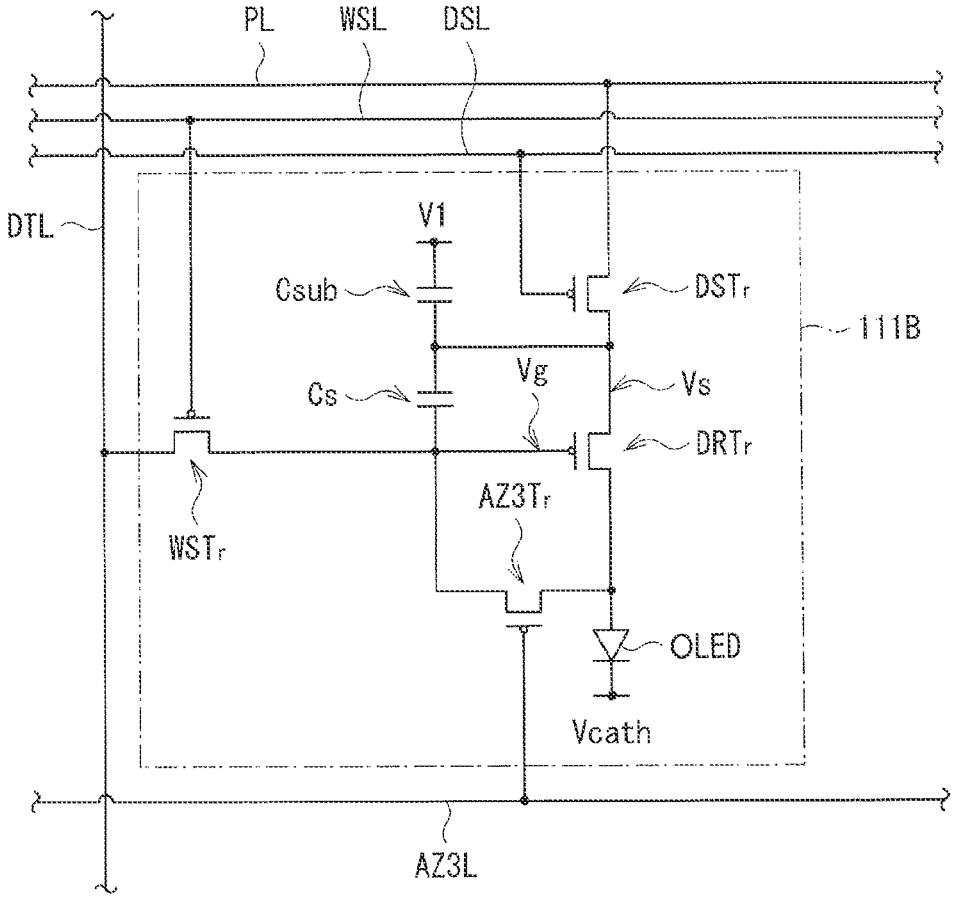
FIG. 59 is a circuit diagram illustrating a configuration example of a sub-pixel shown in FIG. 58.

FIG. 59 illustrates an example of a circuit configuration of the sub-pixel 111B. In the sub-pixel 111B, the source of the power transistor DSTr is connected to the power line PL. The power transistor DSTr corresponds to a specific but not limitative example of "thirteenth transistor" in one embodiment of the present disclosure.

The drive section 120B includes a timing generation section 122B, a scanning line drive section 123B, a control line drive section 124B, a power control line drive section 125B, a power line drive section 126B, and a data line drive section 127B. The timing generation section 122B is a circuit that supplies a control signal to each of the scanning line drive section 123B, the control line drive section 124B, the power control drive section 125B, the power line drive section 126B, and the data line drive section 127B based on the synchronization signal Ssync that is supplied from the outside, and thereby controlling these sections to operate in synchronization with each other. The control line drive section 124B sequentially applies the control signals AZ3 to the plurality of control lines AZ3L in accordance with the control signal supplied from the timing generation section 122B. The scanning line drive section 123B, the power control line drive section 125B, the power line drive section 126B, and the data line drive section 127B have functions similar to those of the scanning line drive section 23, the power control line drive section 25A, the power line drive section 26, and the data line drive section 27, respectively.

Figure 60:
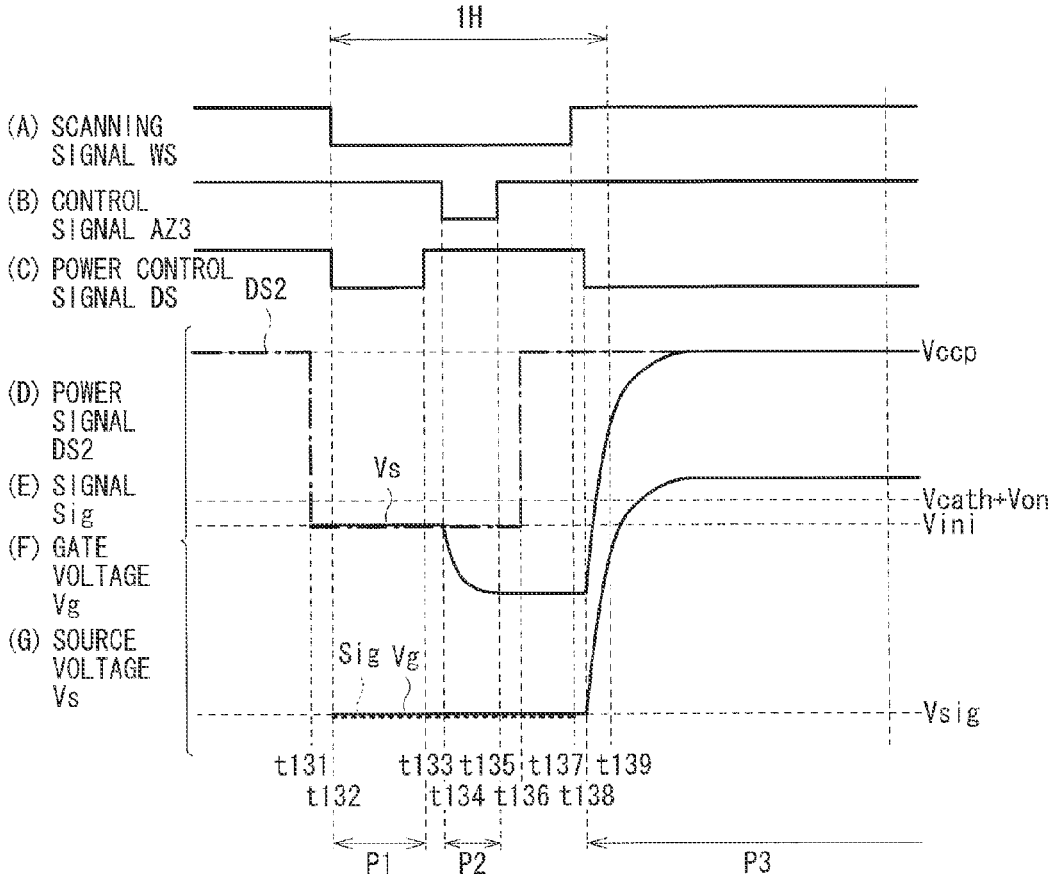
FIG. 60 is a timing waveform chart illustrating an operation example of a display unit shown in FIG. 58.

FIG. 60 is a timing chart of display operation in the display unit 100B. In FIG. 60, Part (A) shows the waveform of the scanning signal WS, Part (B) shows the waveform of the control signal AZ3, Part (C) shows the waveform of the power control signal DS, Part (D) shows the waveform of the power signal DS2, Part (E) shows the waveform of the signal Sig, Part (F) shows the waveform of the gate voltage Vg of the drive transistor DRTr, and Part (G) shows the waveform of the source voltage Vs of the drive transistor DRTr.

First, at timing t131 prior to the write period P1, the power line drive section 126B allows the power signal DS2 to be varied from the voltage Vccp to the voltage Vini (Part (D) in FIG. 60).

Subsequently, the drive section 120B writes the pixel voltage Vsig in the sub-pixel 111B in a period (write period P1) from timing t132 to timing t133, as in the above-described eighth embodiment. Further, at the timing t132, the power control line drive section 125B allows the voltage of the power control signal DS to be varied from a high level to a low level (Part (C) in FIG. 60). Accordingly, the power transistor DSTr is turned on, and the source voltage Vs of the drive transistor DRTr is set to the voltage Vini (Part (G) in FIG. 60). Thus, the sub-pixel 111B is initialized.

Subsequently, at the timing t133, the power control line drive section 125B allows the voltage of the power control signal DS to be varied from the low level to the high level (Part (C) in FIG. 60). Accordingly, the power transistor DSTr is turned off, and the supply of the voltage Vini to the source of the drive transistor DRTr is stopped.

Subsequently, the drive section 120B performs the Ids correction in a period (Ids correction period P2) from timing t134 to timing t135 as in the above-described eighth embodiment.

At timing t136, the power line drive section 126B allows the power signal DS2 to be varied from the voltage Vini to the voltage Vccp (Part (D) in FIG. 60).

Effects similar to those in the above-described eighth embodiment are obtainable also in such a configuration.

[Modification 8-3]

In the above-described eighth embodiment, the voltage Vini is supplied to the source of the drive transistor DRTr by allowing the control transistor AZ1Tr to be ON in the write period P1. However, this is not limitative. Alternatively, for example, the voltage Vccp may be supplied to the source of the drive transistor DRTr by allowing the power transistor DSTr to be ON. The present modification will be described below in detail.

Figure 61:
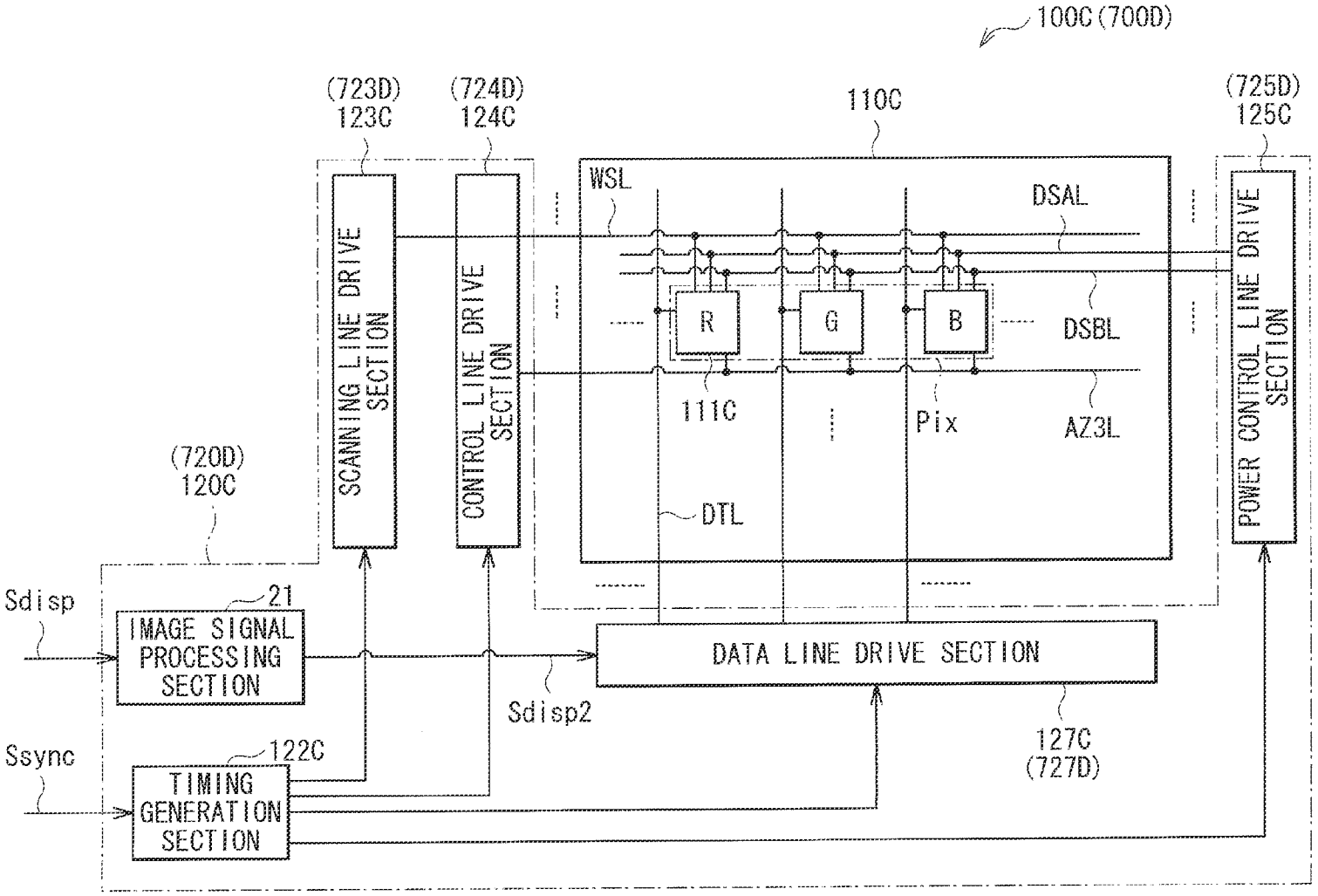
FIG. 61 is a block diagram illustrating a configuration example of a display unit according to another modification of the eighth embodiment.

FIG. 61 illustrates a configuration example of a display unit 100C according to the present modification. The display unit 100C includes a display section 110C and a drive section 120C. The display section 110C includes a plurality of sub-pixels 111C. The display section 110C also includes a plurality of power control lines DSAL and DSBL that extend in the row direction and the plurality of control lines AZ3L that extend in the row direction. One end of each of the power control lines DSAL and DSBL and the control lines AZ3L is connected to the drive section 120C.

Figure 62:
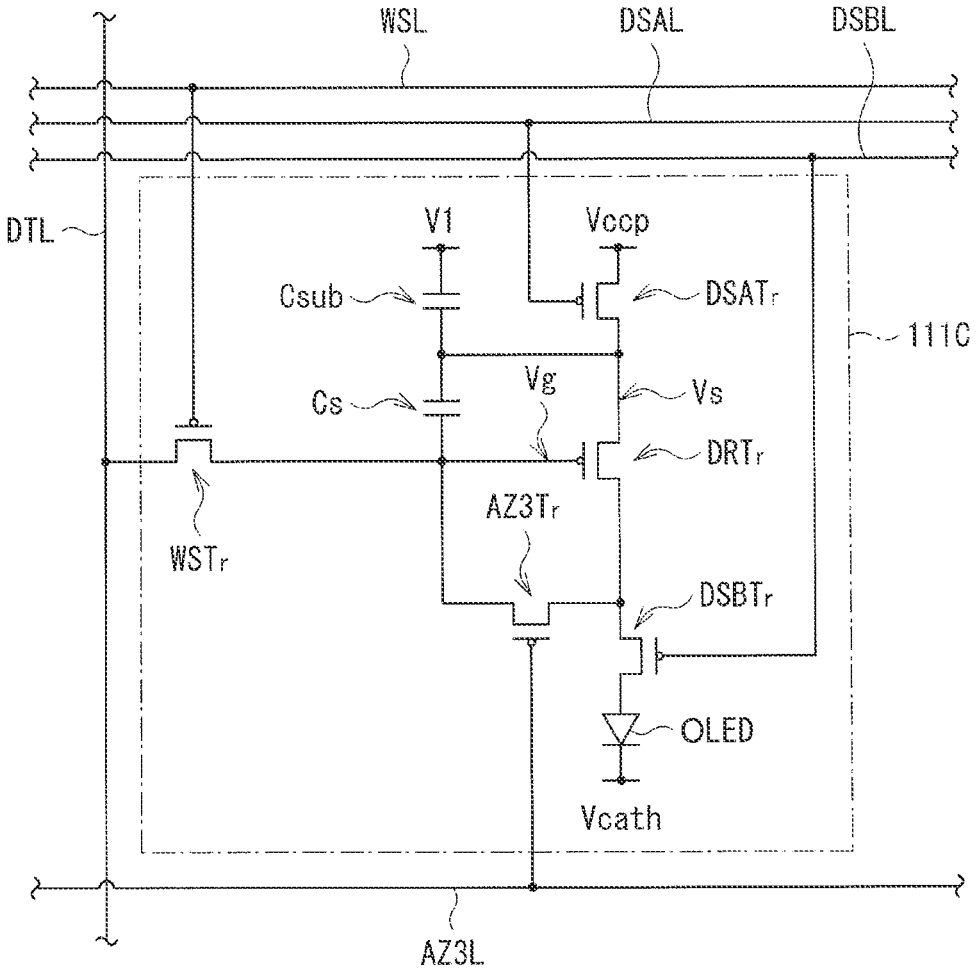
FIG. 62 is a circuit diagram illustrating a configuration example of a sub-pixel shown in FIG. 61.

FIG. 62 illustrates an example of a circuit configuration of the sub-pixel 111C. The sub-pixel 111C includes power transistors DSATr and DSBTr. The power transistors DSATr and DSBTr are each configured of a TFT of a P-channel MOS type. A gate of the power transistor DSATr is connected to the power control line DSAL, a source thereof is supplied with the voltage Vccp by the drive section 120C, and a drain thereof is connected to the source of the drive transistor DRTr, the second end of the capacitor Cs, and the like. A gate of the power transistor DSBTr is connected to the power control line DSBL, a source thereof is connected to the drain of the drive transistor DRTr and the like, and a drain thereof is connected to the anode of the organic EL device OLED. The power transistor DSBTr corresponds to a specific but not limitative example of "fourteenth transistor" in one embodiment of the present disclosure.

The drive section 120C includes a timing generation section 122C, a scanning line drive section 123C, a control line drive section 124C, a power control line drive section 125C, and a data line drive section 127C. The timing generation section 122C is a circuit that supplies a control signal to each of the scanning line drive section 123C, the control line drive section 124C, the power control drive section 125C, and the data line drive section 127C based on the synchronization signal Ssync that is supplied from the outside, and thereby controlling these sections to operate in synchronization with each other. The power control line drive section 125C sequentially applies power control signals DSA to the plurality of power control lines DSAL and sequentially applies power control signals DSB to the plurality of power control lines DSBL, in accordance with the control signal supplied from the timing generation section 122C. The scanning drive section 123C, the control line drive section 124C, and the data line drive section 127C have functions similar to those of the scanning line drive section 23, the control line drive section 124B, and the data line drive section 27, respectively.

Figure 63:
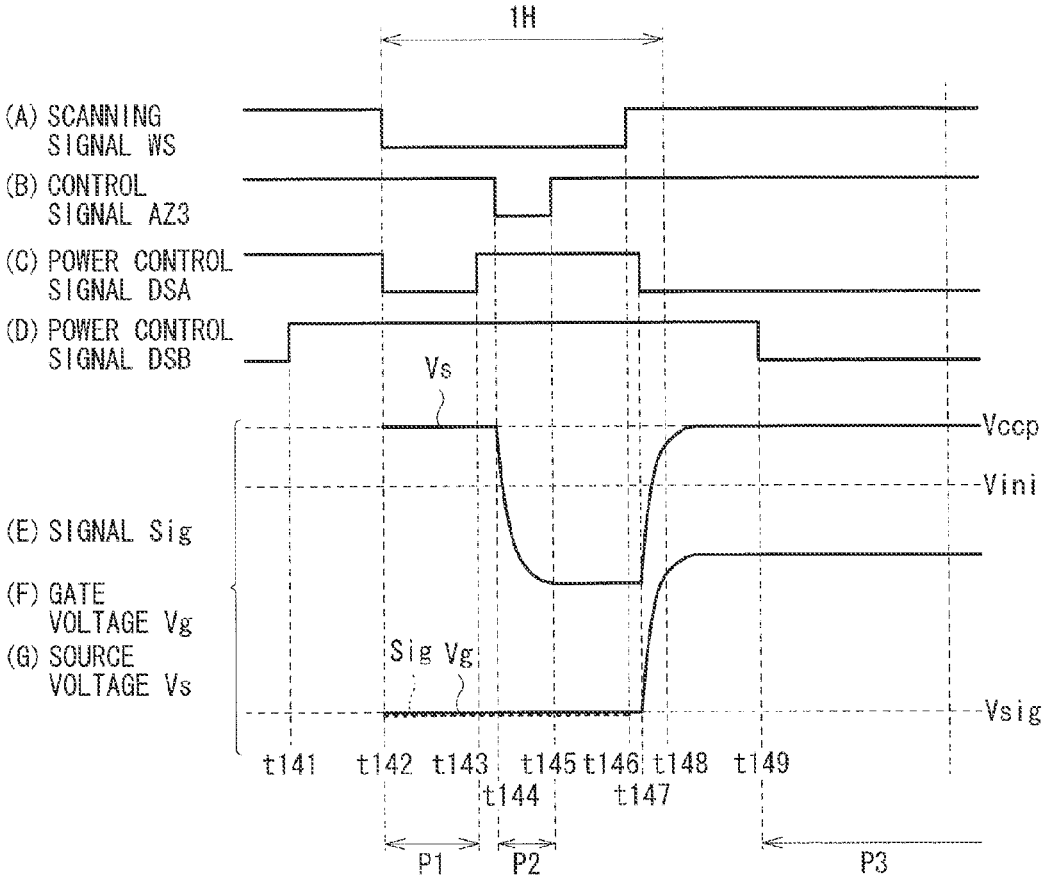
FIG. 63 is a timing waveform chart illustrating an operation example of a display unit shown in FIG. 61.

FIG. 63 is a timing chart of display operation in the display unit 100C. In FIG. 63, Part (A) shows the waveform of the scanning signal WS, Part (B) shows the waveform of the control signal AZ3, Part (C) shows a waveform of the power control signal DSA, Part (D) shows a waveform of the power control signal DSB, Part (E) shows the waveform of the signal Sig, Part (F) shows the waveform of the gate voltage Vg of the drive transistor DRTr, and Part (G) shows the waveform of the source voltage Vs of the drive transistor DRTr.

First, at timing t141 prior to the write period P1, the power control line drive section 125C allows a voltage of the power control signal DSB to be varied from a low level to a high level (Part (D) in FIG. 63). Accordingly, the power transistor DSBTr is turned off.

Subsequently, the drive section 120C writes the pixel voltage Vsig in the sub-pixel 111C in a period (write period P1) from timing t142 to timing t143, as in the above-described eighth embodiment. Further, at the timing t142, the power control line drive section 125C allows a voltage of the power control signal DSA to be varied from a high level to a low level (Part (C) in FIG. 63). Accordingly, the power transistor DSATr is turned on, and the source voltage Vs of the drive transistor DRTr is set to the voltage Vccp (Part (G) in FIG. 63). At that time, because the power transistor DSBTr is OFF, a current does not flow into the organic EL device OLED. Thus, the sub-pixel 111C is initialized.

Subsequently, at the timing t143, the power control line drive section 125C allows the voltage of the power control signal DSA to be varied from the low level to the high level (Part (C) in FIG. 63). Accordingly, the power transistor DSATr is turned off, and the supply of the voltage Vccp to the source of the drive transistor DRTr is stopped.

Subsequently, the drive section 120C performs the Ids correction in a period (Ids correction period P2) from timing t144 to timing t145 as in the above-described eighth embodiment.

Subsequently, at timing t146, the scanning line drive section 123C allows the voltage of the scanning signal WS to be varied from the low level to the high level (Part (A) in FIG. 63). Accordingly, the write transistor WSTr is turned off.

Subsequently, at timing t147, the power control line drive section 125C allows the voltage of the power control signal DSA to be varied from the high level to the low level (Part (C) in FIG. 63). Accordingly, the power transistor DSATr is turned on, and the source voltage Vs of the drive transistor DRTr is increased toward the voltage Vccp (Part (G) in FIG. 63). In accordance therewith, the gate voltage Vg of the drive transistor DRTr is also increased (Part (F) in FIG. 63).

Subsequently, the drive section 120C allows the sub-pixel 111C to emit light in a period (light emission period P3) that begins from timing t149. Specifically, at the timing t149, the power control line drive section 125C allows the voltage of the power control signal DBS to be varied from the high level to the low level (Part (D) in FIG. 63). Accordingly, the power transistor DSBTr is turned on, and a current is flown through a path including the power transistor DSATr, the drive transistor DRTr, the power transistor DSBTr, and the organic EL device OLED in order. Accordingly, the organic EL device OLED emits light.

Effects similar to those in the above-described eighth embodiment are obtainable also in such a configuration.

Moreover, also in the present modification, for example, the sub-pixel may further include other transistors as will be described below.

Figure 64:
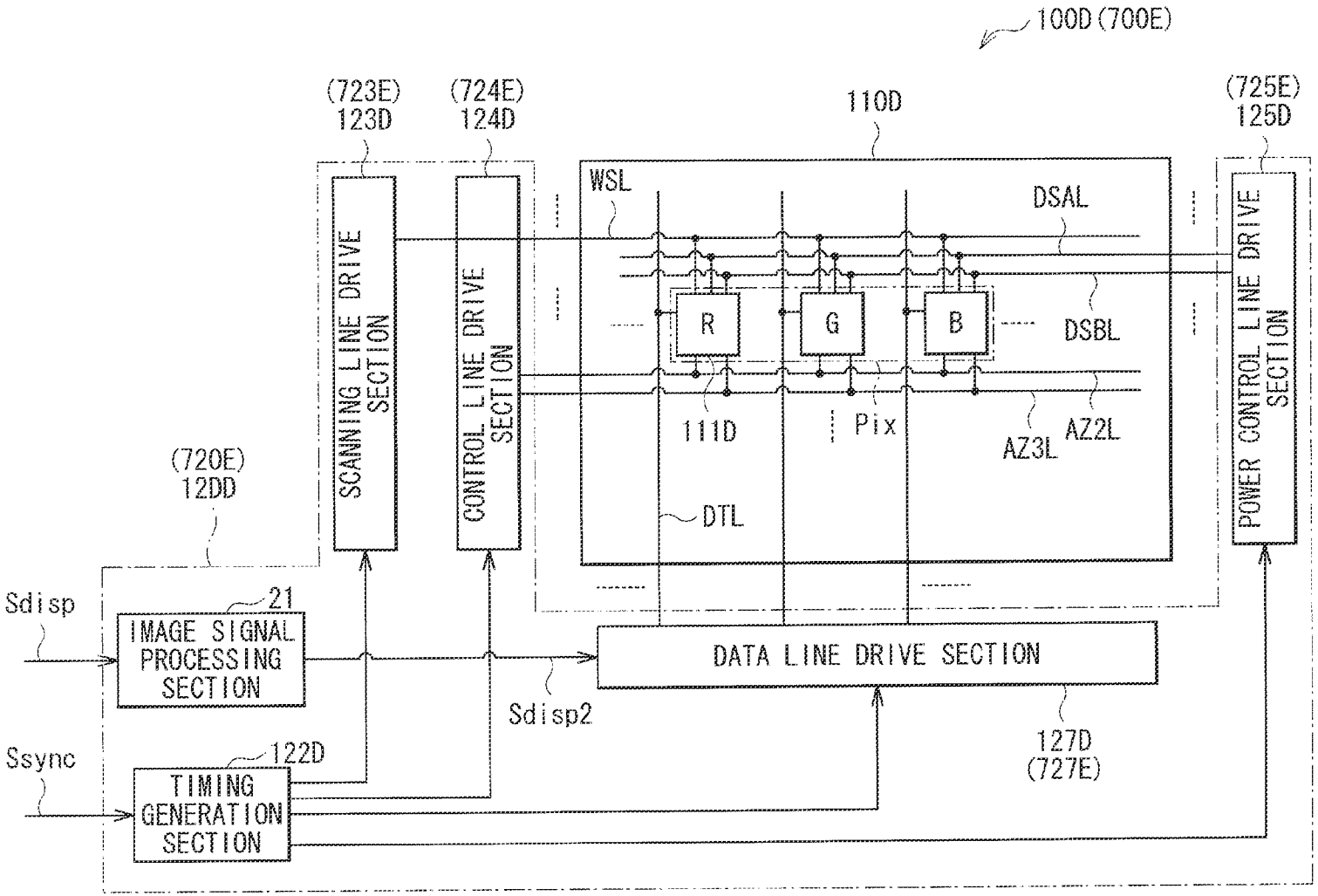
FIG. 64 is a block diagram illustrating a configuration example of a display unit according to another modification of the eighth embodiment.

FIG. 64 illustrates a configuration example of a display unit 100D according to the present modification. The display unit 100D includes a display section 110D and a drive section 120D. The display section 110D includes a plurality of sub-pixels 111D and the plurality of control lines AZ2L that extend in the row direction. One end of each of the control lines AZ2L is connected to the drive section 120D.

Figure 65:
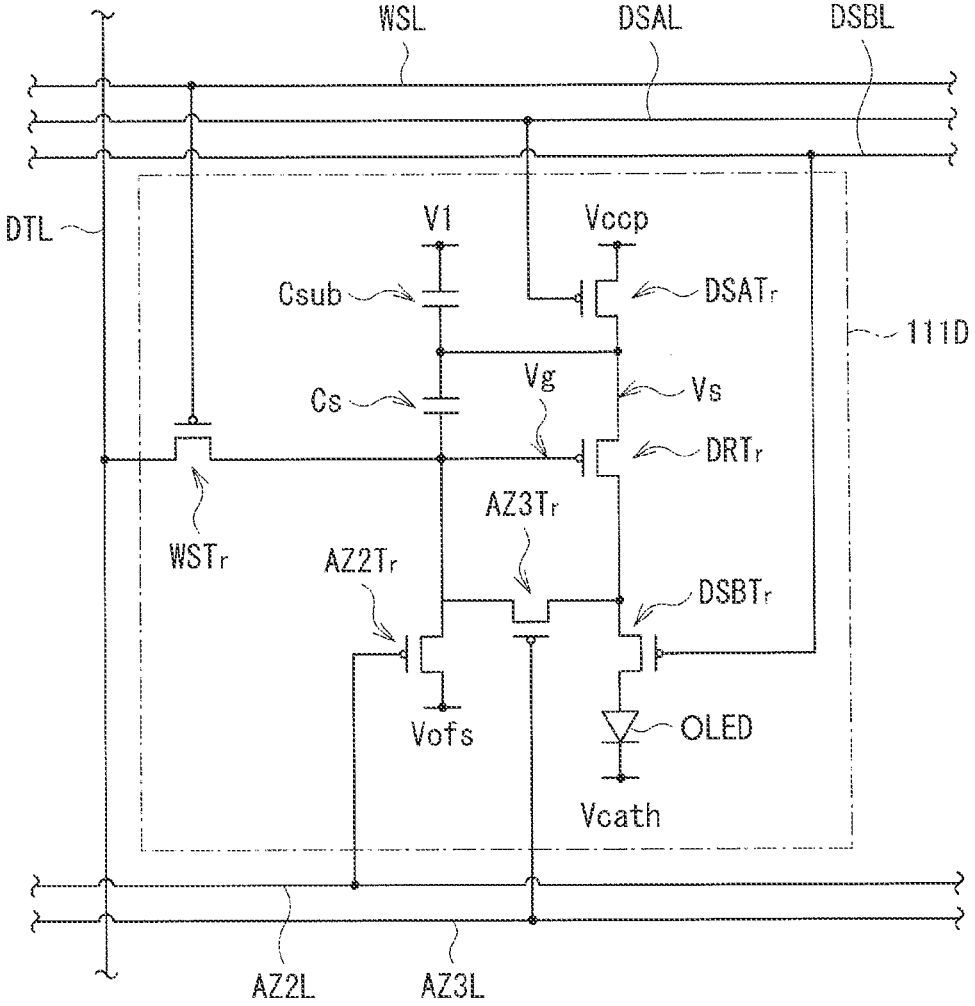
FIG. 65 is a circuit diagram illustrating a configuration example of a sub-pixel shown in FIG. 58.

FIG. 65 illustrates an example of a circuit configuration of the sub-pixel 111D. The sub-pixel 111D includes the control transistor AZ2Tr. The gate of the control transistor AZ2Tr is connected to the control line AZ2L, the source thereof is supplied with the voltage Vofs by the drive section 120D, and the drain thereof is connected to the gate of the drive transistor DRTr, the first end of the capacitor Cs, and the like.

Figure 66:
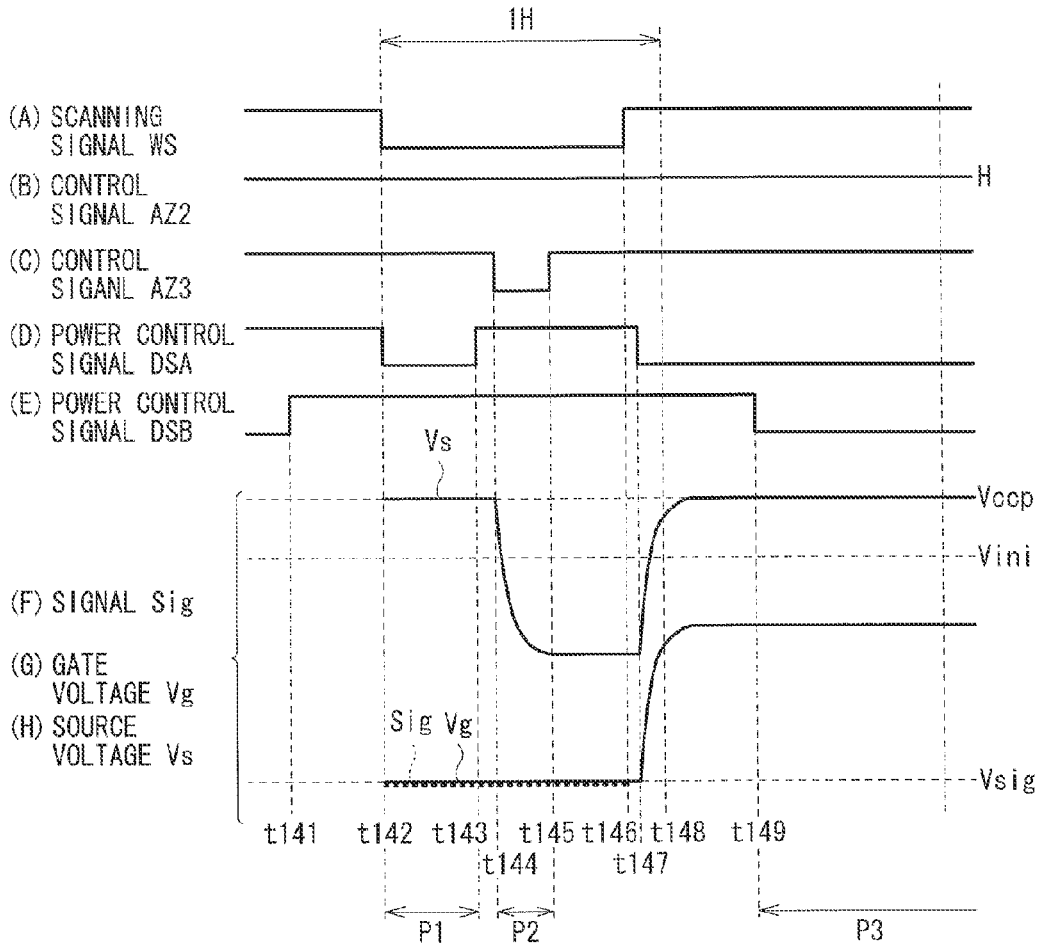
FIG. 66 is a timing waveform chart illustrating an operation example of the display unit shown in FIG. 58.

Also in such a configuration, the same method as the driving method shown in FIG. 63 is achievable by allowing the control signal AZ2 to be mostly at the high level (H) (Part (B) in FIG. 66) to allow the control transistor AZ2Tr to be mostly OFF, as shown in FIG. 66.

9. Ninth Embodiment

Next, a display unit 300 according to a ninth embodiment will be described. In the present embodiment, in a case where the drive transistor DRTr is configured of an NMOS transistor, the pixel voltage Vsig is applied to the source of the drive transistor DRTr, and the gate voltage is varied by the Ids correction. It is to be noted that the same numerals are used to designate substantially the same components of the display unit 1 according to the above-described first embodiment, and the description thereof will be appropriately omitted.

As shown in FIG. 55, the display unit 300 includes a display section 310 and a drive section 320. The display section 310 includes sub-pixels 311. The drive section 320 includes a timing generation section 322, a scanning line drive section 323, a control line drive section 324, a power control line drive section 325, and a data line drive section 327.

Figure 67:
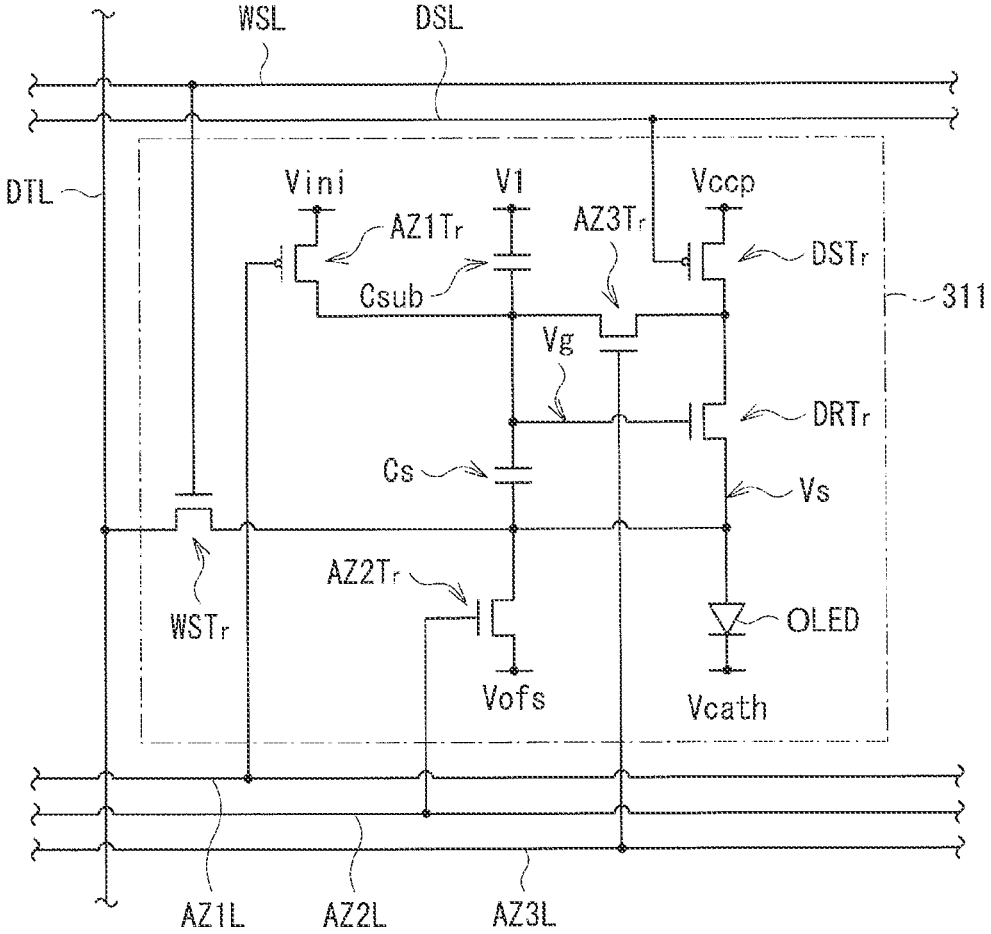
FIG. 67 is a circuit diagram illustrating a configuration example of a sub-pixel according to a ninth embodiment.

FIG. 67 illustrates an example of a circuit configuration of the sub-pixel 311. The sub-pixel 311 includes the write transistor WSTr, the drive transistor DRTr, the control transistors AZ1Tr, AZ2Tr, and AZ3Tr, the power transistor DSTr, and the capacitor Csub.

The write transistor WSTr, the drive transistor DRTr, and the control transistors AZ2Tr and AZ3Tr may each be configured, for example, of a TFT of an N-channel MOS type. The control transistor AZ1Tr and the power transistor DSTr may each be configured, for example, of a TFT of a P-channel MOS type. The gate of the write transistor WSTr is connected to the scanning line WSL, the source thereof is connected to the data line DTL, and the drain thereof is connected to the source of the drive transistor DRTr and the first end of the capacitor Cs. The gate of the drive transistor DRTr is connected to the second end of the capacitor Cs and the like, the drain thereof is connected to the drain of the power transistor DSTr and the like, and the source thereof is connected to the drain of the write transistor WSTr, the first end of the capacitor Cs, the anode of the organic EL device OLED, and the like. The gate of the control transistor AZ1Tr is connected to the control line AZ1L, the source thereof is supplied with the voltage Vini by the drive section 320, and the drain thereof is connected to the gate of the drive transistor DRTr, the second end of the capacitor Cs, and the like. The gate of the control transistor AZ2Tr is connected to the control line AZ2L, the source thereof is supplied with the voltage Vofs by the drive section 320, and the drain thereof is connected to the drain of the write transistor WSTr, the source of the drive transistor DRTr, the first end of the capacitor Cs, and the like. The gate of the control transistor AZ3Tr is connected to the control line AZ3L, one of the source and the drain thereof is connected to the gate of the drive transistor DRTr, the second end of the capacitor Cs, and the like, and the other of the source and the drain thereof is connected to the drain of the drive transistor DRTr, and the like. The gate of the power transistor DSTr is connected to the power control line DSL, the source thereof is supplied with the voltage Vccp by the drive section 320, and the drain thereof is connected to the drain of the drive transistor DRTr, and the like.

One end of the capacitor Csub is connected to the source of the drive transistor DRTr, the second end of the capacitor Cs, and the like, and the other end of the capacitor Csub is supplied with the voltage V1 by the drive section 320. The voltage V1 may be any direct-current voltage, and may be, for example, any of the voltages Vccp, Vini, Vofs, and Vcath.

The write transistor WSTr corresponds to a specific but not limitative example of "sixteenth transistor" in one embodiment of the present disclosure. The control transistor AZ3Tr corresponds to a specific but not limitative example of "seventeenth transistor" in one embodiment of the present disclosure.

Figure 68:
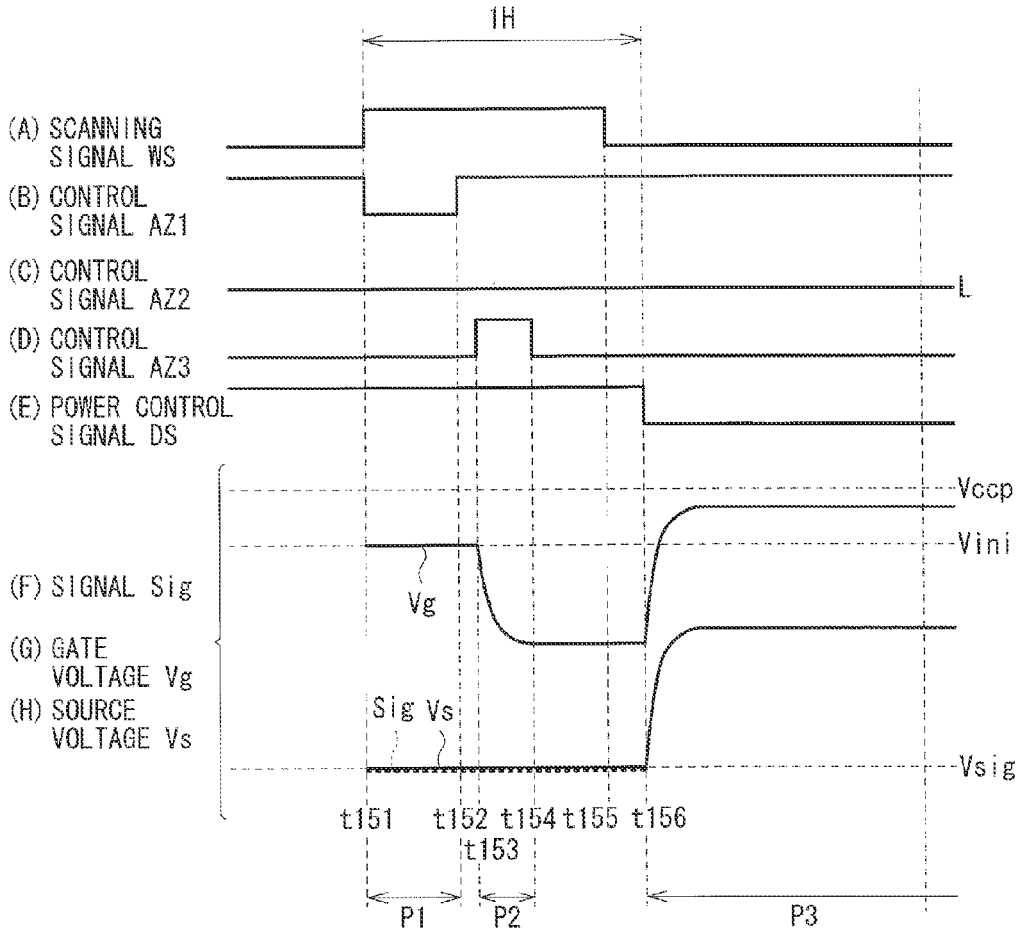
FIG. 68 is a timing waveform chart illustrating an operation example of a display unit according to the ninth embodiment.

FIG. 68 is a timing chart of display operation in the display unit 300. In FIG. 68, Part (A) shows the waveform of the scanning signal WS, Part (B) shows the waveform of the control signal AZ1, Part (C) shows the waveform of the control signal AZ2, Part (D) shows the waveform of the control signal AZ3, Part (E) shows the waveform of the power control signal DS, Part (F) shows the waveform of the signal Sig, Part (G) shows the waveform of the gate voltage Vg of the drive transistor DRTr, and Part (H) shows the waveform of the source voltage Vs of the drive transistor DRTr.

First, the drive section 320 writes the pixel voltage Vsig in the sub-pixel 311 and initializes the sub-pixel 311 in a period (write period P1) from timing t151 to timing t152. Specifically, first, at the timing t151, the data line drive section 327 sets the signal Sig to the pixel voltage Vsig (Part (F) in FIG. 68), and the scanning line drive section 323 allows the voltage of the scanning signal WS to be varied from a low level to a high level (Part (A) in FIG. 68). Accordingly, the write transistor WSTr is turned on, and the source voltage Vs of the drive transistor DRTr is set to the pixel voltage Vsig (Part (H) in FIG. 68). At the same time, the control line drive section 324 allows the voltage of the control signal AZ1 to be varied from a high level to a low level (Part (B) in FIG. 66). Accordingly, the control transistor AZ1Tr is turned on, and the gate voltage Vg of the drive transistor DRTr is set to the voltage Vini (Part (G) in FIG. 68). Thus, the sub-pixel 311 is initialized.

Subsequently, at the timing t152, the control line drive section 324 allows the voltage of the control signal AZ1 to be varied from the low level to the high level (Part (B) in FIG. 68). Accordingly, the control transistor AZ1Tr is turned off, and the supply of the voltage Vini to the gate of the drive transistor DRTr is stopped.

Subsequently, the drive section 320 performs the Ids correction on the sub-pixel 311 in a period (Ids correction period P2) from timing t153 to timing t154. Specifically, at the timing t153, the control line drive section 324 allows the voltage of the control signal AZ3 to be varied from a low level to a high level (Part (D) in FIG. 68). Accordingly, the control transistor AZ3Tr is turned on, and the drain and the gate of the drive transistor DRTr are connected to each other through the control transistor AZ3Tr (a so-called "diode connection"). Accordingly, a current is flown from the gate to the source of the drive transistor DRTr through the drain thereof, and the gate voltage Vg is decreased (Part (G) in FIG. 68). Since the gate voltage Vg is thus decreased, the current flown from the drain to the source of the drive transistor DRTr is decreased. With this negative feedback operation, the gate voltage Vg is decreased in a slower pace over time. A length of the time period (from the timing t153 to the timing t154) for performing the Ids correction is determined in order to suppress variations in the current that flows through the drive transistor DRTr at the timing t154 as described in the above first embodiment.

Subsequently, at the timing t154, the control line drive section 324 allows the voltage of the control signal AZ3 to be varied from the high level to the low level (Part (D) in FIG. 68). Accordingly, the control transistor AZ3Tr is turned off. Therefore, after this, the voltage between the terminals of the capacitor Cs, that is, the gate-source voltage Vgs of the drive transistor DRTr is maintained.

Subsequently, at timing t155, the scanning line drive section 323 allows the voltage of the scanning signal WS to be varied from the high level to the low level (Part (A) in FIG. 68). Accordingly, the write transistor WSTr is turned off.

Subsequently, the drive section 320 allows the sub-pixel 311 to emit light in a period (light emission period P3) that begins from timing t156. Specifically, at the timing t156, the power control line drive section 325 allows the voltage of the power control signal DS to be varied from the high level to the low level (Part (D) in FIG. 68). Accordingly, the power transistor DSTr is turned on, the current Ids is flown into the drive transistor DRTr, and the source voltage Vs of the drive transistor DRTr is increased (Part (H) in FIG. 68). In accordance therewith, the gate voltage Vg of the drive transistor DRTr is also increased (Part (G) in FIG. 68). In this example, the source voltage Vs is increased until the source voltage Vs becomes higher than the drain voltage (the voltage Vcath+an on-voltage Von of the organic EL device). When the source voltage Vs of the drive transistor DRTr becomes higher than the sum (Vel+Vcath) of the threshold voltage Vel and the voltage Vcath of the organic EL device OLED, a current flows between the anode and the cathode of the organic EL device OLED, which allows the organic EL device OLED to emit light. In other words, the source voltage Vs is increased in accordance with the device variations in the organic EL devices OLED, and the organic EL device OLED emits light.

Subsequently, in the display unit 300, the transition is made from the light emission period P3 to the write period P1 after a predetermined period (one frame period) has passed. The drive section 320 so drives the sub-pixel 311 that the above-described series of operation is repeated.

Effects similar to those in the above-described first embodiment and the like are obtainable also with such a configuration.

[Modification 9-1]

Figure 69:
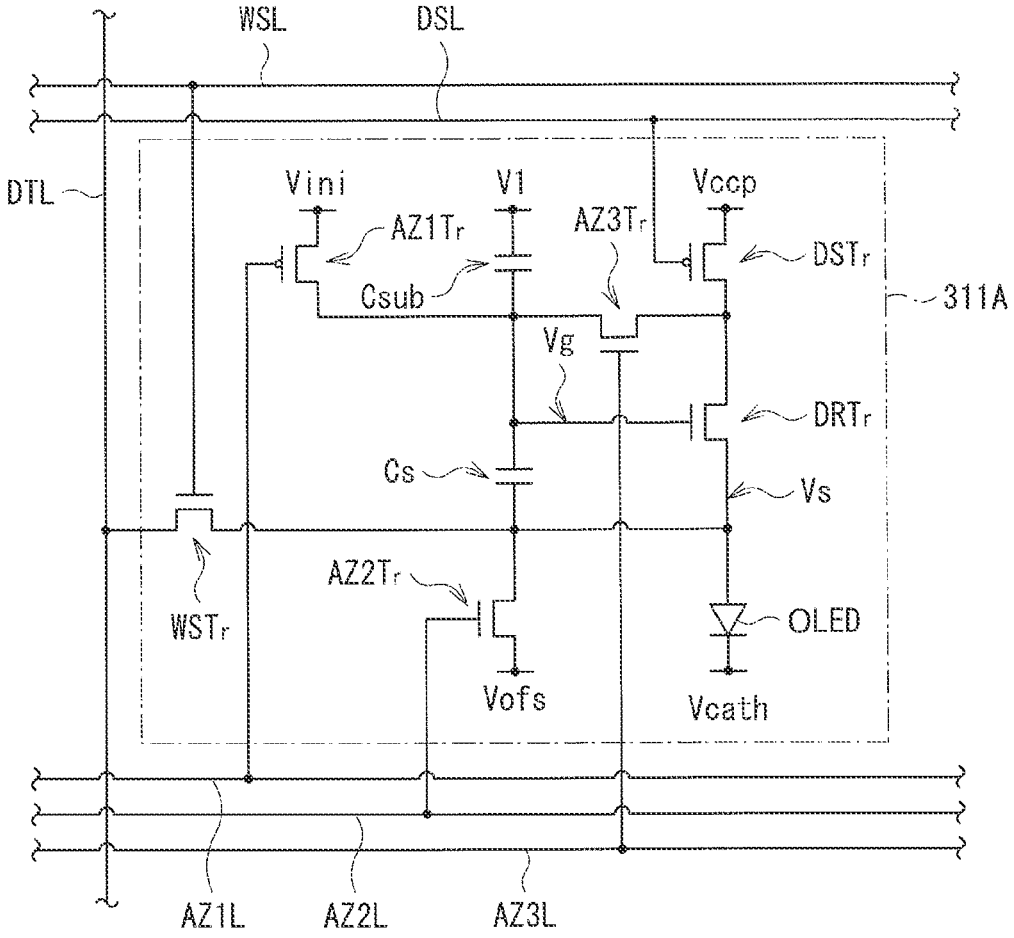
FIG. 69 is a circuit diagram illustrating a configuration example of a sub-pixel according to a modification of the ninth embodiment.
Figure 70:
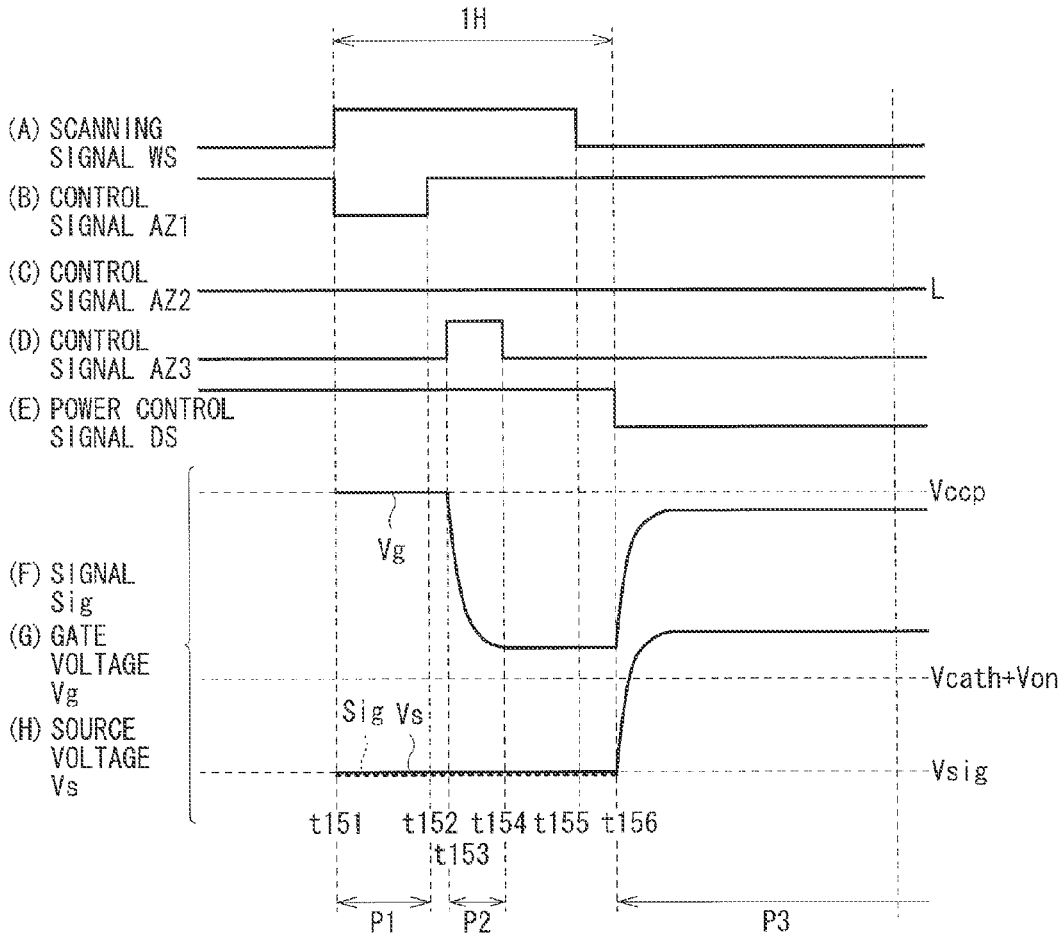
FIG. 70 is a timing waveform chart illustrating an operation example of a display unit according to a modification of the ninth embodiment.

In the above-described ninth embodiment, the voltage Vini is supplied to the gate of the drive transistor DRTr by allowing the control transistor AZ1Tr to be ON in the write period P1. However, this is not limitative. Alternatively, for example, the voltage Vccp may be supplied to the gate of the drive transistor DRTr by allowing the control transistor AZ1Tr to be ON as shown in FIGS. 69 and 70.

[Modification 9-2]

In the above-described ninth embodiment, the control transistor AZ2Tr is provided in the sub-pixel 311. However, this is not limitative. Alternatively, for example, the control transistor AZ2Tr may not be provided.

[Modification 9-3]

In the above-described ninth embodiment, the voltage Vini is supplied to the gate of the drive transistor DRTr by allowing the control transistor AZ1Tr to be ON in the write period P1. However, this is not limitative. Alternatively, for example, the voltage Vccp may be supplied to the gate of the drive transistor DRTr by allowing the power transistor DSTr to be ON. The present modification will be described below in detail.

Figure 71:
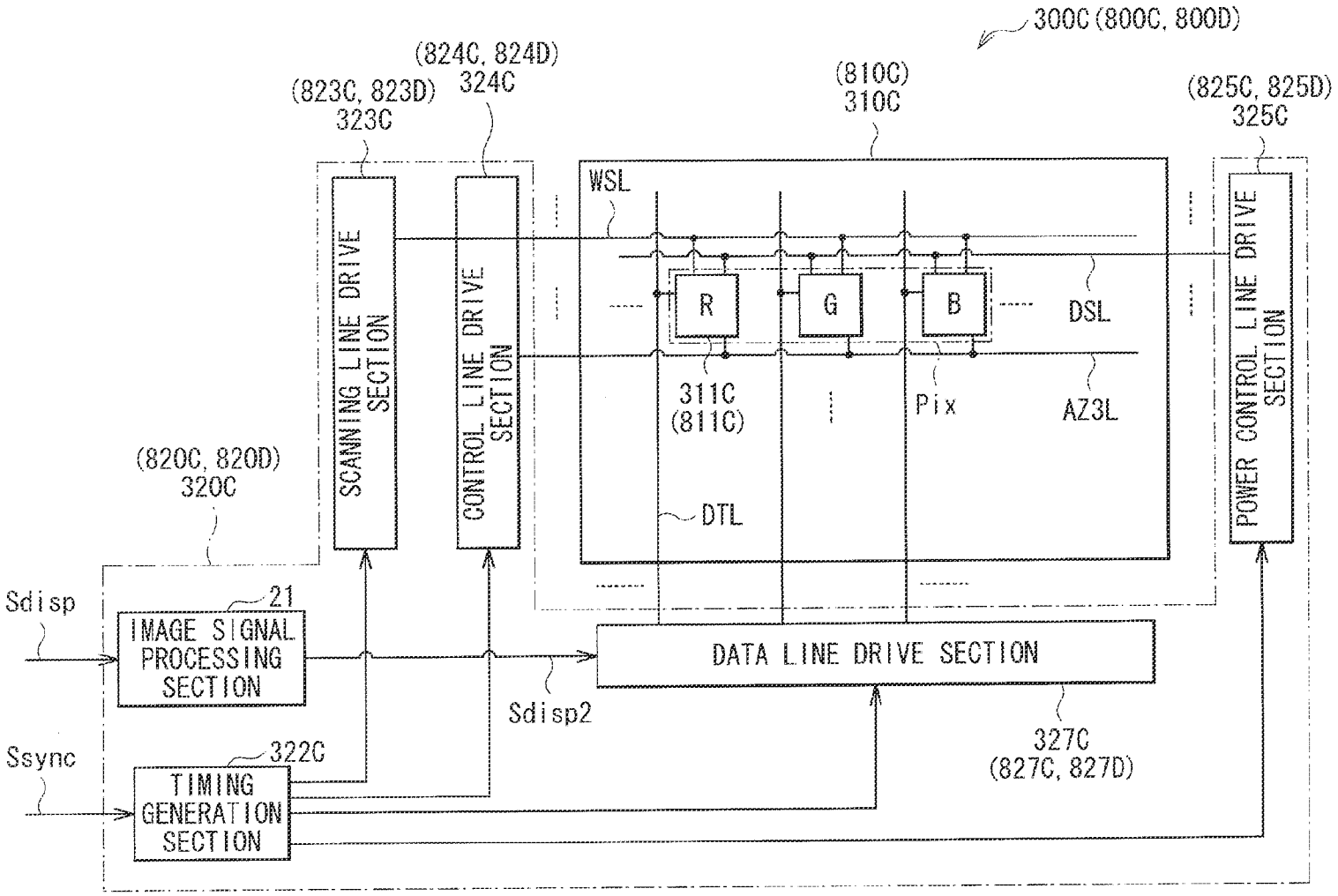
FIG. 71 is a block diagram illustrating a configuration example of a display unit according to another modification of the ninth embodiment.

FIG. 71 illustrates a configuration example of a display unit 300C according to the present modification. The display unit 300C includes a display section 310C and a drive section 320C. The display section 310C includes a plurality of sub-pixels 311C and the plurality of control lines AZ3L that extend in the row direction. One end of each of the control lines AZ3L is connected to the drive section 320C.

Figure 72:
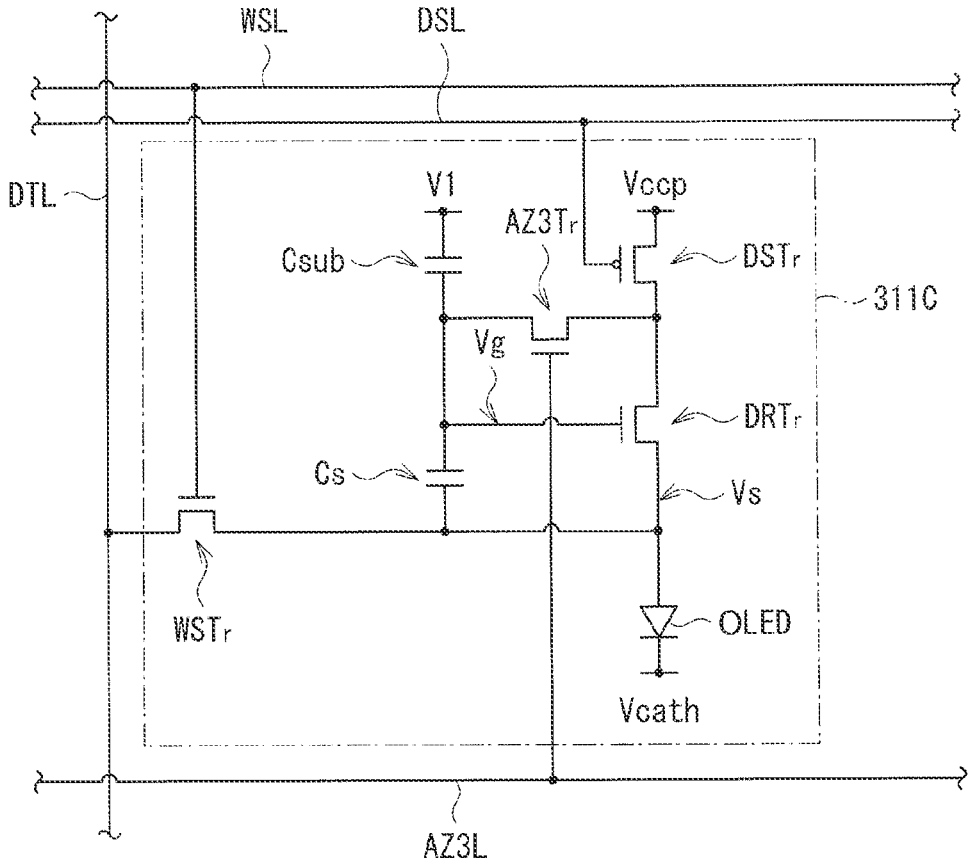
FIG. 72 is a circuit diagram illustrating a configuration example of a sub-pixel shown in FIG. 71.

FIG. 72 illustrates an example of a circuit configuration of the sub-pixel 311C. The sub-pixel 311C has a configuration in which the control transistors AZ1Tr and AZ2Tr are omitted from the sub-pixel 311 according to the above-described ninth embodiment. The power transistor DSTr corresponds to a specific but not limitative example of "eighteenth transistor" in one embodiment of the present disclosure.

The drive section 320C includes a timing generation section 322C, a scanning line drive section 323C, a control line drive section 324C, a power control line drive section 325C, and a data line drive section 327C. The timing generation section 322C is a circuit that supplies a control signal to each of the scanning line drive section 323C, the control line drive section 324C, the power control drive section 325C, and the data line drive section 327C based on the synchronization signal Ssync that is supplied from the outside, and thereby controlling these sections to operate in synchronization with each other. The control line drive section 324C sequentially applies control signals AZ3 to the plurality of control lines AZ3L in accordance with the control signal supplied from the timing generation section 322C. The scanning drive section 323C, the power control line drive section 325C, and the data line drive section 327C have functions similar to those of the scanning line drive section 23, the power control line drive section 25A, and the data line drive section 27, respectively.

Figure 73:
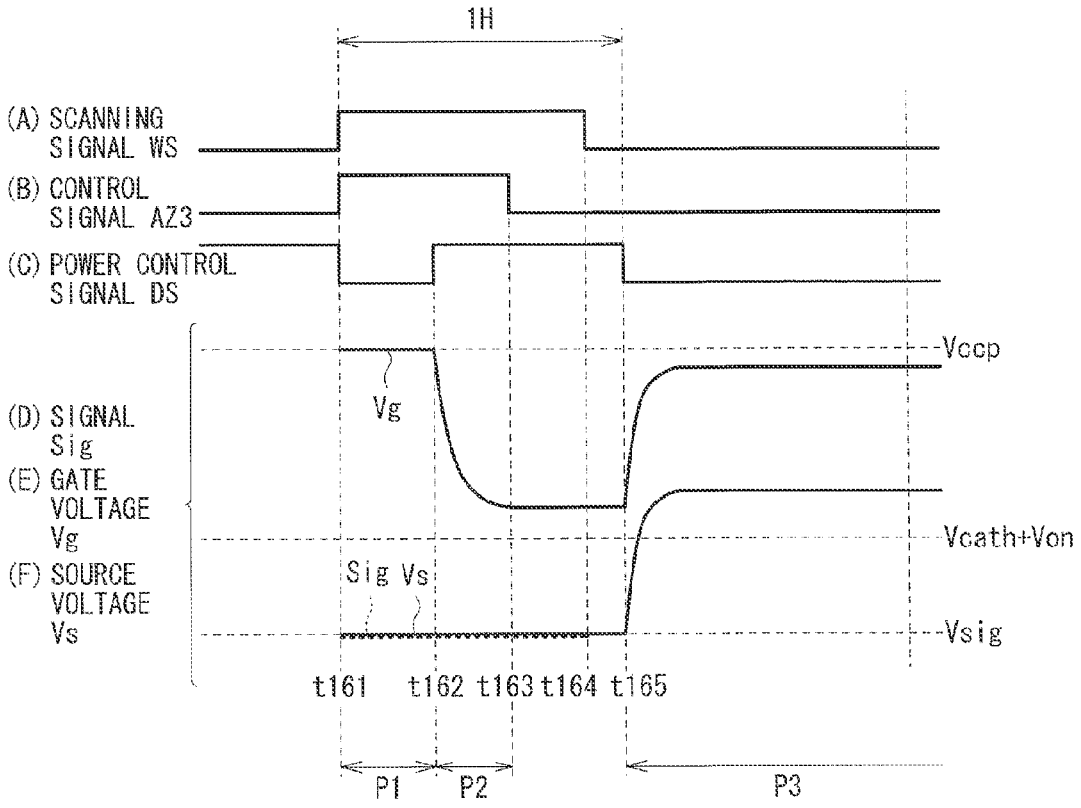
FIG. 73 is a timing waveform chart illustrating an operation example of a display unit shown in FIG. 71.

FIG. 73 is a timing chart of display operation in the display unit 300C. In FIG. 73, Part (A) shows the waveform of the scanning signal WS, Part (B) shows the waveform of the control signal AZ3, Part (C) shows the waveform of the power control signal DS, Part (D) shows the waveform of the signal Sig, Part (E) shows the waveform of the gate voltage Vg of the drive transistor DRTr, and Part (F) shows the waveform of the source voltage Vs of the drive transistor DRTr.

First, the drive section 320C writes the pixel voltage Vsig in the sub-pixel 311C and initializes the sub-pixel 311C in a period (write period P1) from timing t161 to timing t162. Specifically, first, at the timing t161, the data line drive section 327C sets the signal Sig to the pixel voltage Vsig (Part (D) in FIG. 73), and the scanning line drive section 323C allows the voltage of the scanning signal WS to be varied from a low level to a high level (Part (A) in FIG. 73). Accordingly, the write transistor WSTr is turned on, and the source voltage Vs of the drive transistor DRTr is set to the pixel voltage Vsig (Part (F) in FIG. 73). At the same time, the control line drive section 324C allows the voltage of the control signal AZ3 to be varied from a low level to a high level (Part (B) in FIG. 73). Accordingly, the control transistor AZ3Tr is turned on, and the drain and the gate of the drive transistor DRTr are connected to each other through the control transistor AZ3Tr (a so-called "diode connection"). Further, the power control line drive section 325C allows the voltage of the power control signal DS to be varied from a high level to a low level (Part (C) in FIG. 73). Accordingly, the power transistor DSTr is turned on, and the gate voltage Vg of the drive transistor DRTr is set to the voltage Vccp (Part (E) in FIG. 73). Thus, the sub-pixel 311C is initialized.

Subsequently, the drive section 320 performs the Ids correction on the sub-pixel 311C in a period (Ids correction period P2) from timing t162 to timing t163. Specifically, at the timing t162, the power control line drive section 325C allows the voltage of the power control signal DS to be varied from the low level to the high level (Part (C) in FIG. 73). Accordingly, the power transistor DRTr is turned off. Consequently, a current is flown from the gate to the source of the drive transistor DRTr through the drain thereof, and the gate voltage Vg is decreased (Part (E) in FIG. 73). Thus, the drive section 320C performs the Ids correction as in the above-described ninth embodiment.

Subsequently, at the timing t163, the control line drive section 324C allows the voltage of the control signal AZ3 to be varied from a high level to a low level (Part (B) in FIG. 73). Accordingly, the control transistor AZ3Tr is turned off.

Subsequently, at timing t164, the scanning line drive section 323C allows the voltage of the scanning signal WS to be varied from the high level to the low level (Part (A) in FIG. 73). Accordingly, the write transistor WSTr is turned off.

After the Ids correction is completed, the drive section 320C allows the sub-pixel 311C to emit light in a period (light emission period P3) that begins from timing t165, as in the above-described ninth embodiment.

Effects similar to those in the above-described ninth embodiment are obtainable also with such a configuration.

Moreover, also in the present modification, for example, the sub-pixel may further include other transistors as will be described below.

Figure 74:
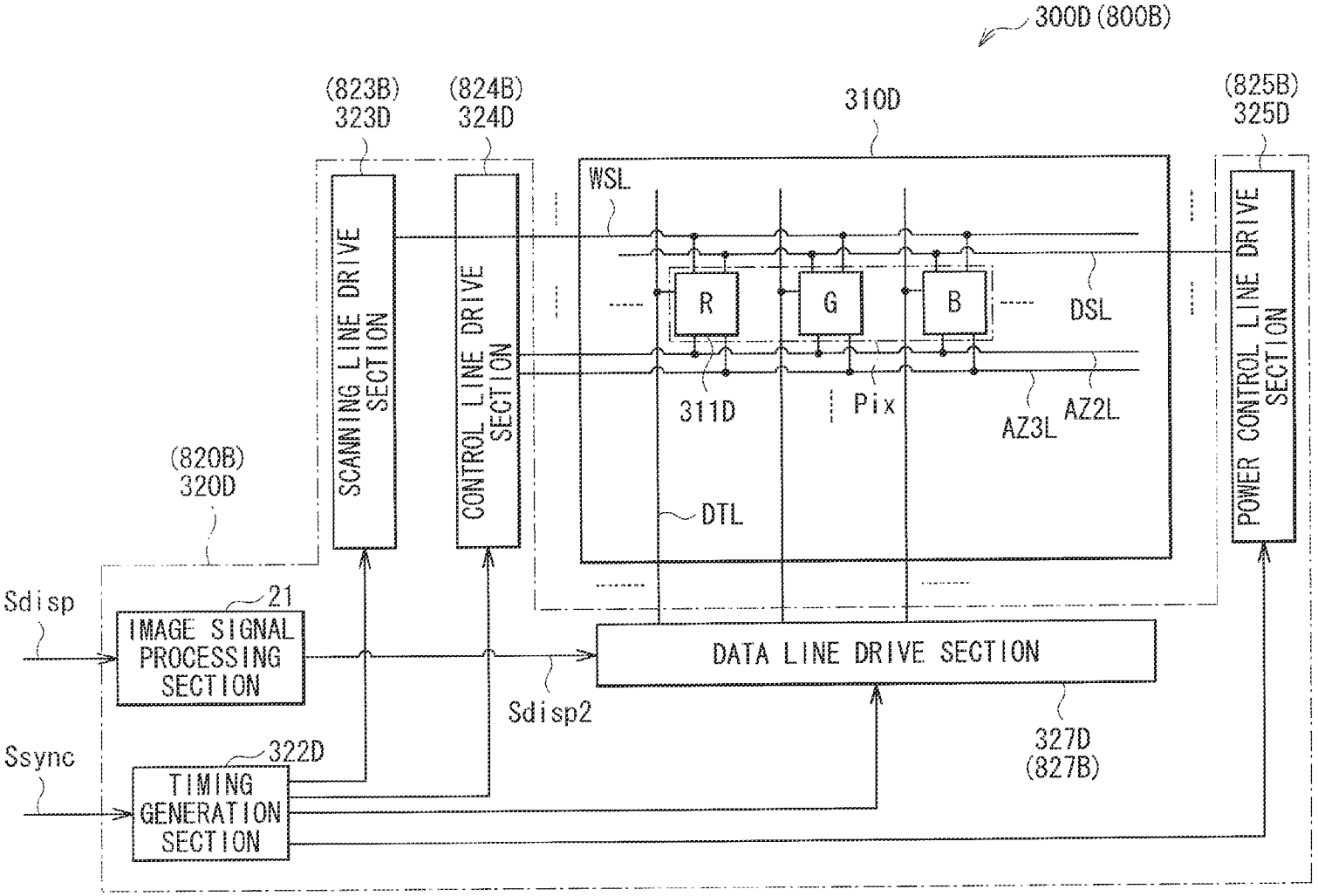
FIG. 74 is a block diagram illustrating a configuration example of a display unit according to another modification of the ninth embodiment.

FIG. 74 illustrates a configuration example of a display unit 300D according to the present modification. The display unit 300D includes a display section 310D and a drive section 320D. The display section 310D includes a plurality of sub-pixels 311D and the plurality of control lines AZ2L that extend in the row direction. One end of each of the control lines AZ2L is connected to the drive section 320D.

Figure 75:
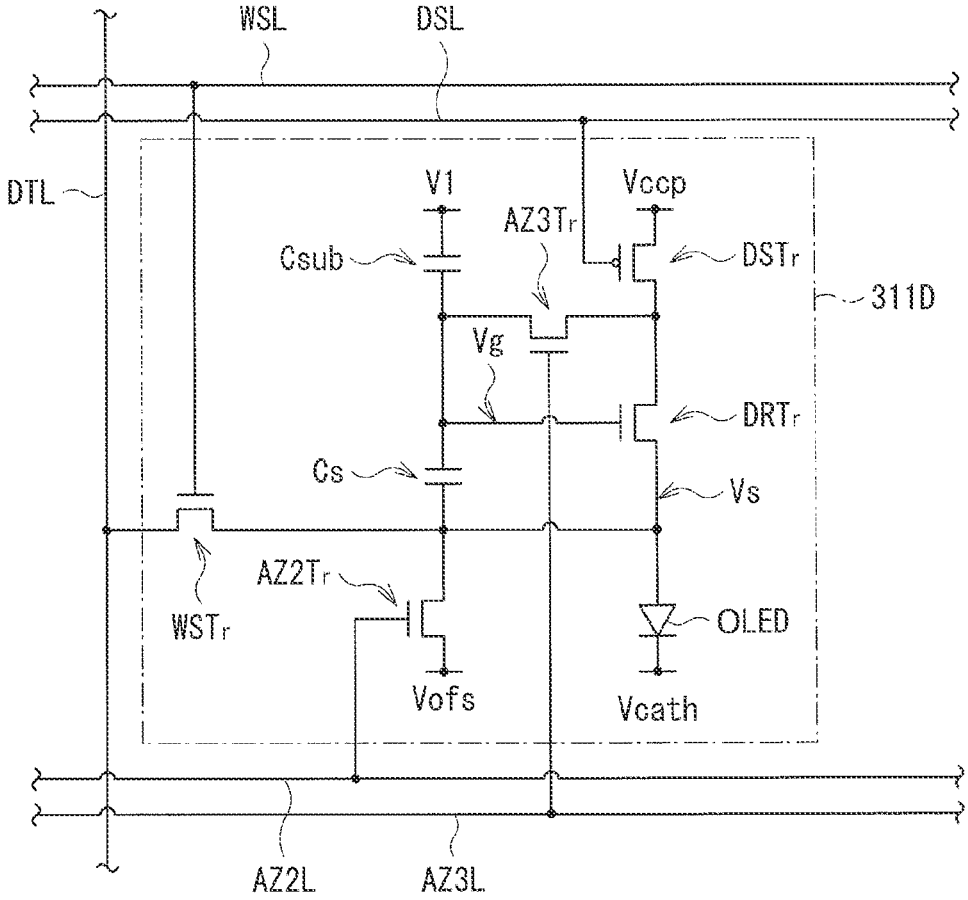
FIG. 75 is a circuit diagram illustrating a configuration example of a sub-pixel shown in FIG. 74.

FIG. 75 illustrates an example of a circuit configuration of the sub-pixel 311D. The sub-pixel 311D includes the control transistor AZ2Tr. The gate of the control transistor AZ2Tr is connected to the control line AZ2L, the source thereof is supplied with the voltage Vofs by the drive section 320D, and the drain thereof is connected to the source of the drive transistor DRTr, the first end of the capacitor Cs, and the like.

Figure 76:
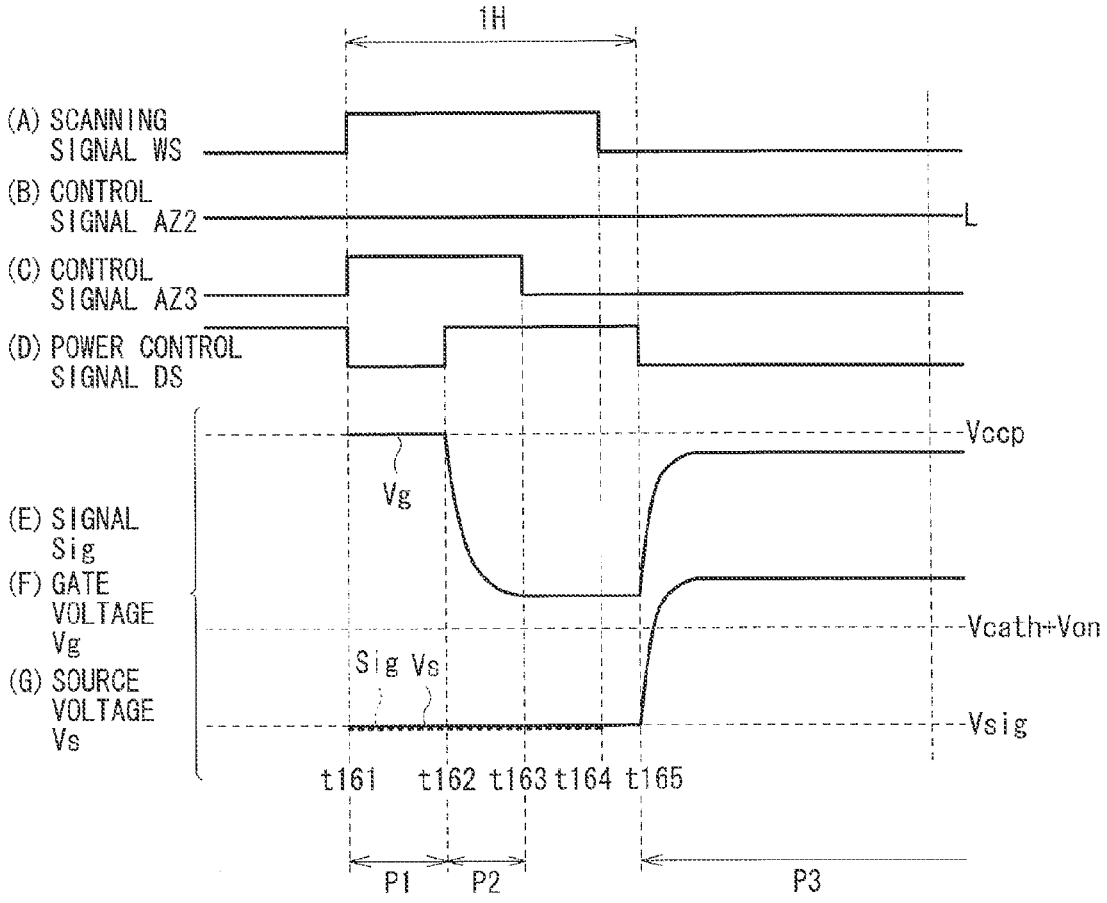
FIG. 76 is a timing waveform chart illustrating an operation example of a display unit shown in FIG. 74.

Also with such a configuration, the same method as the driving method shown in FIG. 73 is achievable by allowing the control signal AZ2 to be mostly at the low level (L) (Part (B) in FIG. 76) to allow the control transistor AZ2Tr to be mostly OFF, as shown in FIG. 76.

10. Tenth Embodiment

Next, a display unit 700A according to a tenth embodiment will be described. In the present embodiment, the Vth correction described in the fifth embodiment is performed with the use of a configuration similar to that of the display unit 100 according to the above-described eighth embodiment and the like. It is to be noted that the same numerals are used to designate substantially the same components of the display units according to the above-described fifth and eighth embodiments and the like, and the description thereof will be appropriately omitted.

As shown in FIGS. 55 and 56, the display unit 700A includes a display section 110A and a drive section 720A. The display section 110A includes the sub-pixels 111A. The drive section 720A includes a scanning line drive section 723A, a control line drive section 724A, a power control line drive section 725A, and a data line drive section 727A.

Figure 77:
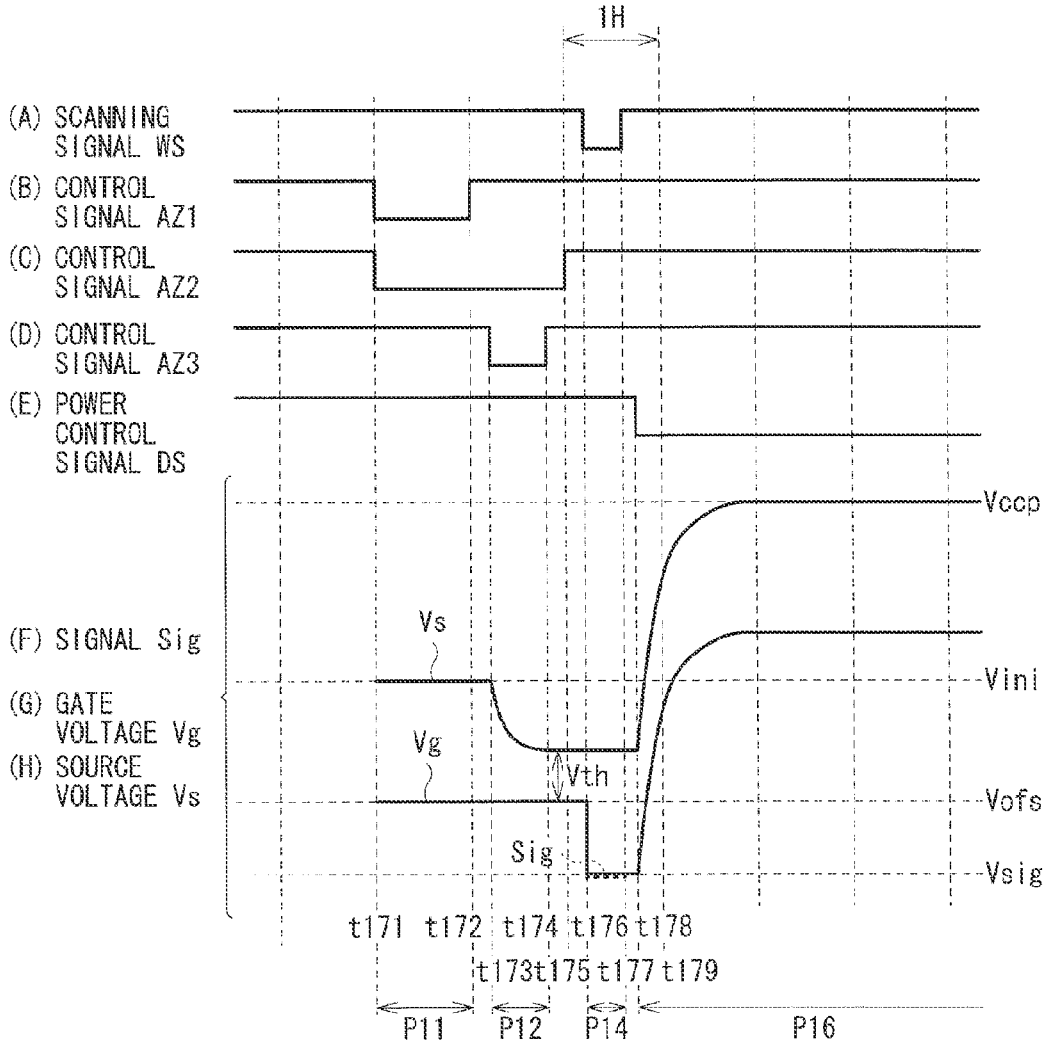
FIG. 77 is a timing waveform chart illustrating an operation example of a display unit according to a tenth embodiment.

FIG. 77 is a timing chart of display operation in the display unit 700A. In FIG. 77, Part (A) shows the waveform of the scanning signal WS, Part (B) shows the waveform of the control signal AZ1, Part (C) shows the waveform of the control signal AZ2, Part (D) shows the waveform of the control signal AZ3, Part (E) shows the waveform of the power control signal DS, Part (F) shows the waveform of the signal Sig, Part (G) shows the waveform of the gate voltage Vg of the drive transistor DRTr, and Part (H) shows the waveform of the source voltage Vs of the drive transistor DRTr.

First, the drive section 720A initializes the sub-pixel 111A in a period (initialization period P11) from timing t171 to timing t172. Specifically, at the timing t171, the control line drive section 724A allows the voltage of the control signal AZ1 to be varied from a high level to a low level (Part (B) in FIG. 77), and allows the voltage of the control signal AZ2 to be varied from a high level to a low level (Part (C) in FIG. 77). Accordingly, the control transistors AZ1Tr and AZ2Tr are turned on. Accordingly, the source voltage Vs of the drive transistor DRTr is set to the voltage Vini (Part (H) in FIG. 77), and the gate voltage Vg is set to the voltage Vofs (Part (G) in FIG. 77). Thus, the sub-pixel 111A is initialized.

Subsequently, the control line drive section 724A allows the voltage of the control signal AZ1 to be varied from the low level to the high level (Part (B) in FIG. 77). Accordingly, the control transistor AZ1Tr is turned off, and the supply of the voltage Vini to the source of the drive transistor DRTr is stopped.

Subsequently, the drive section 720A performs the Vth correction in a period (Vth correction period P12) from timing t173 to timing t174. Specifically, at the timing t173, the control line drive section 724A allows the voltage of the control signal AZ3 to be varied from a high level to a low level (Part (D) in FIG. 77). Accordingly, the control transistor AZ3Tr is turned on, and the drain and the gate of the drive transistor DRTr are connected to each other through the control transistor AZ3Tr (a so-called "diode connection"). Accordingly, a current is flown from the source to the gate of the drive transistor DRTr through the drain thereof, and the source voltage Vs is decreased (Part (H) in FIG. 77). Thus, the gate-source voltage Vgs of the drive transistor DRTr is so converged as to be equal to the threshold voltage Vth of the drive transistor DRTr (Vgs=Vth).

Subsequently, the control line drive section 724A allows the voltage of the control signal AZ3 to be varied from the low level to the high level (Part (D) in FIG. 77). Accordingly, the control transistor AZ3Tr is turned off.

Subsequently, the drive section 720A writes the pixel voltage Vsig in the sub-pixel 111A in a period (write period P14) from timing t176 to timing t177. Specifically, at the timing t176, the scanning line drive section 723A allows the voltage of the scanning signal WS to be varied from the high level to the low level (Part (A) in FIG. 77). Accordingly, the write transistor WSTr is turned on, and the gate voltage Vg of the drive transistor DRTr is decreased from the voltage Vofs to the pixel voltage Vsig (Part (G) in FIG. 77).

Subsequently, at the timing t177, the scanning line drive section 723A allows the voltage of the scanning signal WS to be varied from the low level to the high level (Part (A) in FIG. 77). Accordingly, the write transistor WSTr is turned off.

Subsequently, the drive section 720A allows the sub-pixel 111A to emit light in a period (light emission period P16) that begins from timing t178, as with the drive section 70A (FIG. 38) according to the above-described fifth embodiment.

Effects similar to those in the above-described fifth embodiment and the like are obtainable also with such a configuration.

[Modification 10-1]

In the above-described tenth embodiment, the voltage Vofs is supplied to the gate of the drive transistor DRTr by allowing the control transistor AZ2Tr to be ON in the initialization period P11. However, this is not limitative. Alternatively, for example, the voltage Vofs may be supplied to the gate of the drive transistor DRTr by allowing the write transistor WSTr to be ON. The present modification will be described below in detail.

As shown in FIGS. 52 and 53, a display unit 700B according to the present modification includes the display section 110 and a drive section 720B. The display section 110 includes the sub-pixels 111. The drive section 720B includes a scanning line drive section 723B, a control line drive section 724B, a power control line drive section 725B, and a data line drive section 727B.

Figure 78:
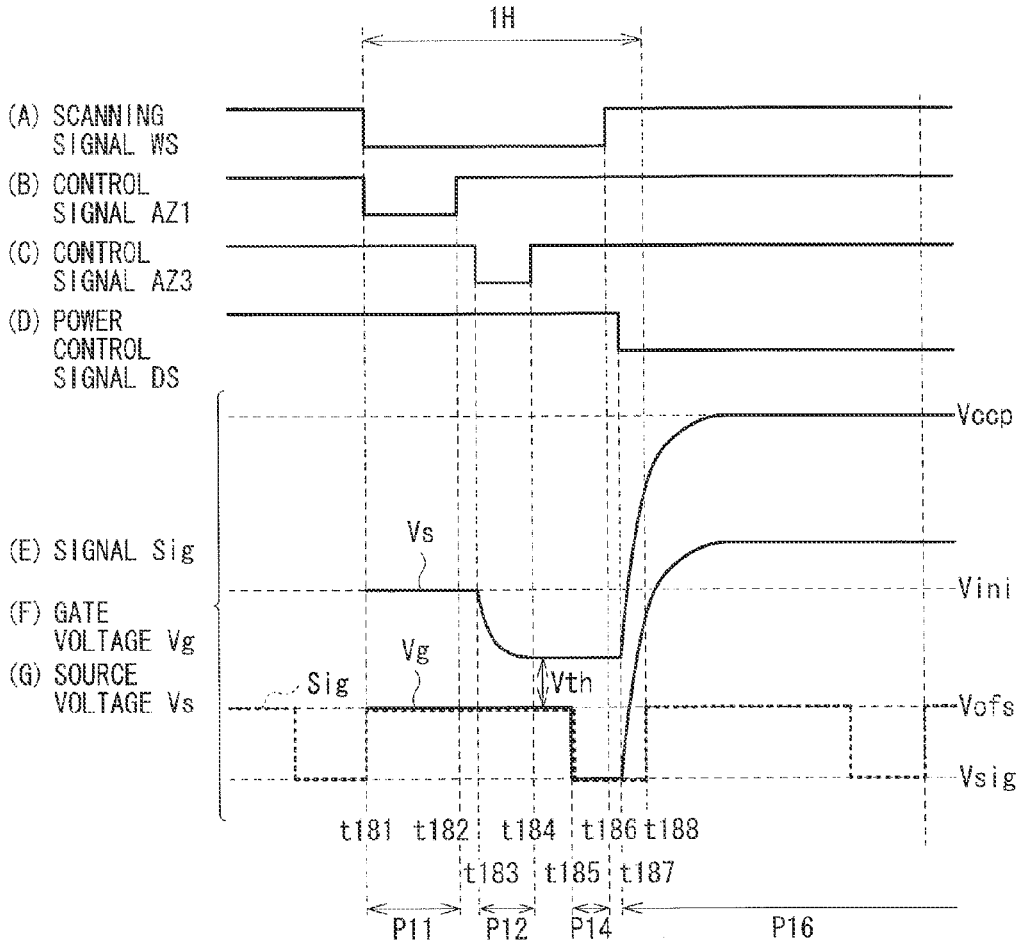
FIG. 78 is a timing waveform chart illustrating an operation example of a display unit according to a modification of the tenth embodiment.

FIG. 78 is a timing chart of display operation in the display unit 700B. In FIG. 78, Part (A) shows the waveform of the scanning signal WS, Part (B) shows the waveform of the control signal AZ1, Part (C) shows the waveform of the control signal AZ3, Part (D) shows the waveform of the power control signal DS, Part (E) shows the waveform of the signal Sig, Part (F) shows the waveform of the gate voltage Vg of the drive transistor DRTr, and Part (G) shows the waveform of the source voltage Vs of the drive transistor DRTr.

First, the drive section 720B initializes the sub-pixel 111 in a period (initialization period P11) from timing t181 to timing t182. Specifically, at the timing t181, the data line drive section 727B sets the signal Sig to the voltage Vofs (Part (E) in FIG. 78), and the scanning line drive section 723B allows the voltage of the scanning line WS to be varied from a high level to a low level (Part (A) in FIG. 78). Accordingly, the write transistor WSTr is turned on, and the gate voltage Vg of the drive transistor DRTr is set to the voltage Vofs (Part (F) in FIG. 78). At the same time, the control line drive section 724B allows the voltage of the control signal AZ1 to be varied from a high level to a low level (Part (B) in FIG. 78). Accordingly, the control transistor AZ1Tr is turned on, and the source voltage Vs of the drive transistor DRTr is set to the voltage Vini (Part (G) in FIG. 78). Thus, the sub-pixel 111 is initialized.

Subsequently, at timing t182, the control line drive section 724A allows the voltage of the control signal AZ1 to be varied from the low level to the high level (Part (B) in FIG. 78). Accordingly, the control transistor AZ1Tr is turned off, and the supply of the voltage Vini to the source of the drive transistor DRTr is stopped.

Subsequently, the drive section 720B performs the Vth correction in a period (Vth correction period P12) from timing t183 to timing t184 as with the drive section 720A (FIG. 77) according to the above-described tenth embodiment.

Subsequently, the drive section 720B writes the pixel voltage Vsig in the sub-pixel 111 in a period (write period P14) from timing t185 to timing t186. Specifically, at the timing t185, the data line drive section 727B allows the signal Sig to be varied from the voltage Vofs to the pixel voltage Vsig (Part (E) in FIG. 78). Accordingly, the gate voltage Vg of the drive transistor DRTr is decreased from the voltage Vofs to the pixel voltage Vsig (Part (F) in FIG. 78).

Subsequently, at the timing t186, the scanning line drive section 723B allows the voltage of the scanning signal WS to be varied from the low level to the high level (Part (A) in FIG. 78). Accordingly, the write transistor WSTr is turned off.

Subsequently, the drive section 720B allows the sub-pixel 111 to emit light in a period (light emission period P16) that begins from the timing t187, as with the drive section 720 (FIG. 77) according to the above-described tenth embodiment.

Effects similar to those in the above-described tenth embodiment are obtainable also with such a configuration.

Moreover, in the display unit 700B, the voltage Vini may be supplied to the source of the drive transistor DRTr by allowing the power transistor DSTr to be ON, as will be described below.

As shown in FIGS. 58 and 59, the display unit 700C according to the present modification includes the display section 110B and a drive section 720C. The display section 110B includes the sub-pixels 111B. The drive section 720C includes a scanning line drive section 723C, a control line drive section 724C, a power control line drive section 725C, a power line drive section 726C, and a data line drive section 727C.

Figure 79:
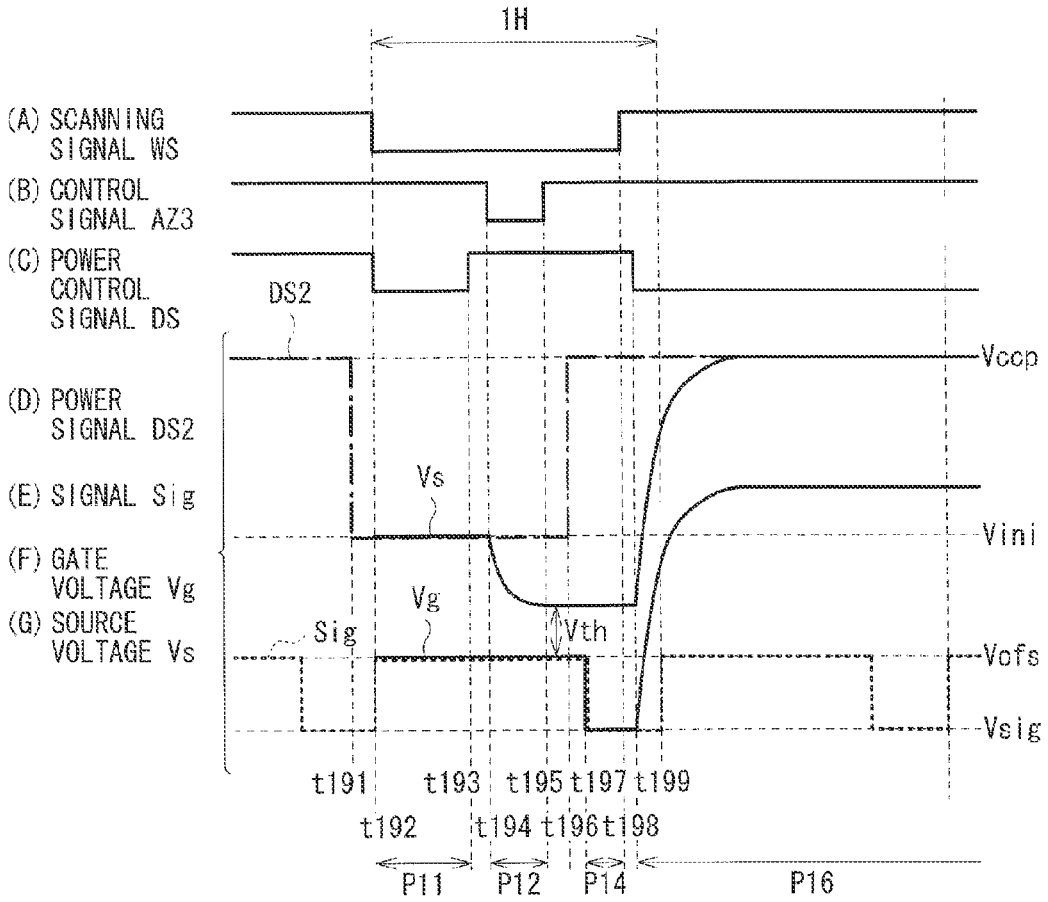
FIG. 79 is a timing waveform chart illustrating an operation example of the display unit according to the modification of the tenth embodiment.

FIG. 79 is a timing chart of display operation in the display unit 700C. In FIG. 79, Part (A) shows the waveform of the scanning signal WS, Part (B) shows the waveform of the control signal AZ3, Part (C) shows the waveform of the power control signal DS, Part (D) shows the waveform of the power signal DS2, Part (E) shows the waveform of the signal Sig, Part (F) shows the waveform of the gate voltage Vg of the drive transistor DRTr, and Part (G) shows the waveform of the source voltage Vs of the drive transistor DRTr.

First, at timing t191 prior to the initialization period P11, the power line drive section 726C allows the power signal DS2 to be varied from the voltage Vccp to the voltage Vini (Part (D) in FIG. 79).

Subsequently, the drive section 720C initializes the sub-pixel 111B in a period (initialization period P11) from timing t192 to timing t193. Specifically, at the timing t192, the data line drive section 727C sets the signal Sig to the voltage Vofs (Part (E) in FIG. 79), and the scanning line drive section 723C allows the voltage of the scanning line WS to be varied from a high level to a low level (Part (A) in FIG. 79). Accordingly, the write transistor WSTr is turned on, and the gate voltage Vg of the drive transistor DRTr is set to the voltage Vofs (Part (F) in FIG. 79). At the same time, the power control line drive section 725C allows the voltage of the power control signal DS to be varied from a high level to a low level (Part (C) in FIG. 79). Accordingly, the power transistor DSTr is turned on, and the source voltage Vs of the drive transistor DRTr is set to the voltage Vini (Part (G) in FIG. 79). Thus, the sub-pixel 111B is initialized.

Subsequently, at the timing t193, the power control line drive section 725C allows the voltage of the power control signal DS to be varied from the low level to the high level (Part (C) in FIG. 79). Accordingly, the power transistor DSTr is turned off, and the supply of the voltage Vini to the source of the drive transistor DRTr is stopped.

Subsequently, the drive section 720C performs the Vth correction in a period (Vth correction period P12) from timing t194 to timing t195 as with the drive section 720B (FIG. 78) according to the above-described modification.

Subsequently, at the timing t196, the power line drive section 726C allows the power signal DS2 to be varied from the voltage Vini to the voltage Vccp (Part (D) in FIG. 79).

Further, the drive section 720C writes the pixel voltage Vsig in the sub-pixel 111B in a period (write period P14) from timing t197 to timing t198, and allows the sub-pixel 111B to emit light in a period (light emission period P16) that begins from timing t199, as with the drive section 720B (FIG. 78) in the above-described modification.

Effects similar to those in the above-described tenth embodiment are obtainable also with such a configuration.

Moreover, in the display unit 700B, the voltage Vccp may be supplied to the source of the drive transistor DRTr by allowing the power transistor DSTr to be ON, as will be described below.

As shown in FIGS. 61 and 62, the display unit 700D according to the present modification includes the display section 110C and a drive section 720D. The display section 110C includes the sub-pixels 111C. The drive section 720D includes a scanning line drive section 723D, a control line drive section 724D, a power control line drive section 725D, and a data line drive section 727D.

Figure 80:
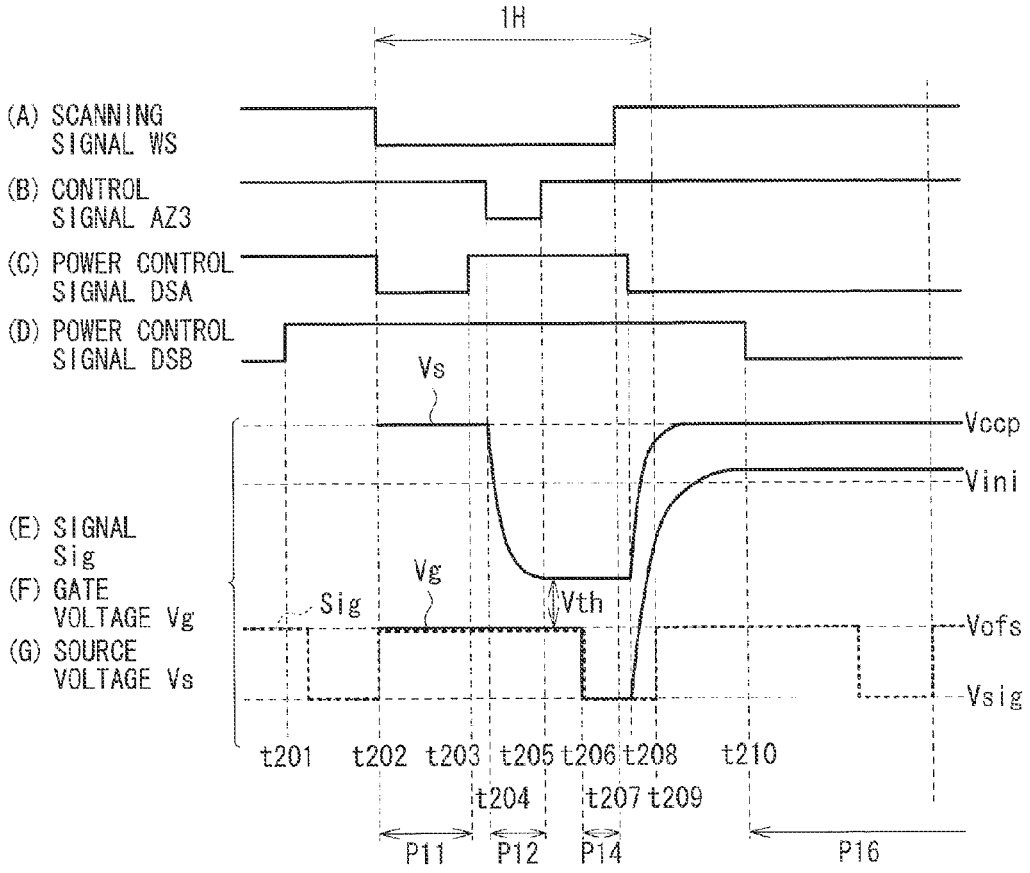
FIG. 80 is a timing waveform chart illustrating an operation example of the display unit according to the modification of the tenth embodiment.

FIG. 80 is a timing chart of display operation in the display unit 700D. In FIG. 80, Part (A) shows the waveform of the scanning signal WS, Part (B) shows the waveform of the control signal AZ3, Part (C) shows the waveform of the power control signal DSA, Part (D) shows the waveform of the power control signal DSB, Part (E) shows the waveform of the signal Sig, Part (F) shows the waveform of the gate voltage Vg of the drive transistor DRTr, and Part (G) shows the waveform of the source voltage Vs of the drive transistor DRTr.

First, at timing t201 prior to the initialization period P11, the power control line drive section 725D allows the voltage of the power control signal DSB to be varied from a low level to a high level (Part (D) in FIG. 80). Accordingly, the power transistor DSBTr is turned off.

Subsequently, the drive section 720D initializes the sub-pixel 111C in a period (initialization period P11) from timing t202 to timing t203. Specifically, at the timing t202, the data line drive section 727D sets the signal Sig to the voltage Vofs (Part (E) in FIG. 80), and the scanning line drive section 723D allows the voltage of the scanning line WS to be varied from a high level to a low level (Part (A) in FIG. 80). Accordingly, the write transistor WSTr is turned on, and the gate voltage Vg of the drive transistor DRTr is set to the voltage Vofs (Part (F) in FIG. 80). At the same time, the power control line drive section 725D allows the voltage of the power control signal DSA to be varied from a high level to a low level (Part (C) in FIG. 80). Accordingly, the power transistor DSATr is turned on, and the source voltage Vs of the drive transistor DRTr is set to the voltage Vccp (Part (G) in FIG. 80). Thus, the sub-pixel 111C is initialized.

Subsequently, at the timing t203, the power control line drive section 725D allows the voltage of the power control signal DSA to be varied from the low level to the high level (Part (C) in FIG. 80). Accordingly, the power transistor DSATr is turned off, and the supply of the voltage Vccp to the source of the drive transistor DRTr is stopped.

Subsequently, the drive section 720D performs the Vth correction in a period (Vth correction period P12) from timing t204 to timing t205, and writes the pixel voltage Vsig in the sub-pixel 111C in a period (write period P14) from timing t206 to timing t207, as with the drive section 720B (FIG. 78) according to the above-described modification.

Subsequently, at the timing t208, the power control line drive section 725D allows the voltage of the power control signal DSA to be varied from the high level to the low level (Part (C) in FIG. 80). Accordingly, the power transistor DSATr is turned on, and the source voltage Vs of the drive transistor DRTr is increased toward the voltage Vccp (Part (G) in FIG. 80). In accordance therewith, the gate voltage Vg of the drive transistor DRTr is also increased (Part (F) in FIG. 80).

Further, the drive section 720D allows the sub-pixel 111D to emit light in a period (light emission period P16) that begins from timing t210. Specifically, at the timing t210, the power control line drive section 725D allows the voltage of the power control signal DSB to be varied from the high level to the low level (Part (D) in FIG. 80). Accordingly, the power transistor DSBTr is turned on, and a current is flown through a path including the power transistor DSATr, the drive transistor DRTr, the power transistor DSBTr, and the organic EL device OLED in order. Accordingly, the organic EL device OLED emits light.

Effects similar to those in the above-described tenth embodiment are obtainable also with such a configuration.

[Modification 10-2]

In the above-described tenth embodiment, the voltage Vini is supplied to the source of the drive transistor DRTr by allowing the control transistor AZ1Tr to be ON in the initialization period P11. However, this is not limitative. Alternatively, for example, the voltage Vccp may be supplied to the source of the drive transistor DRTr by allowing the power transistor DSTr to be ON. The present modification will be described below in detail.

As shown in FIGS. 64 and 65, the display unit 700E according to the present modification includes the display section 110D and a drive section 720E. The display section 110D includes the sub-pixels 111D. The drive section 720E includes a scanning line drive section 723E, a control line drive section 724E, a power control line drive section 725E, and a data line drive section 727E.

Figure 81:
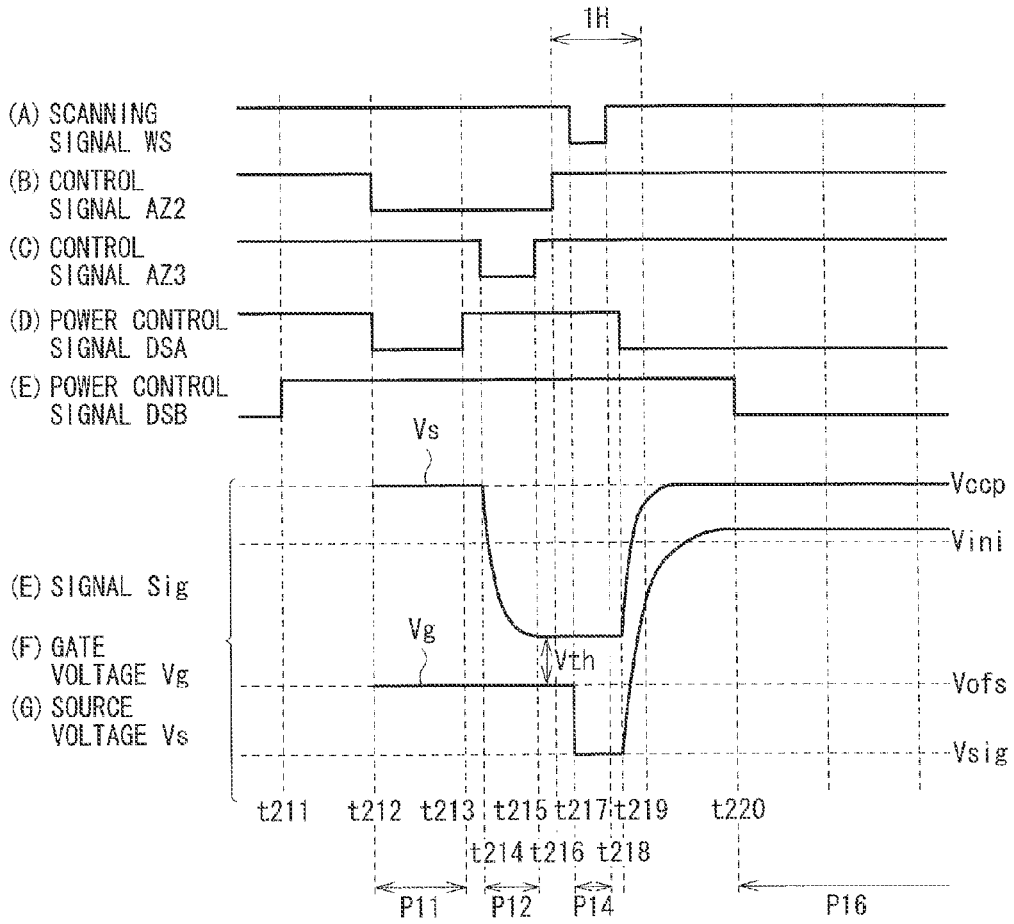
FIG. 81 is a timing waveform chart illustrating an operation example of the display unit according to the modification of the tenth embodiment.

FIG. 81 is a timing chart of display operation in the display unit 700E. In FIG. 81, Part (A) shows the waveform of the scanning signal WS, Part (B) shows the waveform of the control signal AZ2, Part (C) shows the waveform of the control signal AZ3, Part (D) shows the waveform of the power control signal DSA, Part (E) shows the waveform of the power control signal DSB, Part (F) shows the waveform of the signal Sig, Part (G) shows the waveform of the gate voltage Vg of the drive transistor DRTr, and Part (H) shows the waveform of the source voltage Vs of the drive transistor DRTr.

First, at timing t211 prior to the initialization period P11, the power control line drive section 725E allows the voltage of the power control signal DSB to be varied from a low level to a high level (Part (E) in FIG. 81). Accordingly, the power transistor DSBTr is turned off.

Subsequently, the drive section 720E initializes the sub-pixel 111D in a period (initialization period P11) from timing t212 to timing t213. Specifically, at the timing t212, the power control line drive section 725E allows the voltage of the power control signal DSA to be varied from a high level to a low level (Part (D) in FIG. 81). Accordingly, the power transistor DSATr is turned on, and the source voltage Vs of the drive transistor DRTr is set to the voltage Vccp (Part (H) in FIG. 81). At the same time, the control line drive section 724E allows the voltage of the control signal AZ2 to be varied from a high level to a low level (Part (B) in FIG. 81). Accordingly, the control transistor AZ2Tr is turned on, and the gate voltage Vg of the drive transistor DRTr is set to the voltage Vofs (Part (G) in FIG. 81). Thus, the sub-pixel 111D is initialized.

Subsequently, at the timing t213, the power control line drive section 725E allows the voltage of the power control signal DSA to be varied from the low level to the high level (Part (D) in FIG. 81). Accordingly, the power transistor DSATr is turned off, and the supply of the voltage Vccp to the source of the drive transistor DRTr is stopped.

Subsequently, the drive section 720E performs the Vth correction in a period (Vth correction period P12) from timing t214 to timing t215 as with the drive section 720A (FIG. 77) according to the above-described tenth embodiment.

Subsequently, at timing t216, the power line drive section 724E allows the voltage of the control signal AZ2 to be varied from the low level to the high level (Part (B) in FIG. 81). Accordingly, the control transistor AZ2Tr is turned off, and the supply of the voltage Vofs to the gate of the drive transistor DRTr is stopped.

Subsequently, the drive section 720E writes the pixel voltage Vsig in the sub-pixel 111D in a period (write period P14) from timing t217 to timing t218, as with the drive section 720A (FIG. 77) according to the above-described tenth embodiment.

Subsequently, at timing t219, the power control line drive section 725E allows the voltage of the power control signal DSA to be varied from the high level to the low level (Part (D) in FIG. 81). Accordingly, the power transistor DSATr is turned on, and the source voltage Vs of the drive transistor DRTr is increased toward the voltage Vccp (Part (H) in FIG. 81). In accordance therewith, the gate voltage Vg of the drive transistor DRTr is also increased (Part (G) in FIG. 81).

Further, the drive section 720E allows the sub-pixel 111E to emit light in a period (light emission period P16) that begins from timing t220. Specifically, at the timing t220, the power control line drive section 725E allows the voltage of the power control signal DSB to be varied from the high level to the low level (Part (E) in FIG. 81). Accordingly, the power transistor DSBTr is turned on, and a current is flown through a path including the power transistor DSATr, the drive transistor DRTr, the power transistor DSBTr, and the organic EL device OLED in order. Accordingly, the organic EL device OLED emits light.

Effects similar to those in the above-described tenth embodiment are obtainable also with such a configuration.

11. Eleventh Embodiment

Next, a display unit 800 according to an eleventh embodiment will be described. In the present embodiment, the Vth correction described in the fifth embodiment is performed with the use of a configuration similar to that of the display unit 300 according to the above-described ninth embodiment. It is to be noted that the same numerals are used to designate substantially the same components of the display units according to the above-described fifth and ninth embodiments and the like, and the description thereof will be appropriately omitted.

As shown in FIGS. 55 and 67, the display unit 800 includes the display section 310 and a drive section 820. The display section 310 includes the sub-pixels 311. The drive section 820 includes a scanning line drive section 823, a control line drive section 824, a power control line drive section 825, and a data line drive section 827.

Figure 82:
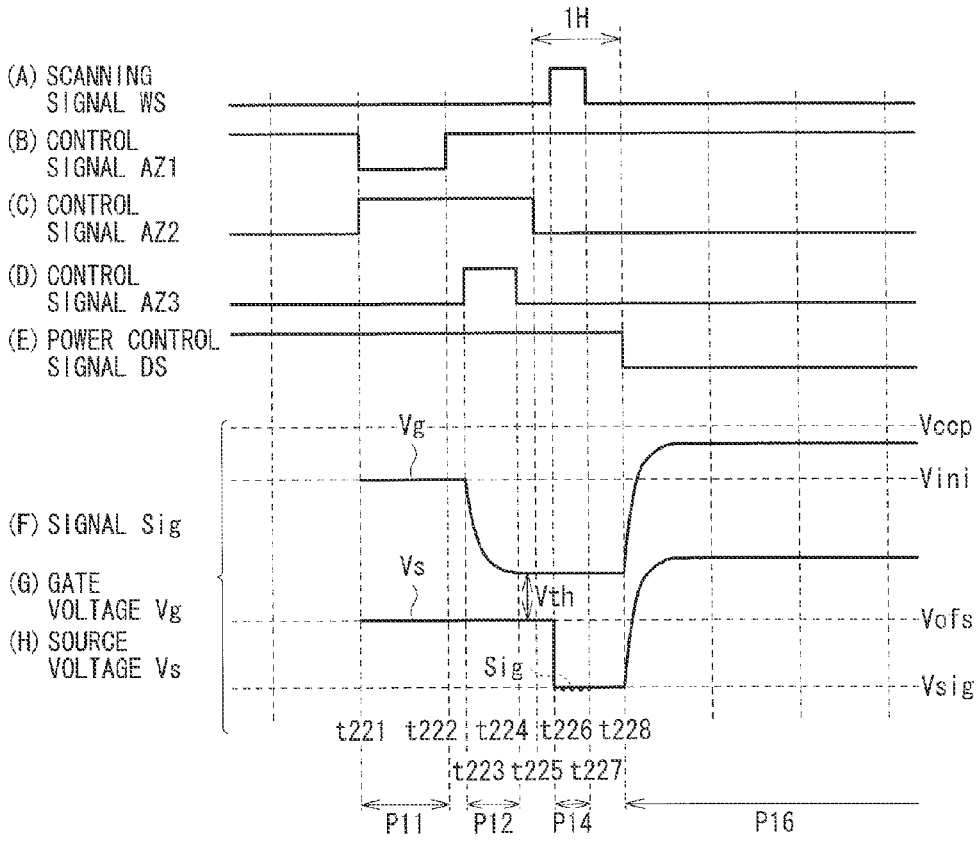
FIG. 82 is a timing waveform chart illustrating an operation example of a display unit according to an eleventh embodiment.

FIG. 82 is a timing chart of display operation in the display unit 800. In FIG. 82, Part (A) shows the waveform of the scanning signal WS, Part (B) shows the waveform of the control signal AZ1, Part (C) shows the waveform of the control signal AZ2, Part (D) shows the waveform of the control signal AZ3, Part (E) shows the waveform of the power control signal DS, Part (F) shows the waveform of the signal Sig, Part (G) shows the waveform of the gate voltage Vg of the drive transistor DRTr, and Part (H) shows the waveform of the source voltage Vs of the drive transistor DRTr.

First, the drive section 820 initializes the sub-pixel 311 in a period (initialization period P11) from timing t221 to timing t222. Specifically, at the timing t221, the control line drive section 824 allows the voltage of the control signal AZ1 to be varied from a high level to a low level (Part (B) in FIG. 82), and allows the voltage of the control signal AZ2 to be varied from a low level to a high level (Part (C) in FIG. 82). Accordingly, the control transistors AZ1Tr and AZ2Tr are turned on. Accordingly, the gate voltage Vg of the drive transistor DRTr is set to the voltage Vini (Part (G) in FIG. 82), and the source voltage Vs is set to the voltage Vofs (Part (H) in FIG. 82). Thus, the sub-pixel 311 is initialized.

Subsequently, at the timing t222, the control line drive section 824 allows the voltage of the control signal AZ1 to be varied from the low level to the high level (Part (B) in FIG. 82). Accordingly, the control transistor AZ1Tr is turned off, and the supply of the voltage Vini to the gate of the drive transistor DRTr is stopped.

Subsequently, the drive section 820 performs the Vth correction in a period (Vth correction period P12) from timing t223 to timing t224. Specifically, at the timing t223, the control line drive section 824 allows the voltage of the control signal AZ3 to be varied from a low level to a high level (Part (D) in FIG. 82). Accordingly, the control transistor AZ3Tr is turned on, and the drain and the gate of the drive transistor DRTr are connected to each other through the control transistor AZ3Tr (a so-called "diode connection"). Accordingly, a current is flown from the gate to the source of the drive transistor DRTr through the drain thereof, and the gate voltage Vg is decreased (Part (G) in FIG. 82). Thus, the gate-source voltage Vgs of the drive transistor DRTr is so converged as to be equal to the threshold voltage Vth of the drive transistor DRTr (Vgs=Vth).

Subsequently, at the timing t224, the control line drive section 824 allows the voltage of the control signal AZ3 to be varied from the high level to the low level (Part (D) in FIG. 82). Accordingly, the control transistor AZ3Tr is turned off. Further, at timing t225, the control line drive section 824 allows the voltage of the control signal AZ2 to be varied from the high level to the low level (Part (C) in FIG. 82). Accordingly, the control transistor AZ2Tr is turned off, and the supply of the voltage Vofs to the source of the drive transistor DRTr is stopped.

Subsequently, the drive section 820 writes the pixel voltage Vsig in the sub-pixel 311 in a period (write period P14) from timing t226 to timing t227. Specifically, at the timing t226, the scanning line drive section 823 allows the voltage of the scanning signal WS to be varied from a low level to a high level (Part (A) in FIG. 82). Accordingly, the write transistor WSTr is turned on, and the source voltage Vs of the drive transistor DRTr is decreased from the voltage Vofs to the pixel voltage Vsig (Part (H) in FIG. 82).

Subsequently, at the timing t227, the scanning line drive section 823 allows the voltage of the scanning signal WS to be varied from the high level to the low level (Part (A) in FIG. 82). Accordingly, the write transistor WSTr is turned off.

Further, the drive section 820 allows the sub-pixel 311 to emit light in a period (light emission period P16) that begins from timing t228 as with the drive section 70A (FIG. 38) according to the above-described fifth embodiment.

Effects similar to those in the above-described fifth embodiment and the like are obtainable also in such a configuration.

[Modification 11-1]

Figure 83:
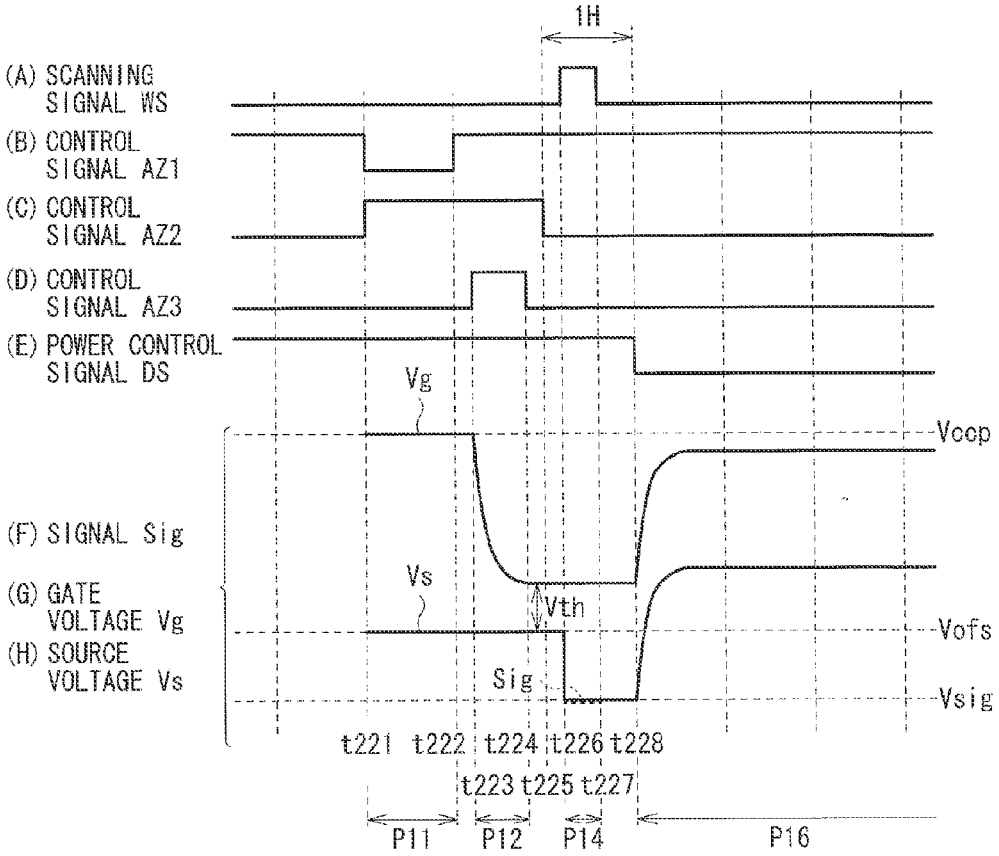
FIG. 83 is a timing waveform chart illustrating an operation example of a display unit according to a modification of the eleventh embodiment.

In the above-described eleventh embodiment, the voltage Vini is supplied to the gate of the drive transistor DRTr by allowing the control transistor AZ1Tr to be ON in the initialization period P11. However, this is not limitative. Alternatively, for example, the voltage Vccp may be supplied to the gate of the drive transistor DRTr by allowing the control transistor AZ1Tr to be ON as shown in FIGS. 55, 69, and 83.

[Modification 11-2]

In the above-described eleventh embodiment, the voltage Vini is supplied to the gate of the drive transistor DRTr by allowing the control transistor AZ1Tr to be ON in the initialization period P11. However, this is not limitative. Alternatively, for example, the voltage Vccp may be supplied to the gate of the drive transistor DRTr by allowing the power transistor DSTr to be ON. The present modification will be described below in detail.

As shown in FIGS. 74 and 75, a display unit 800B according to the present modification includes the display section 310D and a drive section 820B. The display section 310D includes the sub-pixels 311D. The drive section 820B includes a scanning line drive section 823B, a control line drive section 824B, a power control line drive section 825B, and a data line drive section 827B.

Figure 84:
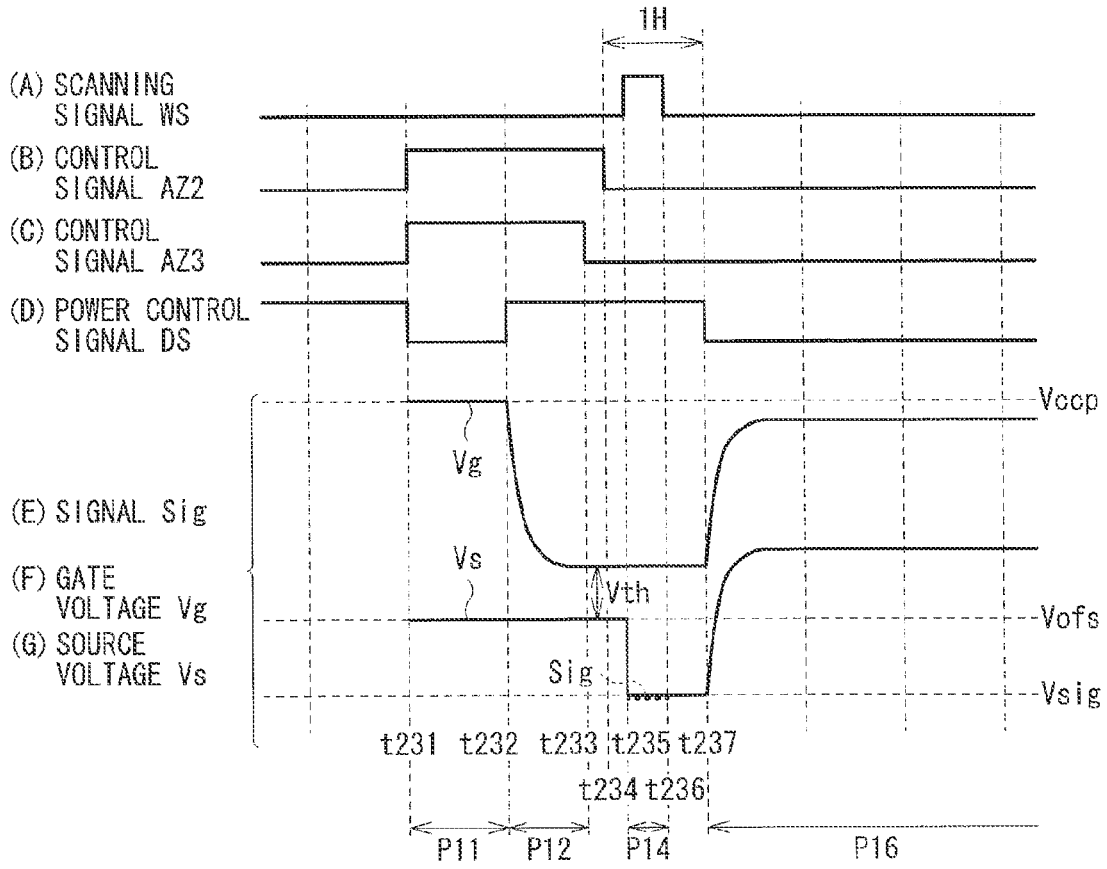
FIG. 84 is a timing waveform chart illustrating an operation example of a display unit according to a modification of the eleventh embodiment.

FIG. 84 is a timing chart of display operation in the display unit 800B. In FIG. 84, Part (A) shows the waveform of the scanning signal WS, Part (B) shows the waveform of the control signal AZ2, Part (C) shows the waveform of the control signal AZ3, Part (D) shows the waveform of the power control signal DS, Part (E) shows the waveform of the signal Sig, Part (F) shows the waveform of the gate voltage Vg of the drive transistor DRTr, and Part (G) shows the waveform of the source voltage Vs of the drive transistor DRTr.

First, the drive section 820B initializes the sub-pixel 311D in a period (initialization period P11) from timing t231 to timing t232. Specifically, at the timing t231, the control line drive section 824B allows the voltage of the control signal AZ2 to be varied from a low level to a high level (Part (B) in FIG. 84). Accordingly, the control transistor AZ2Tr is turned on, and the source voltage Vs of the drive transistor DRTr is set to the voltage Vofs (Part (G) in FIG. 84). At the same time, the control line drive section 824B allows the voltage of the control signal AZ3 to be varied from a low level to a high level (Part (C) in FIG. 84). Accordingly, the control transistor AZ3Tr is turned on, and the drain and the gate of the drive transistor DRTr are connected to each other through the control transistor AZ3Tr (a so-called "diode connection"). Further, the power control line drive section 825B allows the voltage of the power control signal DS to be varied from a high level to a low level (Part (D) in FIG. 84). Accordingly, the power transistor DSTr is turned on, and the gate voltage Vg of the drive transistor DRTr is set to the voltage Vccp (Part (F) in FIG. 84). Thus, the sub-pixel 311D is initialized.

Subsequently, the drive section 820B performs the Vth correction in a period (Vth correction period P12) from timing t232 to timing t233. Specifically, at the timing t232, the power control line drive section 825B allows the voltage of the power control signal DS to be varied from the low level to the high level (Part (D) in FIG. 84). Accordingly, the power transistor DSTr is turned off. Accordingly, a current is flown from the gate to the source of the drive transistor DRTr through the drain thereof, and the gate voltage Vg is decreased (Part (F) in FIG. 84). Thus, the gate-source voltage Vgs of the drive transistor DRTr is so converged as to be equal to the threshold voltage Vth of the drive transistor DRTr (Vgs=Vth).

Subsequently, at the timing t233, the control line drive section 824B allows the voltage of the control signal AZ3 to be varied from the high level to the low level (Part (C) in FIG. 84). Accordingly, the control transistor AZ3Tr is turned off. Subsequently, at timing t234, the control line drive section 824B allows the voltage of the control signal AZ2 to be varied from the high level to the low level (Part (B) in FIG. 84). Accordingly, the control transistor AZ2Tr is turned off, and the supply of the voltage Vofs to the source of the drive transistor DRTr is stopped.

Subsequently, the drive section 820B writes the pixel voltage Vsig in the sub-pixel 311D in a period (write period P14) from timing t235 to timing t236, and allows the sub-pixel 311D to emit light in a period (light emission period P16) that begins from timing t237, as with the drive section 820 (FIG. 82) according to the above-described eleventh embodiment.

Effects similar to those in the above-described eleventh embodiment are obtainable also with such a configuration.

Moreover, in the display unit 800B, the control signal AZ2 and the control signal AZ3 may be a common signal, as will be described below.

As shown in FIG. 71, the display unit 800C according to the present modification includes a display section 810C and a drive section 820C. The display section 810C includes sub-pixels 811C. In the display section 810C, the control lines AZ2L is eliminated compared to the sub-pixels 310D according to the display unit 800B. The drive section 820C includes a scanning line drive section 823C, a control line drive section 824C, a power control line drive section 825C, and a data line drive section 827C.

Figure 85:
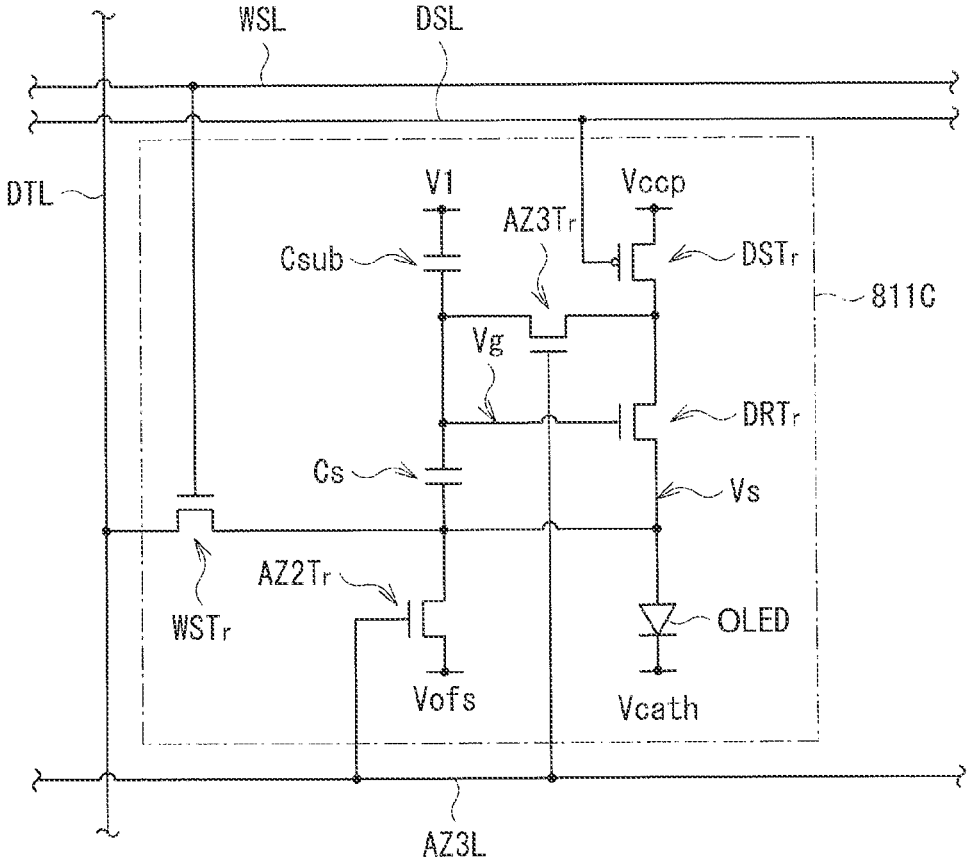
FIG. 85 is a circuit diagram illustrating a configuration example of a sub-pixel according to the modification of the eleventh embodiment.

FIG. 85 illustrates an example of a circuit configuration of the sub-pixel 811C. The sub-pixel 811C has a configuration in which the gate of the control transistor AZ2Tr is connected to the control signal line AZ3L in the sub-pixel 311D according to the display unit 800B.

Figure 86:
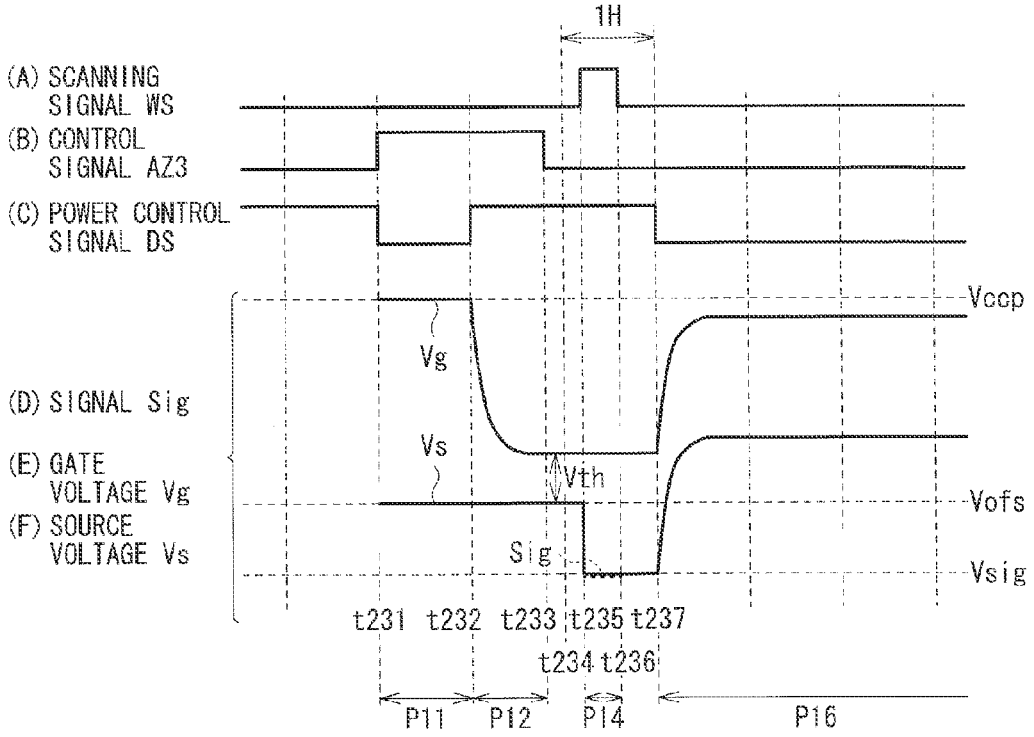
FIG. 86 is a timing waveform chart illustrating an operation example of the display unit according to the modification of the eleventh embodiment.

FIG. 86 is a timing chart of display operation in the display unit 800C. In FIG. 86, Part (A) shows the waveform of the scanning signal WS, Part (B) shows the waveform of the control signal AZ3, Part (C) shows the waveform of the power control signal DS, Part (D) shows the waveform of the signal Sig, Part (E) shows the waveform of the gate voltage Vg of the drive transistor DRTr, and Part (F) shows the waveform of the source voltage Vs of the drive transistor DRTr.

After the Vth correction in the Vth correction period P12, at timing t233, the control line drive section 824C allows the voltage of the control signal AZ3 to be varied from a high level to a low level (Part (B) in FIG. 86). Accordingly, the control transistors AZ2Tr and AZ3Tr are turned off at the same time.

Effects similar to those in the above-described eleventh embodiment are obtainable also with such a configuration.

[Modification 11-3]

In the above-described eleventh embodiment, the voltage Vofs is supplied to the source of the drive transistor DRTr by allowing the control transistor AZ2Tr to be ON in the initialization period P11. However, this is not limitative. Alternatively, for example, the voltage Vofs may be supplied to the source of the drive transistor DRTr by allowing the write transistor WSTr to be ON. The present modification will be described below in detail.

As shown in FIGS. 71 and 72, the display unit 800D according to the present modification includes the display section 310C and a drive section 820D. The display section 310C includes the sub-pixels 311C. The drive section 820D includes a scanning line drive section 823D, a control line drive section 824D, a power control line drive section 825D, and a data line drive section 827D.

Figure 87:
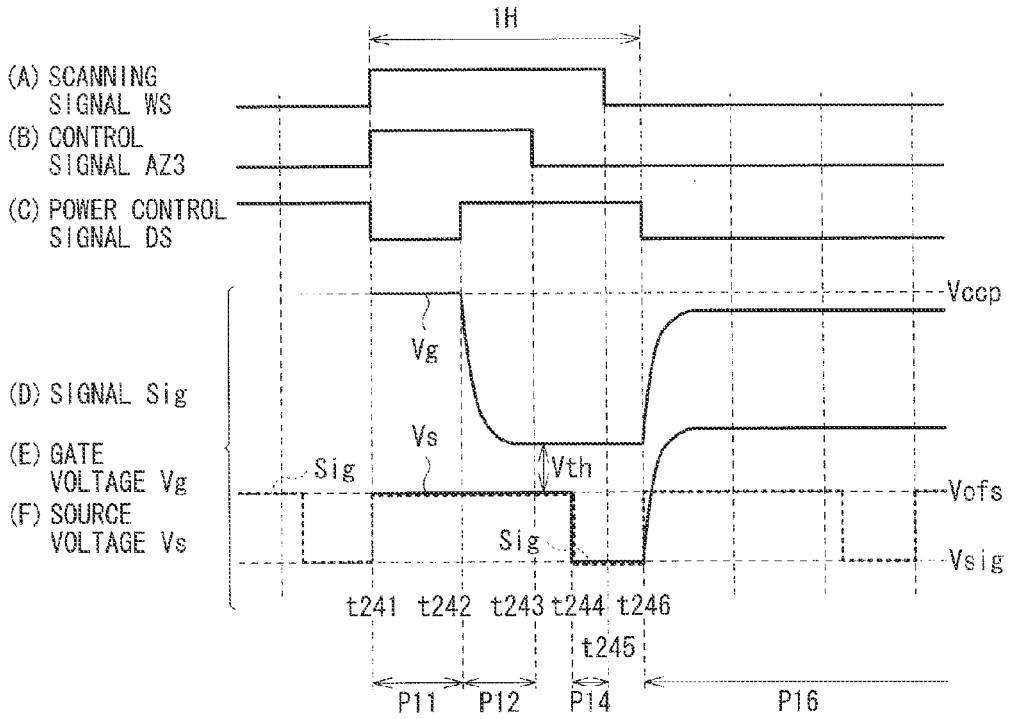
FIG. 87 is a timing waveform chart illustrating an operation example of the display unit according to the modification of the eleventh embodiment.

FIG. 87 is a timing chart of display operation in the display unit 800D. In FIG. 87, Part (A) shows the waveform of the scanning signal WS, Part (B) shows the waveform of the control signal AZ3, Part (C) shows the waveform of the power control signal DS, Part (D) shows the waveform of the signal Sig, Part (E) shows the waveform of the gate voltage Vg of the drive transistor DRTr, and Part (F) shows the waveform of the source voltage Vs of the drive transistor DRTr.

First, the drive section 820D initializes the sub-pixel 311C in a period (initialization period P11) from timing t241 to timing t242. Specifically, at the timing t241, the data line drive section 827D sets the signal Sig to the voltage Vofs (Part (D) in FIG. 87), and the scanning line drive section 823D allows the voltage of the scanning signal WS to be varied from a low level to a high level (Part (A) in FIG. 87). Accordingly, the write transistor WSTr is turned on, and the source voltage Vs of the drive transistor DRTr is set to the voltage Vofs (Part (F) in FIG. 87). At the same time, the control line drive section 824D allows the voltage of the control signal AZ3 to be varied from a low level to a high level (Part (B) in FIG. 87). Accordingly, the control transistor AZ3Tr is turned on, and the drain and the gate of the drive transistor DRTr are connected to each other through the control transistor AZ3Tr (a so-called "diode connection"). Further, the power control line drive section 825D allows the voltage of the power control signal DS to be varied from a high level to a low level (Part (C) in FIG. 87). Accordingly, the power transistor DSTr is turned on, and the gate voltage Vg of the drive transistor DRTr is set to the voltage Vccp (Part (E) in FIG. 87). Thus, the sub-pixel 311C is initialized.

Subsequently, the drive section 820D performs the Vth correction in a period (Vth correction period P12) from timing t242 to timing t243. Specifically, at the timing t242, the power control line drive section 825D allows the voltage of the power control signal DS to be varied from the low level to the high level (Part (C) in FIG. 87). Accordingly, the power transistor DSTr is turned off. Accordingly, a current is flown from the gate to the source of the drive transistor DRTr through the drain thereof, and the gate voltage Vg is decreased (Part (E) in FIG. 87). Thus, the gate-source voltage Vgs of the drive transistor DRTr is so converged as to be equal to the threshold voltage Vth of the drive transistor DRTr (Vgs=Vth).

Subsequently, at the timing t243, the control line drive section 824D allows the voltage of the control signal AZ3 to be varied from the high level to the low level (Part (B) in FIG. 87). Accordingly, the control transistor AZ3Tr is turned off.

Subsequently, the drive section 820D writes the pixel voltage Vsig in the sub-pixel 311C in a period (write period P14) from timing t244 to timing t245. Specifically, at the timing t244, the data line drive section 827D allows the signal Sig to be varied from the voltage Vofs to the pixel voltage Vsig (Part (D) in FIG. 87). Accordingly, the source voltage Vs of the drive transistor DRTr is decreased from the voltage Vofs to the pixel voltage Vsig (Part (F) in FIG. 87).

Subsequently, at the timing t245, the scanning line drive section 823D allows the voltage of the scanning WS to be varied from the high level to the low level (Part (A) in FIG. 87). Accordingly, the write transistor WSTr is turned off.

Further, the drive section 820D allows the sub-pixel 311C to emit light in a period (light emission period P16) that begins from timing t246, as with the drive section 800 (FIG. 82) according to the above-described eleventh embodiment.

Effects similar to those in the above-described eleventh embodiment are obtainable also with such a configuration.

12. Twelfth Embodiment

Next, a display unit 400 according to a twelfth embodiment will be described. In the present embodiment, the sub-pixel includes three TFTs of a P-channel MOS type and one capacitor Cs. It is to be noted that the same numerals are used to designate substantially the same components of the display unit according to the above-described first embodiment and the like, and the description thereof will be appropriately omitted.

Figure 88:
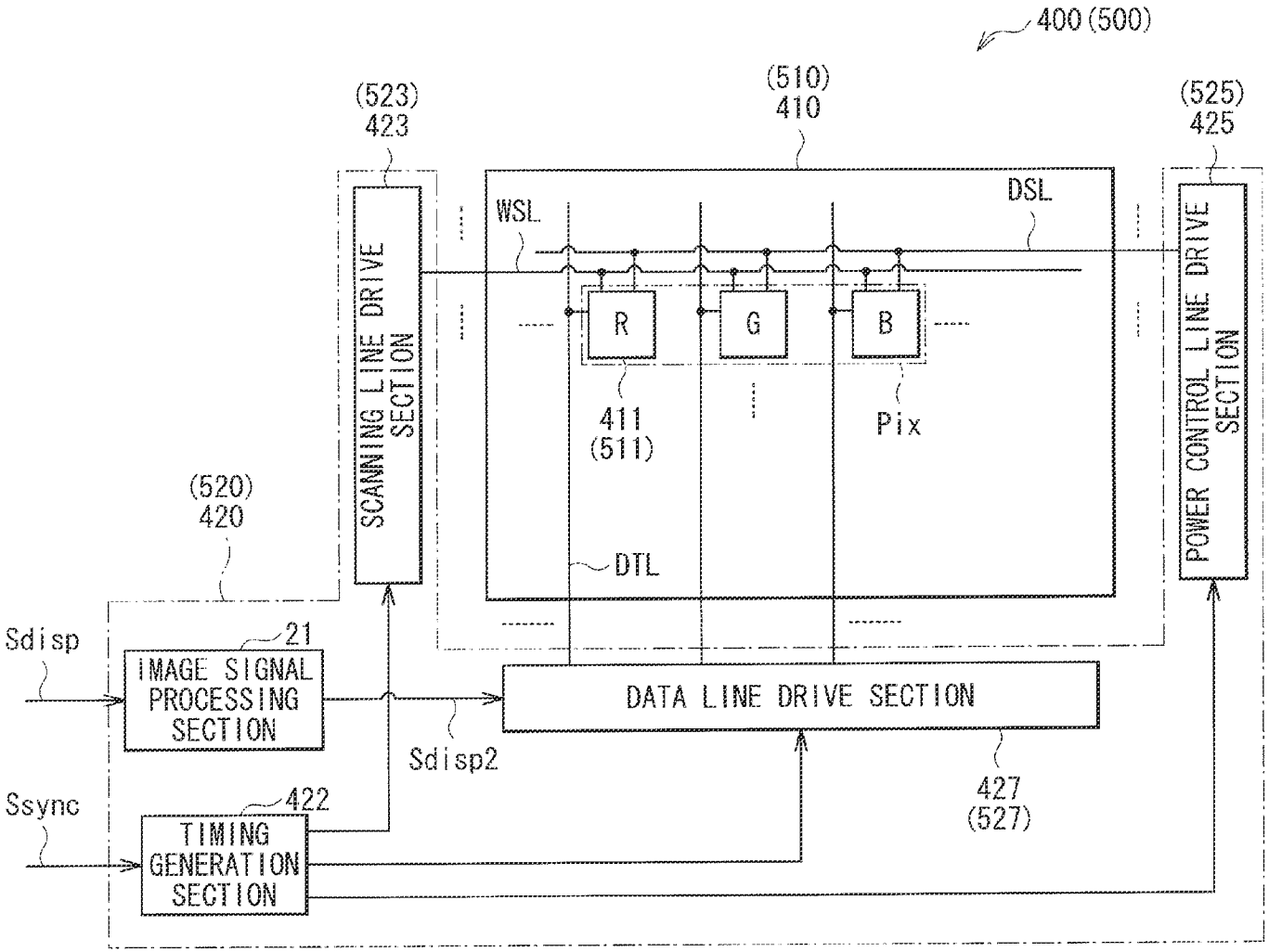
FIG. 88 is a block diagram illustrating a configuration example of a display unit according to a twelfth embodiment.

FIG. 88 illustrates a configuration example of a display unit 400 according to the present embodiment. The display unit 400 includes a display section 410 and a drive section 420.

The display section 410 includes a plurality of sub-pixels 411. The display section 410 also includes the plurality of scanning lines WSL that extend in the row direction and the plurality of power control lines DSL that extend in the row direction. One end of each of the scanning lines WSL and the power control lines DSL is connected to the drive section 420.

Figure 89:
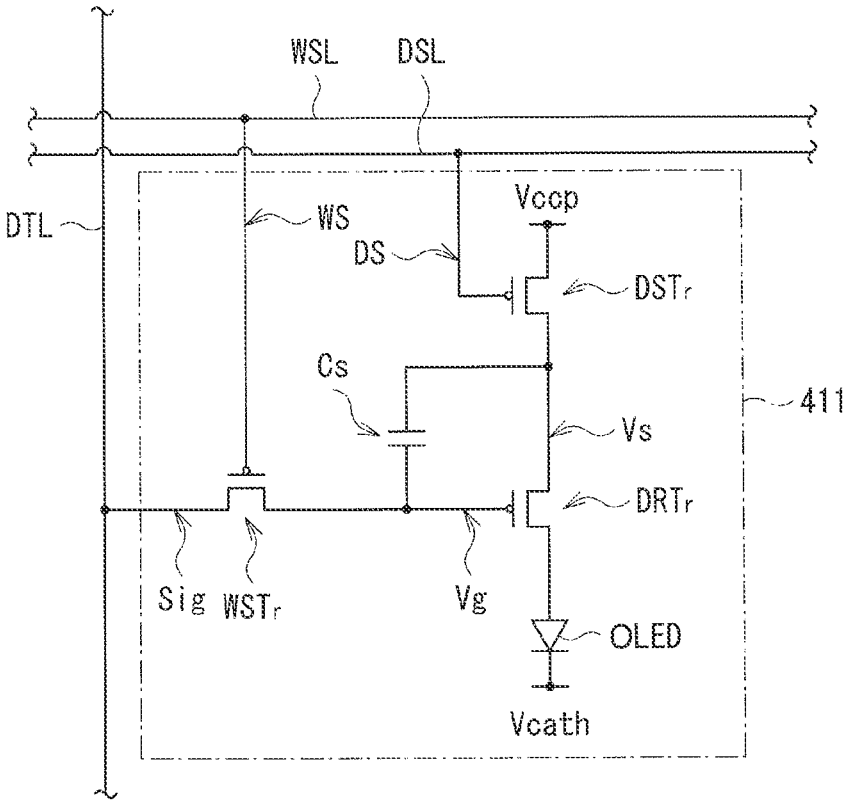
FIG. 89 is a circuit diagram illustrating a configuration example of a sub-pixel shown in FIG. 88.

FIG. 89 illustrates an example of a circuit configuration of the sub-pixel 411. The write transistor WSTr, the drive transistor DRTr, and the power transistor DSTr are each configured of a TFT of a P-channel MOS type. The gate of the write transistor WSTr is connected to the scanning line WSL, the source thereof is connected to the data line DTL, and the drain thereof is connected to the gate of the drive transistor DRTr and the first end of the capacitor Cs. The gate of the drive transistor DRTr is connected to the drain of the write transistor WSTr and the first end of the capacitor Cs, the source thereof is connected to the drain of the power transistor DSTr and the second end of the capacitor Cs, and the drain thereof is connected to the anode of the organic EL device OLED. The gate of the power transistor DSTr is connected to the power control line DSL, the source thereof is supplied with the voltage Vccp by the drive section 420, and the drain thereof is connected to the source of the drive transistor DRTr and the second end of the capacitor Cs.

The write transistor WSTr corresponds to a specific but not limitative example of "eleventh transistor" in one embodiment of the present disclosure. The power transistor DSTr corresponds to a specific but not limitative example of "fifteenth transistor" in one embodiment of the present disclosure.

The drive section 420 includes a timing generation section 422, a scanning line drive section 423, a power control line drive section 425, and a data line drive section 427. The timing generation section 422 is a circuit that supplies a control signal to each of the scanning line drive section 423, the power control line drive section 425, and the data line drive section 427 based on the synchronization signal Ssync that is supplied from the outside, and thereby controlling these sections to operate in synchronization with each other. The scanning line drive section 423, the power control line drive section 425, and the data line drive section 427 have functions similar to those of the scanning line drive section 23, the power control line drive section 25A, and the data line drive section 27, respectively.

Figure 90:
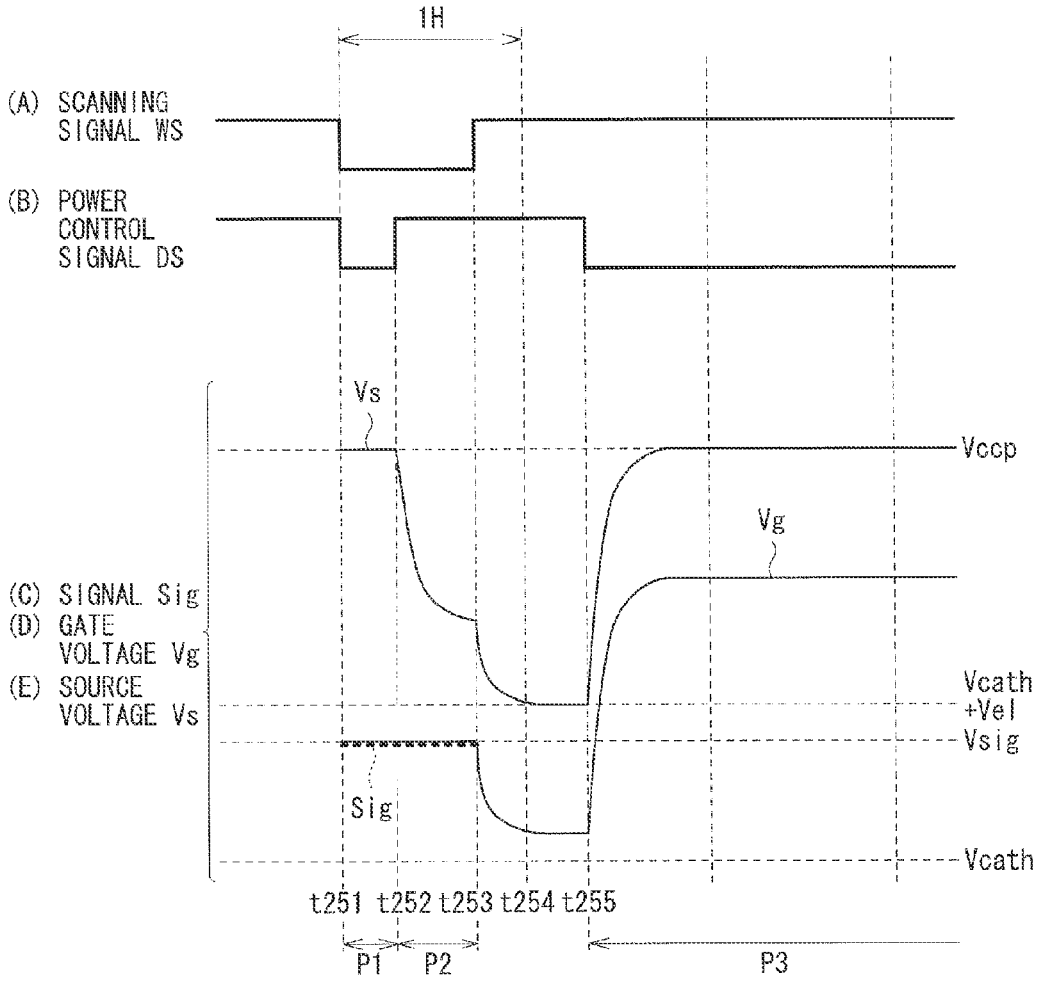
FIG. 90 is a timing waveform chart illustrating an operation example of a display unit shown in FIG. 88.

FIG. 90 is a timing chart of display operation in the display unit 400. In FIG. 90, Part (A) shows the waveform of the scanning signal WS, Part (B) shows the waveform of the power control signal DS, Part (C) shows the waveform of the signal Sig, Part (D) shows the waveform of the gate voltage Vg of the drive transistor DRTr, and Part (E) shows the waveform of the source voltage Vs of the drive transistor DRTr.

First, the drive section 420 writes the pixel voltage Vsig in the sub-pixel 411 and initializes the sub-pixel 411 in a period (write period P1) from timing t251 to timing t252. Specifically, first, at the timing t251, the data line drive section 427 sets the signal Sig to the pixel voltage Vsig (Part (C) in FIG. 90), and the scanning line drive section 423 allows the voltage of the scanning signal WS to be varied from a high level to a low level (Part (A) in FIG. 90). Accordingly, the write transistor WSTr is turned on, and the gate voltage Vg of the drive transistor DRTr is set to the pixel voltage Vsig (Part (D) in FIG. 90). At the same time, the power control line drive section 425 allows the voltage of the power control signal DS to be varied from a high level to a low level (Part (B) in FIG. 90). Accordingly, the power transistor DSTr is turned on, and the source voltage Vs of the drive transistor DRTr is set to the voltage Vccp (Part (E) in FIG. 90). Thus, the sub-pixel 411 is initialized.

Subsequently, the drive section 420 performs the Ids correction on the sub-pixel 411 in a period (Ids correction period P2) from timing t252 to timing t253. Specifically, at the timing t252, the power control line drive section 425 allows the voltage of the power control signal DS to be varied from the low level to the high level (Part (B) in FIG. 90). Accordingly, the power control transistor DSTr is turned off. Accordingly, a current is flown from the source to the drain of the drive transistor DRTr, and the source voltage Vs is decreased (Part (E) in FIG. 90). Because the source voltage Vs is thus decreased, the current flown from the source to the drain of the drive transistor DRTr is decreased. With this negative feedback operation, the source voltage Vs is decreased in a slower pace over time. A length of the time period (from the timing t252 to the timing t253) for performing the Ids correction is determined in order to suppress variations in the current that flows through the drive transistor DRTr at the timing t253 as described in the above first embodiment.

It is to be noted that, in the write period P1 and the Ids correction period P2 (the period from the timing t251 to the timing t253), a current corresponding to the pixel voltage Vsig is flown through the organic EL device OLED, and the organic EL device OLED emits light. However, the period is sufficiently short relative to one frame period (1F). Therefore, such light emission does not have large influence on image quality. Moreover, for example, when the sub-pixel 411 displays black color, the gate-source voltage Vgs is so set that a current is not flown into the drive transistor DRTr at the timing of initialization, and therefore, occurrence of such light emission is prevented. Accordingly, black color is displayed sufficiently, and high contrast is obtained.

Subsequently, at the timing t253, the scanning line drive section 423 allows the voltage of the scanning signal WS to be varied from a low level to a high level (Part (A) in FIG. 90). Accordingly, the write transistor WSTr is turned off, and the supply of the pixel voltage Vsig to the gate of the drive transistor DRTr is stopped. Therefore, after this, the voltage between the terminals of the capacitor Cs, that is, the gate-source voltage Vgs of the drive transistor DRTr is maintained. Further, because a current is flown from the source to the drain of the drive transistor DRTr, the source voltage Vs of the drive transistor DRTr is decreased (Part (E) in FIG. 90). The source voltage Vs is decreased down to a voltage equivalent to the sum (Vcath+Vel) of the voltage Vcath and the threshold voltage Vel of the organic EL device OLED, and the organic EL device OLED stops emitting light. Further, the gate voltage Vg of the drive transistor DRTr is decreased in accordance with the decrease in the source voltage Vs (Part (D) in FIG. 90).

Subsequently, at timing t255, the power control line drive section 425 allows the voltage of the power control signal DS to be varied from the high level to the low level (Part (B) in FIG. 90). Accordingly, the power transistor DSTr is turned on, and a current is flown from the source to the drain of the drive transistor DRTr. Further, the source voltage Vs of the drive transistor DRTr is increased (Part (E) in FIG. 90), and the gate voltage Vg of the drive transistor DRTr is also increased accordingly (Part (D) in FIG. 90). Further, the drive transistor DRTr is allowed to operate in a saturation region, and a current is flown between the anode and the cathode of the organic EL device OLED. Accordingly, the organic EL device OLED emits light.

Subsequently, in the display unit 400, the transition is made from the light emission period P3 to the write period P1 after a predetermined period (one frame period) has passed. The drive section 420 drives the sub-pixel 411 so that the above-described series of operation is repeated.

As described above, in the present embodiment, the display section is configured only of a PMOS transistor without using an NMOS transistor. Therefore, the display section may be manufactured, for example, even in a process in which the NMOS transistor is not allowed to be manufactured, such as in an organic TFT (O-TFT) process. Other effects are similar to those in the above-described first embodiment.

[Modification 12-1]

In the above-described twelfth embodiment, the write transistor WSTr and the power transistor DSTr are each configured of a PMOS transistor. However, this is not limitative. Alternatively, the write transistor WSTr and the power transistor DSTr may each be configured, for example, of an NMOS transistor.

[Modification 12-2]

Figure 91:
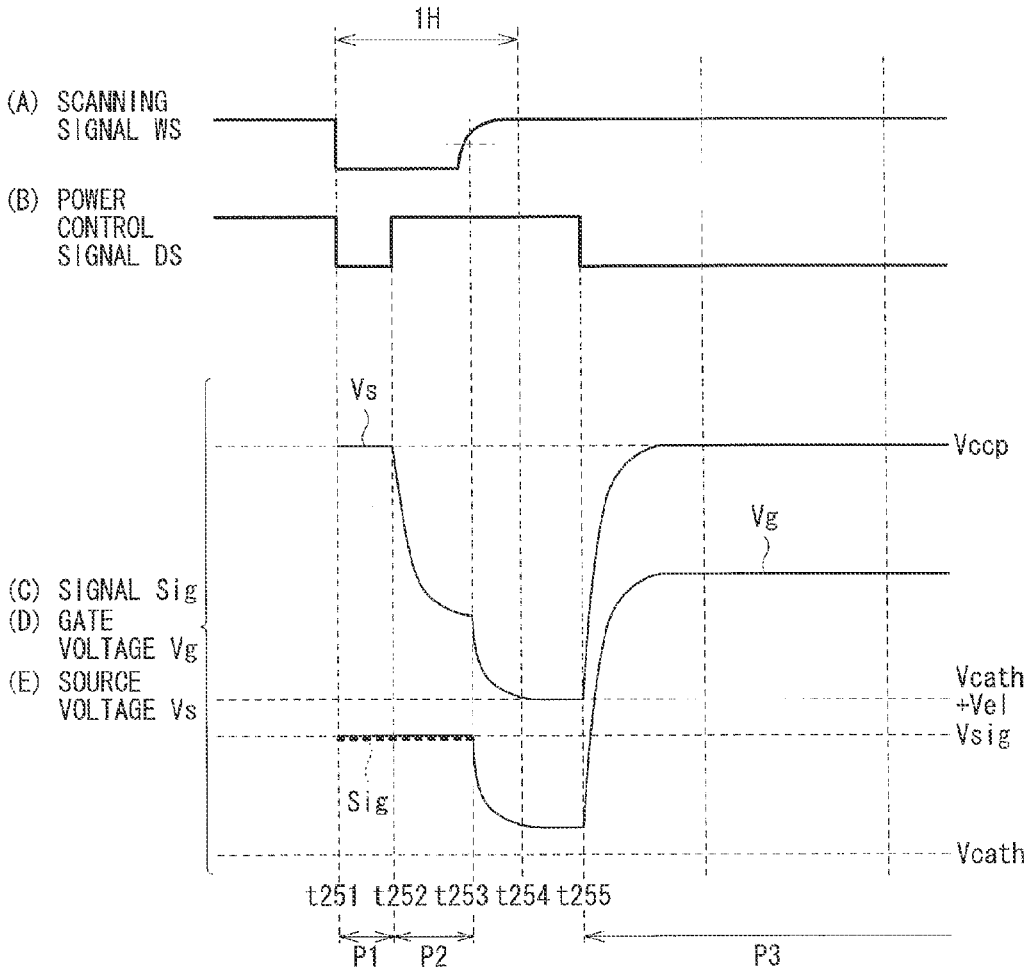
FIG. 91 is a timing waveform chart illustrating an operation example of a display unit according to a modification of the twelfth embodiment.

In the above-described twelfth embodiment, the voltage of the scanning signal WS is varied from the low level to the high level in a short time at the timing t253. However, this is not limitative. Alternatively, as shown in FIG. 91, for example, the voltage of the scanning signal WS may be varied gradually from the low level to the high level. Thus, the length of the Ids correction period P2 is allowed to be varied in accordance with the pixel voltage Vsig as in the display unit 2 according to the second embodiment. Therefore, image quality is improved.

13. Thirteenth Embodiment

Next, a display unit 500 according to a thirteenth embodiment will be described. In the present embodiment, operation similar to that of the display unit 400 according to the twelfth embodiment is achieved with the use of the sub-pixel that includes three TFTs of an N-channel MOS type and one capacitor Cs. It is to be noted that the same numerals are used to designate substantially the same components of the display unit according to the above-described twelfth embodiment and the like, and the description thereof will be appropriately omitted.

As shown in FIG. 88, the display unit 500 includes a display section 510 and a drive section 520. The display section 510 includes sub-pixels 511. The drive section 520 includes a scanning line drive section 523, a power control line drive section 525, and a data line drive section 527.

Figure 92:
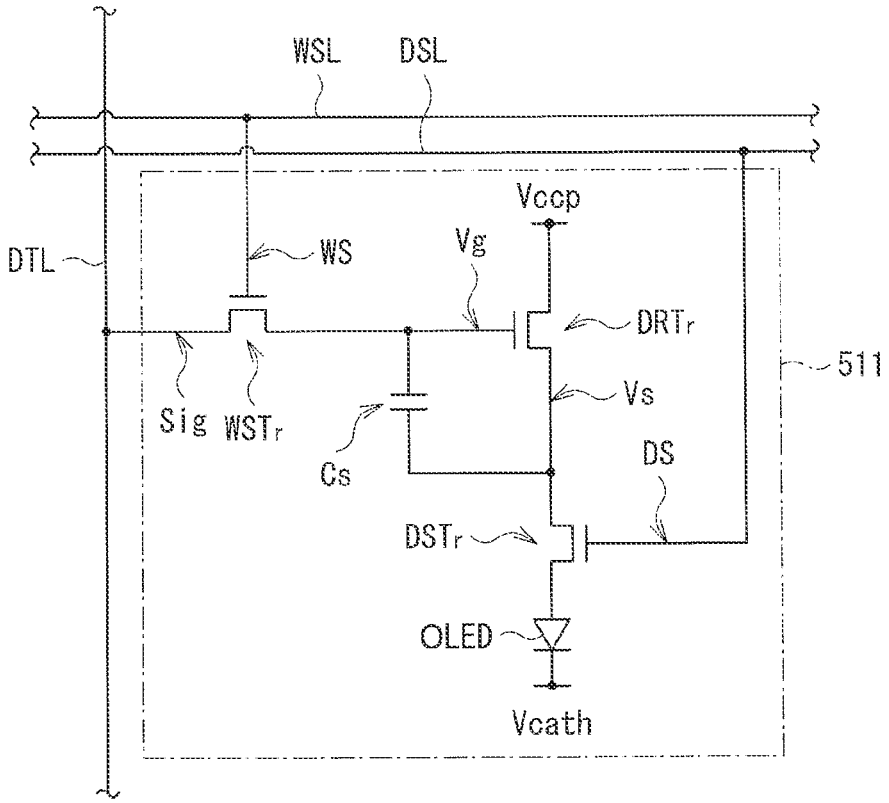
FIG. 92 is a circuit diagram illustrating a configuration example of a sub-pixel according to a thirteenth embodiment.

FIG. 92 illustrates an example of a circuit configuration of the sub-pixel 511. The write transistor WSTr, the drive transistor DRTr, and the power transistor DSTr are each configured of a TFT of an N-channel MOS type. The gate of the write transistor WSTr is connected to the scanning line WSL, the source thereof is connected to the data line DTL, and the drain thereof is connected to the gate of the drive transistor DRTr and the first end of the capacitor Cs. The gate of the drive transistor DRTr is connected to the drain of the write transistor WSTr and the first end of the capacitor Cs, the source thereof is connected to the drain of the power transistor DSTr and the second end of the capacitor Cs, and the drain thereof is supplied with the voltage Vccp by the drive section 520. The gate of the power transistor DSTr is connected to the power control line DSL, the source thereof is connected to the anode of the organic EL device OLED, and the drain thereof is connected to the source of the drive transistor DRTr and the second end of the capacitor Cs.

The write transistor WSTr corresponds to a specific but not limitative example of "second transistor" in one embodiment of the present disclosure. The power transistor DSTr corresponds to a specific but not limitative example of "fifth transistor" in one embodiment of the present disclosure.

Figure 93:
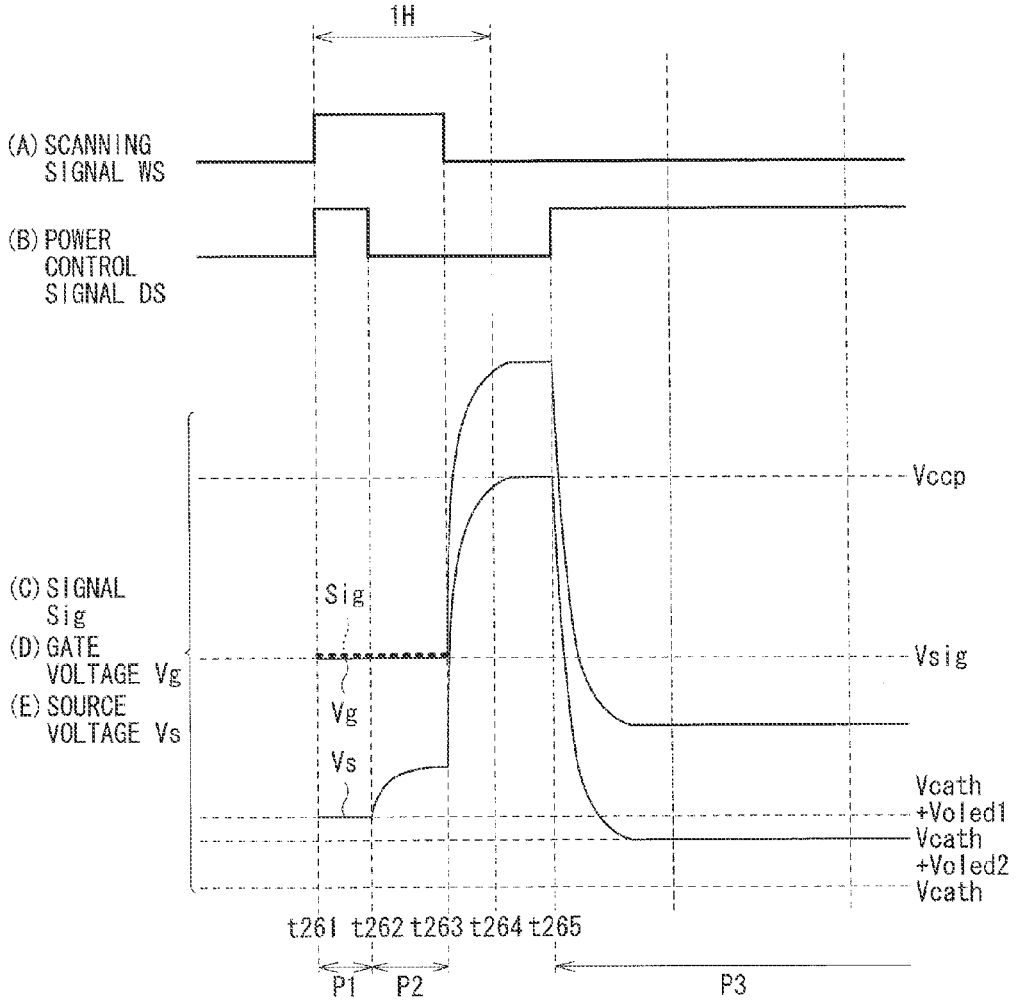
FIG. 93 is a timing waveform chart illustrating an operation example of a display unit according to the thirteenth embodiment.

FIG. 93 is a timing chart of display operation in the display unit 500. In FIG. 93, Part (A) shows the waveform of the scanning signal WS, Part (B) shows the waveform of the power control signal DS, Part (C) shows the waveform of the signal Sig, Part (D) shows the waveform of the gate voltage Vg of the drive transistor DRTr, and Part (E) shows the waveform of the source voltage Vs of the drive transistor DRTr.

First, the drive section 520 writes the pixel voltage Vsig in the sub-pixel 511 and initializes the sub-pixel 511 in a period (write period P1) from timing t261 to timing t262. Specifically, first, at the timing t261, the data line drive section 527 sets the signal Sig to the pixel voltage Vsig (Part (C) in FIG. 93), and the scanning line drive section 523 allows the voltage of the scanning signal WS to be varied from a low level to a high level (Part (A) in FIG. 93). Accordingly, the write transistor WSTr is turned on, and the gate voltage Vg of the drive transistor DRTr is set to the pixel voltage Vsig (Part (D) in FIG. 93). At the same time, the power control line drive section 525 allows the voltage of the power control signal DS to be varied from a low level to a high level (Part (B) in FIG. 93). Accordingly, the power transistor DSTr is turned on, and a current is flown from the drive transistor DRTr to the organic EL device OLED through the power transistor DSTr. Accordingly, the source voltage Vs of the drive transistor DRTr is set to a predetermined voltage (the voltage Vcath+the on-voltage Voled1 of the organic EL device OLED) (Part (E) in FIG. 93). Thus, the sub-pixel 511 is initialized. Here, the predetermined voltage corresponds to a specific but not limitative example of "first voltage" in one embodiment of the present disclosure.

It is to be noted that, in the write period P1 (the period from the timing t261 to the timing t262), a current corresponding to the pixel voltage Vsig is flown through the organic EL device OLED, and the organic EL device OLED emits light. However, the period is sufficiently short relative to one frame period (1F). Also, the current amount is sufficiently small, for example, when the sub-pixel 511 displays black color. Therefore, it is considered that contrast is hardly degraded.

Subsequently, the drive section 520 performs the Ids correction on the sub-pixel 511 in a period (Ids correction period P2) from the timing t262 to timing t263. Specifically, at the timing t262, the power control line drive section 525 allows the voltage of the power control signal DS to be varied from a high level to a low level (Part (B) in FIG. 93). Accordingly, the power control transistor DSTr is turned off, and the organic EL device OLED stops emitting light. Further, a current is flown from the drain to the source of the drive transistor DRTr, and the source voltage Vs is increased (Part (E) in FIG. 93). Because the source voltage Vs is thus increased, a current flown from the drain to the source of the drive transistor DRTr is decreased. With this negative feedback operation, the source voltage Vs is decreased in a slower pace over time. A length of the time period (from the timing t262 to the timing t263) for performing the Ids correction is determined in order to suppress variations in the current that is flown through the drive transistor DRTr at the timing t263 as described in the above first embodiment.

Subsequently, at the timing t263, the scanning line drive section 523 allows the voltage of the scanning signal WS to be varied from the high level to the low level (Part (A) in FIG. 93). Accordingly, the write transistor WSTr is turned off, and the supply of the pixel voltage Vsig to the gate of the drive transistor DRTr is stopped. Therefore, after this, the voltage between the terminals of the capacitor Cs, that is, the gate-source voltage Vgs of the drive transistor DRTr is maintained. Further, because a current is flown from the drain to the source of the drive transistor DRTr, the source voltage Vs of the drive transistor DRTr is increased (Part (E) in FIG. 93). The source voltage Vs is increased toward a voltage substantially equivalent to the voltage Vccp that is applied to the drain of the drive transistor DRTr. Also, the gate voltage Vg of the drive transistor DRTr is increased in accordance with the increase in the source voltage Vs (Part (D) in FIG. 93).

Subsequently, at timing t265, the power control line drive section 525 allows the voltage of the power control signal DS to be varied from the low level to the high level (Power (B) in FIG. 93). Accordingly, the power transistor DSTr is turned on, and the current Ids is flown into the drive transistor DRTr. Also, the source voltage Vs of the drive transistor DRTr is decreased toward a predetermined voltage (the voltage Vcath+an on-voltage Voled2 of the organic EL device OLED) (Part (E) in FIG. 93), and the gate voltage Vg of the drive transistor DRTr is also decreased accordingly (Part (D) in FIG. 93). Further, the drive transistor DRTr is allowed to operate in a saturation region, and a current is flown between the anode and the cathode of the organic EL device OLED. Accordingly, the organic EL device OLED emits light.

Subsequently, in the display unit 500, the transition is made from the light emission period P3 to the write period P1 after a predetermined period (one frame period) has passed. The drive section 520 drives the sub-pixel 511 so that the above-described series of operation is repeated.

As described above, in the present embodiment, the display section is configured only of an NMOS transistor without using a PMOS transistor. Therefore, the display section may be manufactured, for example, even in a process in which the PMOS transistor is not allowed to be manufactured, such as in an oxide TFT (TOSTFT) process. Other effects are similar to those in the above-described first embodiment.

[Modification 13-1]

In the above-described thirteenth embodiment, the write transistor WSTr and the power transistor DSTr are each configured of an NMOS transistor. However, this is not limitative. Alternatively, for example, the write transistor WSTr and the power transistor DSTr may be each configured of a PMOS transistor.

[Modification 13-2]

Figure 94:
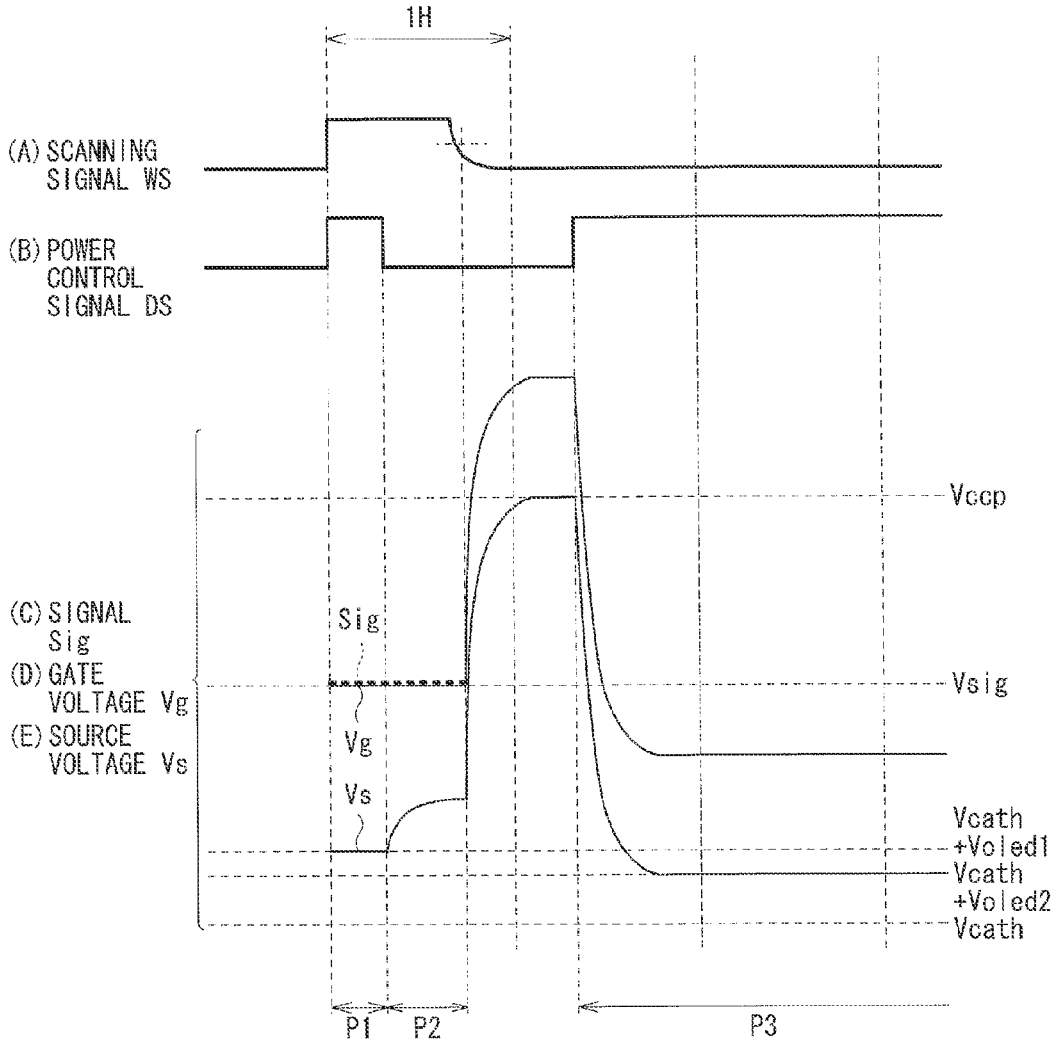
FIG. 94 is a timing waveform chart illustrating an operation example of a display unit according to a modification of the thirteenth embodiment.

In the above-described thirteenth embodiment, the voltage of the scanning signal WS is varied from the high level to the low level in a short time at the timing t263. However, this is not limitative. Alternatively, as shown in FIG. 94, for example, the voltage of the scanning signal WS may be varied gradually from the high level to the low level. Thus, the length of the Ids correction period P2 is allowed to be varied in accordance with the pixel voltage Vsig as in the display unit 2 according to the second embodiment. Therefore, image quality is improved.

14. Comparison Between Schemes

Next, characteristics are compared taking some of the above-described display units as examples.

Figure 95A:
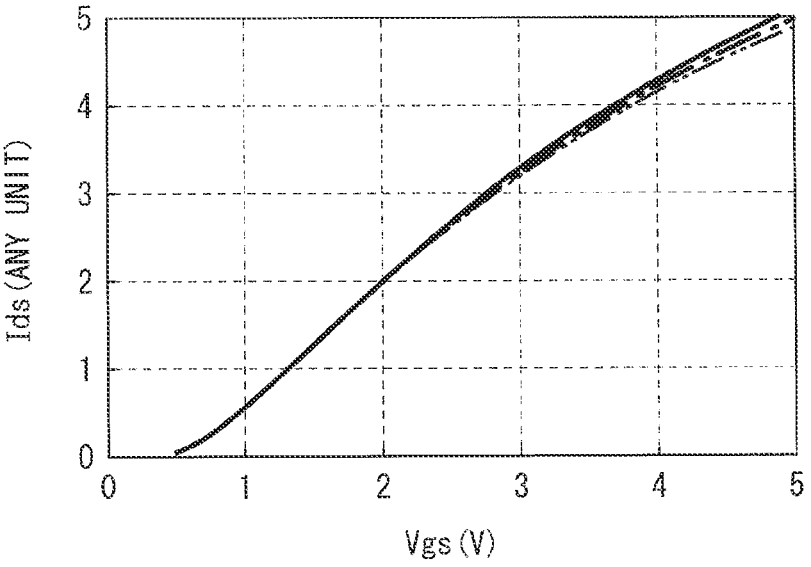
FIG. 95A is a characteristic diagram illustrating a characteristic example of the display unit according to the fourth embodiment.
Figure 95B:
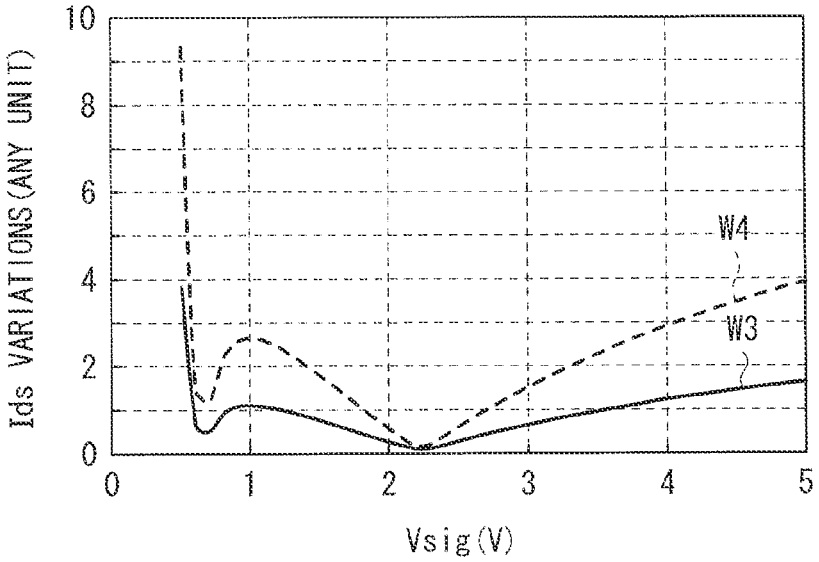
FIG. 95B is another characteristic diagram illustrating a characteristic example of the display unit according to the fourth embodiment.

FIG. 95A illustrates pixel voltage Vsig dependency of the current Ids in the display unit 6 according to the fourth embodiment. FIG. 95A shows results of simulation that assumes cases in which the transistor is manufactured under a plurality of different process conditions. FIG. 95B illustrates pixel voltage Vsig dependency of the variations in the current Ids shown in FIG. 95A.

Figure 96A:
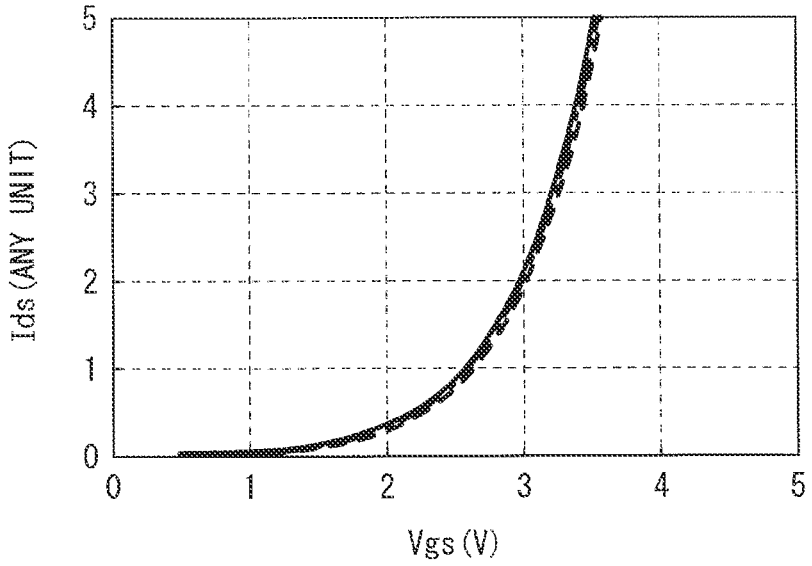
FIG. 96A is a characteristic diagram illustrating a characteristic example of the display unit according to the second embodiment.
Figure 96B:
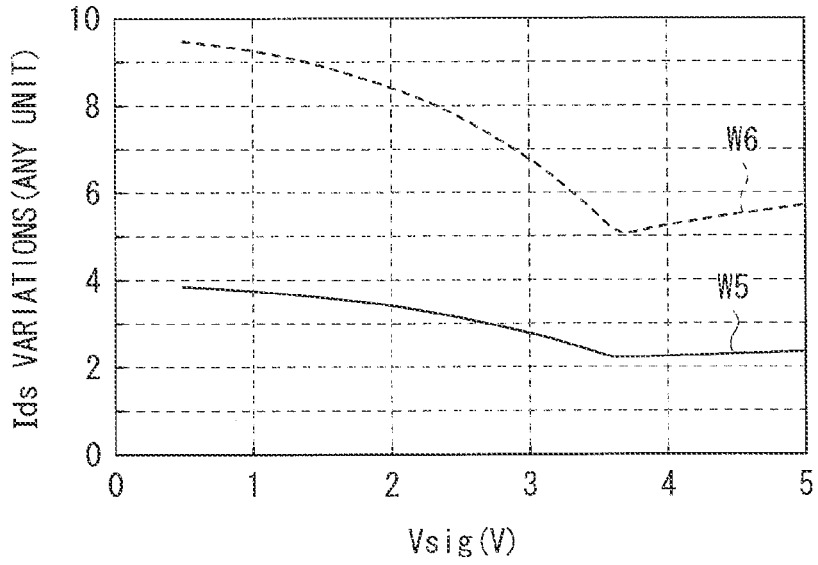
FIG. 96B is another characteristic diagram illustrating a characteristic example of the display unit according to the second embodiment.

FIG. 96A illustrates pixel voltage Vsig dependency of the current Ids in the display unit 2 according to the second embodiment. FIG. 96B illustrates pixel voltage Vsig dependency in the variations of the current Ids shown in FIG. 96A.

Figure 97A:
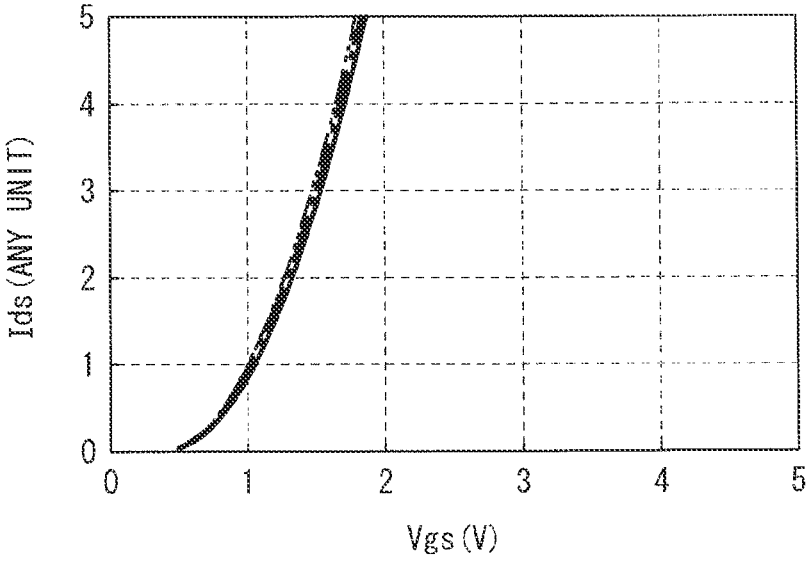
FIG. 97A is a characteristic diagram illustrating a characteristic example of the display unit according to the fifth embodiment.
Figure 97B:
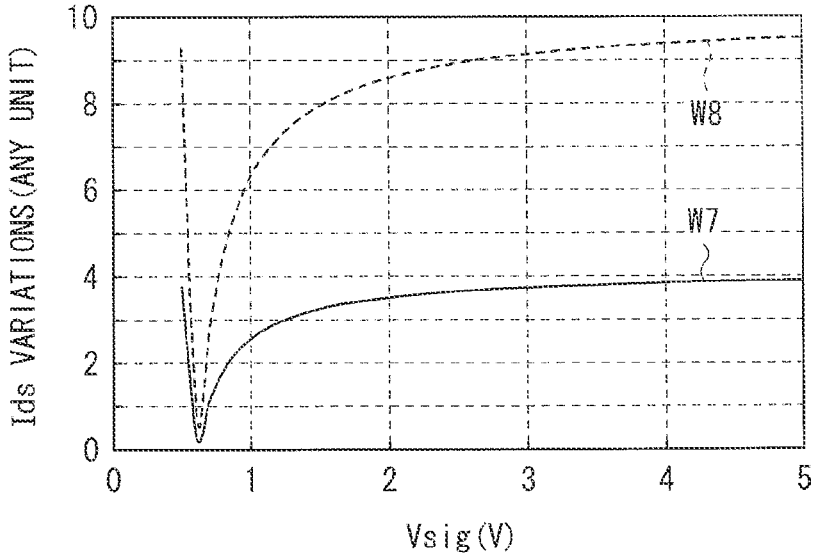
FIG. 97B is another characteristic diagram illustrating a characteristic example of the display unit according to the fifth embodiment.

FIG. 97A illustrates pixel voltage Vsig dependency of the current Ids in the display unit 7 according to the fifth embodiment. FIG. 97B illustrates pixel voltage Vsig dependency in the variations of the current Ids shown in FIG. 97A.

Figure 98:
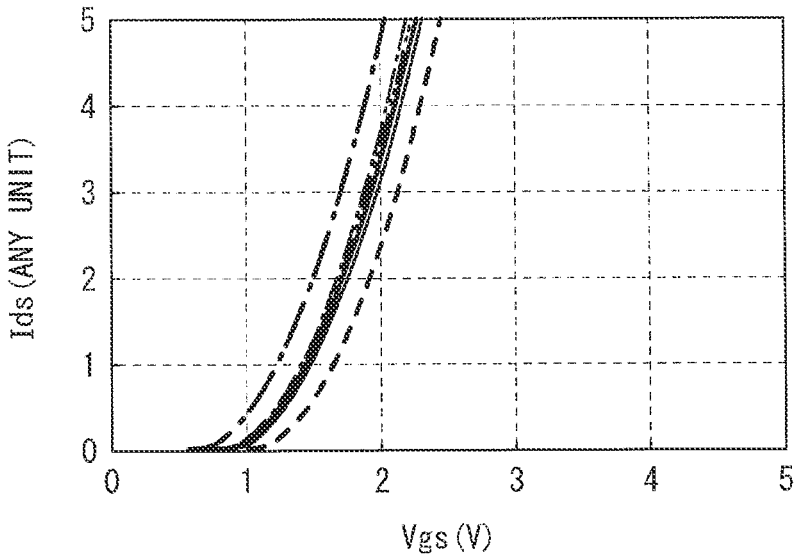
FIG. 98 is a characteristic diagram illustrating a characteristic example of the display unit according to the seventh embodiment.

FIG. 98 illustrates voltage Vgs dependency of the current Ids in the display unit 9 according to the seventh embodiment.

In FIGS. 95B, 96B, and 97B, the characteristics W3, W5, and W7 each indicate a value (σ/ave.) that is obtained by dividing standard deviation by an average value, and the characteristics W4, W6, and W8 each indicate a value (Range/ave.) that is obtained by dividing a width of variations by the average value.

As shown in the drawings, in the display unit 6 (FIGS. 95A and 95B), the display unit 2 (FIGS. 96A and 96B), and the display unit 7 (FIGS. 97A and 97B), variations in the current Ids is suppressed compared to the display unit 9

(FIG. 98) in which the correction for suppressing the influence, on image quality, of the device variations in the drive transistors DRTr is not performed. In particular, the variations in the current Ids are suppressed at the most in the display unit 6 (FIGS. 95A and 95B), and the variations are suppressed in the display unit 2 (FIGS. 96A and 96B) in the second place. The variations are also suppressed in the display unit 7 (FIGS. 97A and 97B).

On the other hand, as described above, the driving method of the display unit 9 is the simplest, and the driving method is more complex in order of the display units 7, 2, and 6. In terms of robustness, freedom in design, etc., a simpler driving method is more favorable.

Moreover, as shown in FIGS. 95A, 95B, 96A, 96B, 97A, and 97B, the pixel voltage Vsig for obtaining the same current Ids is largest in the display unit 6 (FIGS. 95A and 95B), and becomes smaller in order of the display unit 2 (FIGS. 96A and 96B) and the display unit 7 (FIGS. 97A and 97B). In other words, in the display unit 6, a high voltage is necessary for operation, which may lead to high electric power consumption. Further, withstand voltage that is necessary for the transistors configuring the sub-pixel may be increased.

As described above, these display units are, for example, in a trade-off relationship in terms of the variations in the current Ids, simplicity in the driving method, and the operation voltage. Therefore, for example, it may be desirable to select an optimum configuration depending on the device variations that is caused in the manufacturing process. Specifically, when the manufacturing process causing small device variations is used, for example, the display unit, such as the display units 9 and 7, in which a simpler driving method is used may be selected. When the manufacturing process causing large device variations is used, for example, the display unit, such as the display units 6 and 2, in which the variations of the current Ids are further suppressed may be selected.

15. Application Examples

Next, an application example of the display units described above in the embodiments and the modifications will be described.

Figure 99:
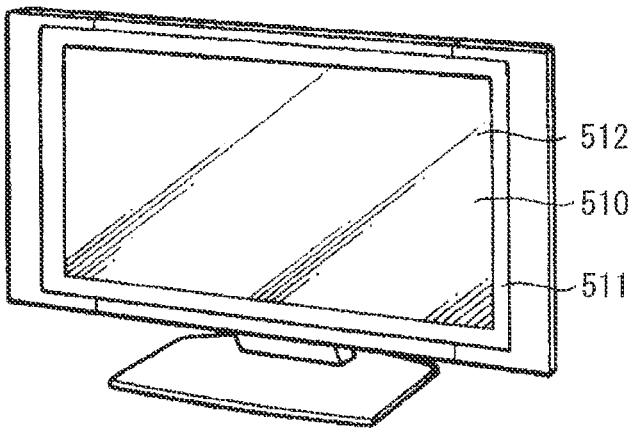
FIG. 99 is a perspective view illustrating an appearance configuration of a television to which the display unit according to any of the embodiments is applied.

FIG. 99 illustrates an appearance of a television to which any of the display units according to the above-described embodiments and the like is applied. The television may include, for example, an image display screen section 510 that includes a front panel 511 and a filter glass 512. The television is configured of the display unit according to any of the above-described embodiments or the like.

The display units according to the above-described embodiments and the like are applicable to electronic apparatuses in any fields such as digital cameras, notebook personal computers, mobile information terminals such as mobile phones, portable game players, and video camcorders, in addition to such a television. In other words, the display units according to the above-described embodiments and the like are applicable to electronic apparatuses in any field that display images.

Hereinabove, the present technology has been described referring to some embodiments, modifications, and application examples to electronic units. However, the present technology is not limited to the embodiments and the like, and may be variously modified.

For example, in each of the above-described embodiments and the like, the display unit includes the organic EL display element. However, this is not limitative, and the display unit may be of any kind as long as the display unit includes a current-driven display element.

It is possible to achieve at least the following configurations from the above-described example embodiments and the modifications of the disclosure.

(1) A Display Unit Including:

a pixel circuit including a display element, a first transistor having a gate and a source, and a capacitor inserted between the gate and the source of the first transistor, the first transistor supplying a current to the display element; and a drive section driving the pixel circuit, through performing a first driving operation and performing a second driving operation after the first driving operation, the first driving operation allowing the drive section to apply a pixel voltage to a first terminal and allowing a second terminal to be at a first voltage, the pixel voltage determining luminance of the display element, the first terminal being one of the gate and the source of the first transistor, and the second terminal being the other of the gate and the source of the first transistor, and the second driving operation allowing the second terminal to be at a second voltage, through applying the pixel voltage to the first terminal and allowing a current to flow through the first transistor.

(2) The display unit according to (1), wherein the display section further performs a third driving operation after the second driving operation, the third driving operation allowing voltages at both of the gate and the source of the first transistor to be varied while maintaining a voltage between the gate and the source of the first transistor at a constant voltage, under a condition of no pixel-voltage applied, and the display section allows the display element to emit light at a timing after the third driving operation.

(3) The display unit according to (1) or (2), wherein the pixel circuit further includes a second transistor that allows, through turning on, the pixel voltage to be applied to the gate of the first transistor, the source of the first transistor is connected to the display element, and the drive section allows the second transistor to turn on during the first and second driving operations.

(4) The display unit according to (3), wherein the drive section allows an effective on-period of the second transistor to be varied in accordance with a level of the pixel voltage.

(5) The display unit according to (4), wherein the second transistor has a gate connected to the drive section, and the drive section applies, to a gate of the second transistor, a gate pulse having a pulse shape where a voltage level in a rear-end section of pulse width gradually varies with time.

(6) The display unit according to any one of (3) to (5), wherein the first transistor has a drain connected to the drive section, the drive section applies, during the first driving operation, the first voltage to the source of the first transistor through the drain of the first transistor, and the drive section applies, during the second driving operation, a third voltage to the drain of the first transistor, thereby allowing a current to flow through the first transistor.

(7) The display unit according to (6), wherein the pixel circuit further includes a third transistor that allows, through turning on, the drain of the first transistor to be connected to the drive section, the drive section allows, during the first and second driving operations, the third transistor to turn on, thereby allowing a voltage to be applied to the first transistor through the third transistor, and during a time period between the first driving operation and the second driving operation, the drive section allows the third transistor to turn off, and allows the voltage applied to the third transistor to be varied from the first voltage to the third voltage.

(8) The display unit according to any one of (3) to (5), wherein the first transistor has a drain connected to the drive section, the pixel circuit further includes a third transistor that allows, through turning on, a third voltage to be applied to the drain of the first transistor, the drive section allows the third transistor to turn off during the first driving operation, and the drive section allows the third transistor to turn on, thereby allowing a current to flow through the first transistor during the second driving operation.

(9) The display unit according to (8), wherein the pixel circuit further includes a fourth transistor that allows, through turning on, the first voltage to be applied to the source of the first transistor, and the drive section allows the fourth transistor to turn on during the first driving operation, and allows the fourth transistor to turn off during the second driving operation.

(10) The display unit according to any one of (3) to (5), wherein the pixel circuit further includes a fifth transistor that allows, through turning on, the source of the first transistor to be connected to the display element, the drive section allows, during the first driving operation, the fifth transistor to turn on, thereby allowing a current to flow through the first transistor and allowing the source of the first transistor to be at the first voltage, and the drive section allows the fifth transistor to turn off during the second driving operation.

(11) The display unit according to (1) or (2), wherein the pixel circuit further includes a sixth transistor that allows, through turning on, the pixel voltage to be applied to the source of the first transistor, the first transistor has a drain connected to the display element, and the drive section allows the sixth transistor to turn on during the first and second driving operations.

(12) The display unit according to (11), wherein the pixel circuit further includes a seventh transistor that allows, through turning on, the gate of the first transistor to be connected to the drain of the first transistor, and the drive section allows the seventh transistor to turn off during the first driving operation, and allows the seventh transistor to turn on during the second driving operation.

(13) The display unit according to (11) or (12), wherein the pixel circuit further includes an eighth transistor that allows, through turning on, the first voltage to be applied to the gate of the first transistor, the drive section allows the eighth transistor to turn on during the first driving operation, and allows the eighth transistor to turn off during the second drive operation.

(14) The display unit according to any one of (11) to (13), wherein the pixel circuit further includes a ninth transistor that allows, through turning on, the drain of the first transistor to be connected to the display element, and a tenth transistor that allows, through turning on, a third voltage to be applied to the source of the first transistor, and the drive section allows both the ninth and tenth transistors to turn off during the first and second driving operations.

(15) The display unit according to (1) or (2), wherein the pixel circuit further includes an eleventh transistor that allows, through turning on, the pixel voltage to be applied to the gate of the first transistor, the first transistor has a drain connected to the display element, and the drive section allows the eleventh transistor to turn on during the first and second driving operations.

(16) The display unit according to (15), wherein the pixel circuit further includes a twelfth transistor that allows, thorough turning on, the gate of the first transistor to be connected to the drain of the first transistor, during the first driving operation, the drive section applies the first voltage to the source of the first transistor and allows the twelfth transistor to turn off, and the drive section allows, during the second driving operation, the twelfth transistor to turn on, thereby allowing a current to flow through the first transistor.

(17) The display unit according to (15) or (16), wherein the pixel circuit further includes a thirteenth transistor that allows, through turning on, the source of the first transistor to be connected to the drive section, the drive section allowing, during the first driving operation, the thirteenth transistor to turn on, thereby applying the first voltage to the source of the first transistor through the thirteenth transistor, and after the first driving operation, the drive section allows the thirteenth transistor to turn off and allows a voltage applied to the thirteenth transistor to be varied from the first voltage to a third voltage.

(18) The display unit according to (17), wherein the pixel circuit further includes a fourteenth transistor that allows, through turning on, the drain of the first transistor to be connected to the display element, and the drive section allows the fourteenth transistor to turn off during the first and second driving operations.

(19) The display unit according to (15), wherein the drive section allows an effective on-period of the eleventh transistor to be varied in accordance with a level of the pixel voltage.

(20) The display unit according to (15) or (19), wherein the pixel circuit further includes a fifteenth transistor that allows, through turning on, the first voltage to be applied to the source of the first transistor, the drive section allows the fifteenth transistor to turn on during the first driving operation, and the drive section allows the fifteenth transistor to turn off during the second driving operation.

(21) The display unit according to (1) or (2), wherein the pixel circuit further includes a sixteenth transistor that allows, through turning on, the pixel voltage to be applied to the source of the first transistor, the source of the first transistor is connected to the display element, and the drive section allows the sixteenth transistor to turn on during the first and second driving operations.

(22) The display unit according to (21), wherein the first transistor has a drain connected to the drive section, the pixel circuit further includes a seventeenth transistor that allows, through turning on, the gate of the first transistor to be connected to the drain of the first transistor, during the first driving operation, the drive section applies the first voltage to the gate of the first transistor and allows the seventeenth transistor to turn off, and the drive section allows, during the second driving operation, the seventeenth transistor to turn on, thereby allowing a current to flow through the first transistor.

(23) The display unit according to (22), wherein the pixel circuit further includes an eighteenth transistor that allows, through turning on, the drain of the first transistor to be connected to the drive section, the drive section allows, during the first driving operation, the seventeenth and eighteenth transistors to turn on, thereby applying the first voltage to the gate of the first transistor through the seventeenth and eighteenth transistors, and during the second driving operation, the drive section allows the seventeenth transistor to turn on, and allows the eighteenth transistor to turn off.

(24) The display unit according to any one of (1) to (23), wherein an absolute value of a difference between the pixel voltage and the first voltage is larger than an absolute value of a threshold voltage of the first transistor.

(25) The display unit according to any one of (1) to (24), further including:

a plurality of the pixel circuits, and a plurality of signal lines transmitting the pixel voltage, wherein two of the pixel circuits, that are adjacent to each other in a direction intersecting an extending direction of the signal lines, are connected to one of the signal lines.

(26) The display unit according to (25), wherein the drive section time-divisionally drives the two of the pixel circuits in each horizontal period.

(27) A drive circuit including a drive section, the drive section performing a first driving operation and performing a second driving operation after the first driving operation, the first driving operation allowing the drive section to apply a pixel voltage to a first terminal and allowing a second terminal to be at a first voltage, the pixel voltage determining luminance of a display element, the first terminal being one of a gate and a source of a first transistor, the second terminal being the other of the gate and the source of the first transistor, the first transistor having the gate and the source between which a capacitor is inserted, and the first transistor supplying a current to the display element, and the second driving operation allowing the second terminal to be at a second voltage, through applying the pixel voltage to the first terminal and allowing a current to flow through the first transistor.

(28) A driving method including:

performing a first driving operation and performing a second driving operation after the first driving operation, the first driving operation allowing a pixel voltage to be applied to a first terminal and allowing a second terminal to be at a first voltage, the pixel voltage determining luminance of a display element, the first terminal being one of a gate and a source of a first transistor, the second terminal being the other of the gate and the source of the first transistor, the first transistor having the gate and the source between which a capacitor is inserted, and the first transistor supplying a current to the display element, and the second driving operation allowing the second terminal to be at a second voltage, through applying the pixel voltage to the first terminal and allowing a current to flow through the first transistor.

(29) An electronic apparatus with a display unit and a control section controlling operation of the display unit, the display unit including:

a pixel circuit including a display element, a first transistor having a gate and a source, and a capacitor inserted between the gate and the source of the first transistor, the first transistor supplying a current to the display element; and a drive section driving the pixel circuit, through performing a first driving operation and performing a second driving operation after the first driving operation, the first driving operation allowing the drive section to apply a pixel voltage to a first terminal and allowing a second terminal to be at a first voltage, the pixel voltage determining luminance of the display element, the first terminal being one of the gate and the source of the first transistor, and the second terminal being the other of the gate and the source of the first transistor, and the second driving operation allowing the second terminal to be at a second voltage, through applying the pixel voltage to the first terminal and allowing a current to flow through the first transistor.

The present application contains subject matter related to that disclosed in Japanese Priority Patent Application JP 2012-170487 filed in the Japan Patent Office on Jul. 31, 2012, Japanese Priority Patent Application JP 2012-202840 filed in the Japan Patent Office on Sep. 14, 2012, and Japanese Priority Patent Application JP 2012-248286 filed in the Japan Patent Office on Nov. 12, 2012, the entire content of each of which is hereby incorporated by reference.

It should be understood by those skilled in the art that various modifications, combinations, sub-combinations, and alterations may occur depending on design requirements and other factors insofar as they are within the scope of the appended claims or the equivalents thereof.

What is claimed is:

1. A display unit comprising:

a pixel circuit including a display element, a first transistor having a gate and a source, a second transistor having a current terminal directly connected to the gate of the first transistor, and a capacitor inserted between the gate and the source of the first transistor, the first transistor is configured to supply a current to the display element; and a drive section configured to drive the pixel circuit, through performing a first driving operation and performing a second driving operation after the first driving operation, wherein during the first driving operation a pixel voltage is applied to a first terminal, and a second terminal is caused to be at a first voltage, the pixel voltage determining luminance of the display element, the first terminal being one of the gate and the source of the first transistor, and the second terminal being the other of the gate and the source of the first transistor, during the second operation the second terminal is caused to be at a second voltage, through applying the pixel voltage to the first terminal and allowing a current to flow through the first transistor, the second transistor is configured to be turned on during the first and second driving operations, and the first and the second driving operations are different from each other.

2. The display unit according to claim 1, wherein the drive section is configured to further perform a third driving operation after the second driving operation, the third driving operation allowing voltages at both of the gate and the source of the first transistor to be varied while maintaining a voltage between the gate and the source of the first transistor at a constant voltage, under a condition of no pixel-voltage applied, and the drive section allows the display element to emit light at a timing after the third driving operation.

3. The display unit according to claim 1, wherein the pixel voltage is configured to be applied to the gate of the first transistor, and the source of the first transistor is connected to the display element.

4. The display unit according to claim 3, wherein the dive section allows an effective on-period of the second transistor to be varied in accordance with a level of the pixel voltage.

5. The display unit according to claim 4, wherein the second transistor has a gate connected to the drive section, and the dive section is configured to apply, to the gate of the second transistor, a gate pulse having a pulse shape where a voltage level in a rear-end section of pulse width gradually varies with time.

6. The display unit according to claim 3, wherein the first transistor has a drain connected to the drive section, the drive section is configured to apply, during the first driving operation, the first voltage to the source of the first transistor through the drain of the first transistor, and the drive section is configured to apply, during the second driving operation, a third voltage to the drain of the first transistor, thereby allowing a current to flow through the first transistor.

7. The display unit according to claim 6, wherein the pixel circuit further includes a third transistor that is configured to allow, through turning on, the drain of the first transistor to be connected to the drive section, the drive section is configured to allow, during the first and second driving operations, the third transistor to turn on, thereby allowing a voltage to be applied to the first transistor through the third transistor, and during a time period between the first driving operation and the second driving operation, the drive section is configured to allow the third transistor to turn off, and allow the voltage applied to the third transistor to be varied from the first voltage to the third voltage.

8. The display unit according to claim 3, wherein the first transistor has a drain connected to the drive section, the pixel circuit further includes a third transistor that is configured to allow, through turning on, a third voltage to be applied to the drain of the first transistor, the drive section is configured to allow the third transistor to turn off during the first driving operation, and the drive section is configured to allow the third transistor to turn on, thereby allowing a current to flow through the first transistor during the second driving operation.

9. The display unit according to claim 8, wherein the pixel circuit further includes a fourth transistor that is configured to allows, through turning on, the first voltage to be applied to the source of the first transistor, and the drive section is configured to allow the fourth transistor to turn on during the first driving operation, and allow the fourth transistor to turn off during the second driving operation.

10. The display unit according to claim 3, wherein the pixel circuit further includes a fifth transistor that is configured to allow, through turning on, the source of the first transistor to be connected to the display element, the drive section allow, during the first driving operation, the fifth transistor to turn on, thereby allowing a current to flow through the first transistor and allowing the source of the first transistor to be at the first voltage, and the drive section is configured to allow the fifth transistor to turn off during the second driving operation.

11. The display unit according to claim 1, wherein the pixel circuit further includes a sixth transistor that is configured to allow, through tuning on, the pixel voltage to be applied to the source of the first transistor, the first transistor has a drain connected to the display element, and the drive section is configured to allow the sixth transistor to turn on during the first and second driving operations.

12. The display unit according to claim 11, wherein the pixel circuit further includes a seventh transistor that is configured to allows, through turning on, the gate of the first transistor to be connected to the drain of the first transistor, and the drive section is configured to allow the seventh transistor to turn off during the first driving operation, and allow the seventh transistor to turn on during the second driving operation.

13. The display unit according to claim 11, wherein the pixel circuit further includes an eighth transistor that is configured to allows, through turning on, the first voltage to be applied to the gate of the first transistor, the drive section is configured to allow the eighth transistor to turn on during the first driving operation, and allow the eighth transistor to turn off during the second driving operation.

14. The display unit according to claim 11, wherein the pixel circuit further includes a ninth transistor that is configured to allow, through turning on, the drain of the first transistor to be connected to the display element, and a tenth transistor that is configured to allow, through turning on, a third voltage to be applied to the source of the first transistor, and the drive section is configured to allow both ninth and tenth transistors to turn off during the first and second driving operations.

15. The display unit according to claim 1, wherein the pixel circuit further includes an eleventh transistor that is configured to allow, through turning on, the pixel voltage to be applied to the gate of the first transistor, the first transistor has a drain connected to the display element, and the drive section is configured to allow the eleventh transistor to turn on during the first and second driving operations.

16. The display unit according to claim 15, wherein the pixel circuit further includes a twelfth transistor that is configured to allows, thorough turning on, the gate of the first transistor to be connected to the drain of the first transistor, during the first driving operation, the drive section is configured to apply the first voltage to the source of the first transistor and allow the twelfth transistor to turn off, and the drive section is configured to allow, during the second driving operation, the twelfth transistor to turn on, thereby allowing a current to flow through the first transistor.

17. The display unit according to claim 15, wherein the pixel circuit further includes a thirteenth transistor that is configured to allow, through turning on, the source of the first transistor to be connected to the drive section, the drive section is configured to allow, during the first driving operation, the thirteenth transistor to turn on, thereby applying the first voltage to the source of the first transistor through the thirteenth transistor, and after the first driving operation, the drive section is configured to allow the thirteenth transistor to turn off and allow a voltage applied to the thirteenth transistor to be varied from the first voltage to a third voltage.

18. The display unit according to claim 17, wherein the pixel circuit further includes a fourteenth transistor that is configured to allow, through turning on, the drain of the first transistor to be connected to the display element, and the drive section is configured to allow the fourteenth transistor to turn off during the first and second driving operations.

19. The display unit according to claim 15, wherein the drive section is configured to allow an effective on-period of the eleventh transistor to be varied in accordance with a level of the pixel voltage.

20. The display unit according to claim 15, wherein the pixel circuit further includes a fifteenth transistor that is configured to allow, through tuning on, the first voltage to be applied to the source of the first transistor, the drive section is configured to allow the fifteenth transistor to turn on during the first driving operation, and the drive section is configured to allow the fifteenth transistor to turn off during the second driving operation.

21. The display unit according to claim 1, wherein the pixel circuit further includes a sixteenth transistor that is configured to allow, through turning on, the pixel voltage to be applied to the source of the first transistor, the source of the first transistor is connected to the display element, and the drive section is configured to allow the sixteenth transistor to turn on during the first and second driving operations.

22. The display unit according to claim 21, wherein the first transistor has a drain connected to the drive section, the pixel circuit further includes a seventeenth transistor that is configured to allow, through turning on, the gate of the first transistor to be connected to the drain of the first transistor, during the first driving operation, the dive section is configured to apply the first voltage to the gate of the first transistor and allow the seventeenth transistor to turn off, and the drive section is configured to allow, during the second driving operation, the seventeenth transistor to turn on, thereby allowing a current to flow through the first transistor.

23. The display unit according to claim 22, wherein the pixel circuit further includes an eighteenth transistor that is configured to allow, through turning on, the drain of the first transistor to be connected to the drive section, the drive section is configured to allow, during the first driving operation, the seventeenth and eighteenth transistors to turn on, thereby applying the first voltage to the gate of the first transistor through the seventeenth and eighteenth transistors, and during the second driving operation, the drive section is configured to allow the seventeenth transistor to turn on, and allow the eighteenth transistor to turn off.

24. The display unit according to claim 1, wherein an absolute value of a difference between the pixel voltage and the first voltage is larger than an absolute value of a threshold voltage of the first transistor.

25. The display unit according to claim 1, further comprising:

a plurality of the pixel circuits, and a plurality of signal lines configured to transmit the pixel voltage, wherein two of the pixel circuits, that are adjacent to each other in a direction intersecting an extending direction of the signal lines, are connected to one of the signal lines.

26. The display unit according to claim 25, wherein the drive section is configured to time-divisionally drive the two of the pixel circuits in each horizontal period.

27. A drive circuit comprising a drive section, the drive section configured to perform a first driving operation and a second driving operation after the first driving operation, wherein the first and the second driving operations are different from each other, wherein during the first driving operation, a pixel voltage is applied to a first terminal, and a second terminal is caused to be at a first voltage, the pixel voltage determining luminance of a display element, the first terminal being one of a gate and a source of a first transistor, the second terminal being the other of the gate and the source of the first transistor, the first transistor having the gate and the source between which a capacitor is inserted, and the first transistor is configured to supply a current to the display element, during the second driving operation the second terminal is caused to be at a second voltage, through applying the pixel voltage to the first terminal and allowing a current to flow through the first transistor, and wherein the drive section is configured to turn on a second transistor during the first and second driving operations, the second transistor having a current terminal which is directly connected to the gate of the first transistor.

28. A driving method comprising:

performing a first driving operation and performing a second driving operation after the first driving operation, wherein the find and the second driving operations are different from each other, wherein during the first driving operation, a pixel voltage is applied to a first terminal, and a second terminal is caused to be at first voltage, the pixel voltage determining luminance of a display element, the first terminal being one of a gate and a source of a first transistor, the second terminal being the other of the gate and the source of the first transistor, the first transistor having the gate and the source between which a capacitor is inserted, and the first transistor is configured to supply a current to the display element, and wherein during the second driving operation, the second terminal is caused to be at a second voltage, through applying the pixel voltage to the first terminal and allowing a current to flow through the first transistor, and turning on a second transistor during the first and second driving operations, the second transistor having a current terminal which is directly connected to the gate of the first transistor.

29. An electronic apparatus with a display unit and a control section configured to control operation of the display unit, the display unit comprising:

a pixel circuit including a display element, a first transistor having a gate and a source, a second transistor having a current terminal directly connected to the gate of the first transistor, and a capacitor inserted between the gate and the source of the first transistor, the first transistor is configured to supply a current to the display element; and a drive section configured to drive the pixel circuit, through performing a first driving operation and performing a second driving operation after the first driving operation, wherein during the first driving operation a pixel voltage is applied to a first terminal, and a second terminal is caused to be at a first voltage, the pixel voltage determining luminance of the display element, the first terminal being one of the gate and the source of the first transistor, and the second terminal being the other of the gate and the source of the first transistor, and during the second driving operation the second terminal is caused to be at a second voltage, through applying the pixel voltage to the first terminal and allowing a current to flow through the first transistor, the second transistor is configured to be turned on during the first and second driving operations, and the first and the second driving operations are different from each other.

* * * * *